US012419419B2

(12) United States Patent
Chambers

(10) Patent No.: US 12,419,419 B2
(45) Date of Patent: Sep. 23, 2025

(54) FURNITURE COMPONENTS AND ASSEMBLIES

(71) Applicant: CPC ENGINEERING DESIGN LIMITED, North Shore City (NZ)

(72) Inventor: Christopher Paul Chambers, North Shore City (NZ)

(73) Assignee: CPC ENGINEERING DESIGN LIMITED (NZ)

( * ) Notice: Subject to any disclaimer, the term of this patent is extended or adjusted under 35 U.S.C. 154(b) by 1094 days.

(21) Appl. No.: 17/265,596

(22) PCT Filed: Aug. 1, 2019

(86) PCT No.: PCT/NZ2019/050090
§ 371 (c)(1),
(2) Date: Feb. 3, 2021

(87) PCT Pub. No.: WO2020/027667
PCT Pub. Date: Feb. 6, 2020

(65) Prior Publication Data

US 2021/0321772 A1 Oct. 21, 2021

(30) Foreign Application Priority Data

Aug. 3, 2018 (NZ) ..... 744906

(51) Int. Cl.
*A47B 96/20* (2006.01)

(52) U.S. Cl.
CPC ..... *A47B 96/205* (2013.01); *A47B 96/201* (2013.01)

(58) Field of Classification Search
CPC ..... A47B 96/205; A47B 96/201
See application file for complete search history.

(56) References Cited

U.S. PATENT DOCUMENTS 215,348 A 5/1879 Gregg
404,004 A 5/1889 Hovey
(Continued)

FOREIGN PATENT DOCUMENTS

DE 10251096 2/2004
EP 2428137 3/2012
(Continued)

OTHER PUBLICATIONS

European Extended Search Report from corresponding EP case (based from PCT/NZ2019/050090), dated Sep. 2, 2021.
(Continued)

*Primary Examiner* — Travis M Figg
(74) *Attorney, Agent, or Firm* — Edmonds & Cmaidalka, P.C.

(57) ABSTRACT

A furniture panel and a furniture assembly which incorporates such a panel. The panel is formed from at least two structural components including a first structural component being an edge structure and a second or subsequent structural component(s) selected from one or more cover sheet(s) and one or more edge structure(s). At least one internal fixing element is also provided to engage together at least two of said structural components, with the internal fixing element or elements being at least partially enclosed within a housing defined by the engagement of said structural components. The housing defined at least partially conceals the internal fixing element from view.

18 Claims, 99 Drawing Sheets

(56) References Cited

U.S. PATENT DOCUMENTS

| | | | | |
|---|---|---|---|---|
| 571,042 | A | 11/1896 | Edquist | |
| 573,942 | A | 12/1896 | Watson | |
| 754,814 | A | 3/1904 | Schriefer | |
| 754,815 | A | 3/1904 | Schriefer | |
| 754,816 | A | 3/1904 | Schriefer | |
| 754,817 | A | 3/1904 | Schriefer | |
| 801,020 | A | 10/1905 | Kirkpatrick | |
| 1,381,501 | A | 6/1921 | Reigersberg | |
| 1,608,153 | A | 11/1926 | Anderson | |
| 1,887,814 | A | 11/1932 | Gall | |
| 2,691,502 | A | 10/1954 | Jones | |
| 2,785,035 | A | 3/1957 | Hammer | |
| 3,025,971 | A | 3/1962 | McLean | |
| 3,132,910 | A | 5/1964 | Vigna | |
| 3,193,885 | A | 7/1965 | Gartner et al. | |
| 3,251,163 | A * | 5/1966 | Russell | E04B 1/14 52/584.1 |
| 4,304,073 | A | 12/1981 | Reith | |
| 5,519,971 | A | 5/1996 | Ramirez | |
| 8,001,910 | B2 | 8/2011 | Yee et al. | |
| 2004/0221533 | A1 | 11/2004 | Tokuno et al. | |
| 2014/0205779 | A1 * | 7/2014 | Lin | A47B 96/201 428/34.1 |
| 2018/0055229 | A1 * | 3/2018 | Game | A47B 46/005 |

FOREIGN PATENT DOCUMENTS

| | | |
|---|---|---|
| FR | 2331303 | 6/1977 |
| KR | 101745457 | 6/2017 |

OTHER PUBLICATIONS

International Search Report and Written Opinion for international application No. PCT/NZ2019/050090, mailed on Sep. 24, 2019.

* cited by examiner

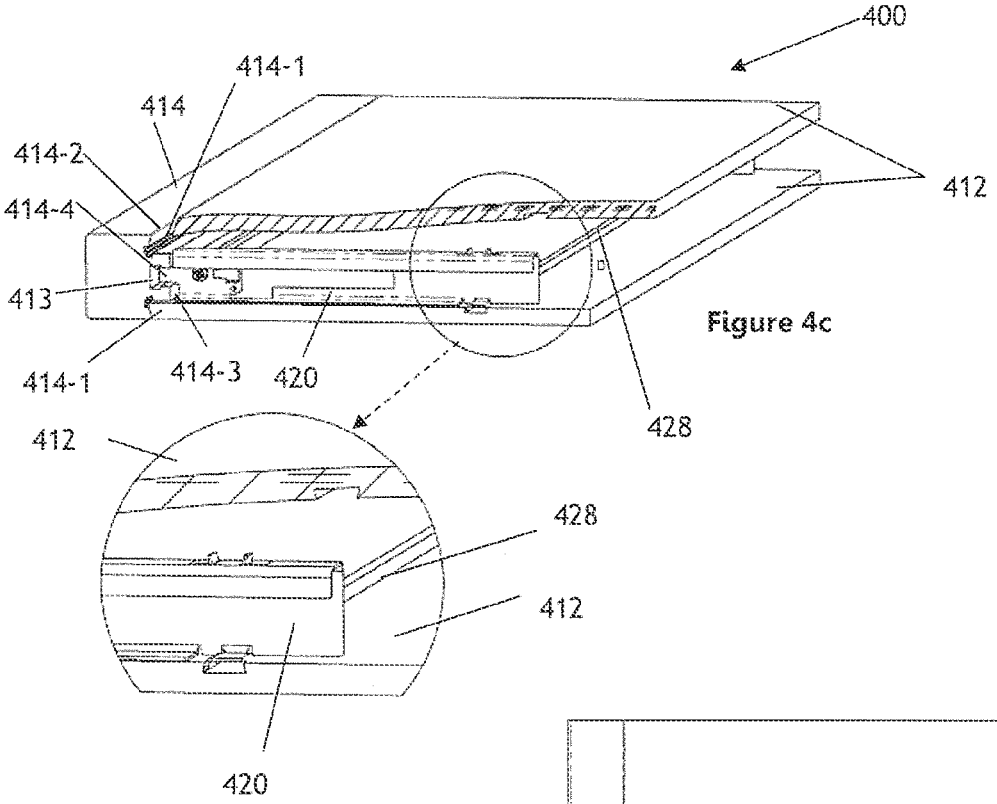
Figure 4c
Figure 4d
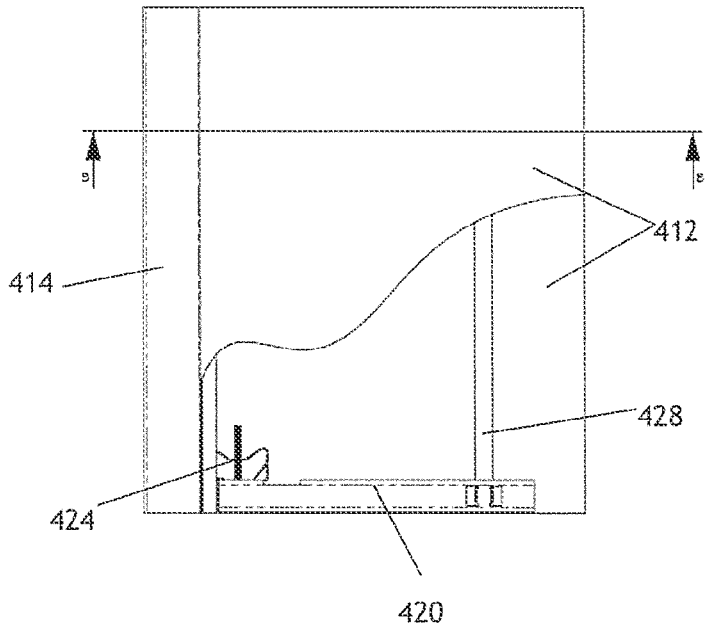
Figure 4e
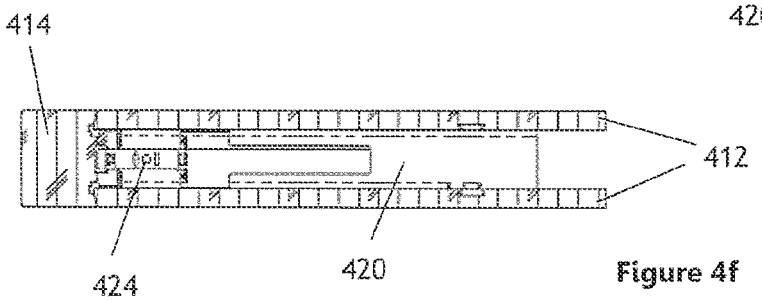
Figure 4f

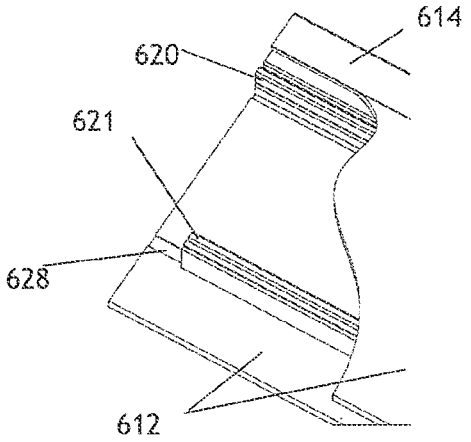
Figure 6a
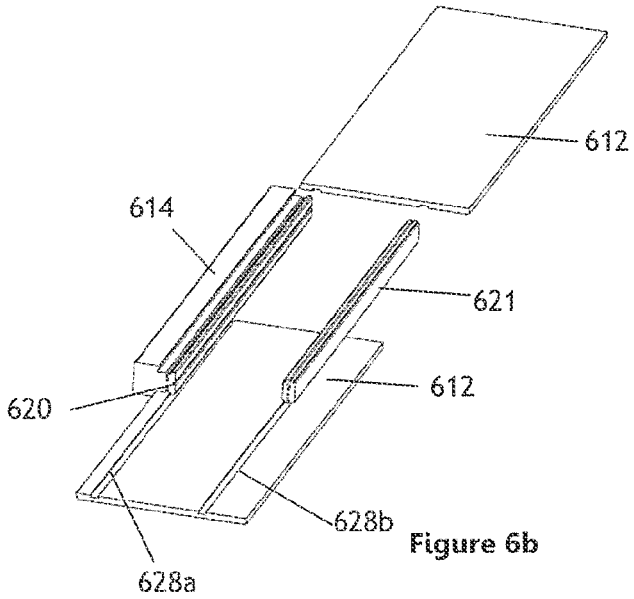
Figure 6b
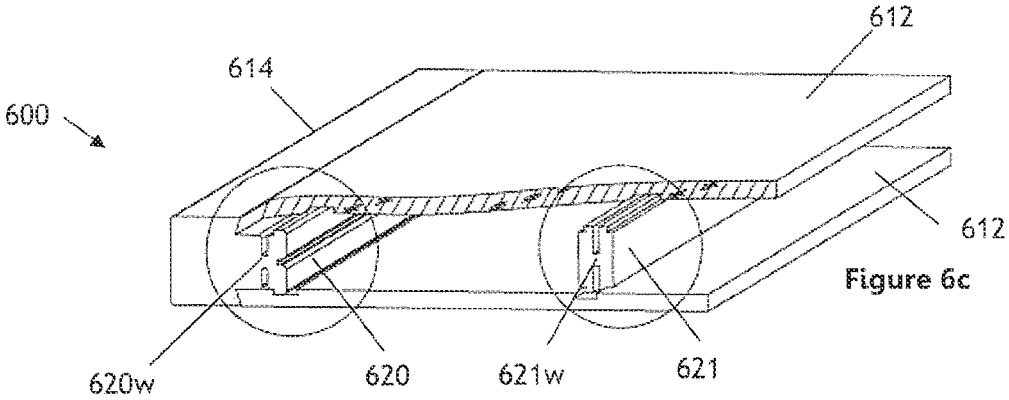
Figure 6c
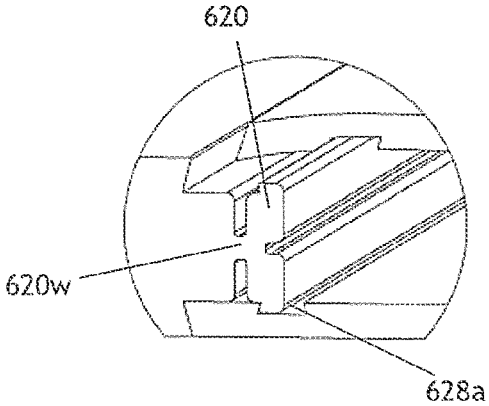
Figure 6c(i)
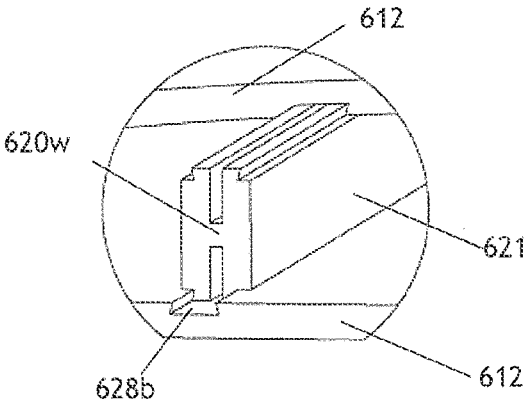
Figure 6c(ii)

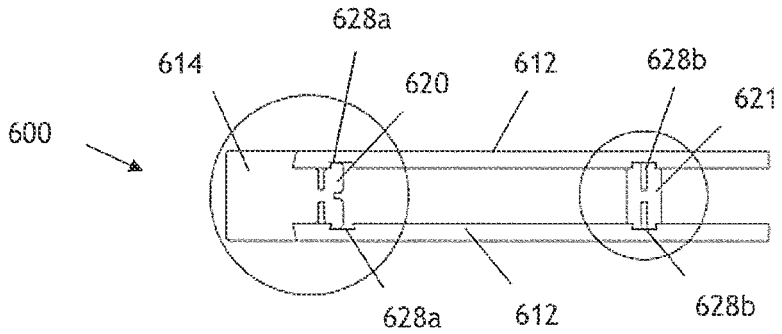
Figure 6d
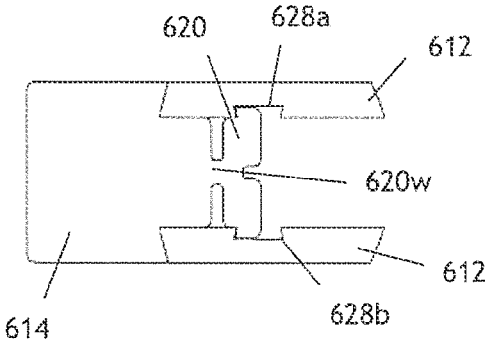
Figure 6d(i)
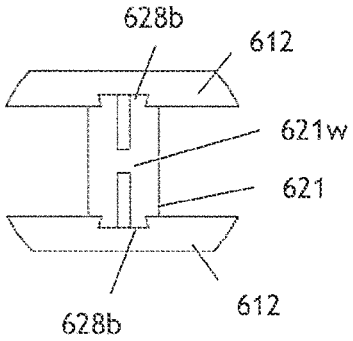
Figure 6d(ii)

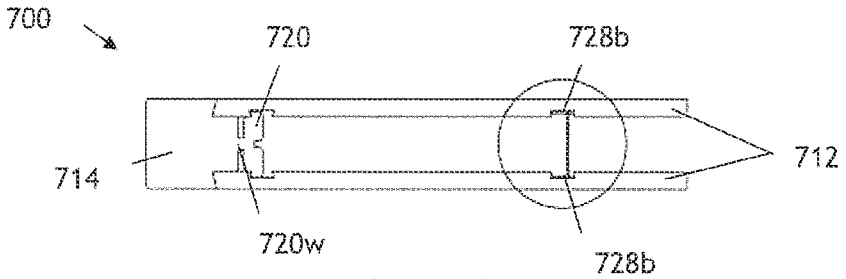
Figure 7d
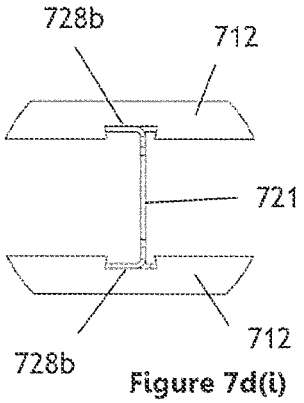
Figure 7d(i)
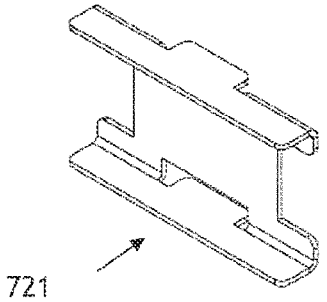
Figure 7d(ii)

Figure 8a
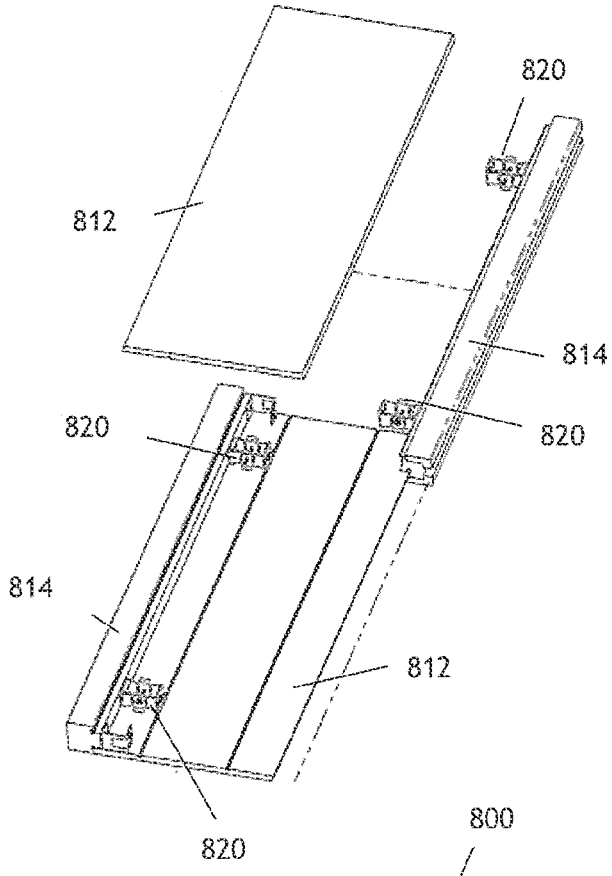
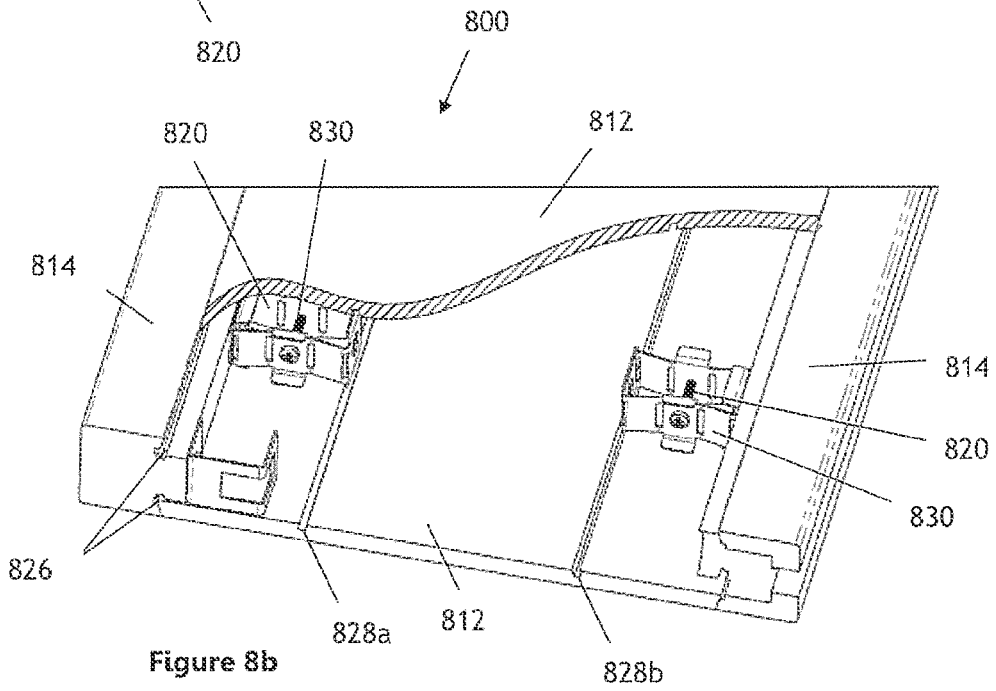
Figure 8b

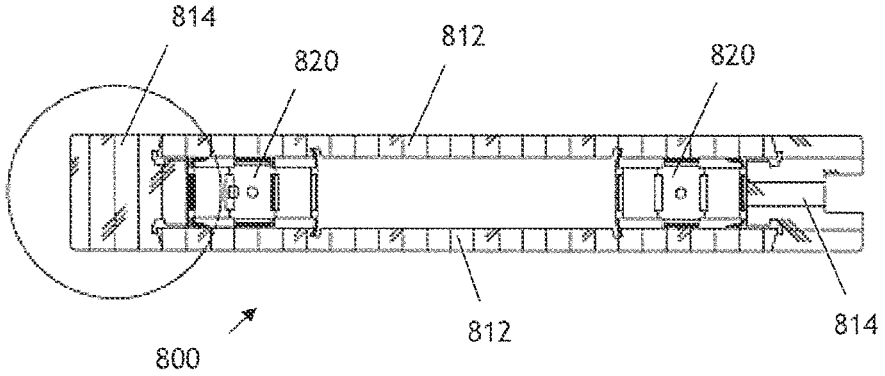
Figure 8c(i)
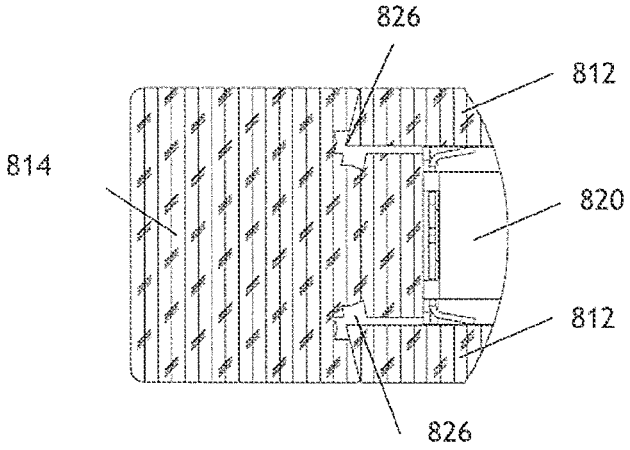
Figure 8c(ii)

(i)

(ii)

Figure 19e
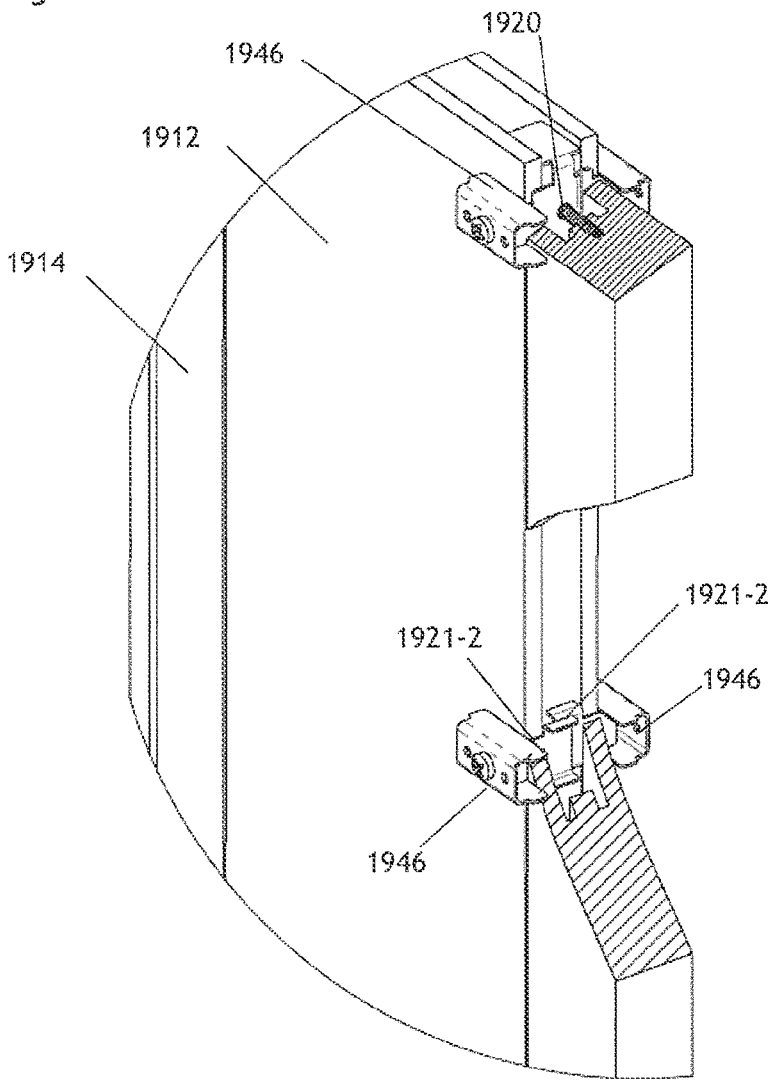
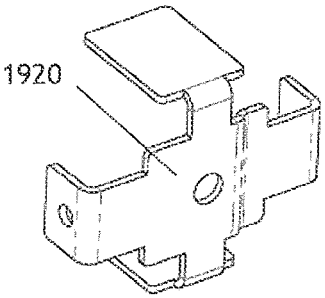
Figure 19f
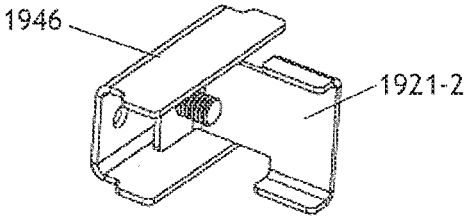
Figure 19g
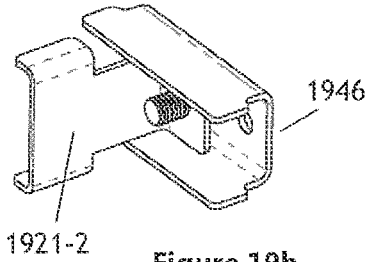
Figure 19h

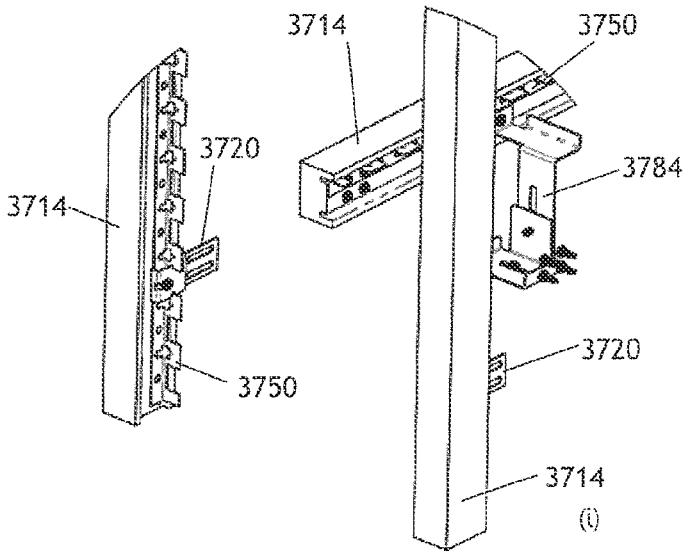
Figure 37b
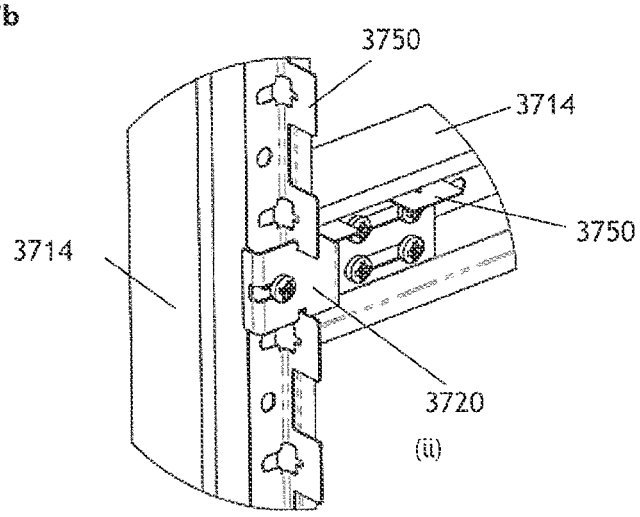

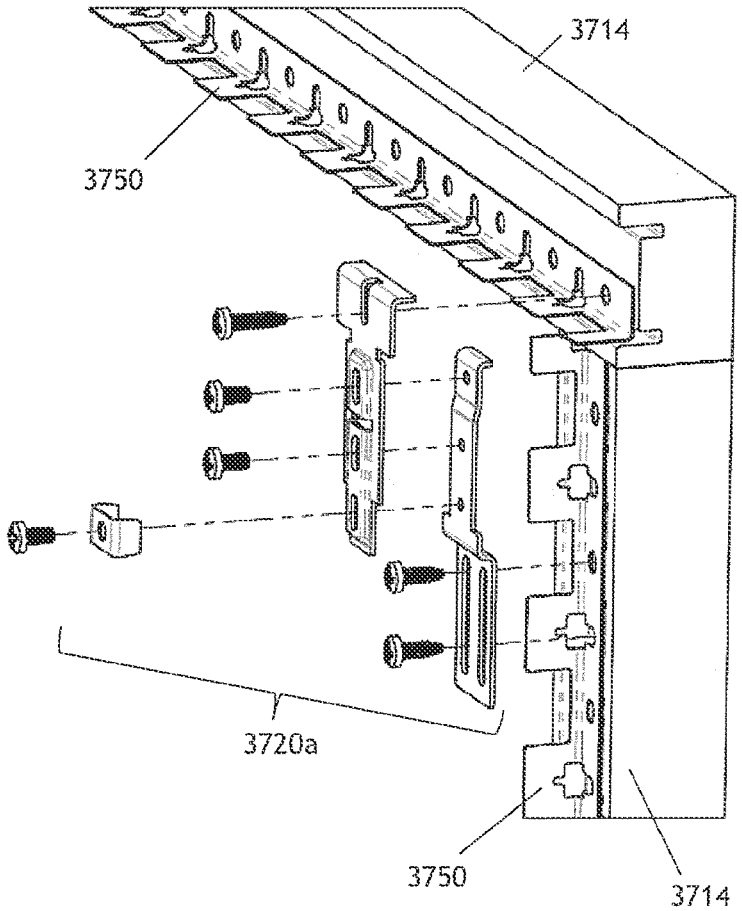
Figure 37d(ii)

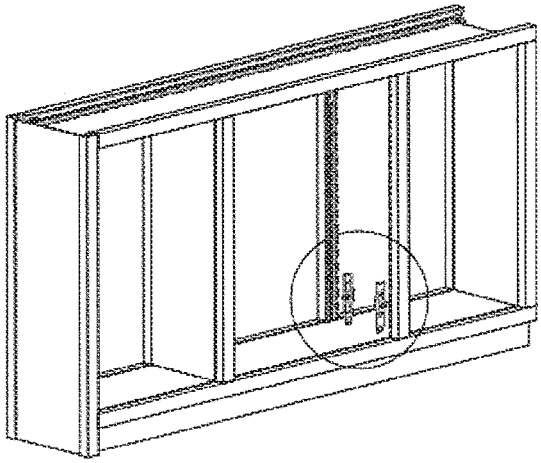
(i)
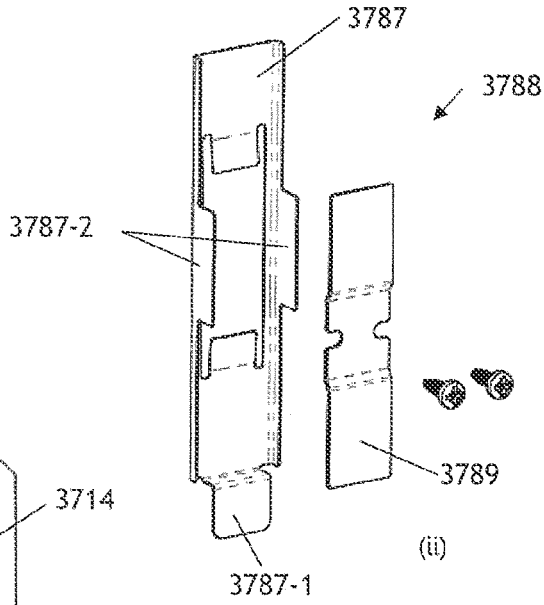
(ii)
Figure 37e
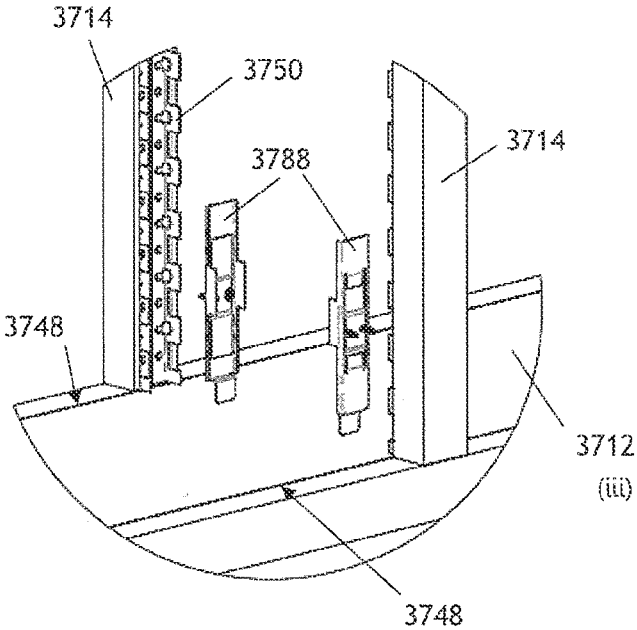
(iii)

Figure 38a
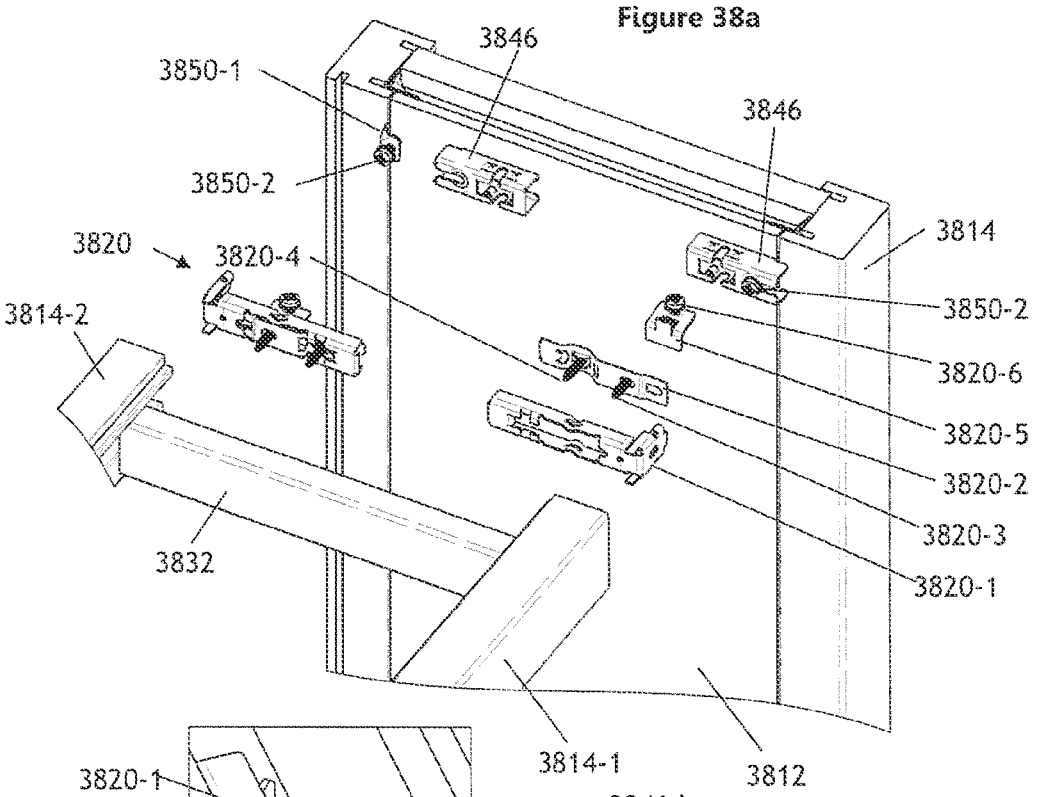
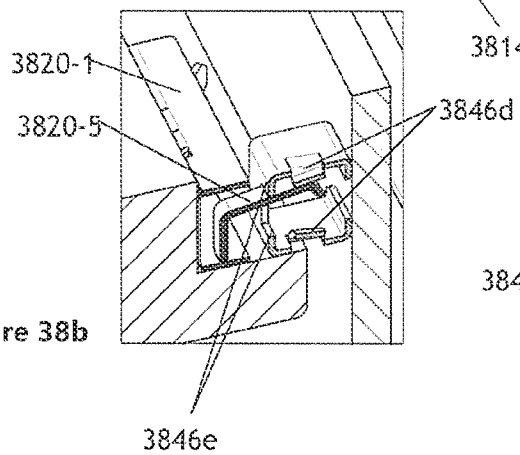
Figure 38b
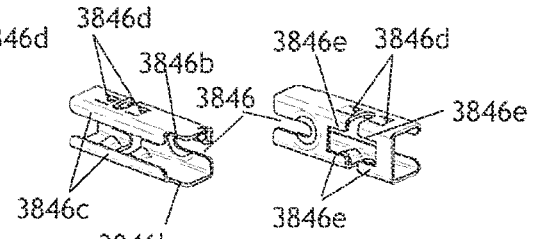
Figure 38c
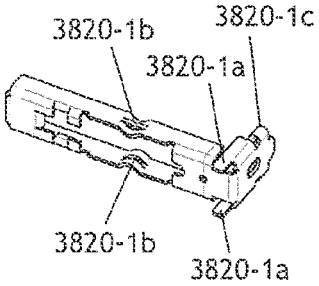
Figure 38d
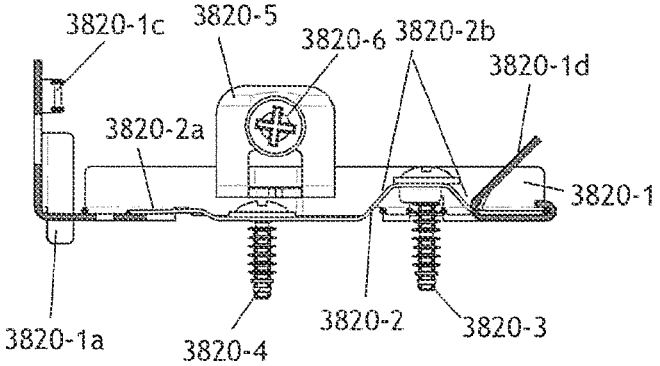
Figure 38e

FURNITURE COMPONENTS AND ASSEMBLIES

CROSS-REFERENCE TO RELATED APPLICATIONS

This is a National Stage Application under 35 U.S.C. § 371 of PCT/NZ2019/050090, filed on Aug. 1, 2019, which claims priority to New Zealand Patent Application having serial number 744906, filed on Aug. 3, 2018, which is incorporated by reference herein.

FIELD OF THE INVENTION

This invention relates to improved furniture components and the resulting furniture assemblies formed using such components. In various preferred embodiments the invention allows for the construction of furniture assemblies formed from lightweight and inexpensive wooden materials.

BACKGROUND OF THE INVENTION

Articles of furniture and cabinetry are commonly formed from wooden materials and are found in both commercial and residential settings. These types of articles can be permanently built into or fixed to the interior of a structure, or may have a mobile character.

Wooden furniture has a wide appeal due to its aesthetic qualities, with furniture made from solid wooden components being particularly sought-after. It is common for the components of solid wooden furniture to be connected together through traditional joinery techniques, with the adjacent abutting ends of wooden components being worked into complimentary shapes to provide for strong connections. Traditional joinery techniques preserve the aesthetic appeal of solid wood furniture, providing clean lines and for the most part hiding from view the techniques used to join components together.

However using solid wood in the construction of furniture substantially increases the cost of manufacture for such articles. These types of articles are also relatively heavy, with their weight increasing significantly for large pieces of furniture. Increases in weight in turn increase distribution costs which need to be borne by the ultimate purchaser of the furniture. The use of solid wood components also increases the environmental footprint of the furniture when compared with other articles which require less wooden material in their construction.

Wooden furniture constructed using traditional joinery techniques requires a high degree of skill to produce. Specialist tools and training are generally required to allow for the production of such furniture, and these types of furniture are generally slow to produce.

Most types of furniture are generally presented to a potential purchaser either fully assembled, or as a 'flat-pack' system with instructions provided for assembly using simple connection systems. In either case the purchaser is not provided with any opportunity to customise or modify the resulting form or dimensions of the furniture involved.

It would therefore be of advantage to have improvements in the field of furniture construction which addressed any or all the above issues, or at least provide an alternative choice to the prior art. In particular, it would be of advantage to have improvements over the prior art which allowed for the provision of built-in furniture or mobile furniture articles formed from lightweight and inexpensive wooden materials. It would also be of advantage to have improved furniture components and furniture assemblies formed from such components which could be connected together without the connection systems used being visible to the end user of the furniture. Improvements in the field of furniture construction which also provide an assembler with the ability to modify or adjust the resulting dimensions of the furniture being assembled would also be of advantage.

DISCLOSURE OF THE INVENTION

According to one aspect of the present invention there is provided a furniture panel used to form a component of a furniture assembly, the panel being formed from: at least two structural components, a first structural component being an edge structure and a second or subsequent structural component(s) being selected from: one or more further edge structure, and/or one or more cover sheet; and at least one internal fixing element configured to engage together at least two of said structural components, said at least one internal fixing element being at least partially enclosed within a housing defined by the engagement of said structural components, wherein the housing defined at least partially conceals the internal fixing element from view.

According to another aspect of the present invention there is provided a furniture panel used to form a component of a furniture assembly substantially as described above wherein a furniture panel incorporates a first structural component being an edge structure, and a second structural component and a third structural component selected from any combination of: at least one edge structure, at least one cover sheet and/or at least one mid-beam.

According to a further aspect of the present invention there is provided a furniture panel used to form a component of a furniture assembly, the panel being formed from a first cover sheet, a first edge structure, at least one of a second cover sheet or a second edge structure, and at least one internal fixing element configured to engage together at least two of said first cover sheet, first edge structure, second cover sheet or second edge structure, said at least one internal fixing element being at least partially enclosed within a housing defined by the engagement of said first cover sheet, first edge structure, second cover sheet or second edge structure, wherein the housing defined at least partially conceals the internal fixing element from view.

According to another aspect of the present invention there is provided a furniture panel used to form a component of a furniture assembly, the panel being formed from: at least two structural components selected from: one or more cover sheet; and one or more edge structure; and at least one internal fixing element configured to engage together at least two of said structural components, said at least one internal fixing element being at least partially enclosed within a housing defined by the engagement of said structural components, wherein the housing defined at least partially conceals the internal fixing element from view.

According to a further aspect of the invention there is provided a furniture panel substantially as described above wherein the furniture panel has a regular transverse cross section form.

According to another aspect of the invention there is provided a furniture panel substantially as described above further including at least one mid beam.

According to another aspect of the invention there is provided a furniture panel substantially as described above where the at least one mid beam includes a further fixing element, in some forms the further fixing element is an exterior fixing element.

According to another aspect of the present invention there is provided a furniture panel substantially as described above wherein at least a portion or component of an internal fixing element also defines at least a portion of an exterior fixing element.

According to some embodiments the internal fixing element may include a plurality of fixing elements that form an internal fixing element assembly.

According to a further aspect of the present invention there is provided a method of constructing a furniture panel substantially as described above characterised by the steps of:

making at least one cut through the transverse cross section of one or more structural components to provide a desired length, depth or height dimension for the structural component, and engaging together two or more structural components using at least one internal fixing element to construct a panel which defines a housing which at least partially encloses the internal fixing element or elements and at least partially conceals said internal fixing element or elements from view.

The present invention is adapted to provide a furniture panel used to form a component of a furniture assembly. Further aspects of the invention encompass the provision of furniture assemblies which are constructed using such panels.

Reference in general is made throughout this specification to the invention facilitating the construction of articles of furniture. These furniture articles may be either mobile stand-alone pieces or static built in articles which are permanently secured in place and effectively form part of the structure in which they are located. For example in some embodiments the invention may facilitate the provision of standalone furniture pieces such as entertainment units, bookcases or shelving units, or potentially permanently installed articles such as built in wardrobes or cabinetry. Those skilled in the art should therefore appreciate that these references made to furniture per se encompass a variety of support structures or stands with a range of forms.

The invention provides for the assembly of one or more furniture panels from two or more structural components and at least one internal fixing element. These structural components include an edge structure and at least one additional component formed from a further edge structure and/or a cover sheet. In various additional embodiments the structural components used to assemble a panel may include an edge structure and at least one additional component formed from a further edge structure, a mid beam and/or a cover sheet.

A structural component as referenced throughout this specification may be provided by a material which forms an interior or exterior surface of the resulting panel and which preferably provides the panel with structural integrity and a load bearing capacity. In particular the invention may employ structural components formed from cover sheets, edge structures and/or mid beams as discussed further below.

In various preferred embodiments structural components used by the invention may be formed from wooden materials. Wooden materials are a renewable resource which can be formed into visually attractive furniture articles.

A furniture panel provided in accordance with some aspects of the invention includes at least one cover sheet, the cover sheet being a type of structural component. A cover sheet may preferably be formed by a flat sheet material which is arranged to span the distance between or extend from the at least one edge structure of the panel. When the resulting panel is provided with a horizontal orientation a cover sheet may form the top or bottom surface of the panel. Conversely when the resulting panel is provided with a vertical orientation one or more cover sheets may be provided to form a side wall or sidewalls of the panel.

One side or face of a cover sheet will form the exterior surface of the sheet while the opposite side will form the sheet's interior surface. In some further embodiments the interior surface of a cover sheet may define one or more complimentary engagement forms which cooperate with an internal fixing element used to assemble the resulting panel.

A furniture panel provided in accordance with the invention includes at least one edge structure, the edge structure being a type of structural component. In various embodiments one edge structure may be used to form the front visible edge of a panel when installed in a furniture assembly. An edge structure may be used to span the distance required between two cover sheets with these cover sheets preferably extending at a right angle from an interior surface of an edge structure. The edge structure may be in the form of an edge beam including a front edge beam, rear edge beam, mid beam, joining beam or similar.

In other embodiments two edge structures may be engaged together using the at least one internal fixing element to form a first portion of a furniture panel. In this arrangement the furniture panel may be formed by joining two or more first portions using one or more joining edge structure. The one or more joining edge structure may be a different size and/or shape to the edge structures forming the first portion, for example a different length and/or cross-sectional shape.

An edge structure may be formed from a beam or length of wooden material or moulding which contributes to the strength and rigidity of the resulting panel. In a preferred embodiment an edge structure may be formed from a wooden beam with a substantially rectangular cross-section. In some forms the edge structure may be include rebates or grooves configured to cooperate with a cover sheet, and preferably receive a portion of a cover sheets. However those skilled in the art will appreciate that other shapes or forms of edge structures may also be utilised in additional embodiments of the invention.

One side or face of an edge structure will form the exterior surface of the structure while the opposite side will form the edge structure's interior surface. Those skilled in the art will appreciate that the exterior surface of the edge structure may also define various decorative features or forms in embodiments where it forms the front visible edge of a panel. In some further embodiments the interior surface of an edge structure may define one or more complimentary engagement forms which cooperate with an interior fixing element and/or a mid beam used to assemble the resulting panel.

A furniture panel provided in accordance with some forms of the invention may further include one or more mid beams. These components extend from the ends of an edge structure and are preferably formed from a beam or length of wooden material which contributes to the strength and rigidity of the resulting panel.

One side or face of a mid beam will form an exterior surface of the mid beam while the opposite side will form the mid beams interior surface. In some further embodiments the interior surface of a mid beam may define one or more complimentary engagement forms which cooperate with an interior fixing element or an edge structure used to assemble the resulting furniture panel.

A furniture panel provided by the invention also includes at least one internal fixing element used to engage two or more of the above components together. For example in some embodiments an internal fixing element can engage together two edge structures, or a cover sheet and an edge structure. In various embodiments an internal fixing elements can also be provided to engage together a mid beam with an edge structure. In yet other embodiments an internal fixing element may engage three or more of such components together—such as for example, two cover sheets with an edge structure, or two edge structures with a cover sheet. Those skilled in the art will appreciate that various combinations and permutations of such connections are within the scope of the present invention.

In various preferred embodiments an internal fixing element may also be configured to allow for the connection, and subsequent disconnection of structural components from one another. In such embodiments this arrangement of internal fixing elements allows for easy disassembly of panels and/or furniture assemblies if desired.

In preferred embodiment a panel formed in conjunction with the invention may include a plurality of separate, distinct internal fixing elements. An array of internal fixing elements may be deployed within the interior volume of a panel to fix its component parts together into a strong rigid form.

Reference in general throughout this specification will also be made to a panel being formed using a plurality of internal fixing elements. However those skilled in the art will appreciate that a single fixing element may perform this role in an alternative embodiment.

These internal fixing elements form a housing for themselves by engaging at least two structural components together. This housing at least partially conceals the internal fixing elements from view.

Those skilled in the art will appreciate that determining whether internal fixing elements are being obscured from view relies on an assessment of the observer's position and angle of view of the resulting panel. The panels provided in accordance with the present invention may therefore be designed and assembled with consideration paid to the role the panel is to perform in an assembled article of furniture, and the probable position and angle of view of an observer of this furniture.

For example in instances where a panel is to be provided with a horizontal orientation within a piece of furniture it is unlikely that an observer will view the furniture from a low angle or be positioned close to the ground. In these circumstances a panel may—as an example of one embodiment—be constructed from two cover sheets spanning a single front facing edge structure joined together using at least one internal fixing element. The housing formed by these components will therefore define a volume which locates the internal fixing elements and prevents them from being visible from directly in front of the furniture and from above the furniture. Alternatively, the furniture panel may include two edge structures.

In other instances where a panel is to be provided with a vertical orientation within a piece of furniture a similar design criteria may be applied. Again, as an example of one embodiment, a front facing edge structure may be engaged with two cover sheets forming the sides of the panel and engaged together using at least one internal fixing element. As an observer is unlikely to be in a position to view the rear of the furniture assembly a rear facing edge structure can be dispensed with, and the housing formed will obscure the internal fixing elements from being viewed from the front and sides of the furniture. The furniture panel may also include a back facing edge structure. The vertical panel is preferably used in combination with one or more horizontal element that will cover the open top end or bottom ends of the vertical panel.

Those skilled in the art will appreciate that the housing provided for the internal fixing elements does not necessarily need to fully enclose the volume involved but instead obscure this volume from being viewed from the most likely positions and orientations of a potential observer.

The internal fixing elements employed by the invention act to lock together and tension the various components of the panel they engage together. This action results in a self-supporting panel structure capable of performing the role required of it within a particular furniture assembly.

Furthermore in some embodiments an internal fixing element or element may be used to engage two structural components together by locking the relative position of each component with respect to each other while defining or retaining an aperture between these components. This aperture can be formed to allow at least a portion of an internal or external fixing element to extend between and project past the two engaged structural components.

A wide range and variety forms of internal fixing elements may be employed in various embodiments of the invention.

In a variety of embodiments an internal fixing element may incorporate included drive mechanism. This drive mechanism may be operated by an assembler of a panel to tension against at least one structural component of the panel enabling engagement with another structural component of the panel. A drive mechanism may also be operated in reverse in various embodiments. By providing a drive mechanism which is configured to operate reversibly this allows the drive mechanism to move at least one structural component of the panel towards and into engagement or disengagement with another structural component of the panel.

For example, in a variety of embodiments a drive mechanism may be formed by a threaded screw drive mounted to one part of an internal fixing element with the end of the screw drive bearing against another part. Rotation of the screw drive can therefore apply a force to separate or draw together these parts of the internal fixing element. In other embodiments an equivalent drive mechanism may be mounted within an internal fixing element to deform a linking member which engages together other parts of the internal fixing element which are engaged with a panel's structural components.

In some embodiments an internal fixing element may be formed by a bracket which cooperates with at least one connector formed from, for example, screws tacks, or similar mechanisms. These connectors can be used to engage the faces of the bracket with two or more internal surfaces of a panels edge structures, cover sheets or mid beams.

For example in one further embodiment an internal fixing element formed as a bracket may include at least one projection which is configured to cooperate with a complimentary form defined in a structural component. These forms of bracket based internal fixing elements may engage with the complimentary form or area defined in one or more structural components, and may also cooperate with additional connection systems to engage with one or more additional structural components.

In yet other embodiments an internal fixing element may be formed by a bracket which defines an engagement face or faces which cooperates with or connect to a structural component. This form of bracket can also incorporate a linking member connected to the engagement face(s) where deformation of the linking member by a force acting at an angle to the engagement face exerts a force on any connected structural component.

In additional embodiments a clamp structure may be used to form an internal fixing element. Such a clamp structure can be defined by a pair of opposed engagement faces which when moved towards one another lock a structural component in place relative to another structural component. Optionally this pair of opposed engagement faces may be connected by way of a linking member disposed between the faces. This linking member can then be deformed by force acting at an angle to the engagement faces to pull or push the engagement faces and any connected structural components together or apart.

For example in some embodiments an internal fixing element may be formed by a clamp or press like structure which is loosely engaged with two or more distinct components of the panel. Such clamps or presses may then be tensioned with use of a drive mechanism such as a threaded screw or similar element to draw the components of the panel towards and into engagement with one another.

In other embodiments an internal fixing element may be formed by a clip which is engaged with two or more distinct components of the panel. Such clip or grip structures may also be formed from a resilient material which can be then be tensioned when installed to draw the components of the panel towards and into engagement with one another.

In a variety of embodiments an internal fixing structure may also cooperate with a complimentary form or shape defined within the interior surface of a panel's edge structure, cover sheet, or mid beam. Such complimentary forms or mechanical keys may be used by an internal fixing structure to lock on these internal surfaces and facilitate the tensioning function performed by the internal fixing structure.

A furniture panel is an assembled panel configured to form one component of a furniture assembly such as a wall, a side, a shelf, a pair of coupled legs or such like. A furniture panel is a component of a furniture assembly and is preferably joined with one or more other furniture component to form the furniture assembly. The furniture component may include one or more further furniture panels or may include a separate wall, surface or structure to which the furniture panel is coupled to or with, such as an internal wall of a building. A furniture assembly may be constructed of a plurality of furniture panels, the plurality of furniture panels may be the same or different or combinations thereof.

In a number of embodiments a furniture panel provided by the invention may have a regular transverse cross section form. This characteristic of the resulting panel provides the end user or furniture assembler with a degree of freedom in the modification or adjustment of the final dimensions of the panel. The assembler may make cuts through the transverse cross section of the components of the panel to easily modify one of the panel's dimensions. Once these components have been cut to the required dimensions they may simply be assembled together using the internal fixing structures referenced above.

In various embodiments one or more of the structural components used to construct a furniture panel may be provided with a constant cross section form. This characteristic of structural components again allows an assembler to make at least one cut through the transverse cross section of the component to provide a desired length, depth or height dimension for the structural component.

Some forms of the furniture panel may include one or more exterior fixing elements. This exterior fixing elements or element may be used to engage the panel with other components, such as other furniture panels, of an associated furniture assembly. The exterior fixing elements being mounted on the exterior surface of the furniture panel may be positioned away from any cut to be made through the transverse cross section of the panel. Furthermore in some embodiments a portion or component of an interior fixing element may be used to define or provide at least a portion of an exterior fixing element.

According to another aspect of the present invention there is provided a furniture assembly formed from a plurality of furniture panels substantially as described above wherein at least one of the panels defines a receiving cavity, said at least one of the panels include at least one exterior fixing element, said exterior fixing element being used to connect the panel to another panel which defines a receiving cavity, wherein the receiving cavity encapsulates one or more exterior fixing elements used to connect to panels together.

According to a further aspect of the present invention there is provided a furniture assembly formed from a plurality of furniture panels substantially as described above, a plurality of said panels defining a receiving cavity, a plurality of said panels including at least one exterior fixing element extending from an exterior surface of the panel, said exterior fixing element being used to connect the panel to another panel which defines a receiving cavity, wherein said receiving cavity encapsulates the exterior fixing element used to connect the two panels together.

Preferably an exterior fixing element may be mounted on an exterior surface of a furniture panel.

The furniture assembly may include a shelf (such as a wall shelf or box shelf), a wardrobe, a bookcase, a table, a coffee table, kitchen unit, kitchen cabinetry, a cabinet, entertainment unit or any other type of assembled furniture. The furniture assembly may be free standing or in-built to a fixed structure, such as on or against a building wall; or under, within or on a bench top or surface.

According to another aspect of the invention there is provided a furniture assembly substantially as described above wherein at least one panel defining a receiving cavity includes an exterior fixing element located in said receiving cavity and arranged to engage with an exterior fixing element extending from the exterior surface of another panel, wherein said receiving cavity encapsulates both exterior fixing elements when engaged together.

In a preferred embodiment at least one panel provided by the invention defines a receiving cavity. Such a receiving cavity can be used to encapsulate an exterior fixing element used to connect the panel to another panel. As with the internal fixing elements used to assemble a panel, a receiving cavity can be used to at least partially conceal an exterior fixing element from view.

In some embodiments two panels may be connected together with an exterior fixing element mounted on an exterior surface of one of the panels which is encapsulated by a receiving cavity defined by the other panel.

Again those skilled in the art will appreciate that determining whether exterior fixing elements are being obscured from view relies on an assessment of the observer's position and angle of view of the resulting connected panels. The panels connected by exterior fixing elements may therefore be designed and assembled with consideration paid to the role the panels are to perform in an assembled article of furniture, and the probable position and angle of view of an observer of this furniture.

A receiving cavity formed in a panel may be formed in a number of ways in various embodiments.

For example in one embodiment a receiving cavity may be formed by a recess defined in the exterior surface of one or more components of a panel—such as for example a recess formed between one or more engaged cover sheets or edge structures substantially as described above.

In yet other embodiments a receiving cavity may be defined by the placement and arrangement of the exterior surfaces of components used to make up a panel. For example, in one embodiment the end or ends of one or more edge structures may extend past a mid beam to form a receiving cavity in combination with one or more cover sheets.

In yet further embodiments a receiving cavity may be formed by an interior housing defined within a panel and also used to enclose the internal fixing elements of the panel.

As referenced above in a number of preferred embodiments a plurality of panels used to assemble article of furniture may also incorporate exterior fixing elements. These exterior fixing elements can be implemented in a number of different ways in various embodiments, as described in further detail below.

In some embodiments, an exterior fixing element may engage directly with the wooden material of each panel it is to engage together. However in other embodiments an exterior fixing element may engage with the wooden material of one panel, and then be connected to another co-operating exterior fixing element which is itself engaged with the wooden material of the second panel. For example in one such embodiment a first exterior fixing element may project from the exterior surface of a first panel, with a second co-operating fixing element being located within the receiving cavity of a second panel. These two exterior fixing elements may then be engaged together while being encapsulated in the receiving cavity of the second panel to connect the two panels together while obscuring the exterior fixing elements from view.

Reference in general throughout this specification is also made to exterior fixing elements projecting from the exterior surface of the panel. Those skilled in the art should appreciate that in some embodiments a portion only of an exterior fixing element may extend from an exterior surface of the panel, with the remainder of the element being located within an interior region or volume or housing defined by the panel. References made to exterior fixing elements projecting from an exterior surface of a panel therefore encompass the entire fixing element forming a projection, or a portion only of the fixing element projecting from this exterior surface.

An exterior fixing element used to engage two panels together may be formed in a number of ways in various embodiments.

For example in one embodiment an exterior fixing element may be formed from an angled bracket which cooperates with a series of connectors such as screws, tacks or similar mechanisms which are driven into the wooden exterior surface of each panel to be connected. The dimensions and geometry of such a bracket may control the positioning and orientation of each connected panel with respect to its neighbour, with the material the bracket itself being hidden from view within the receiving cavity of one of these panels.

In yet another embodiment a pair of matched co-operating exterior fixing elements may be engaged together to interconnect two panels. For example in one further embodiment a pair of connectors with complimentary forms may be slid into engagement with one another with the sliding force applied tensioning the connection between these components.

The present invention may provide many potential advantages over the prior art.

The present invention has the potential to provide improvements over the prior art which allows for the provision of built-in furniture or mobile furniture articles formed from lightweight and inexpensive wooden materials.

The invention may also provide improved furniture components and furniture assemblies formed from such components which can be connected together without the connection systems used being visible to the end user of the furniture.

The invention may also provide fixing elements for use in constructing furniture panels and/or for assembling furniture panels to form furniture assemblies.

Improvements in the field of furniture construction are also available through use of the invention which provide furniture assemblers with the ability to modify or adjust the resulting dimensions of the furniture being assembled.

BRIEF DESCRIPTION OF THE DRAWINGS

Additional and further aspects of the present invention will be apparent to the reader from the following description of embodiments, given in by way of example only, with reference to the accompanying drawings.

FIGS. 4*a* to 4*f* show range of views of a further alternative exemplary box shelf furniture panel including an alternative clamping internal fixing element according to an embodiment of the invention.

FIGS. 6*a* to 6*d*(*ii*) show a range of views of an exemplary box shelf furniture panel including a keyed fixing element according to an embodiment of the invention.

FIGS. 7*a* to 7*d*(*ii*) show a range of views of a further exemplary box shelf furniture panel including a keyed internal fixing element according to an embodiment of the invention.

FIGS. 8*a* to 8*c*(*ii*) show a range of views of an exemplary box shelf furniture panel including a clamping internal fixing element according to an embodiment of the invention.

FIGS. 19*a* to 19*l* show a range of views of a further exemplary continuous sheet furniture panel including an alternative exemplary internal fixing element according to an embodiment of the invention.

FIGS. 24*d*(*i*) to 24*d*(*iv*) show a range of views of a further exemplary upright pair style furniture panel including an exemplary internal fixing element according to an embodiment of the invention.

FIGS. 31*g*(*i*) to (*iv*) show a range of views of the exemplary internal fixing element shown in FIGS. 31*a* to 31*h* according to an embodiment of the invention.

FIGS. 37*a* to 37*f*(*iv*) show an example of a built-in-place furniture assembly according to an embodiment of the invention.

FIG. 38 illustrates a further embodiment of a type of shelf furniture panel and the components used in the assembly of this panel.

Figure 1A:
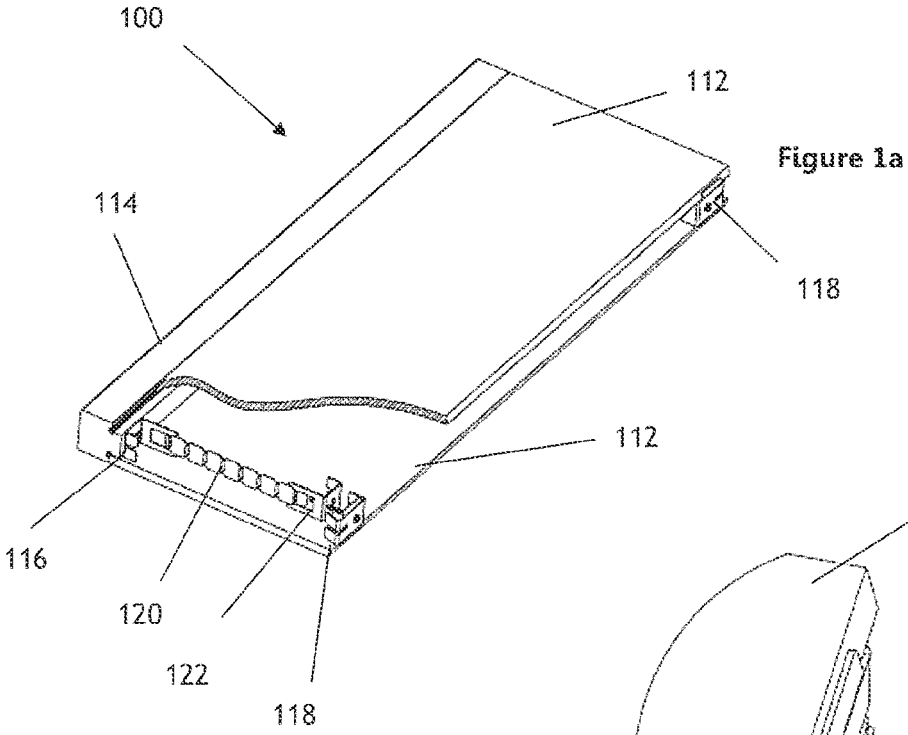
FIGS. 1*a* to 1*d* shows a range of views of an exemplary box shelf furniture panel including a pair of clamping internal fixing element according to an embodiment of the invention.

Further aspects of the invention will become apparent from the following description of the invention which is given by way of example only of particular embodiments.

BEST MODES FOR CARRYING OUT THE INVENTION

Shelf Furniture Panel

A first exemplary furniture panel according to a number of embodiments of the invention is a shelf. A shelf furniture panel is generally positioned in a substantially horizontal orientation, although as it would be understood by a skilled addressee the shelf may also be positioned in a substantially vertical orientation to form a wall type component.

A first type of shelf furniture panel is a box shelf. A box shelf furniture panel may include a pair of cover sheets coupled with at least one edge structure to construct a box-like arrangement having an internal cavity in which one or more internal fixing elements are located. The edge structure engages an interior surface of each of the pair of cover sheets and are secured using at least one internal fixing elements. In use, open faces of the furniture panel may be positioned against or between walls or other structures, such as one or more other furniture panels, to hide the internal fittings within the internal cavity. In other forms, the box shelf furniture panel may include at least one cover sheet coupled between a pair of edge structures. The box shelf furniture panel may form a shelf, panel or a shelf component of a furniture assembly.

FIGS. 1*a* to 1*d* show a range of views of an exemplary box shelf furniture panel including a pair of clamping internal fixing element according to an embodiment of the invention. As shown in FIGS. 1*a* to 1*d* the box shelf furniture panel 100 comprises a pair of cover sheets 112 and an edge structure 114 joined together using internal fixing element 120. Each of the internal fixing elements 120 engaged together the three structural elements formed by the pair of cover sheets 112 and edge structure 114.

Once assembled together the cover sheets 112 and edge structure 114 define a housing which contains the internal fixing elements 120. The edge structure can be used to define the forward facing front of the shelf so that this housing conceals the internal fixing elements from the view of an observer in front of the shelf.

The edge structure 114 may include a pair of rebates 126, each rebate 126 being configured to receive an edge of one of the pair of cover sheets 112. The rebates 126 preferably include an angled, inclined or undercut face or surface configured to correspond to the profile of the edge of each of the cover sheets 112. The angled, inclined or undercut face assists in providing a reaction force to securely engage the inner edge of each of the cover sheets 112 in the respective rebates 126 of the edge structure 114.

An edge beam fitting 116 is fastened to the edge structure 114. The edge beam fitting 116 comprises a first substantially perpendicular flange having an aperture 116*a* provided therein. The aperture 116*a* is adapted to receive the internal fixing element 120, shown as a segmented strap in this embodiment, through the hole when presented at an angle and captured by the sides of the aperture 116*a* when aligned in the substantially perpendicular position. The segmented strap 120 includes a series of segments with notches provided therebetween, the notches being adapted to engage with the sides of the hole 116*a* to secure a first end of the internal fixing element provided by segmented strap 120 with the edge beam fitting 116 and consequently the edge structure 114. The second end of the internal fixing element 120 is secured at a desired segment position in a similar manner to an aperture 122*a* provided in the termination fitting 122.

The segmented strap internal fixing element 120 may be adjusted to the desired length by cutting the notches between the segments to create a strap of the desired length. In some forms, the edge beam fitting 116 and the termination fitting 122 may be the same. In other forms the edge beam fitting 116, termination fitting 122 and segmented strap may be formed as an integrated internal fixing element 120. In this later arrangement, the length of the segmented strap would preferably be predefined.

The edge beam fitting 116 may further comprise a second substantially perpendicular flange 116*b* having a perpendicular slot 116*c* adapted to engage with a support rail or other fixing means (not shown). The support rail or other fixing means being part of another furniture panel or wall and configured to facilitate engagement of the box shelf furniture panel therewith.

An edge sheet fitting 118 is fastened to the termination fitting 122 with a fastener 124 that also provides tensioning of the assembly. During this assembly the termination fitting 122 is pulled towards the edge structure 114 engaging with an outer edge of each of the cover sheets 112 as seen in FIG. 1*b*. This forces the opposing inner edges of each of the cover sheets 112 into the rebates 126 the edge structure 114 forming a tight assembly. A slot in a flange in the termination fitting 122 is similar to that in the edge beam fitting 116 and may engage with a support rail providing support for the pair of cover sheets 112. The internal fitting element 120 are located within an internal cavity formed by the assembly of the pair of cover sheets 112 and the edge structure 114.

Figure 1B:
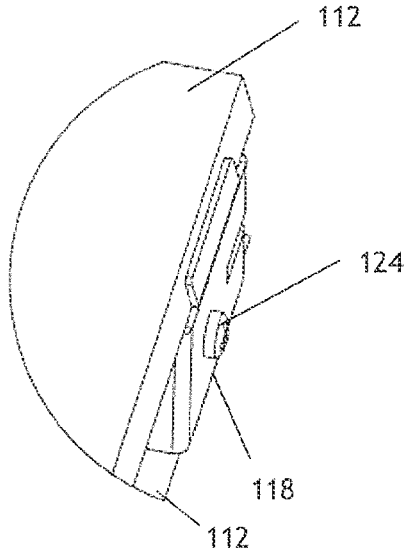
Figure 1C:
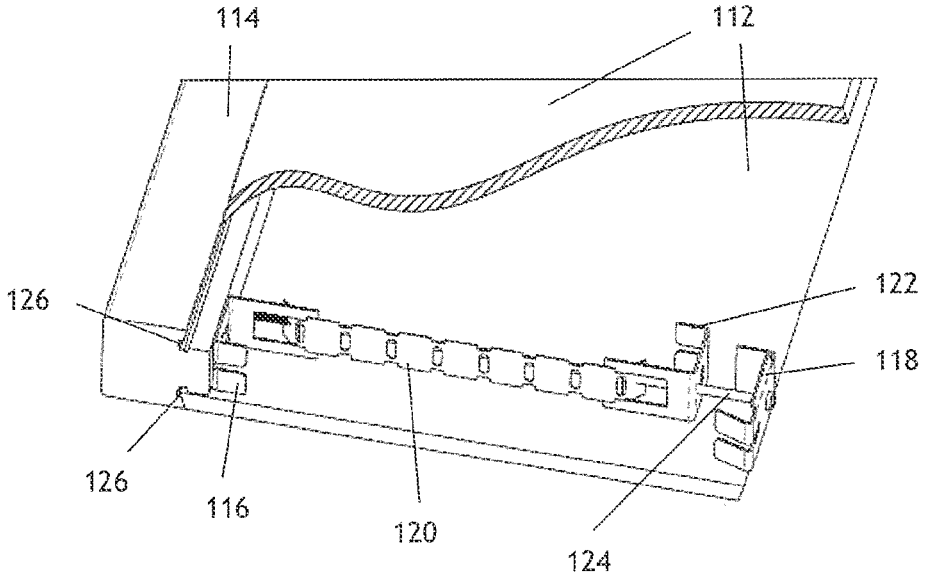
Figure 1D:
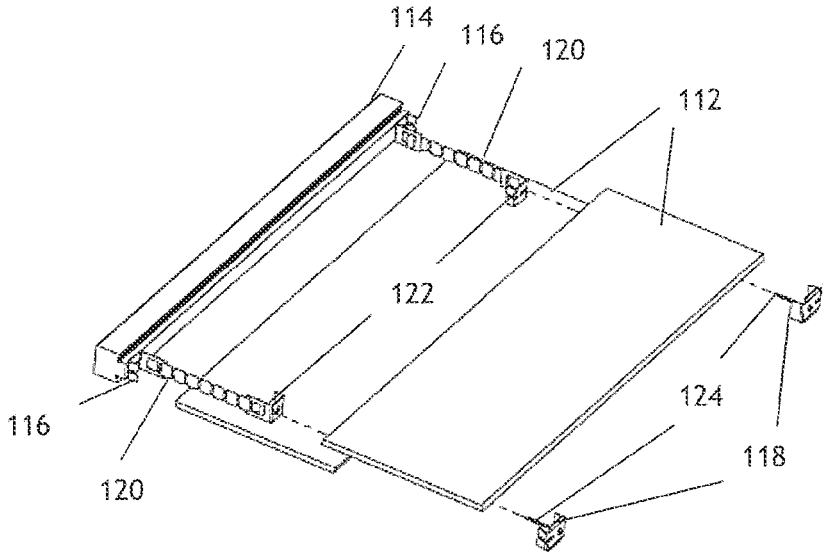

As shown in FIG. 1*d*, in this embodiment there are two fixing assemblies, one provided internally adjacent each side of the furniture panels 100. In some forms adhesive may also be applied along the surfaces of the rebate to further secure the cover sheets 112 to the edge structure 114 providing additional structural strength.

Figure 2:
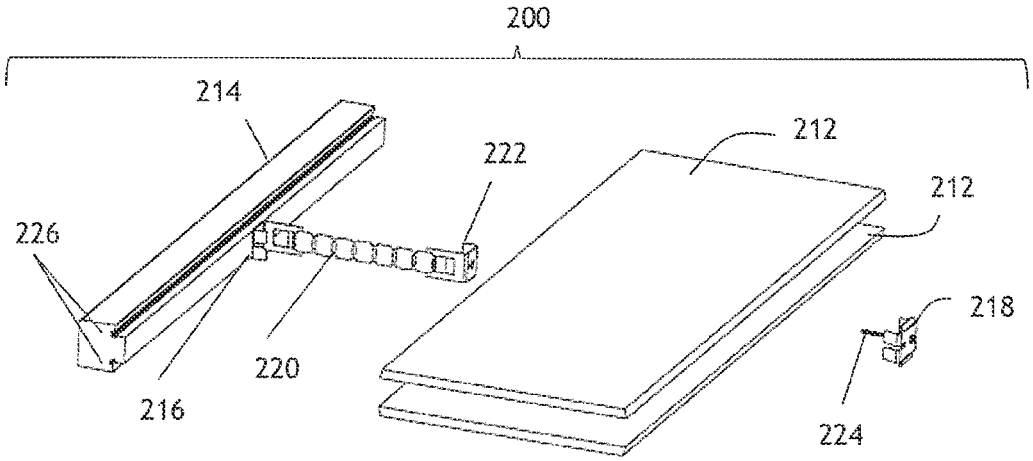
FIG. 2 show an alternative exemplary box shelf furniture panel including a clamping internal fixing element according to an embodiment of the invention.

FIG. 2 shows an embodiment of a box shelf furniture panel 200 that is constructed in a similar manner to that described for FIG. 1*a* except uses a single internal fixing element. As shown the single fitting assembly is positioned within a housing or internal cavity in an internally substantially central position. Again this housing conceals the internal fixing element from the view of an observer in front of the panel.

Figure 3:
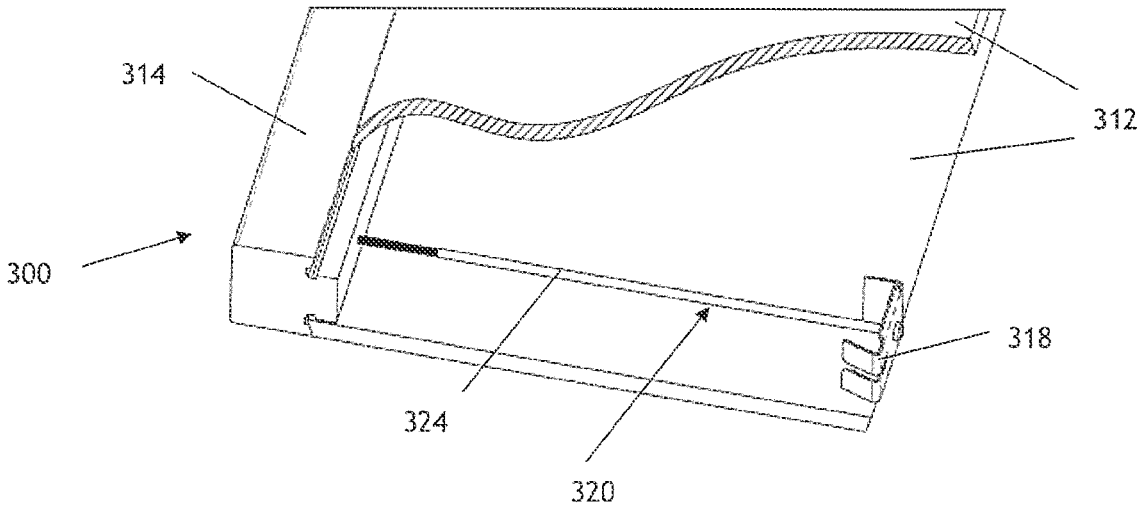
FIG. 3 show a further alternative exemplary box shelf furniture panel including an alternative clamping internal fixing element according to an embodiment of the invention.

FIG. 3 shows a further embodiment of a box shelf furniture panel 300. This furniture panel includes a different internal fixing element 320 in the form of a fastener having a long shaft. The box shelf furniture panel 300 similarly comprises a pair of cover sheets 312 and an edge structure 314 joined together using at least one, preferably two, internal fixing elements 320. The shaft of the internal fixing element 320 is inserted through a hole in the edge sheet fitting 318 with the end of the internal fixing element being fastenedly secured into the edge structure 314, for example by screwing. This fastening consequently pulling the edge sheet fitting against the outer edges of each of the cover sheets 312 in a similar manner to that described above.

FIGS. 4*a* to 4*f* show a further embodiment of a box shelf furniture panel 400 that uses a further embodiment of an internal fixing element 420. As described above the box shelf furniture panel 400 comprises an edge structure 414 coupled to a pair of cover sheets 412 using at least two internal fixing elements 420. The internal fixing elements 420 are preferably provided along or adjacent the side edges of the pair of cover sheets 412 substantially perpendicular to the inner edge of each of the pair of cover sheets 412 that are engaged with the edge structure 414. In this arrangement, the internal fixing element 420 may set the spacing between the pair of cover sheets 412.

Figure 4A:
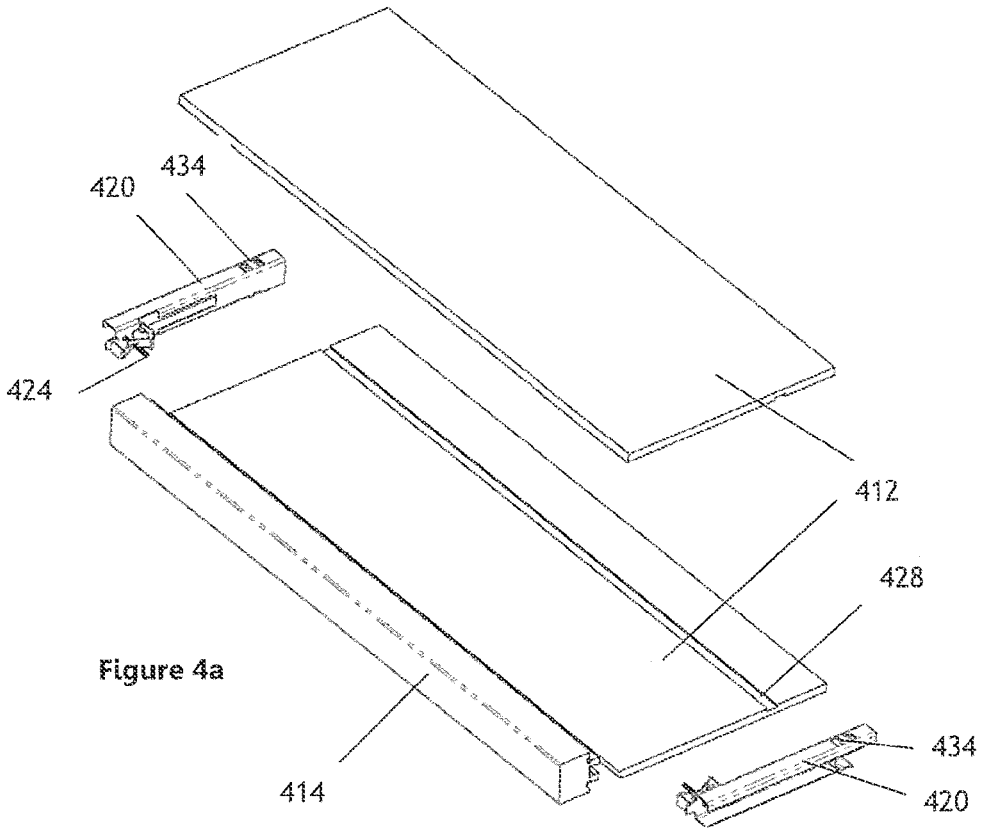

FIG. 4*a* is an exploded view of the box shelf furniture panel 400 showing the components thereof. FIGS. 4*b* to 4*e* show the assembled box shelf furniture panel with a portion of one of the cover sheets 412 removed to show one of the internal fixing arrangements. FIG. 4*f* is a cross-sectional view showing the internal fixing element 420 engaged with the pair of cover sheets 412 and edge structure 414.

As seen in FIGS. 4*a* to 4*e* each of the cover sheets includes a complimentary engagement form provide by groove 428 configured to engage one or more flange portions 434 of the internal fixing element 420. The one or more flange portions 434 protrude or extend from the upper and lower surfaces of the internal fixing element 420 to allow engagement with the grooves 428 in use and assist in securing the internal fixing element 420 in position and/or provide support and/or a desired spacing between the cover sheets 412. The grooves 428 may have a dovetail, slot, tongue/groove profile or any other common joinery joint. In an alternative arrangement, the internal fixing element 420 may include the grooves and each of the cover sheets 412 may comprise a complementary surface configured to engage with one of the grooves in the internal fixing element 420.

Figure 4B:
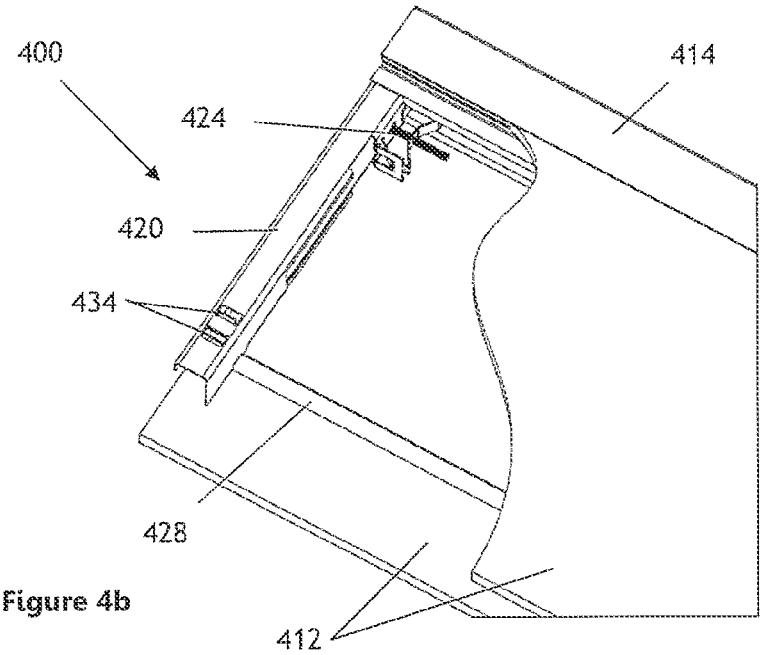
Figure 4G:
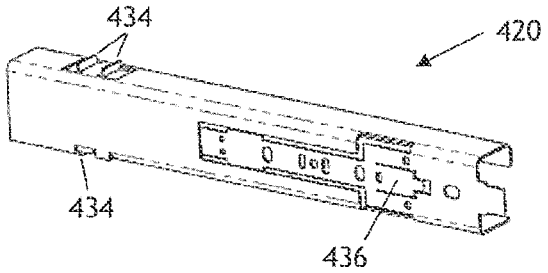
FIGS. 4*g* to 4*i* show a range of views of the exemplary internal fixing element from FIGS. 4*a* to 4*f* with a panel furniture according to an embodiment of the invention.
Figure 4H:
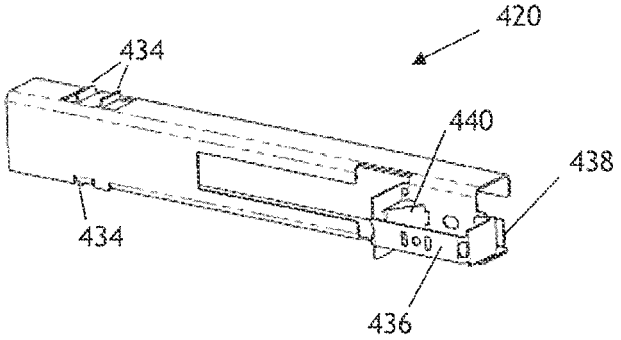

An engagement or end face of the internal fixing element 420 is configured to engage with the inner facing surface of the edge structure 414. As shown, the inner facing surface of the edge structure 414 includes a complimentary engagement form defined by a T-slot portion 413 that receives an extending flange 438 provide along the engagement face of the internal fixing element 420. The extending flange 438 is configured to provide vertical engagement and/or support with the edge structure 414. An exemplary internal fixing element 420 according to this embodiment is shown in FIGS. 4*g* to 4*i* and is discussed in more detail below.

Figure 4I:
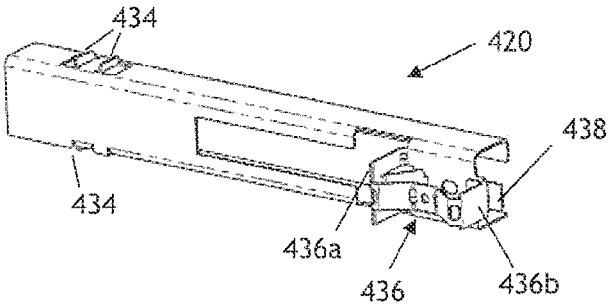
Figure 5A:
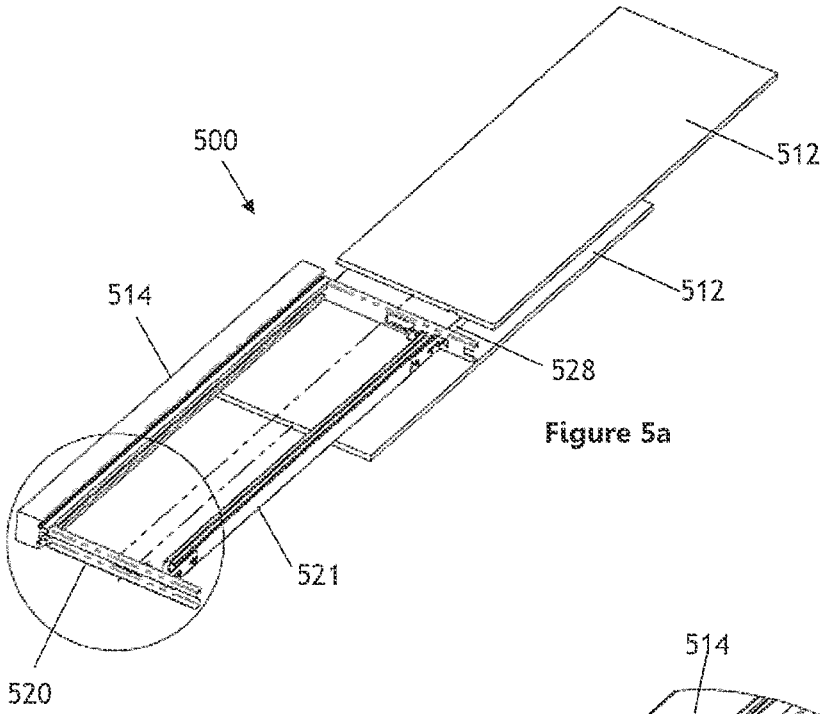
FIGS. 5*a* to 5*h* show a range of views of a further exemplary of box shelf furniture panel including plurality of internal fixing elements according to an embodiment of the invention.
Figure 5B:
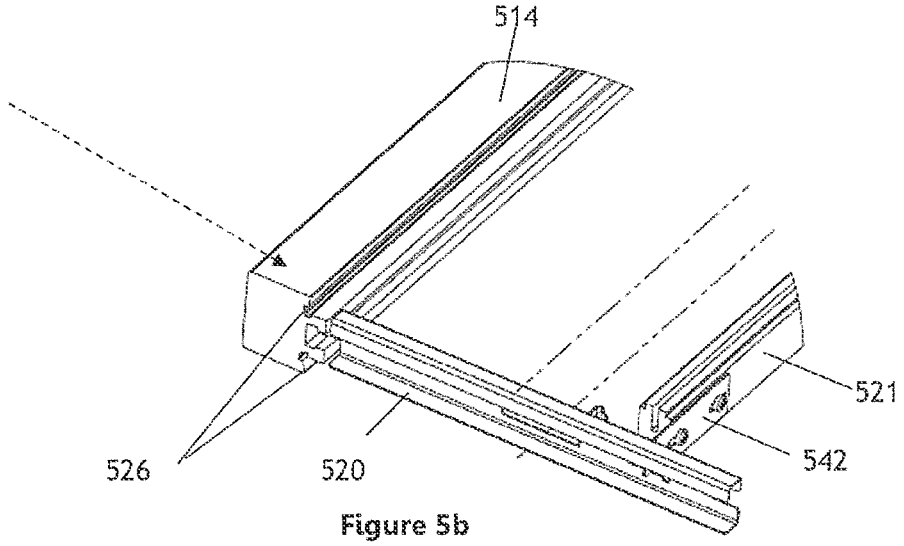
Figure 5C:
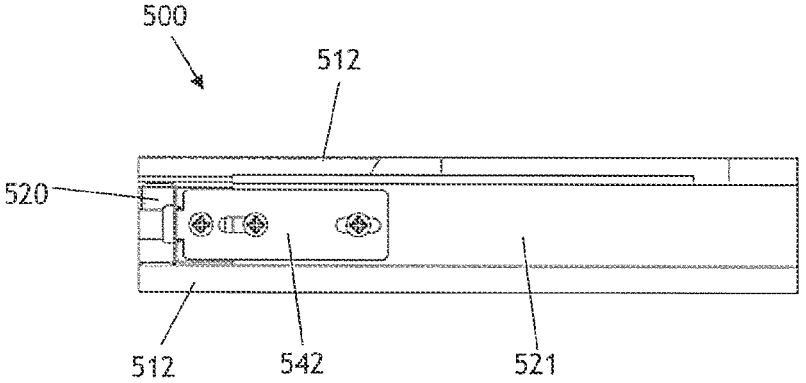
Figure 5D:
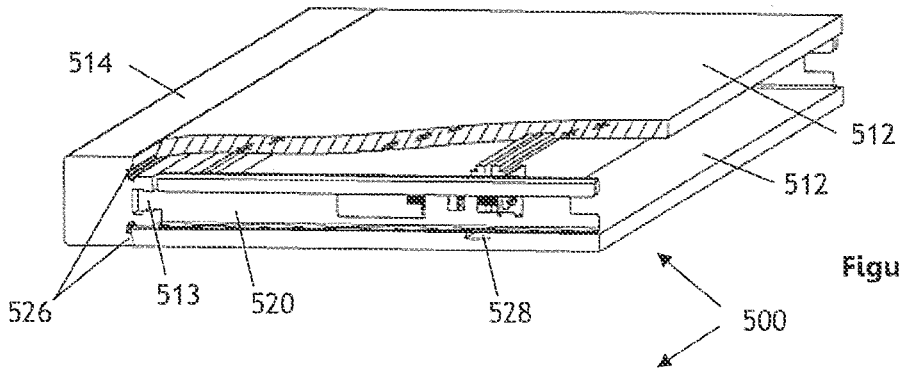
Figure 5E:
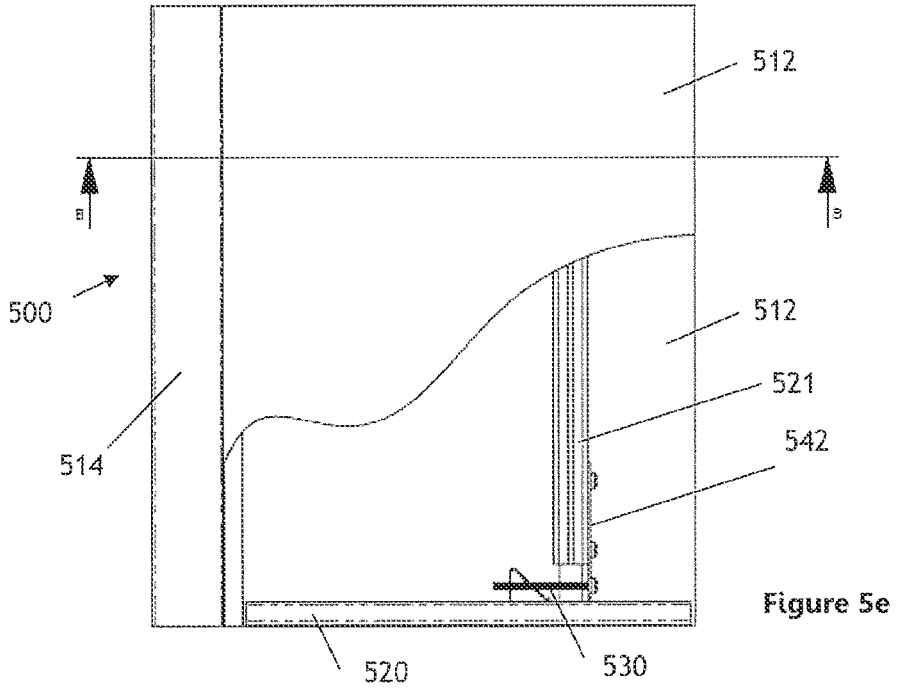
Figure 5F:
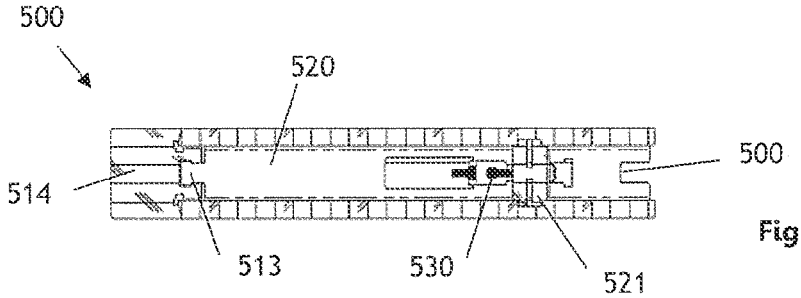
Figure 5G:
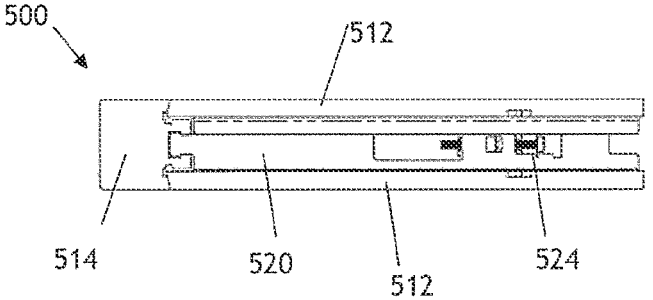
Figure 5H:
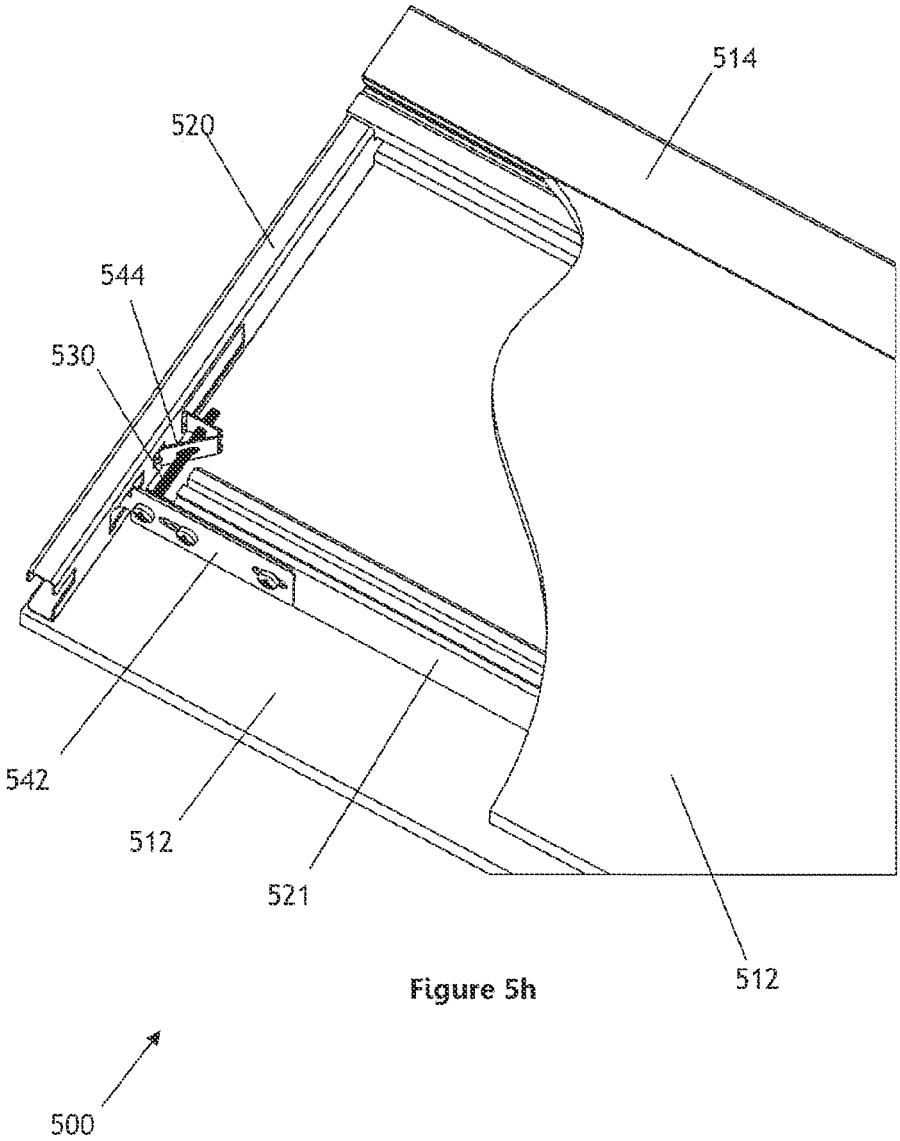

The internal fixing element 420 includes a linking member formed by a bridge portion 436 defined on an inner surface thereof (as seen in FIG. 4*i*) adjacent the engagement face and extending flange 438. The bridge portion 436 includes an inner support end 436*a* and an outer support end 436*b*. The outer support end 436*b* of the bridge portion 436 is located adjacent the edge structure 414 and captured within the T-slot portion thereof. A tensioning fastener 424 (as seen in FIGS. 4A, 4B and 4E), such as a screw, passes through a central region of the bridge portion 436 provided between support ends 436*a*, 436*b*. As the fastener 424 is tightened it forces the central region of the bridge portion 436 to collapse.

The inner support end 436*a* of the bridge portion 436 is restrained, strengthened or stiffened to prevent or significantly reduce any movement when the central region of the bridge portion 436 collapses. In contrast, the outer support end 436*b* of the bridge portion 436 is pulled towards the collapsing central region of the bridge portion 436 as a result of tightening of the fastener 424. This tensioning action consequently draws the internal fixing element 420 and the edge structure 414 toward each other. Furthermore, the edges of the pair of cover sheets 412 via the interaction of the grooves 428 and the flange portions 434 are also forced or drawn inwards into the rebates 426 provided in the edge structure 414. Therefore the application of a force acting at an angle to the engagement face of the internal fixing element 420 pulls the connected structural components together.

The bridge portion 436 is formed in a desired shape to allow for stiffening in some places and cut away material at other places where bending is required as described in more detail below.

FIGS. 4*g* to 4*i* show the formation of an internal fixing element 420 according to an embodiment of the invention. The internal fixing element 420 is formed as a single integrated unit, preferably from a metal. Cut outs are provided to allow the folding of portions of the unit to form the assembled internal fixing element 420 as shown in 4*i*. In other forms the internal fixing element 420 may be constructed from a plurality of interconnecting components.

As shown in FIGS. 4*g* to 4*i* the flange portions 434 may be formed as cut outs that are subsequently bent outwards to form the flange portions 434. The bridge portion 436 is formed by folding of a large cut out as shown in FIG. 4*g*. The large cut out includes a number of narrowed or thinned portions to facilitate the folding of the large cut out to form the bridge portion 436. In this arrangement, a support 440 may be formed at the inner end of the bridge portion by folding a portion of the cut out and locking it into a supporting position by inserting an end into an aperture formed in internal fixing element 420. The support 440 is configured to provide strengthening support to the inner support end 436*a* to prevent or significantly reduce movement of the inner support end 436*a* when the tensioning fastener is tightened to collapse the bridge in use. The outer support 436*b* is configured to be drawn inwards as the central region of the bridge collapses in response to the tightening of the fastener 434 in use.

FIGS. 5*a* to 5*h* show a further embodiment of a box shelf furniture panel similar to that described above having a pair of cover sheets 512 coupled, using internal fixing element 520 in combination with a secondary fixing element 521, to an edge structure 514. Each cover sheet 512 being received in a respective rebate 526 formed in the edge structure 514. The edge face of internal fixing element 520 may include a complementary profile to the inner edge of the edge structure 514, such as a T-slot 513. Each of the pair of cover sheets 512 have a groove 528 configured to receive opposing edges of the secondary fixing element 521. Preferably the grooves 528 and edges of the secondary fixing element 521 have complementary shapes to facilitate engagement therebetween.

A joining member 542 is coupled between the internal fixing element 520 and secondary fixing element 521. The joining member 542 may be a separate component fastened to at least the secondary fixing element 521 via one or more fasteners 524. When fastened to the secondary fixing element 521 the joining member 542 may comprise an engagement portion that engages with an aperture or slot in the internal fixing element 520. As shown the joining member is fastened to the secondary fixing element 521 and includes a T-shaped engagement portion that engages with a slot in the internal fixing element 520 (see FIG. 5*h*). The joining member 542 is configured to engage with the internal fixing element 520 to tension the secondary fixing element 520 along the axis of the internal fixing element 520 and consequently secure the cover sheets 512 into the rebates 526 in the edge structure 514 fastening them together.

The internal fixing element 520 includes a projection 544 configured to receive a tensioner element that passes through the joining element and into engagement with the projection 544. As illustrated the tensioner element 530 may be in the form of a screw or other type of fastener. The tensioner element 530 being configured to draw or pull the secondary fixing element 521 inwards towards the edge structure 514 as it is tightened. This tightening action pulls or draws the cover sheets 512 into the rebates 526 in the edge structure 514 securing them together. As the tensioner element 530 is tightened the T-shaped engagement portion of the joining member 542 is pulled or drawn within the slot in the internal fixing element 520 to laterally secure the internal fixing element 520.

In an alternative arrangement, the joining member 542 may be integrated into the secondary fixing element 521 or may be formed as an aperture in the end of the secondary fixing element 521 adapted to receive the tensioner element 530.

FIGS. 6*a* to 6*d*(*ii*) show a further alternative embodiment of a box shelf furniture panel similar to that discussed in relation to FIG. 5*a* to 5*h*. In this arrangement, the internal fixing element 620 is integrated with edge structure 614. The internal fixing element 620 including upper and lower protruding surfaces configured to engage with a first pair of complementary shaped grooves 628*a* provided in each of the pair of cover sheets 612. The complementary shapes may facilitate use of a keyed engagement mechanism.

To provide additional support and spacing for the cover sheets 612 a secondary fixing element 621 may be configured to engage with a second groove 628*b* being provided in each of the cover sheets 612.

It is acknowledged that in an alternative arrangement the grooves and protruding surfaces keyed engagement mechanism may be in the opposite arrangement. For example, the internal fixing element 620 may include upper and lower grooves and each of the cover sheets 612 may comprise a corresponding complementary protruding surface configured to engage with one of the grooves provided in the internal fixing element 620.

In some forms, the profiles of the internal fixing element 620 and the secondary fixing element 621 may include a dovetail shape having slots 620*w*, 621*w* to weaken the structure such that the dovetail engagement faces can move as the profile flexes. This provides allowance for manufacturing tolerances facilitating engagement with the cover sheets 612 while reducing the force of friction once assembled. Preferably the secondary fixing element 621 is form from a wood, metal or plastic material.

FIGS. 7*a* to 7*d*(*ii*) show a similar keyed box shelf furniture panel 700 to that described in FIGS. 6*a* to 6*d*(*ii*) above except using a different embodiment of a secondary fixing element 721 as shown in 7*d*(*ii*). In this arrangement, the furniture panel 700 may include at least one secondary fixing element 721.

In this embodiment, the secondary fixing element 721 is a beam having an I-shaped profile. The I-shaped profile has top and bottom flanges configured to engage with grooves in each of the pair of cover sheets 712. The secondary fixing element 721 may be one continuous beam that engages along the length of the grooves 728*a* in the pair of cover sheets or may be one or more shorter beams that may be distributed along the grooves 728*a* or provide adjacent at each end of the grooves 728*a*. Preferably the secondary fixing element 721 is made from metal.

Figure 7A:
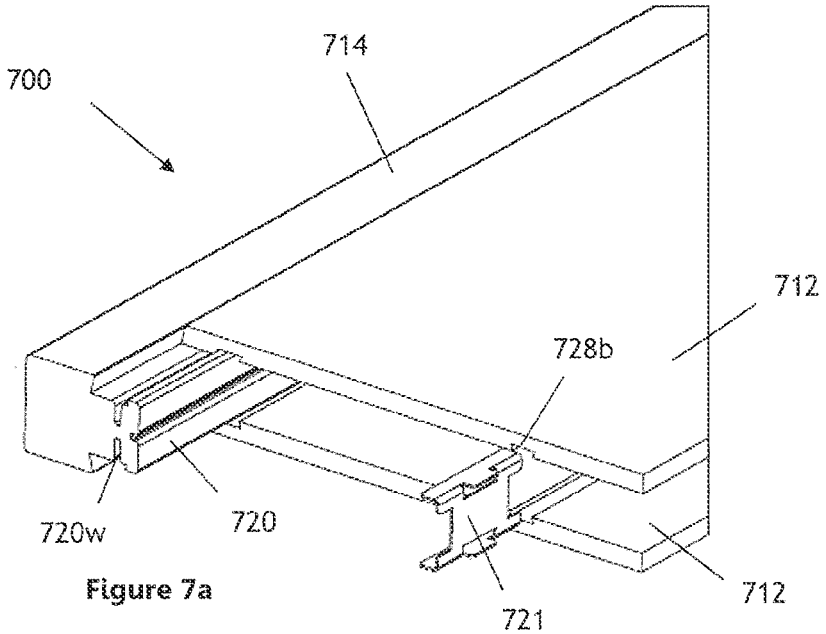
Figure 7B:
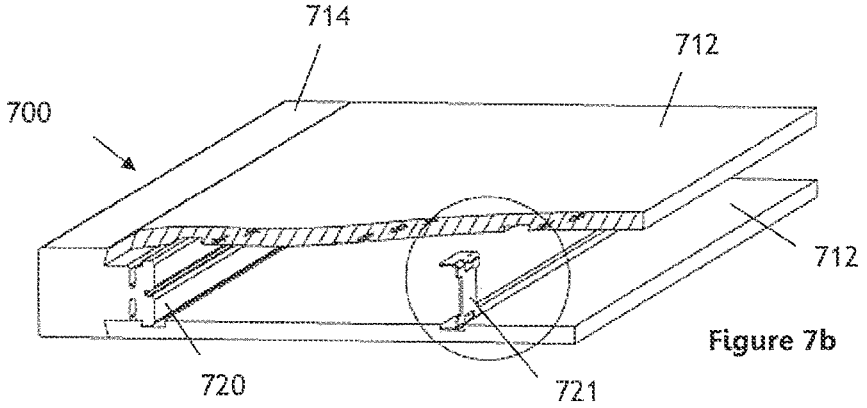
Figure 7C:
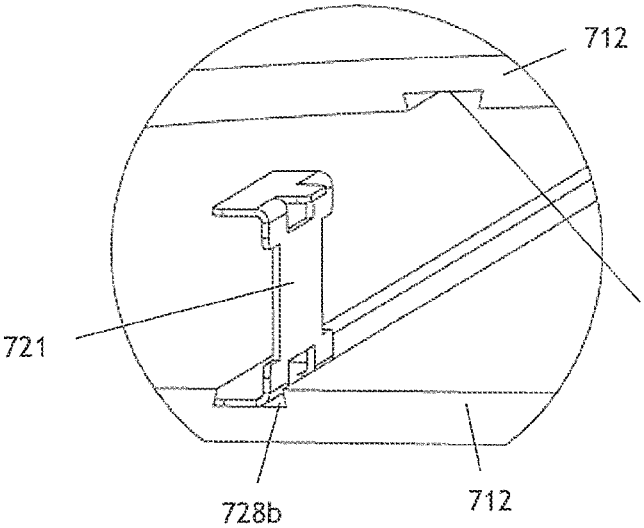

As seen in FIGS. 7*c* and 7*d*(*ii*) the secondary fixing element 721 may include one or more element configured to facilitate engagement of the furniture panel 700 with another furniture panel or supporting means.

FIGS. 8*a* to 8*c*(*ii*) show a further embodiment of a box shelf furniture panel 800 comprising a pair of opposing edge structures 814 supporting a pair of cover sheets 812 therebetween.

At least one internal fixing element which forms a clamp structure 820 is coupled to an inner face of each of the edge structures 814. In some forms, an engagement face 835 of the internal fixing elements 820 are fastened using a fastener 824 to the inner face of the edge structures 814. The fastening may include a screw, nail, glue or other forms of fixing two components together. In other forms as shown in FIGS. 8*e* to 8*g* the engagement face of the internal fixing element 820 may couple to the inner face of edge structure 814 using a complementary keyed arrangement. As shown the engagement face of the internal fixing element 820 has a predefined shape, such as a T-shape, that inserts into a complementary predefine shaped slot or channel 813, such as a T-slot, provided in the inner face of the edge structure 814.

Figure 8D:
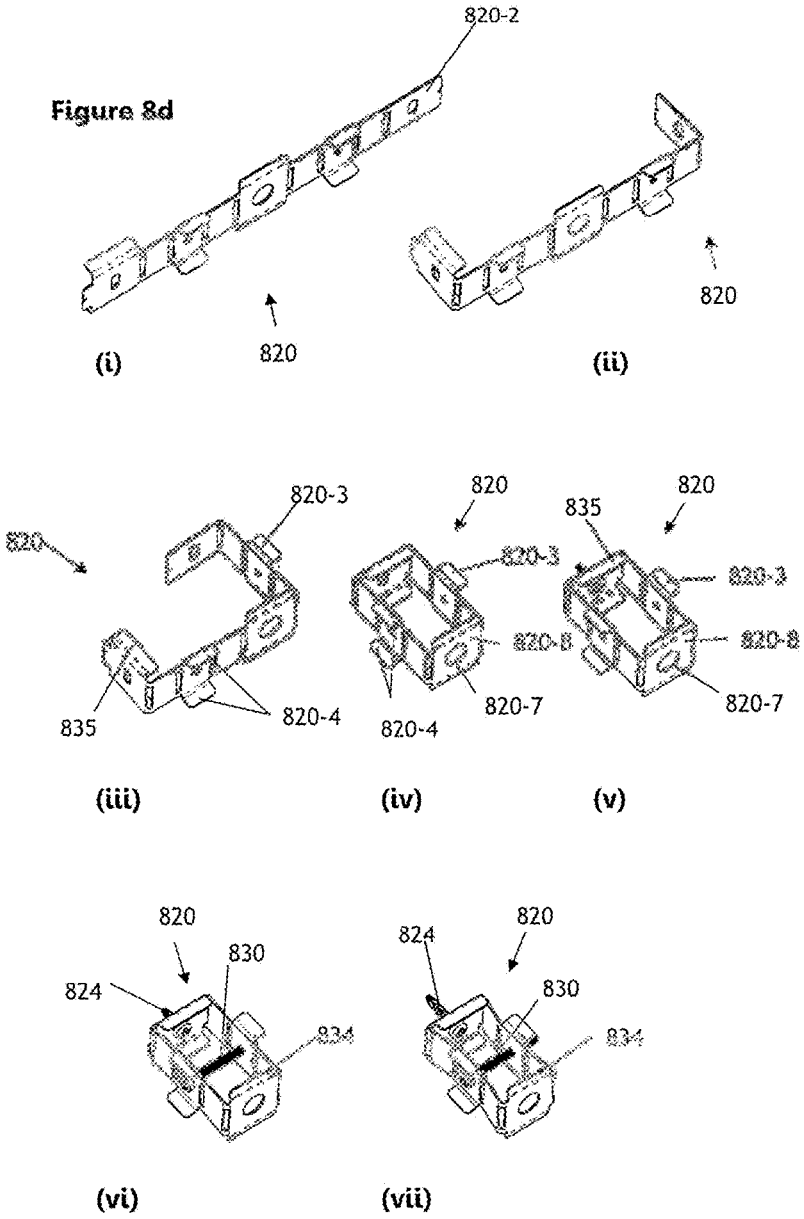
FIGS. 8*d*(*i*) to 8*d*(*vii*) show a range of views showing the construction of an exemplary internal fixing element according to an embodiment of the invention.
Figure 8E:
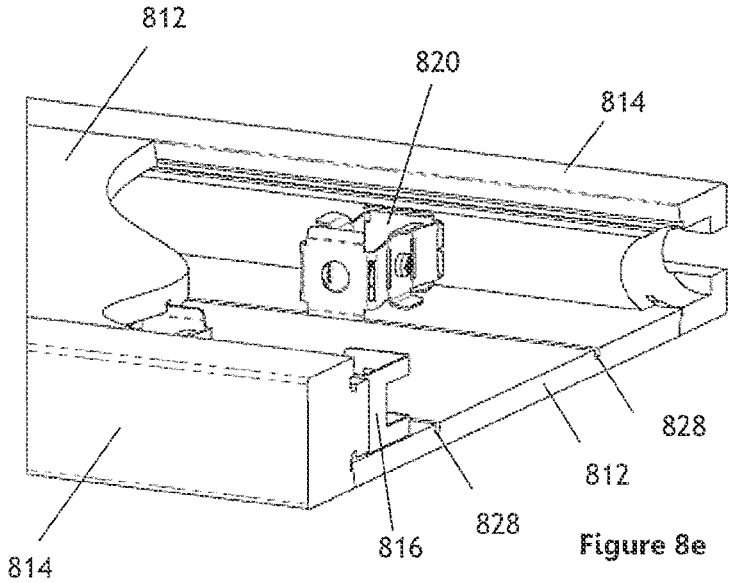
FIG. 8*e* shows an exemplary use of the internal fixing element shown in FIG. 8*d*(*vii*) according to an embodiment of the invention.
Figure 8F:
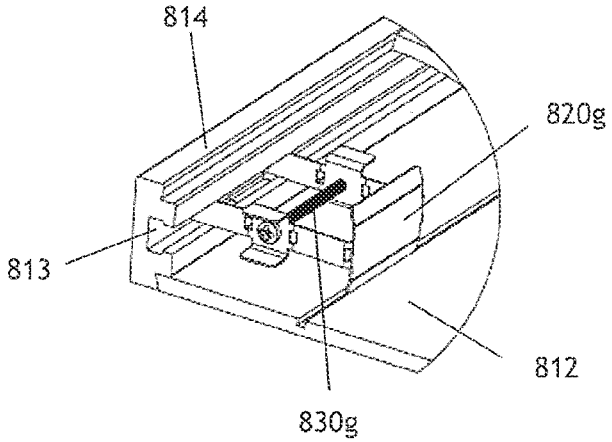
FIGS. 8*f* and 8*g* show an alternative exemplary internal fixing element and an exemplary use in a furniture panel according to an embodiment of the invention.
Figure 8G:
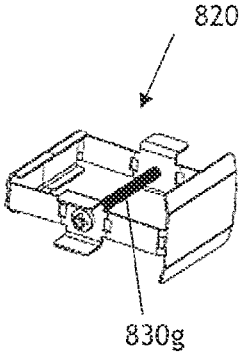

Details of the internal fixing element 820 are shown in FIGS. 8*d*(*i*) to 8*d*(*vii*) and described in more detail below. In this arrangement, each edge structure 814 is coupled to two internal fixing elements 820, however it is to be understood that one, three, four or more internal fixing elements may be used. The number of internal fixing elements may be based on the size or length of the edge structure.

As shown in FIGS. 8*d*(*i*) to (*vii*) the internal fixing element may be formed by folding an elongated element to form a generally rectangular shaped internal fixing element 820 seen in FIG. 8*d*(*iv*) having four sides or faces. The two free ends 820-1 and 820-2 of the elongated element are folded to overlap and form an engagement face. The engagement face formed is opposed to a further engagement face defined on the other end or side of the connector. The engagement face is configured to couple to the edge structure 814 in use. Free end 820-1 may include projections adapted to provide support or strength the overlapping free ends 820-1, 820-2 to prevent distortion or bending during tensioning in use. Optionally flange portions 820-3 and 820-4 may comprise extending flanges configured to support the pair of cover sheets 812.

A fastening tool, if required, such as a screw driver may access through aperture 820-7 in face 820-8 to facilitate fastening of the internal fixing element 820 to the edge structure 814. A drive mechanism provided by tensioner element 830 passes through the aperture in 820-4 and threads into the face in 820-3. This form of drive mechanism is also operable to reversibly move a connected structural component towards and into engagement or disengagement with another connected structural component.

The tensioner element 830 may be a tensioning fastener configured to pass through a hole in a first side of the fixing element 820 and engage with the second side of the fixing element 820. The tensioning element or fastener 830 is preferably positioned perpendicular to the engagement face of the internal fixing element 820. Furthermore, the head of the tensioning element preferably faces the outside of the panel for ease of access for tensioning adjustment. As the tensioner element 830 is tightened the opposing sides of the internal fixing element 820 are configured to draw or pull towards each other as seen in FIG. 8*d*(*vii*). As can be seen from these figures the action of the tensioner element 830 will deform the pair of intermediate linking members which join together the two opposed engagement faces provided at opposite ends of the internal fixing element 820. In this way a force acting an angle to the engagement faces is used to pull two structural components together, or alternatively can disengage two structural components.

The internal fixing element 820 further comprises flange portions 834 extending from upper and lower surfaces of the element. The flange portions 834 may be provided on the opposite face to the engagement face of the internal fixing element. The flange portions 834 configured to engage with grooves 828*a*, 828*b* located in the cover sheets 812 to facilitate assembly of the cover sheets 812 with the edge structures 814.

Each of the pair of cover sheets 812 comprise a first groove 828*a* and a second groove 828*b*. Each of the first and second grooves 828*a*, 828*b* being adapted to engage with the flange portion 834 of the at least one internal fixing elements 820 coupled to the edge structures 814. As the tensioner element 830 is adjusted and the two sides of the internal fixing element 820 are pulled together the flange portions 834 that are located in the cover sheet grooves 828*a*, 828*b* are also drawn inwards towards the fixed engagement face. This forces the cover sheets 812 into rebates 826 provided along the inner edges of each of the edge structures 814 securing the cover sheets 812 with the edge structures 814. In this arrangement, the internal fixing element 820 is tensioned after assembly to secure the engagement of the cover sheets 812 to the edge structures 814.

In some forms, at least one edge beam fitting 816 may be attached adjacent to an end of one or more of the pair of edge structures 814. The at least one edge beam fitting 816 is configured to engage with a support rail or other fixing means (not shown). The support rail or other fixing means being part of another furniture panel or wall and configured to facilitate engagement of the box shelf furniture panel 800 therewith.

FIGS. 8*f* and 8*g* show use of an alternative version of the internal fixing element 820*g*. This internal fixing element functions in a similar way to the internal fixing element 820 with a tensioning element 830*g*. The internal fixing element 820*g* is coupled to the edge structures 814 via use of a complementary keying arrangement that slides into the slot 813 in the edge structure 814.

Figure 9A:
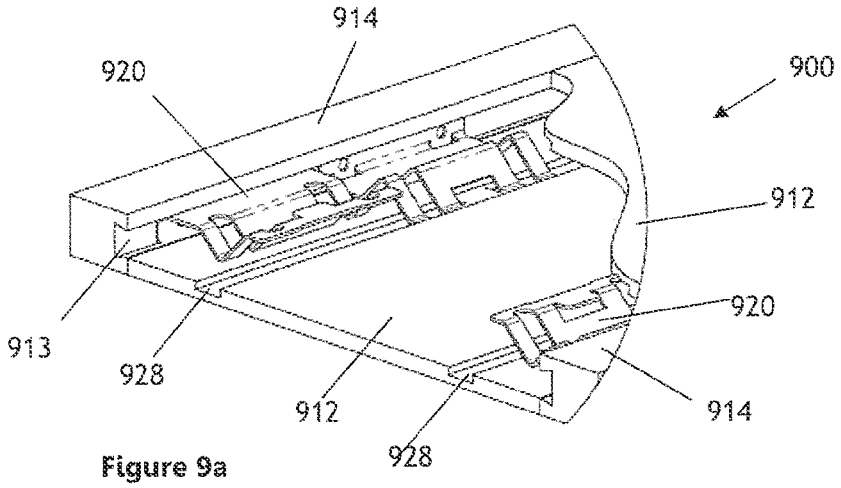
FIGS. 9*a* to 9*c* show a range of views of a further exemplary box shelf furniture panel including an alternative internal fixing element according to an embodiment of the invention.
Figure 9B:
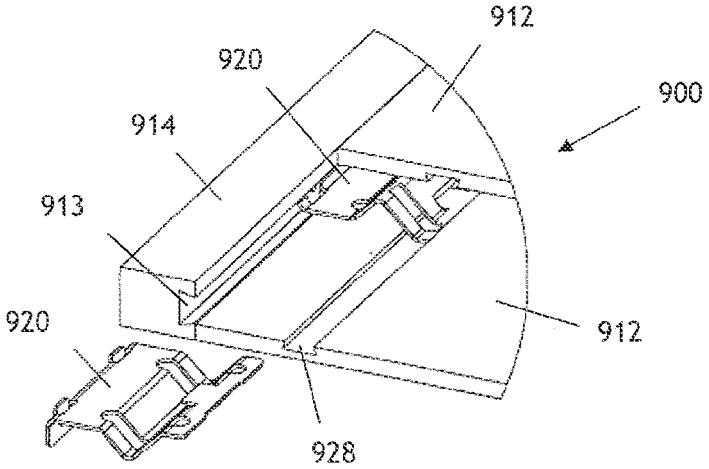
Figure 9C:
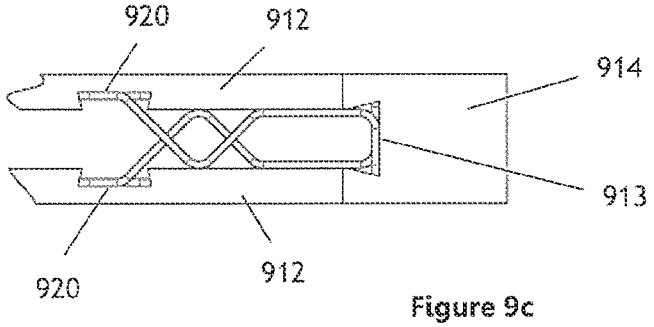

FIGS. 9*a* to 9*c* show a further alternative of a box shelf furniture panel 900 comprising two edges structures 914 coupled, using alternative internal fixing elements 920, with a pair of cover sheets 912. In this arrangement, the internal fixing element 920 comprises profiled faces or edge surfaces that are configured to engage with a slot 913 provided on the inner face of the edge structure 914 and grooves 928 provided in the cover sheets 912. Preferably at least one internal fixing element 920 is configured to engage between each of the edge structures 914 and each of the cover sheets 912. For example, a first internal fixing element 920 is inserted in a slot 913 provided in a first edge structure 912 and also engaged with a groove 928 provided in one of the cover sheets 912 (e.g. a top cover sheet). A second internal fixing element 920 is also engaged with the slot 913 in the first edge structure 914 but engages with the groove 928 in the second cover sheet 912 (i.e. the bottom cover sheet). The slot 913 in the second edge structure 914 is similarly engaged with two internal fixing elements that are subsequently engaged with the two different cover sheets 912. In this arrangement, each panel furniture 900 includes at least four internal fixing elements 920. Alternatively, the internal fixing elements 920 may comprise an integrated internal fixing element configured to engage one edge structure 914 with each of the cover sheets 912.

In some arrangements, the internal fixing element 920 may comprise sprung joiners that are configured to provide flex and spring to pull the different components together and reduce gaps that may be caused by tolerance variations. In other forms, the internal fixing element 920 may be substantially rigid and configured to accurately be inserted into complementary shaped grooves and slots. The internal fixing element 920 is preferably made from metal or a polymeric material such as a plastic. In some arrangements glue or bonding means may optionally also be used to fixedly secure the cover sheets 912 to the edge structures 914.

FIGS. 10*a* to 10*f* show a further example of a type of shelf furniture panel 1000. The shelf furniture panel 1000 may be referred to as a frame shelf. The frame shelf 1000 includes two edge structures 1014 coupled with at least one cover sheet 1012. In some forms, the edge structures may form the front and back of a shelf. At least one mid beam 1032 is provided between the two edge structures 1014 and supports the at least one cover sheet 1012. Preferably two mid beams 1032 are provided along the outer edge of the at least one cover sheet 1012 and are positioned substantially perpendicular to the two edge structures 1014, forming an outer frame around the outer edges of the framed shelf furniture panel 1000. Each mid beam 1032 is engaged with a pair of internal fixing elements 1020 coupled at opposing ends of the mid beam 1032. Each of the pair of internal fixing elements 1020 are configured to fasten to one of the edge structures 1014.

Figure 10A:
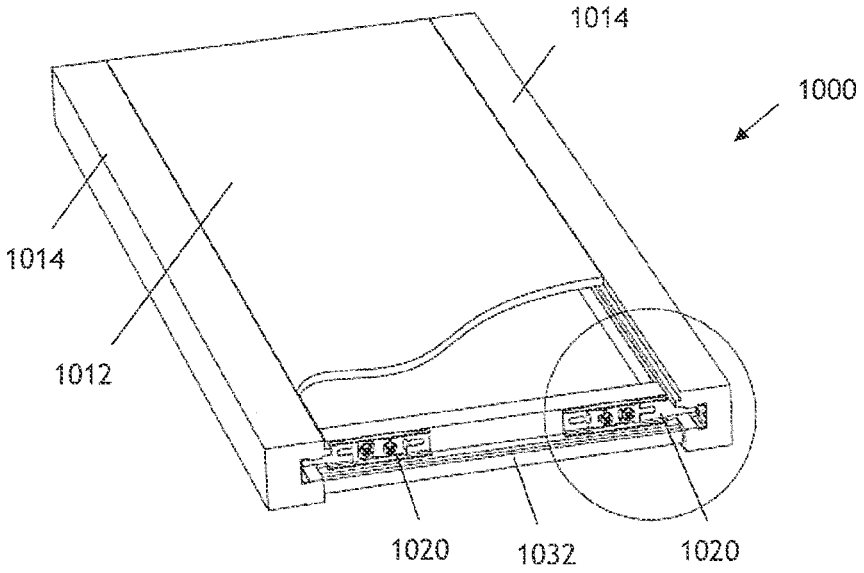
FIGS. 10*a* to 10*f* show a range of views of an exemplary framed shelf furniture panel including an exemplary internal fixing element according to an embodiment of the invention.
Figure 10B:
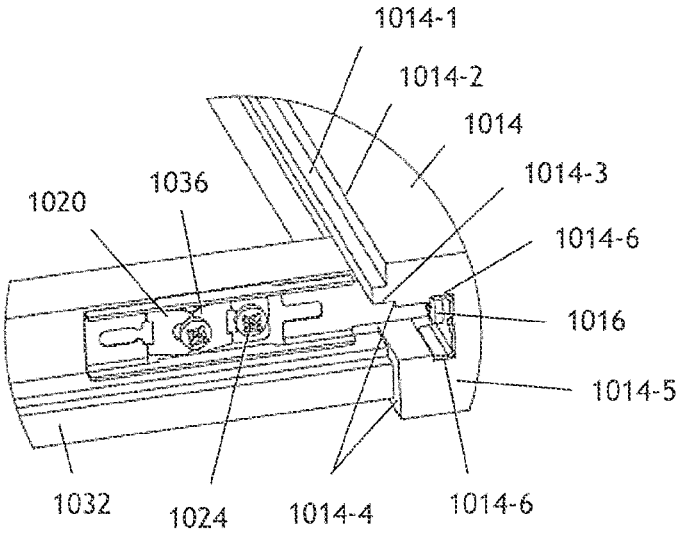
Figure 10C:
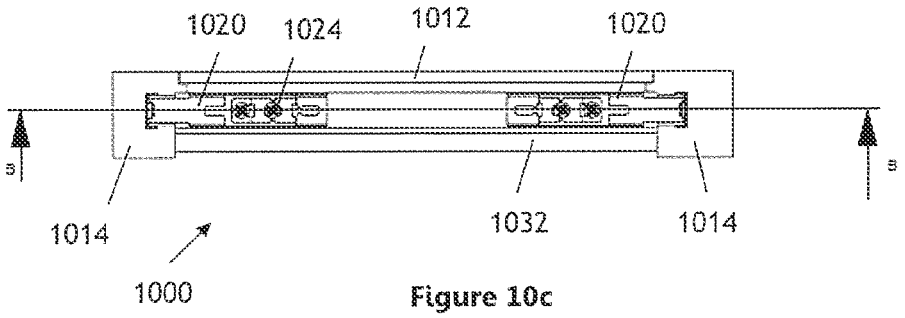
Figure 10D:
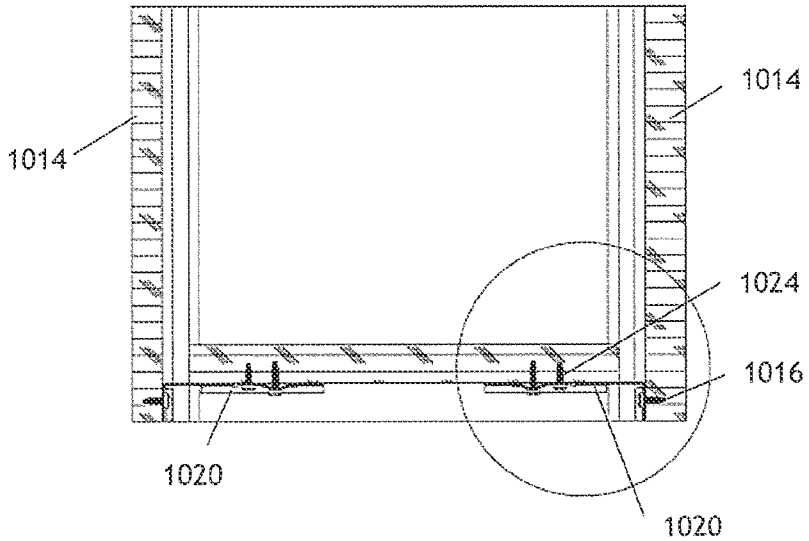
Figure 10E:
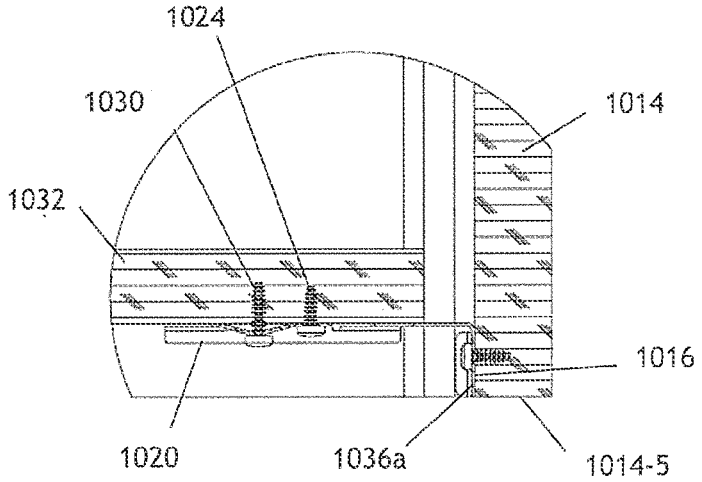
Figure 10F:
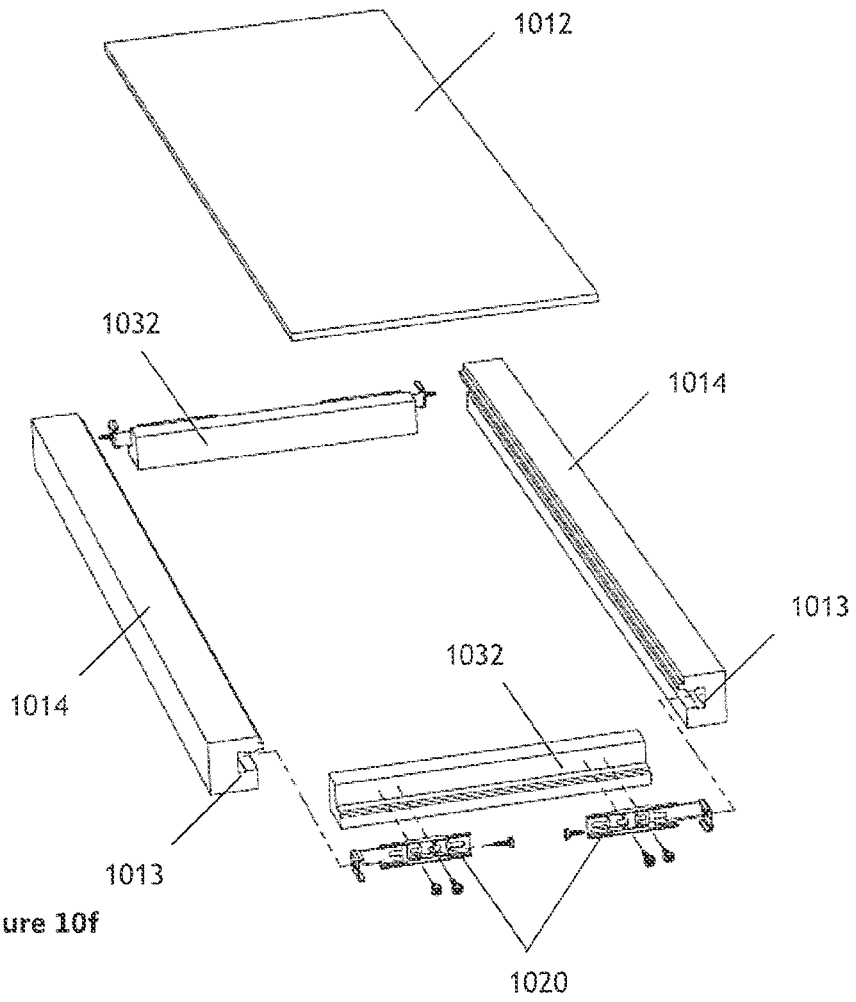
Figure 10G:
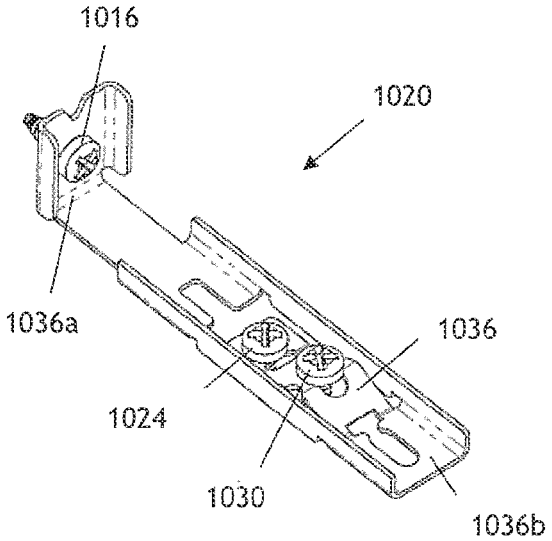
FIGS. 10*g* to 10*k* show a range of views of an exemplary internal fixing element for use in a framed shelf furniture panel according to an embodiment of the invention.
Figure 10H:
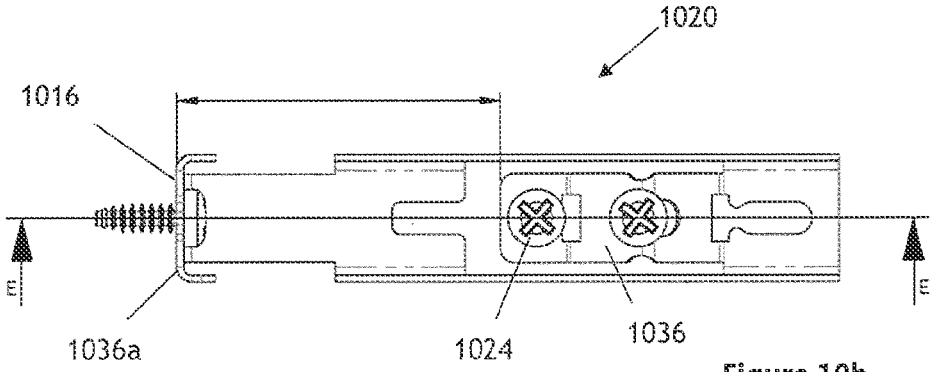
Figure 10I:
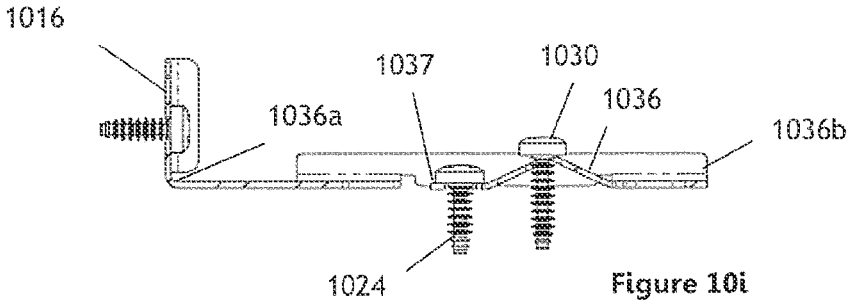
Figure 10J:
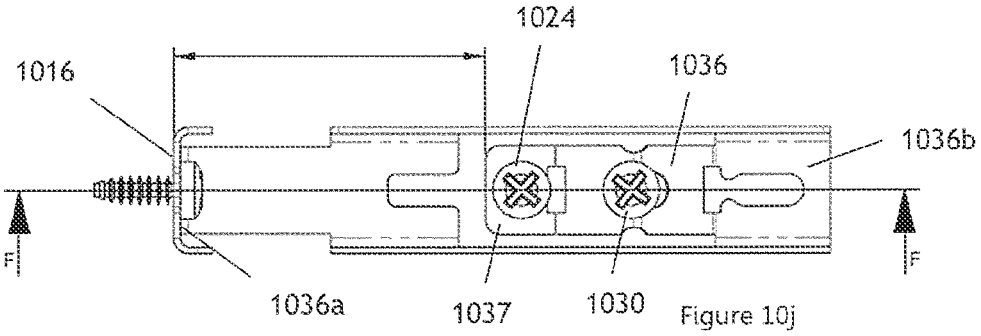
Figure 10K:
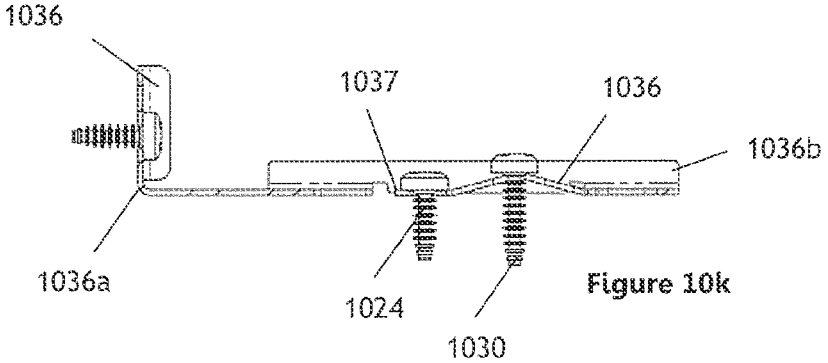

An exemplary internal fixing element 1020 is shown in FIGS. 10*g* to 10*k*. As shown the internal fixing element 1020 comprises an edge beam fitting portion 1016 at a first end 1036*a* for securing the internal fixing element 1020 to the edge structure 1014. In other forms as seen in FIG. 10*f*, the edge beam fitting may be in the form of an extending flange or tang adapted to be received in a slot 1013 provided in the inner face of the edge structure 1014. The internal fixing element 1020 further comprises a bridge portion 1036. The internal fixing element is secured or fixed (e.g. using a fastener 1024) to the mid beam 1032 at a securing portion 1037 adjacent the bridge portion 1036. The bridge portion 1036 is configured to receive a tensioner element 1030. FIGS. 10*h* and 10*i* show the bridge 1036 with tensioner element 1030 in a pre-tensioned state. In contrast FIGS. 10*j* and 10*k* show the bridge portions 1036 in a tensioned state. When the tensioner element 1030 is adjusted or tightened, in use, the bridge portion 1036 is configured to collapse or flatten which forces the second end 1036*b* of the internal fixing element inwards. This consequently pulls the edge structure 1014 secured via the edge beam fitting 1016 inwards towards the opposing edge structure.

When both of the internal fixing elements 1020 are attached and tensioned to each of the edge structures the at least one cover sheet 1012 may be clamped between the two edge structures 1014. In this arrangement, the edge structures 1014 define rebates 1026 configured to receive an edge of the at least one cover sheet 1012. The rebates 1026 are configured to facilitate clamping and securing the at least one cover sheet 1012 between the two edge structures 1014 when the tensioner element 1030 is tensioned. Alternatively, the cover sheet 1012 may drop in or slide into complimentary rebates provided in one or more of the mid beam 1032 and/or the edge structures 1014.

The distance D between the first end 1036*a* of the internal fixing element 1020 and the securing portion 1037 decreases when the bridge portion 1036 is tensioned.

Figure 11A:
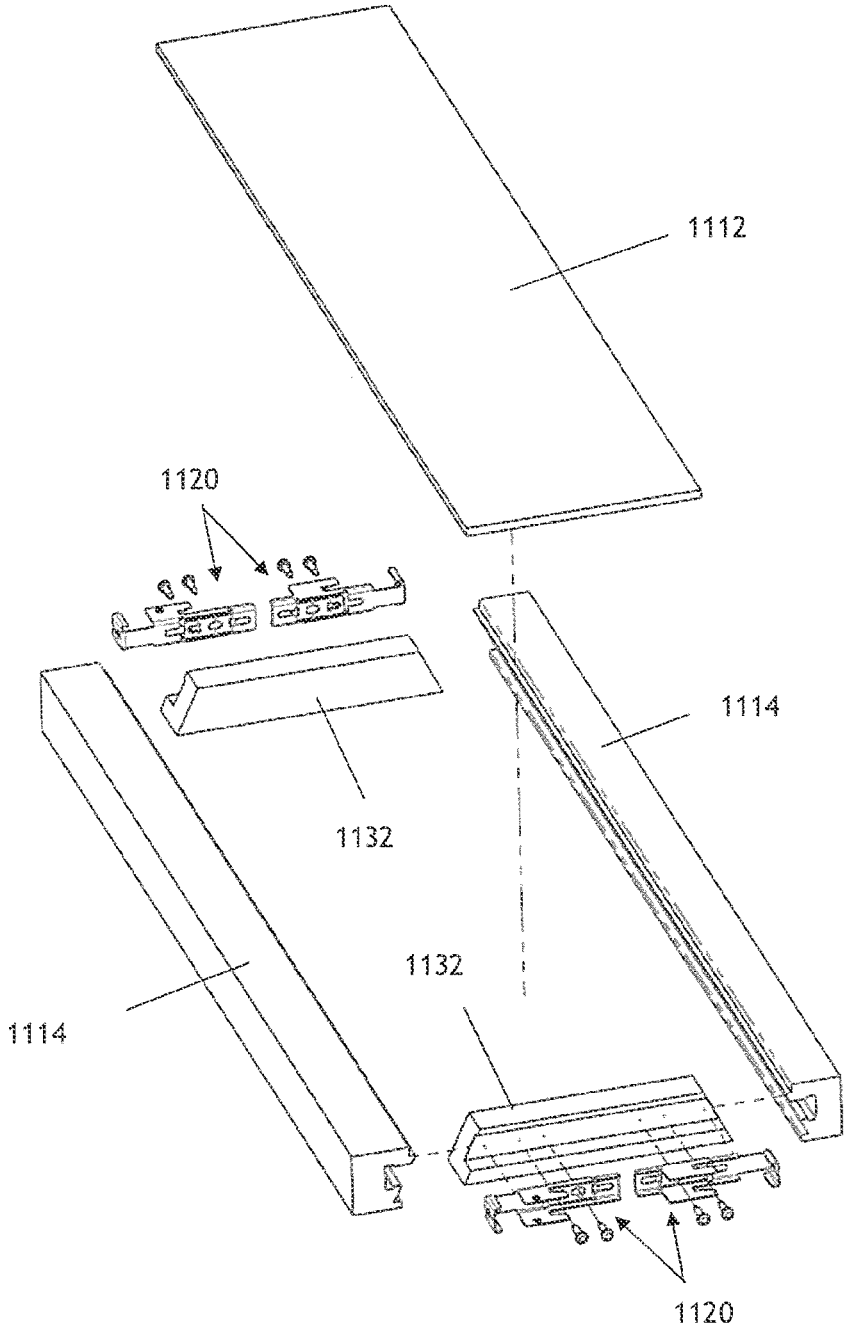
FIGS. 11*a* to 11*c* show a range of views of a further exemplary framed shelf furniture panel including an exemplary internal fixing element according to an embodiment of the invention.
Figure 11B:
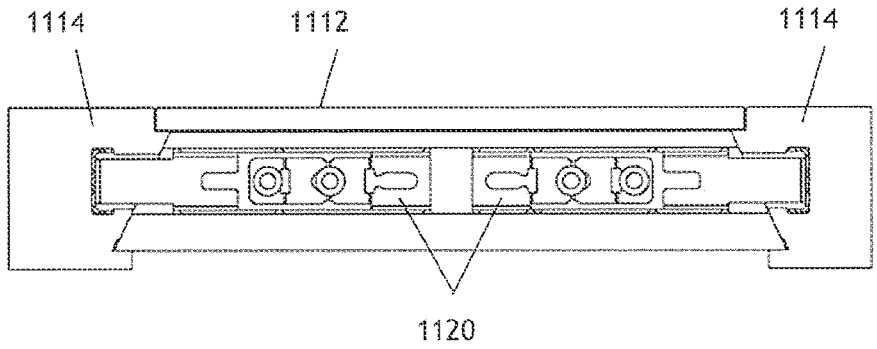
Figure 11C:
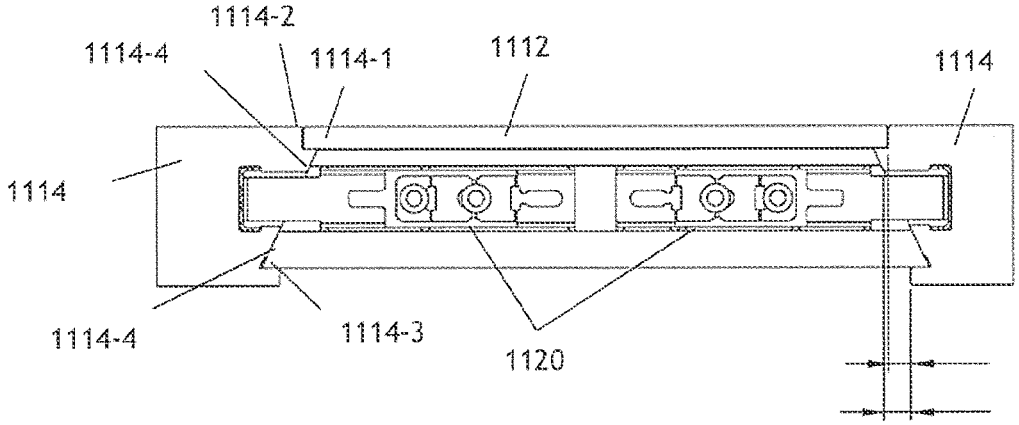

FIGS. 11*a* to 11*c* show a further example of a frame shelf furniture panel 1100 similar to that described above. In this arrangement, the edge of the mid beam 1132 comprises complimentary engagement forms provided by angled profile edges configured to couple with complementary profiles provided on each of the edge structures 1114. The at least one cover sheet 1112 may drop in, slide in or similarly comprise an angled edge to couple with rebates provided along the inner edge of the edge structures 1114. As shown the two mid beams 1132 and edge structures 1114 may form a frame around the outer edges of the shelf furniture panel 1100.

Continuous Sheet Furniture Panel

A further exemplary furniture panel according to the invention is a continuous sheet furniture panel. FIGS. 12*a* to 19*k* and 28*a* to 28*c* provide examples of continuous sheet furniture panels. The continuous sheet furniture panel comprises two edge structures and two cover sheets that are coupled together using a plurality of internal fixing elements. The continuous sheet furniture panel may optionally include cap elements as described in more detail below. The continuous sheet furniture panel may be used in a furniture assembly. Preferably the continuous sheet furniture panel may be used as one or more vertical panels of a furniture assembly.

In some forms, a first cover sheet of the two cover sheets is coupled to each of the edge structures in one or more locations such that the arrangement positions the first cover sheet spaced away from the pair of edge structures to create a narrow slot or gap that may appear like a dark line from a distance. The slot or gap may be used to provide access for removable fixing or bracket solutions for other furniture panels such as shelf panels. Preferably the width of the slot (gap) and the depth of the slot (which may be equal to the sheet thickness) creates the illusion that the slot is merely the transition between the edges of two components. The second cover sheet may be held within a channel or rebate in each of the pair of edge structures. The second cover sheet being adapted to cover and conceal the internal cavity of the furniture panel.

FIGS. 12*a* to 12*g* show an embodiment of a continuous sheet furniture panel 1200. In this arrangement edge structures 1214 are structurally connected to a first cover sheet 1212-1 via a plurality of internal fixing elements 1220. The first cover sheet 1212-1 is positioned adjacent the inner edge of each of the edge structures 1214 in manner to form a gap or slot 1248 provided along and between the inner edges of the cover sheet 1212-1 and the edge structures 1214. The width of the gap or slot 1248 is configured to provide access for fixing elements to pass through and engage with a bracketing element provided within the edge structures. Preferably the gap or slot 1248 is limited or narrow to create an illusion of being a transition between the edges of the two components, for example the gap may be 0.5 mm to 2.5 mm wide, preferably 0.5 mm to 2.0 mm. For general household furniture, the gap width may preferably have a ratio of width to depth of approximately 1:6 to define a characteristic viewing angle and shadow angle. The width of the gap or slot 1248 is sufficient to allow a first tang 1220-1*a* of the internal fixing element 1220-1 to pass through. In this way the internal fixing elements 1220 lock the relative position of each structural component with respect to each other, and define an aperture between two adjacent structural components, allowing at least a portion of an internal or external fixing element to extend between and project past these components.

A second cover sheet 1212-2 is coupled to each of the edge structures 1214 and configured to conceal the internal cavity of the furniture panel 1200. As shown the second cover sheet 1212-2 may be held in a channel or grooves provided in each edge structure 1214.

Figure 12A:
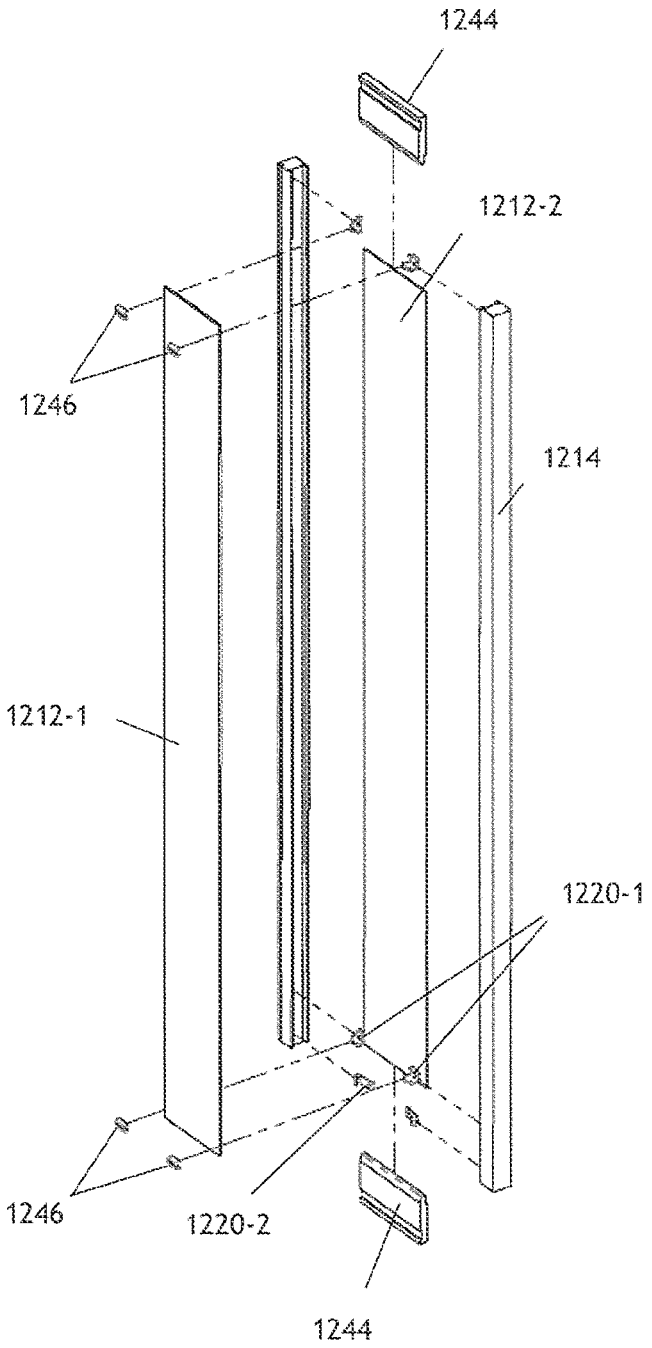
FIGS. 12*a* to 12*g* show a range of views of an exemplary continuous sheet furniture panel including an exemplary internal fixing element according to an embodiment of the invention.
Figure 12B:
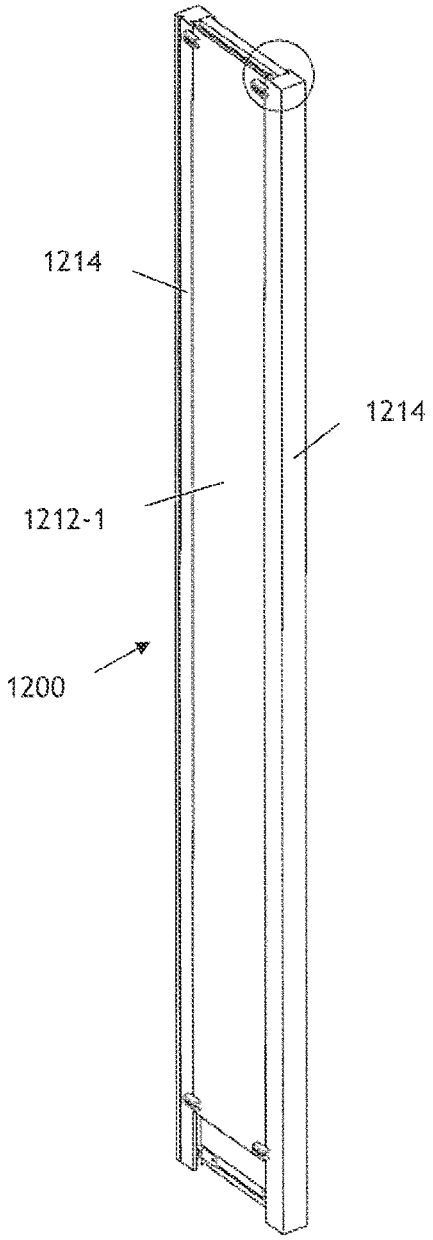
Figure 12C:
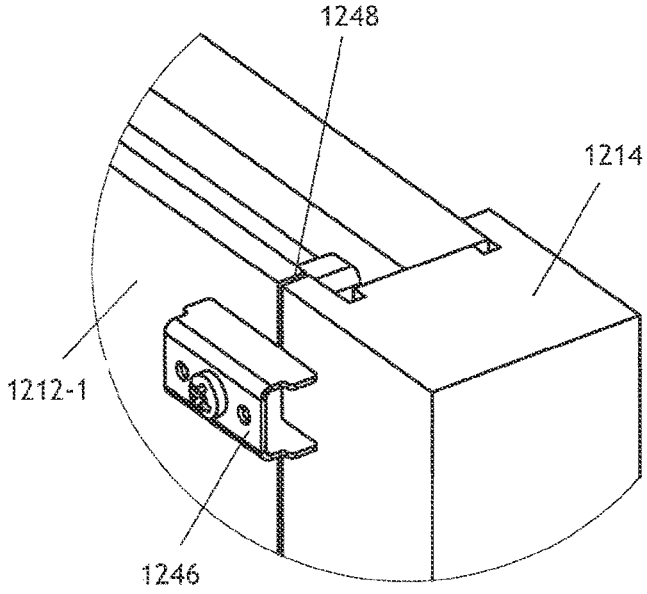
Figure 12D:
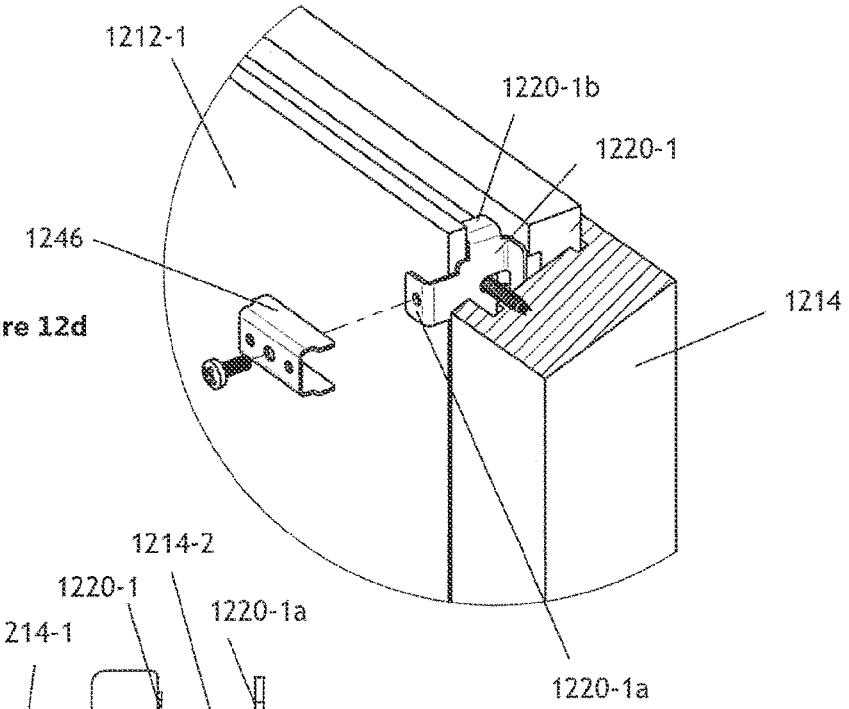
Figure 12E:
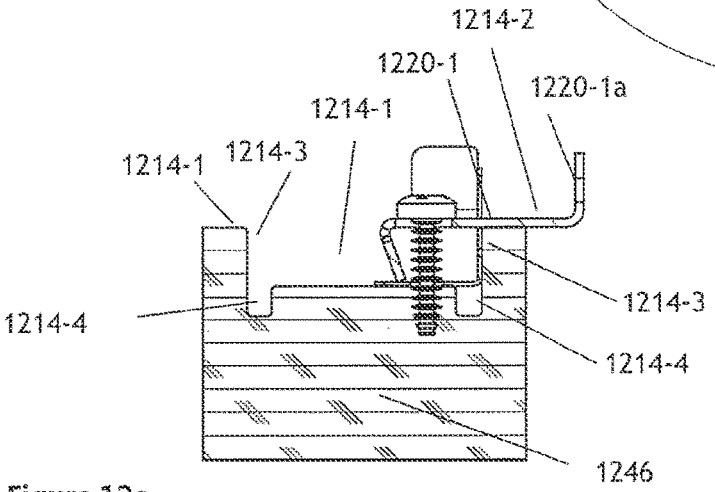
Figure 12F:
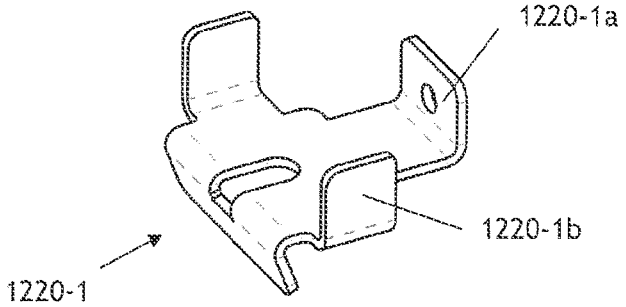
Figure 12F:
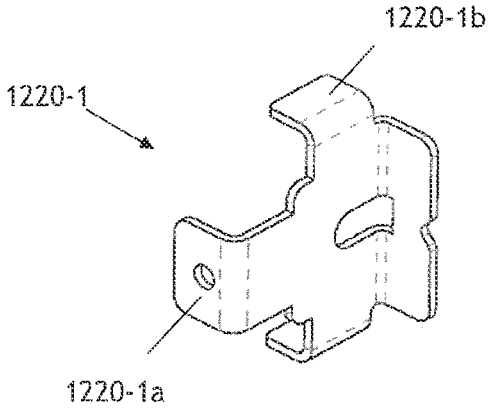
Figure 12G:
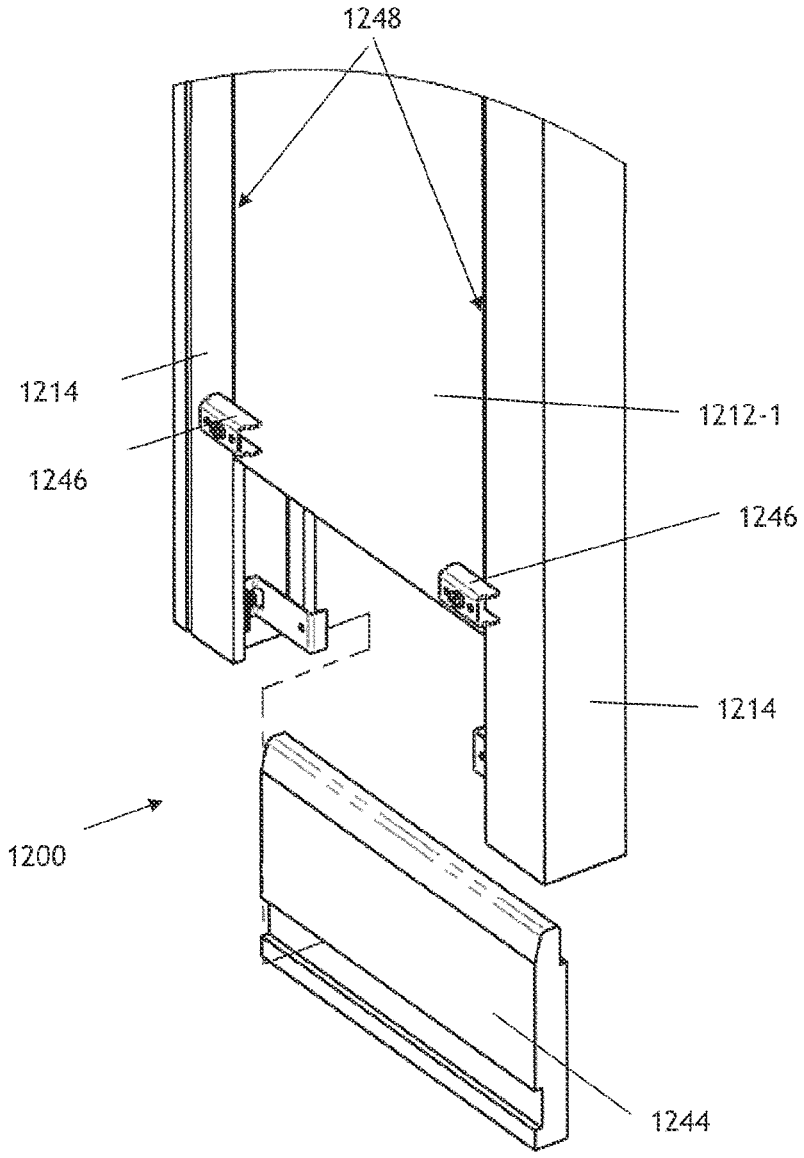
Figure 13A:
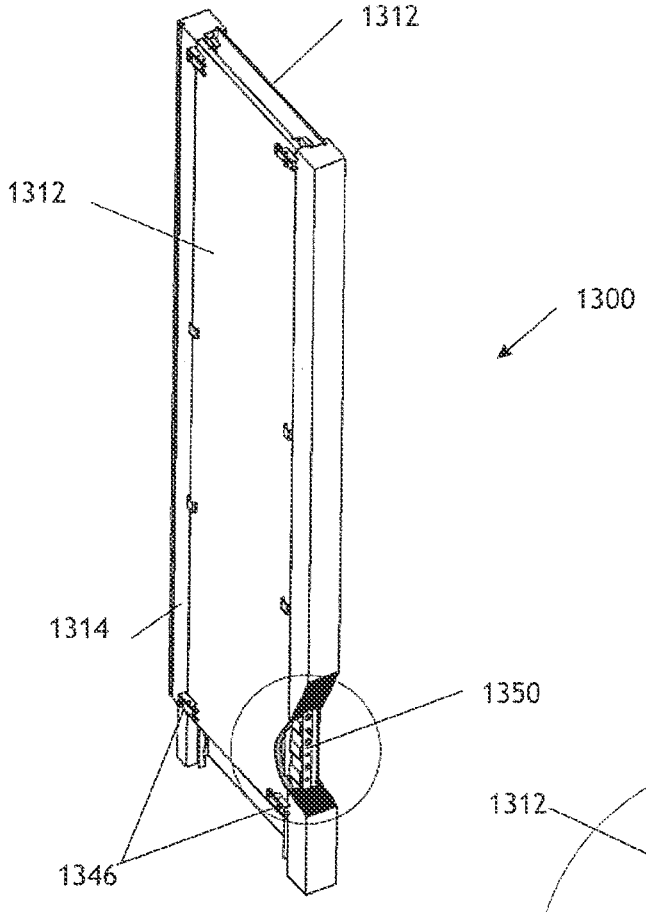
FIGS. 13*a* to 13*d* show a range of views of a further exemplary continuous sheet furniture panel including an exemplary internal fixing element according to an embodiment of the invention.
Figure 13B:
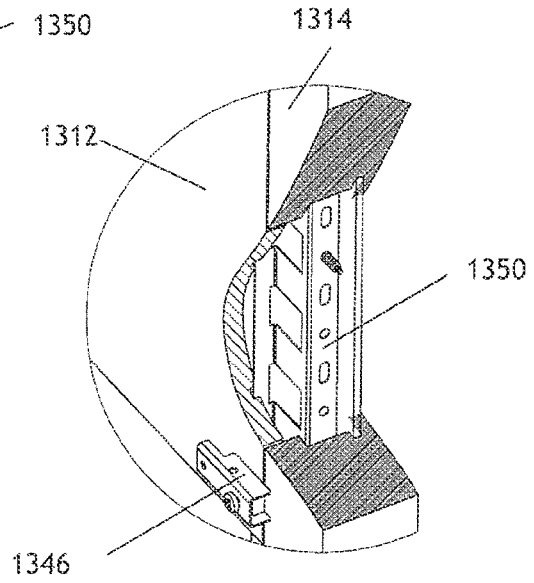
Figure 13C:
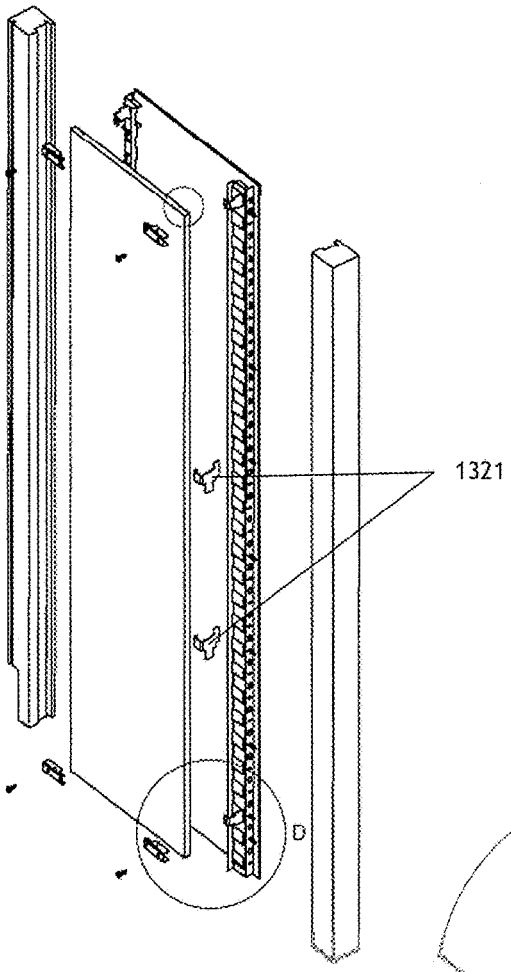
Figure 13D:
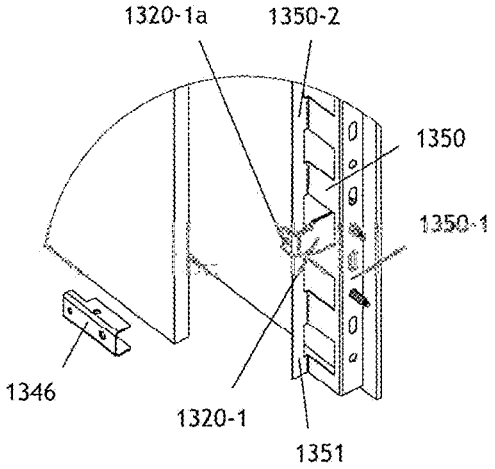

An internal fixing element 1220-1 (see FIGS. 12*f* (*i*) and (*ii*)) is coupled, for example using a fastener, to an inner surface adjacent each end of each edge structure 1214 (see FIG. 12*e*). The first tang 1220-1*a* can be configured to extend out and over the first cover sheet 1212-1 on the outer face of the furniture panel (see FIGS. 12*d*). The internal fixing element 1220-1 may also include a second tang 1220-1*b* perpendicular to the first tang 1220-1*a* configured to support the inner face of 1212-1 against a clamping force provided by a clamp shoe 1246 and to secure the cover sheet 1212-1 to the edge structure 1214.

The clamp shoe 1246 is coupled to an outer surface of the furniture panel 1200 in use and engages with the first tang 1220-1*a* of the internal fixing element 1220-1. The clamp shoe 1246 is positioned to overlap the gap or slot 1248 between the first cover sheet and the edge structure 1214. Tightening or securing of the clamp shoe 1246 onto the cover sheet 1212-1 secures or traps the cover sheet 1212-1 between the clamp shoe 1246 and the second tang 1220-1*b* of the internal fixing element 1220-1. In a furniture assembly, the clamp shoe 1246 provided on the outer surface of the first cover sheet 1212-1 is preferably located within an internal cavity portion of another furniture panel. For example, this approach may be used to implement a box shelf furniture panel.

As shown two internal fixing elements 1220-1 may be used for coupling each edge structure 1214 with a first cover sheet 1212-1. One internal fixing element 1220-1 can be provided substantially adjacent each end of an edge structure 1214. Thus, a continuous sheet furniture panel 1200 generally includes at least four internal fixing elements 1220-1 to provide structural integrity in the assembled furniture panel 1200. Alternatively, in a simpler form only one internal fixing element 1220-1 may be provided at a central position of the edge structure 1214 (not shown).

In some forms, further internal fixing elements 1220-2 may be coupled at or adjacent an edge of each of the edge structures 1214. A cap element 1244 may be inserted and retained in the outer region of the internal cavity or channel formed in the assembled continuous sheet furniture panel 1200 and retained by the internal fixing element 1220-2. Each cap element 1244 may comprise a rebate or groove configured to support the top and bottom edge of the second cover sheet 1212-2.

In some forms (not shown) the continuous sheet furniture panel may include a runged rail internal fixing element configured to support the first cover sheet 1212-1 and provide positioning of the internal fixing element 1220-1 including the first tang 1220-1*a* and other brackets introduced through the slot.

Figure 16A:
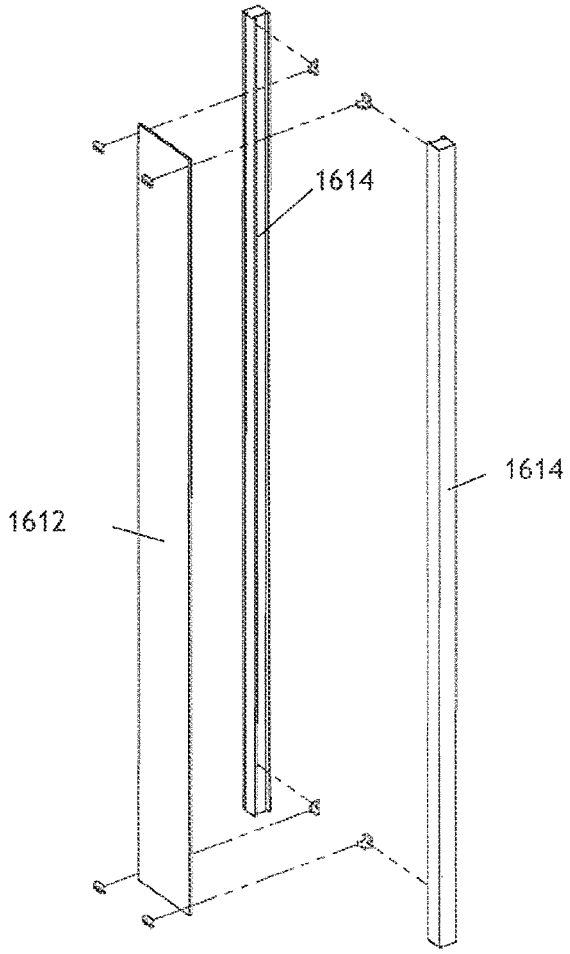
FIGS. 16*a* to 16*f* show a range of views of a further exemplary continuous sheet furniture panel including a further fastening exemplary internal fixing element according to an embodiment of the invention.
Figure 16B:
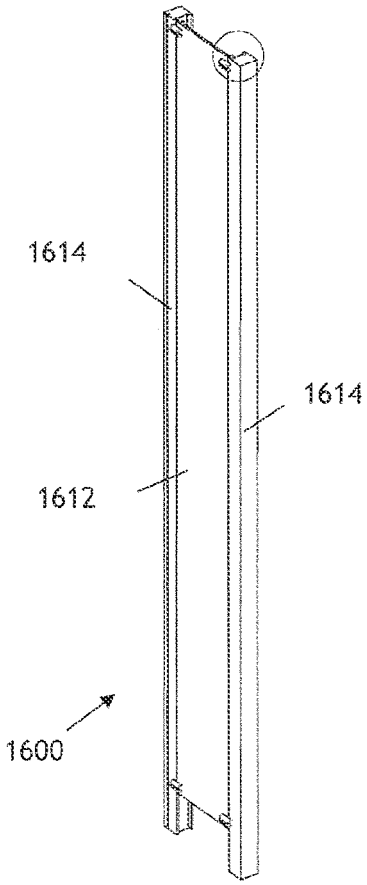
Figure 16C:
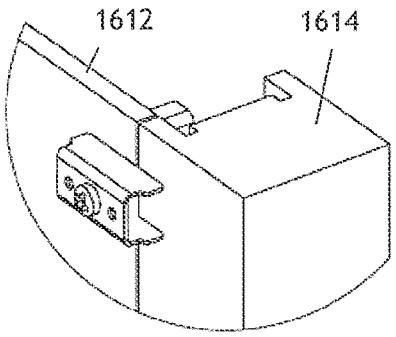
Figure 16D:
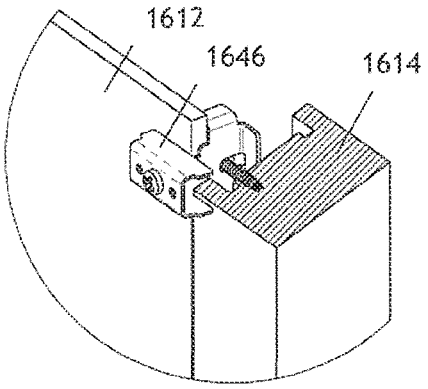
Figure 16E:
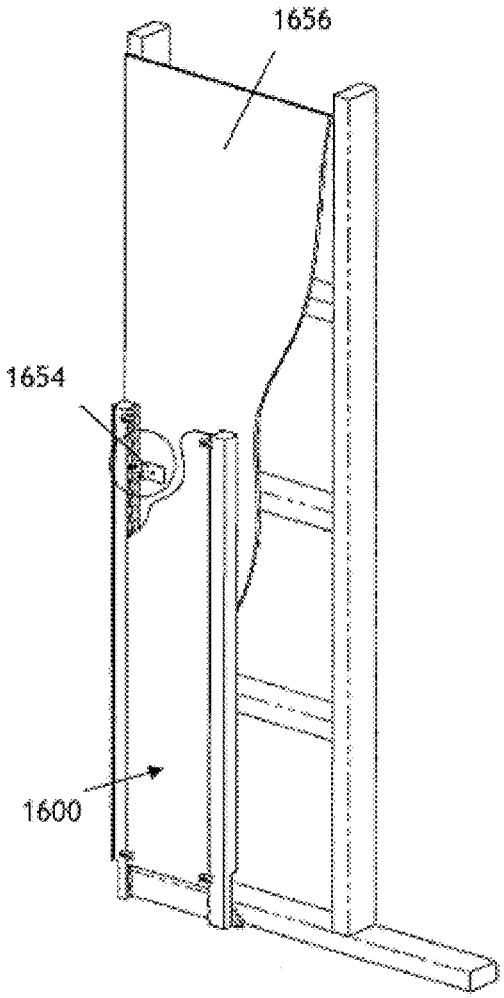
Figure 16F:
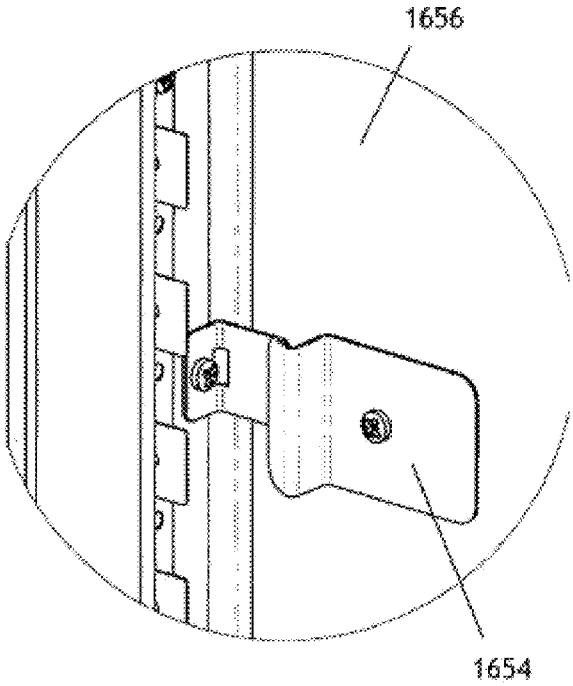

FIGS. 16*a* to 16*f* illustrate a similar continuous sheet furniture panel 1600 according to an aspect of the invention. This arrangement is similar but with one cover sheet and no cap elements and constructed as described above. In this form, the continuous sheet furniture panel 1600 is adapted for securing to a wall or other structure such that the internal fixings are hidden or covered in use, as shown by FIG. 16*e*. FIGS. 16*e* and 16*f* show an exemplary mount fitting 1654 that may be used to fix the continuous sheet furniture panel 1600 to the wall or other structure.

Figure 18A:
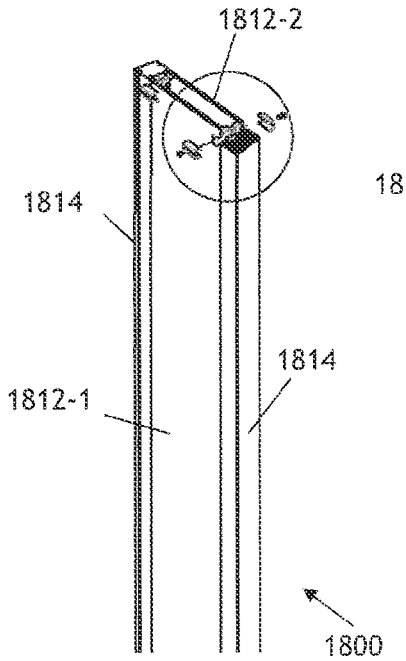
FIGS. 18*a* to 18*c* show a range of views of a further exemplary continuous sheet furniture panel including an alternative exemplary internal fixing element according to an embodiment of the invention.
Figure 18B:
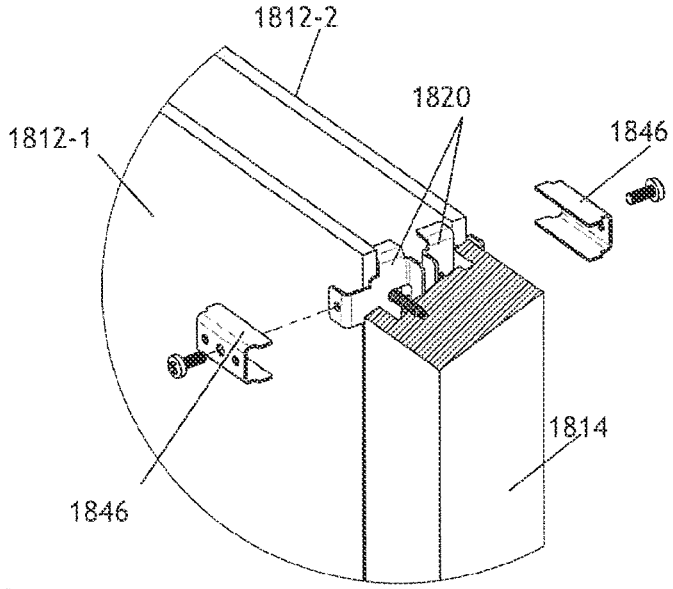
Figure 18C:
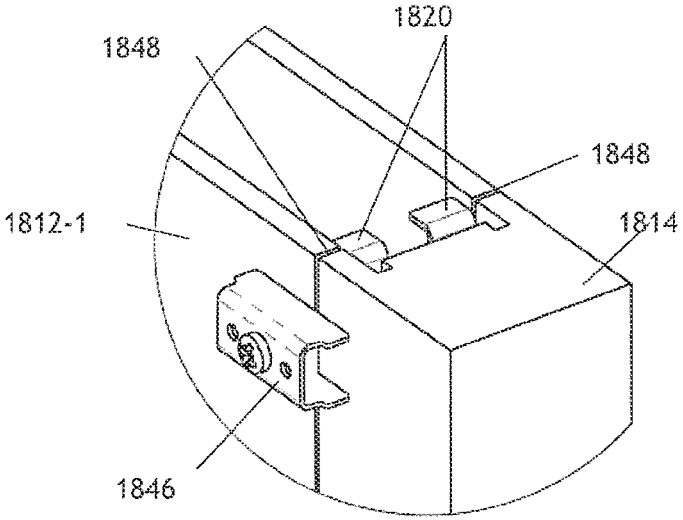

FIGS. 18*a* to 18*c* illustrate a further example of a continuous sheet furniture panel 1800. This construction is similar to that described for FIGS. 12*a* to 12*e* above in relation to the first cover sheet 1212-1 (1812-1 as shown in FIGS. 18*a* to 18*c*). The second cover sheet 1812-1 can be coupled to the edge structure in the same way as the first cover sheet 1812-1. With this construction a gap or slot 1848 is provided along both sides of each of the edge structures 1814. There is also no requirement for any cap elements and their associated fixing elements in this arrangement.

FIGS. 19*a* to 19*l* illustrate a further embodiment of a continuous sheet furniture panel 1900 according to a further aspect of the invention. Like the arrangement described above in relation to FIGS. 18*a* to 18*c* the furniture panel 1900 includes a gap or slot 1948 provided along both sides of each of the edge structures 1914. The cover sheets 1912 can be coupled to the edge structures 1914 in a similar manner.

Figure 19A:
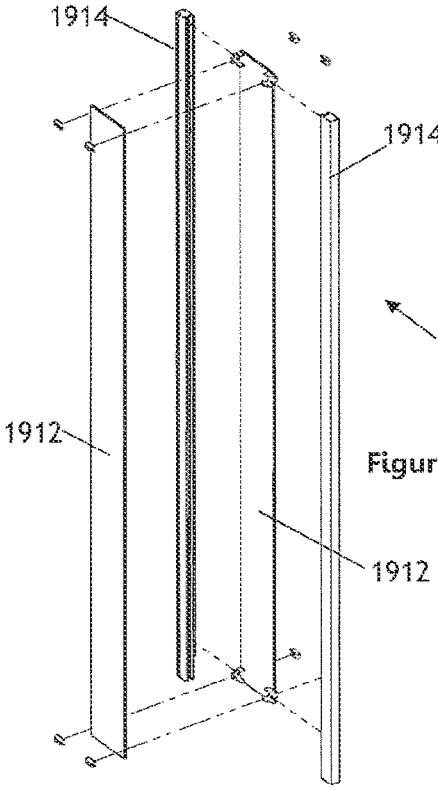
Figure 19B:
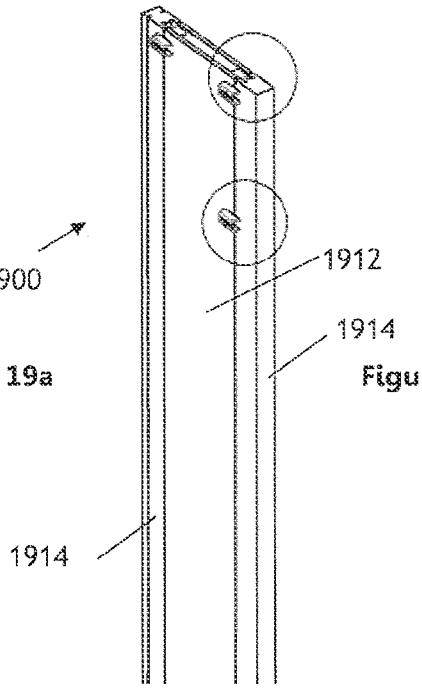
Figure 19C:
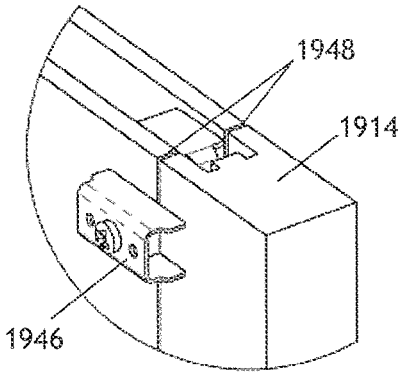
Figure 19D:
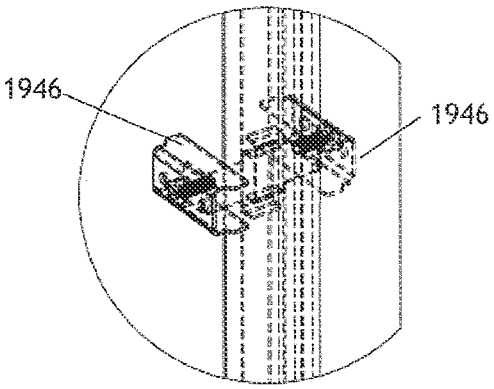
Figure 19I:
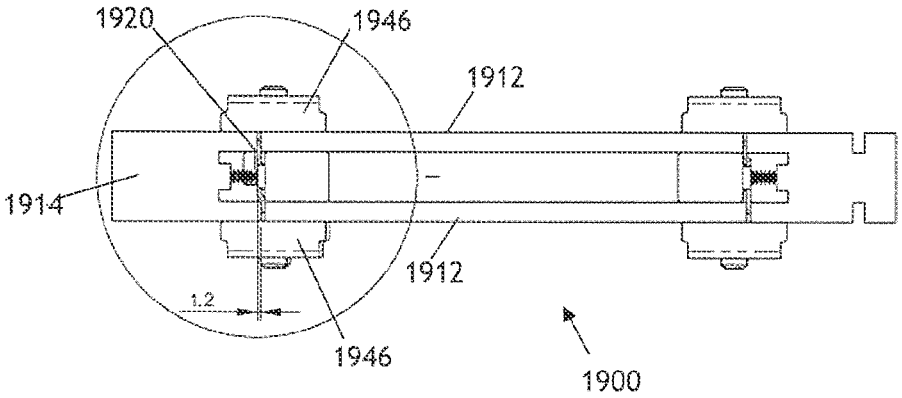
Figure 19J:
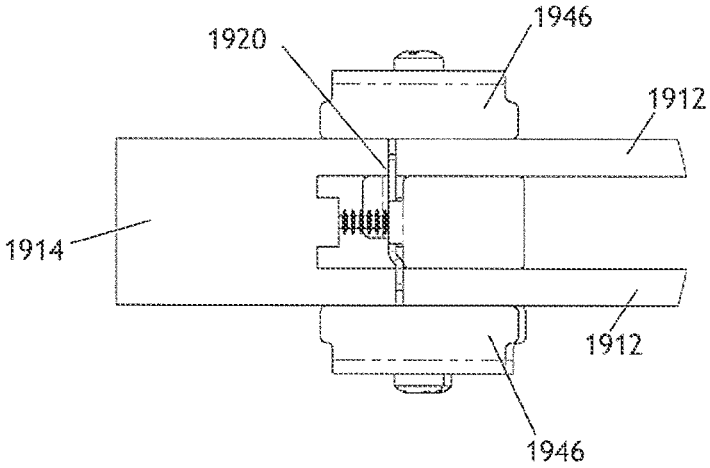

The internal fixing element 1920 (see FIG. 19*f*) may be formed as a double sided component having tangs on both side adapted to engage with clamp shoes 1946 that engage with each of the cover sheets on opposing sides of the furniture panel 1900 (see FIGS. 19*i* and 19*j*).

Figure 19K:
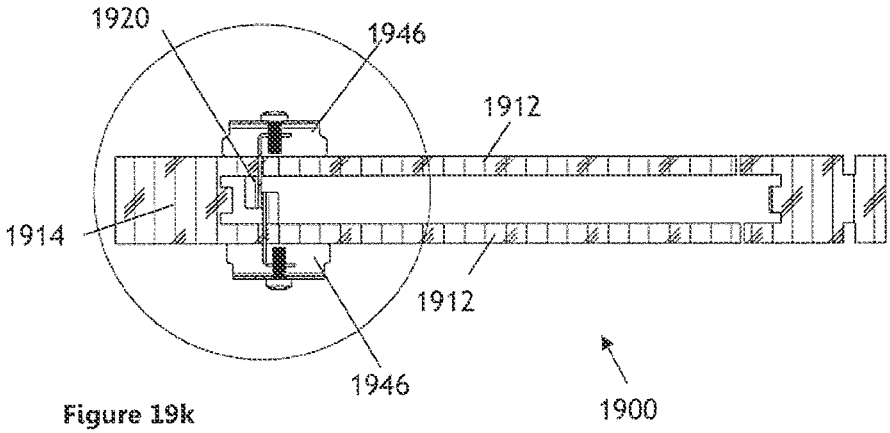
Figure 19L:
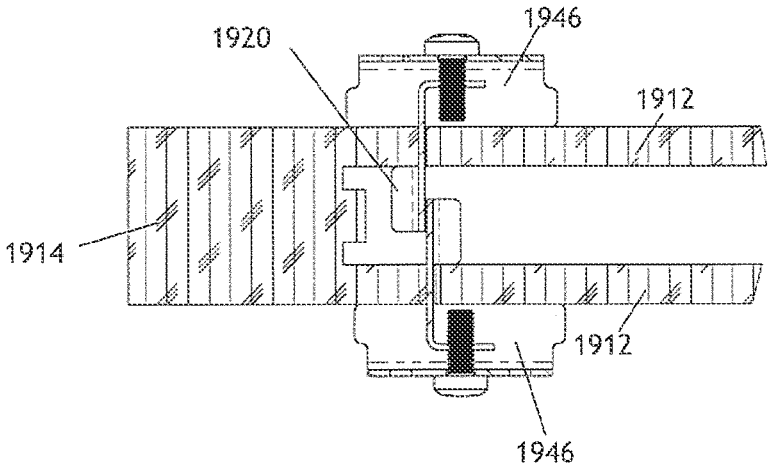

Additional removable fixing elements 1921-1, 1921-2 are configured to insert through the opposing the gaps or slots 1946 whilst avoiding interfering with each other (see FIGS. 19*k* and 19*l*). As seen in FIGS. 19*g* and 19*h* the flange profile edges on the two removable fixing elements 1921-1 and 1921-2 can be offset from each other to allow the fixing elements to pass each other. The additional removable fixing elements 1921-1 and 1921-2 may be used to couple shelves or other furniture panels to the continuous sheet furniture panel 1900.

FIGS. 13*a* to 13*d* show an example of a continuous sheet furniture panel according to the invention. This arrangement is similar to that described above but includes an internal fixing element in the form of a bracket rail 1350. The bracket rail 1350 having a first edge 1350-1 adapted to be secured along an inner facing portion of one of the edge structures 1314, and an opposing second edge 1350-2 having a projection or flange 1351 adapted to engage with a complimentary groove 1328 adjacent the edge of a first cover sheet 1312-1. The continuous sheet furniture panel 1300 comprises two bracket rails 1350 one secured or fastened to each of the two edge structures 1314 by an additional connector. The first cover sheet 1312-1 can include grooves 1328 adjacent both edges to facilitate engagement with each of the bracket rails 1350 coupled to the respective edge structures 1314.

An internal fixing element 1320-1 is coupled, for example using a fastener, to each of the edge structures 1314 via or through the corresponding bracket rails 1350 at one or more desired locations to position a shelf or further furniture panel. The internal fixing element 1320-1 can have a first tang 1320-1*a* configured to extend outwardly away from the opposing edge structure 1314, in use. The first tang 1320-1*a* can be configured to extend out and over the first cover sheet 1312-1 on the outer face of the furniture panel 1300 (see FIGS. 13*d*).

Similar to the above, a clamp shoe 1346 is coupled to an outer surface of the furniture panel 1300, in use, and engages with the first tang 1320-1*a* of the internal fixing element 1320-1. The clamp shoe 1346 is positioned to overlap the gap or slot 1348 between the first cover sheet 1312-1 and the edge structure 1314. Each edge structure 1214 is engaged with at least one internal fixing element 1320-1 to secure the first cover sheet 1312-1 to each of the edge structures 1314. Preferably, each edge structure 1314 is engaged with at least two internal fixing elements 1320-1 provided at spaced locations along the length of the edge structure 1314.

In some forms, at least one secondary fixing element 1321 may be configured to releasably engage with an aperture in the bracket rail 1350. The secondary fixing element 1321 can have a plurality of projections to facilitate releasable engagement with the bracket rail 1350. The secondary fixing element 1321 may also include a similar first tang to that of the internal fixing element 1320-1 configured to engage with the first cover sheet 1312-1 and a shoe clamp 1346 as described above.

A second cover sheet 1312-2 is coupled to each of the edge structures 1314 and configured to conceal the internal cavity of the furniture panel 1300. The second cover sheet 1312-2 may be held in a channel or grooves provided in each edge structure 1314 similar to that described above.

The continuous sheet furniture panel 1300 may also include one or more cap elements in a similar arrangement to that described above.

Figure 14A:
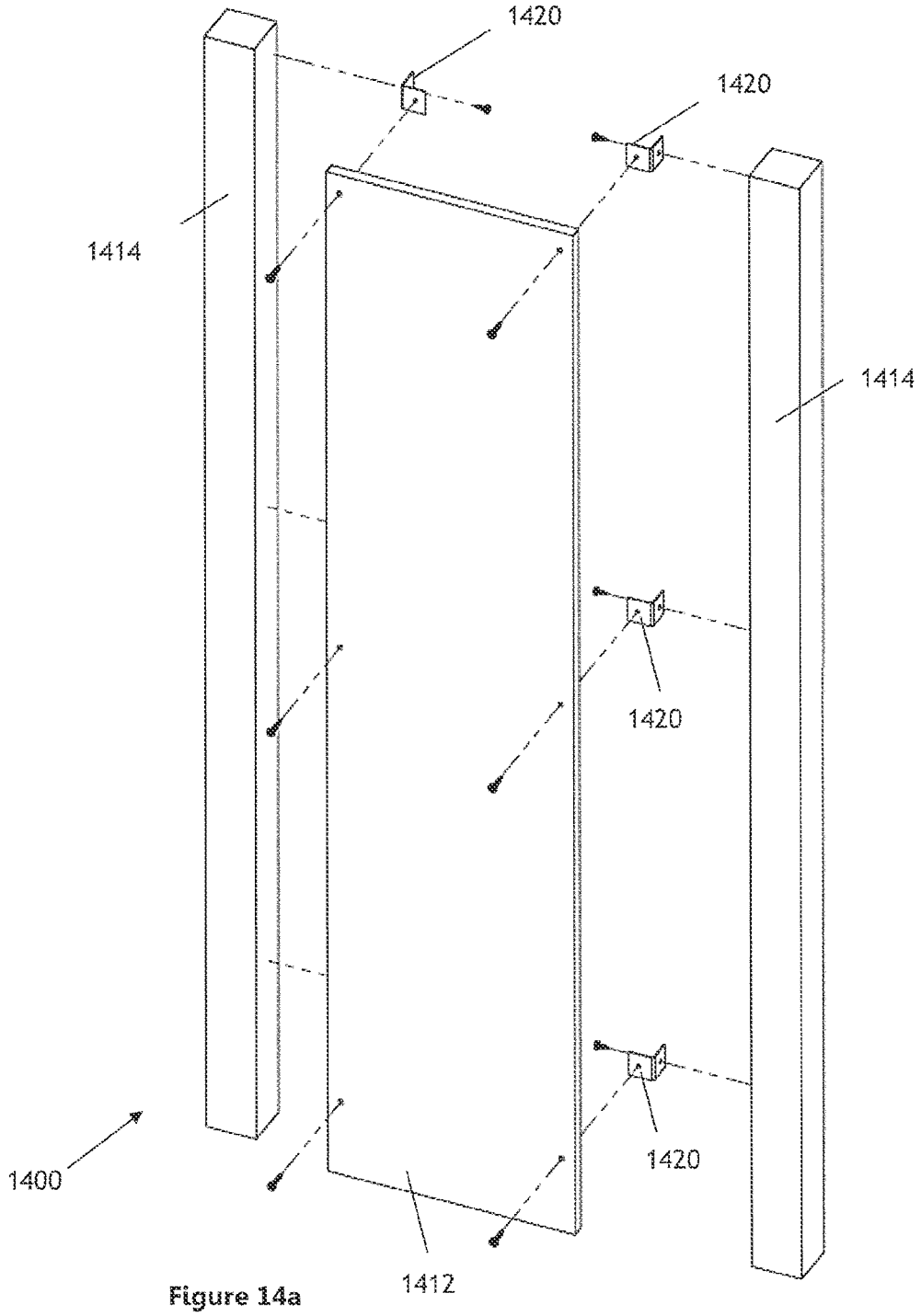
FIGS. 14*a* to 14*b* show a range of views of a further exemplary continuous sheet furniture panel including a fastening exemplary internal fixing element according to an embodiment of the invention.
Figure 14B:
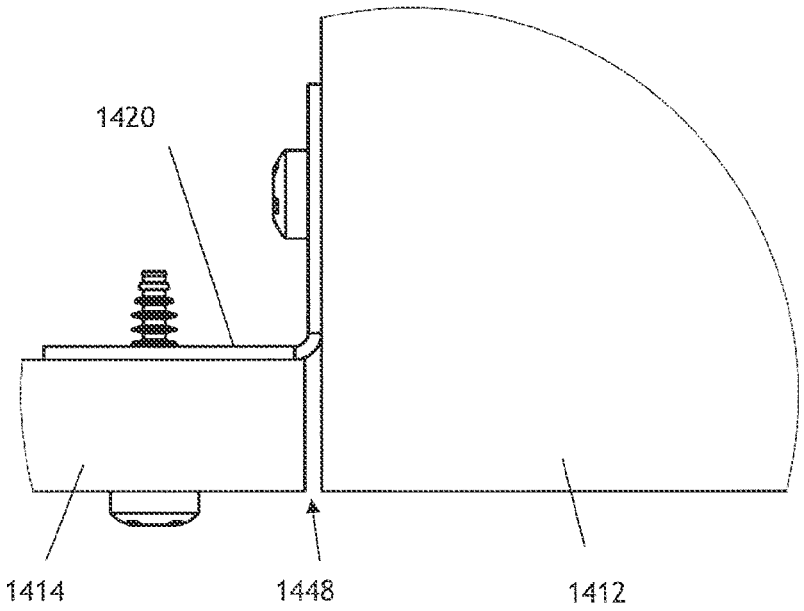

FIGS. 14*a* and 14*b* show a further example of a continuous sheet furniture panel 1400 according to an aspect of the invention. The continuous sheet furniture panel 1400 comprises a pair of edge structures 1414 each coupled to one cover sheet 1412 using a plurality of fixing elements 1420. Each of the plurality of fixing elements 1420 being fixed, fastened or secured to one of the pair of edges structures 1414 and the cover sheet 1412 such that the cover sheet 1412 is secured between the pair of edge structures 1414.

As illustrated the fixing elements 1420 may be in the form of an L-shaped bracket. Preferably the L-shaped bracket fixing element 1420 may facilitate a narrow gap or slot 1448 to be formed between the inner edges of the cover sheet 1412 and each of the edge structures 1414. The gap or slot 1448 may allow insertion of further fixing elements or bracketing arrangements.

This form of continuous sheet furniture panel 1400 may be fastened to a wall or other structure to conceal of hide the fixing elements in use.

Figure 15A:
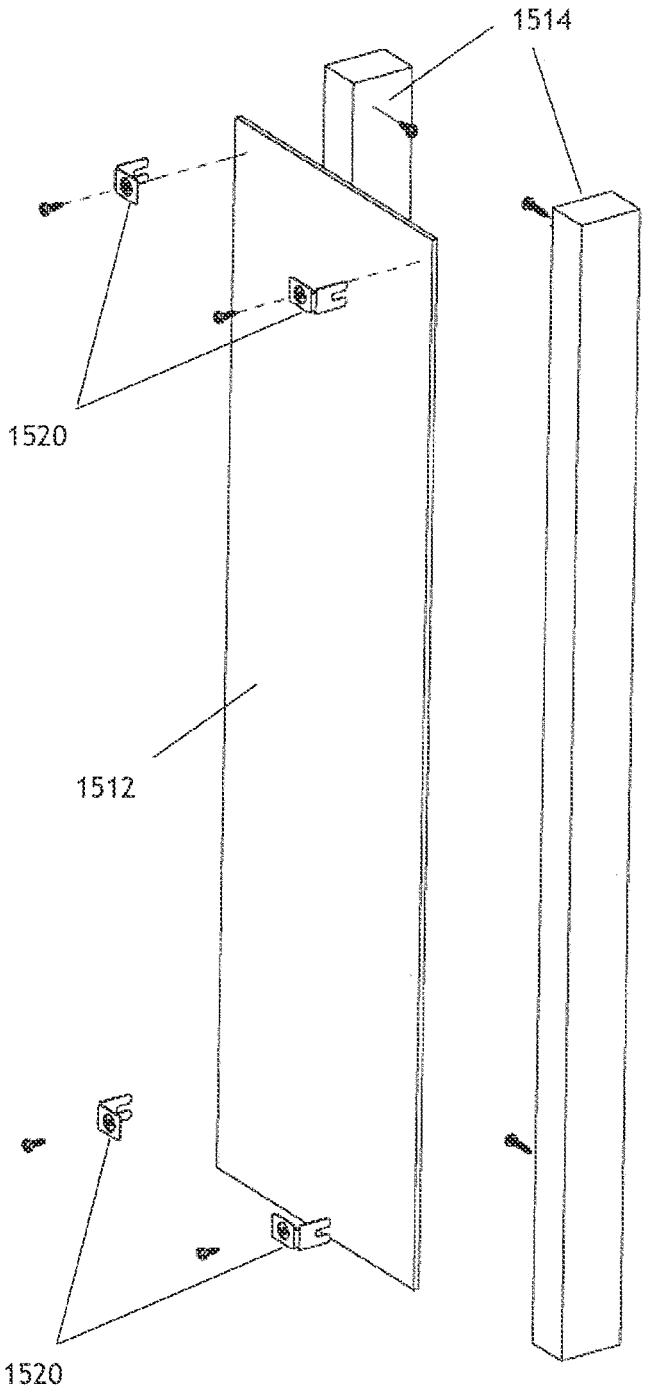
FIGS. 15*a* to 15*e* show a range of views of a further exemplary continuous sheet furniture panel including a fastening exemplary internal fixing element according to an embodiment of the invention.
Figure 15B:
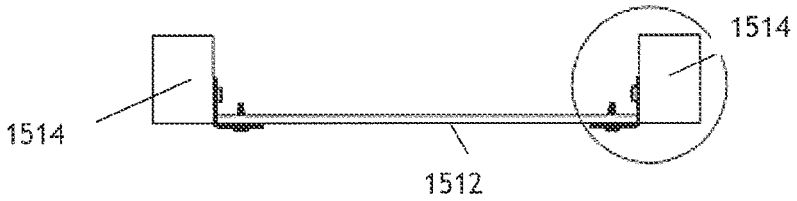
Figure 15C:
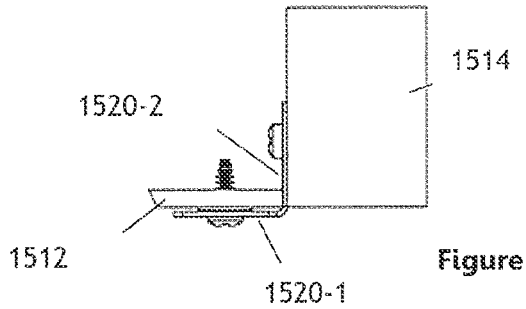

FIGS. 15*a* to 15*e* show a further example of a continuous sheet furniture panel 1500 according to another aspect of the invention. In this arrangement, a pair of edge structures 1514 engage with a cover sheet 1512 using a plurality of fixing elements 1520. In a similar arrangement to above, each of the plurality of fixing elements 1520 is fixed, fastened or secured to one of the pair of edges structures 1514 and the cover sheet 1512 such that the cover sheet 1512 is secured between the pair of edge structures 1514. Additionally, the fixing element 1520 is preferably L-shaped having a first portion 1520-1 adapted to engage with the cover sheet 1512 and a second portion 1520-2 adapted to engage with one of the edge structures 1514. In contrast to above, the first portion 1520-1 of the fixing element 1520 is configured to engage with the front surface of the cover sheet 1512 and the second portion 1520-2 is configured to engage with the inner facing edge of one of the edge structures 1514 such that a portion of the fixing element 1520 is sandwiched between the edge structure 1514 and the cover sheet 1512 as seen in FIGS. 15*a* to 15*c*.

Figure 15D:
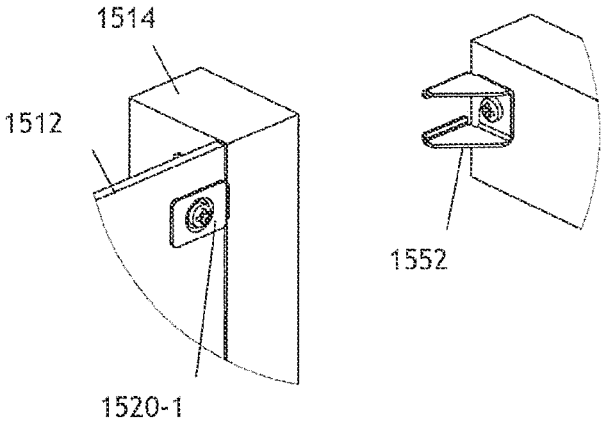
Figure 15E:
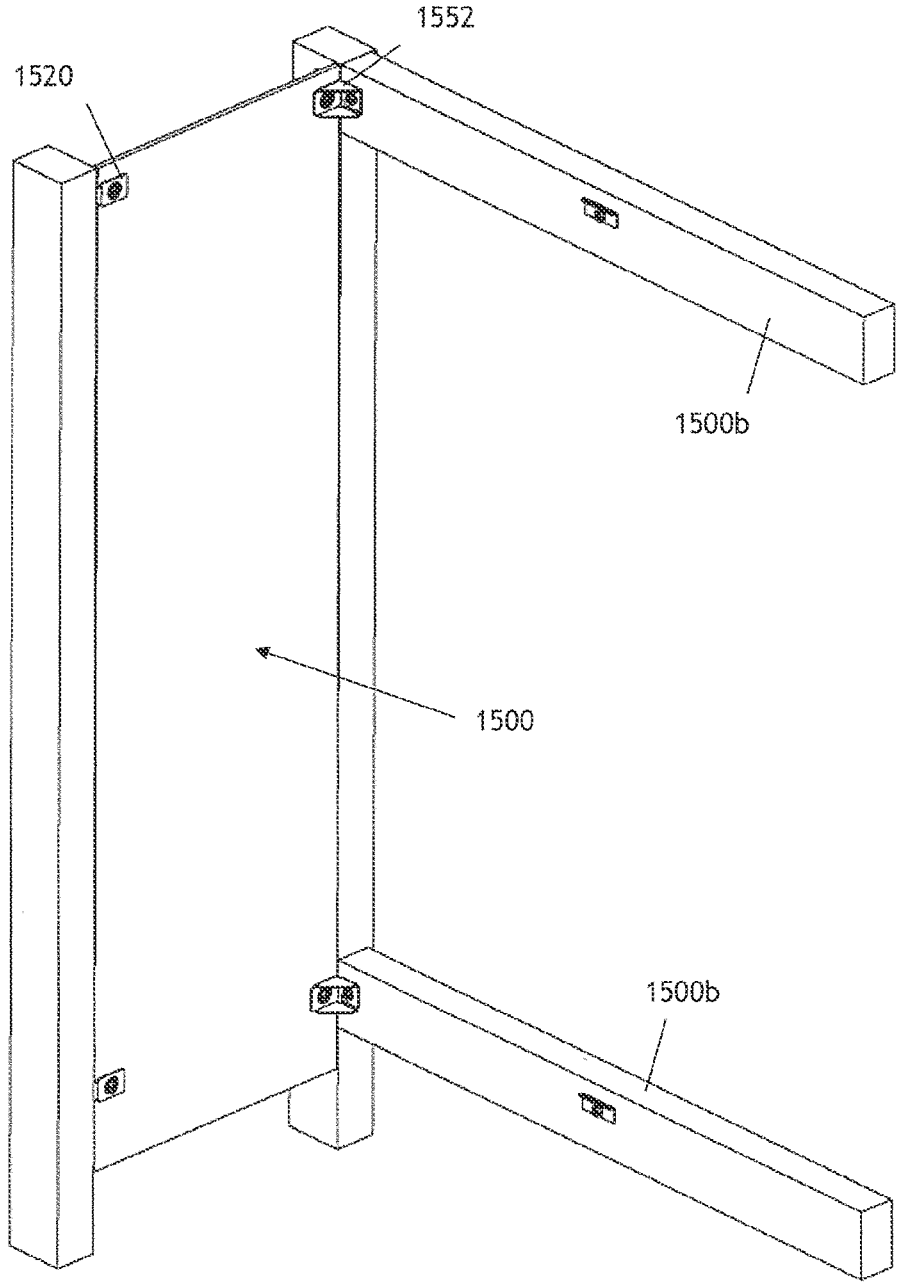

The first portion 1520-1 of the fixing element 1520 having a keyed profile configured for subsequent engagement with a complementary element 1552 fixed, fastened or secured to a second furniture panel (see FIGS. 15*d* and 15*e*). The keyed profile on the first portion 1520-2 facilitating assembly of a furniture assembly or sub-assembly from multiple furniture panels as illustrated in FIG. 15*e*. As shown the continuous sheet furniture panel 1500 is connected to two other furniture panels 1500*b*.

FIGS. 17*a* to 17*g* illustrate an alternative construction of fixing elements that may be used to construct a furniture panel. In this embodiment, there is no requirement to use fasteners to attach the fixing elements, the fixing elements may interconnect to retain each other and hold the furniture panel together. Such furniture panels may be used for quick and short-term installations such as film sets, show scenery, exhibition displays or similar.

Internal fixing elements clips 1720 are configured to insert and be retained in a complementary shaped slot or aperture 1726, such as a T-shaped slot, in each of the pair of edge structures 1714 (only one edge structure being shown). For example, an interference fit may retain the internal fixing element 1720 within the slot in the edge structure 1714 (see FIGS. 17*d* to 17*g*). The internal fixing element 1720 comprises gripping arms 1720-1, 1720-2 adapted to engage with a cover sheet 1712. There may be one or more first gripping arm(s) 1720-1 configured to support the inner face of the cover sheet 1712. A bent second gripping arm 1720-2 may have an angled face and is configured to fit over the edge of the sheet. At least one of the first gripping arm 1720-1 or second gripping arm 1720-2 is spring loaded to provide a gripping force on the cover sheet 1712 by the first gripping arm 1720-1 and second gripping arm 1720-2. In the example shown the second gripping arm 1720-1 is spring loaded and as seen in FIG. 17*e* a tool may be used to assist in opening the second gripping arm 1720-1 for insertion of the cover sheet 1712 between the two first gripping arms 1720-1 and the second gripping arm 1720-2. Once assembled the second gripping arm 1720-2 extends through a slot provided between the cover sheet 1712 and the edge structure 1714 and on the outer surface of the cover sheet 1712. A shoulder portion 1720-3 may be provided from which the second gripping arm 1720-2 extends. The shoulder portion 1720-3 can be configured to couple with fittings of a further furniture panel to facilitate engagement of two furniture panels together.

Figure 17A:
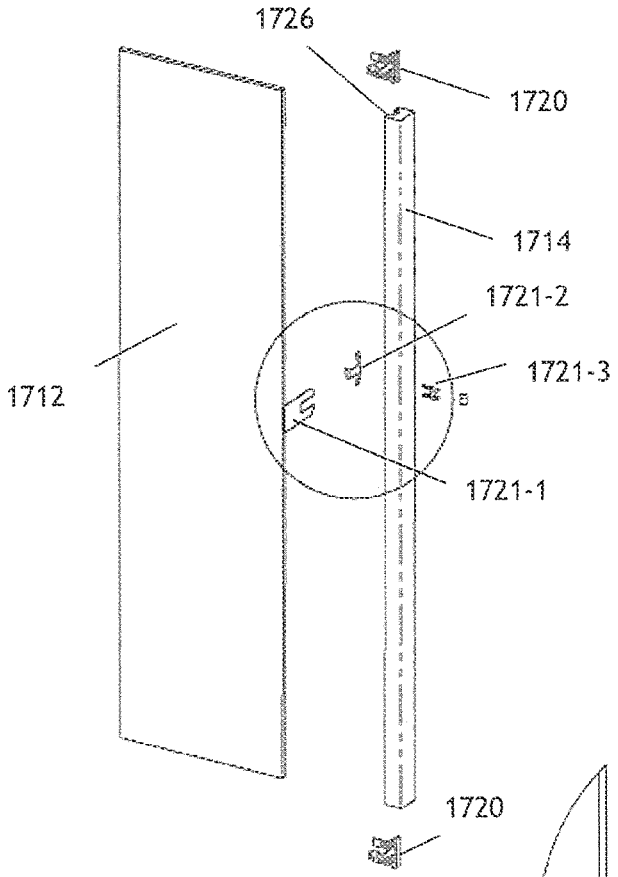
FIGS. 17*a* to 17*g* show a range of views of a further exemplary continuous sheet furniture panel including an alternative exemplary internal fixing element according to an embodiment of the invention.
Figure 17B:
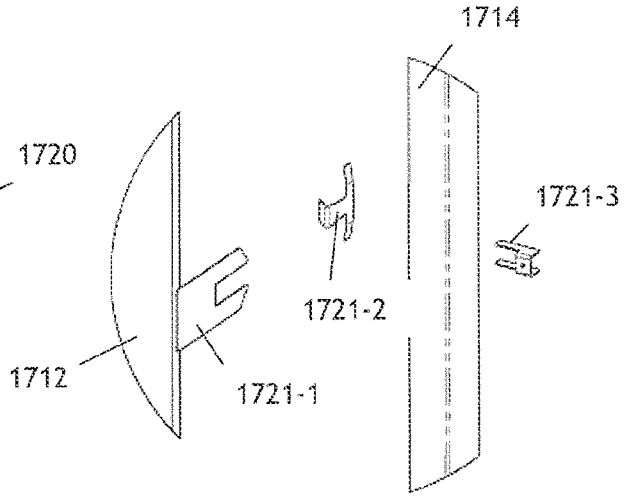
Figure 17C:
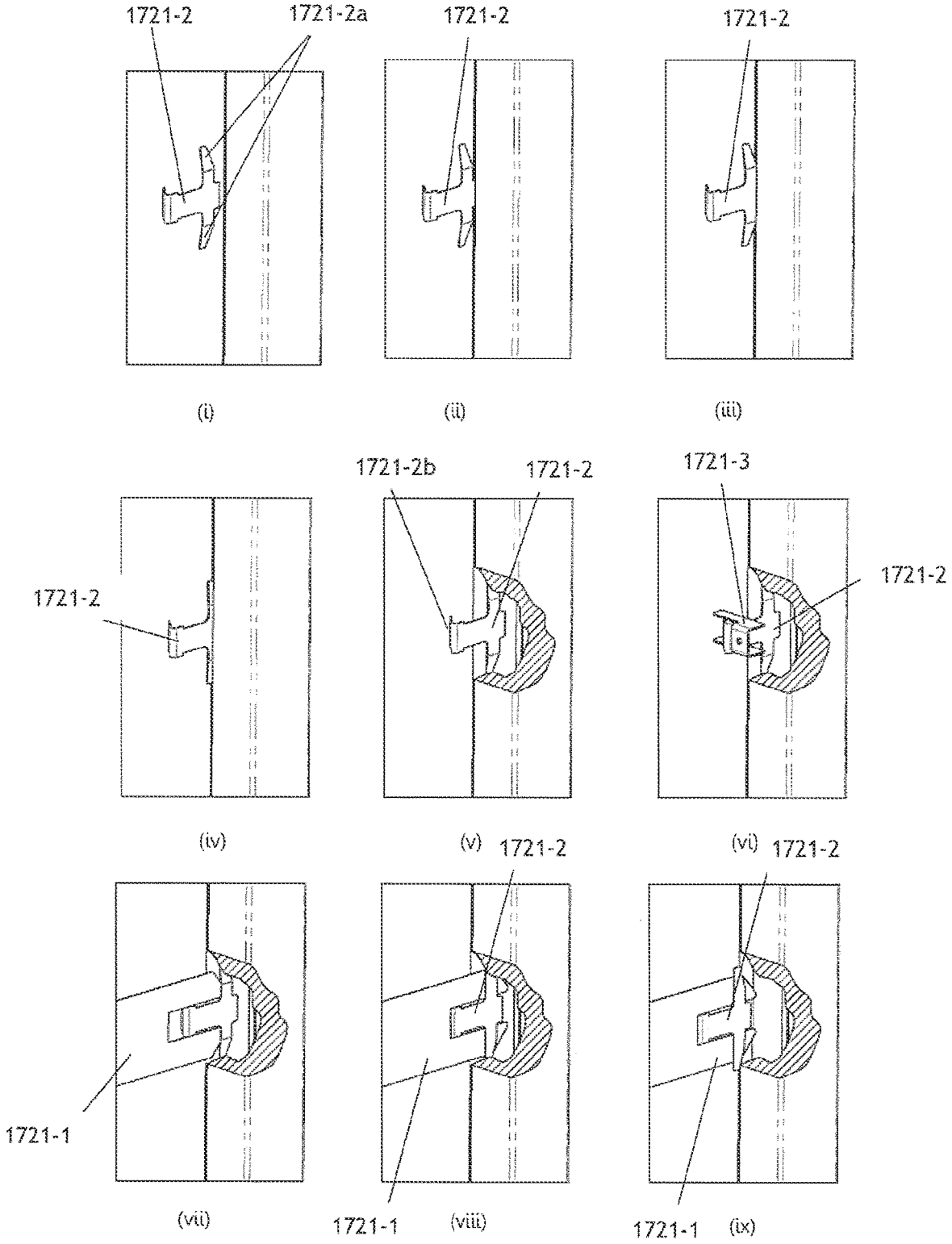
Figure 17D:
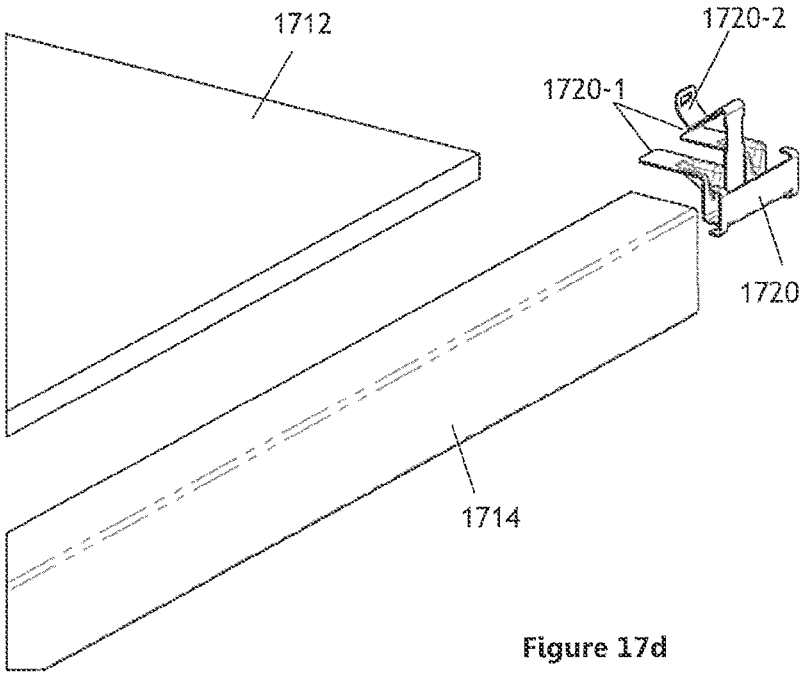
Figure 17E:
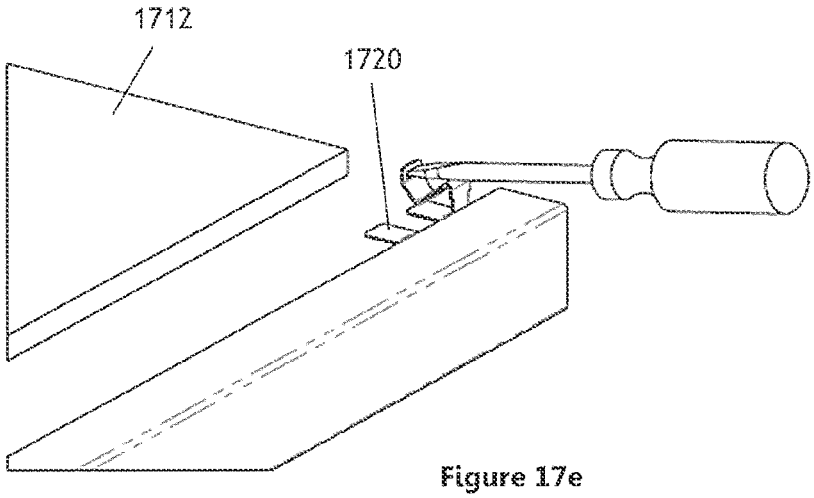
Figure 17F:
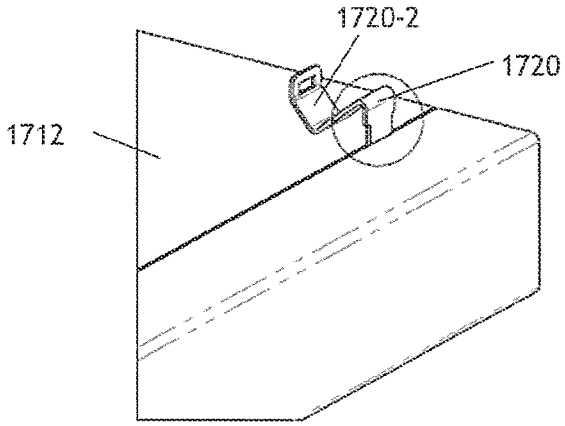
Figure 17G:
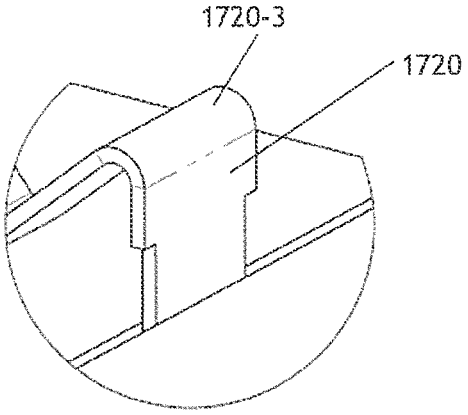

As shown in FIGS. 17*a* to 17*c*(*ix*) a secondary fixing element may be formed from or assembled using a plurality of components 1721-1, 1721-2 and 1721-3. A first component of the secondary fixing element 1721-1 is a tool configured to pass through a gap or slot formed between the edge structure 1714 and the cover sheet 1712. The tool 1721-1 is configured to push back the ears on the second component 1721-2 to allow insertion and removal. After insertion of the second component into the slot the ears are released so they engage against the inner surface of the cover sheet. A bent portion of 1721-2 overhangs the cover sheet and may optionally clamp the outer surface of the cover sheet 1712. The third component 1721-3 is pushed into position such that its two prongs straddle the tang of 1721-2 and are positioned under the bend portion of the tang. This is flexed away from the sheet and forces 1721-3 to the cover sheet 1712 and edge structure 1714.

FIGS. 17*c* (*i*) to (*v*) show the installation process for inserting the second component 1721-2 in a slot between the edge structure 1714 and the cover sheet 1712. FIG. 17*c* (*vi*) shows the coupling of the third component 172-3 with the second component 1721-2. An attachment portion 1721-2*b*, for example a hook or latch, of the second component is configured to engage with a connecting portion, such as a catch, of the third component 1721-3. FIGS. 17*c* (*vii*) to (*ix*) show the use of the tool 1721-1 for removing the second component 1721-2. The removal procedure using the tool may also be performed in reverse for installation.

As shown the ears 1721-2*a* may be forced back without using a tool for insertion into the slot. The ears 1721-2*a* are shown as angled edges of the bracket that spring back behind the cover sheet 1712. However, it is to be understood that the ears may spring on the other side and engage behind a rib on the upright beam 1714 (not shown).

The removal tool 1721-1 has two prongs that have lead angles at the end. The points of these fit between the cover sheet and the second component 1721-2 and extend past the ears 1721-2*a*. The angled edge of each prong runs along the ear and forces it back or at least forces itself past the ear. When the two are removed together the tool provides a lead to allow the ears to pass the cover sheet and the second component 1721-2 to be removed. The spring force of the ear will push the tool 1721-1 against the face of the cover sheet 1712 and edges of the slot. However with the application of moderate force the momentary resistance can be overcome and the bracket removed due to the acute lead angle that the flexed tool presents against the cover sheet and the second component against the edge structure 1714. The spring action of the ears 1721-2*a* and that the slender tool 1721 does not so much overcome this force but provides a surface between the sheet or upright that would otherwise catch the ears so that the ears don't catch when being removed. The spring force of the ears 1721-2*a* will force the tool and the bracket apart and the friction between each side of the slot and the bracket and tool will mean they are gripped by the slot. Pulling the two together will remove them from the slot because the ears are forced back behind the tool but a force is required to overcome this gripping action. In this arrangement, the combined widths of the second component 1721-2 and the tool 1721-1 are less than the width of the slot to facilitate the insertion and removal through the slot.

Figure 28A:
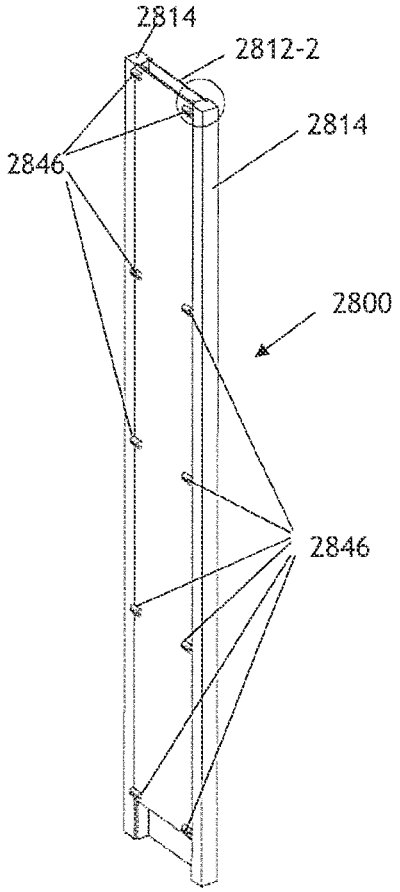
FIGS. 28*a* to 28*c* show a range of views of a further exemplary continuous sheet furniture panel including an alternative exemplary internal fixing element according to an embodiment of the invention.
Figure 28B:
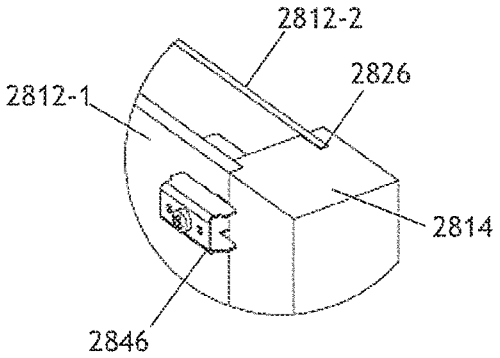
Figure 28C:
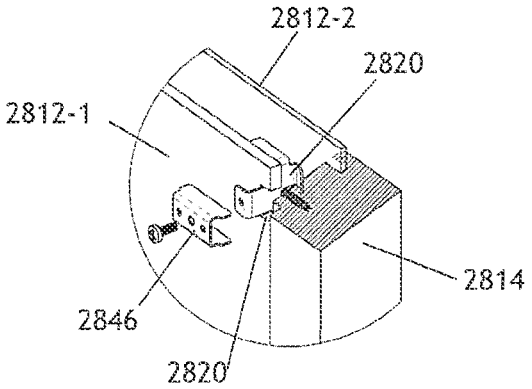

FIGS. 28*a* to 28*c* show a further embodiment of the continuous sheet furniture panel 2800 according to an aspect of the invention. Like that described in relation to FIGS. 12*a* to 12*e*, the furniture panel includes a pair of edge structures 2814 engaged with a first cover sheet 2812-1 using internal fixing elements 2820 in combination with a clamp show 2846. A second cover sheet may engage with the edge structures 2814 via a rebate 2826 in the edge structure 2814.

In the present arrangement, no gap or slot is provided for receiving removable fixing elements. The internal fixing element 2820 is coupled to an edge structure 2814 at a position where a fixed shelf or other furniture panel is to be located. A groove or cut-out in the first cover sheet 2828 is configured to receive a portion of the internal fixing element 2820. The clamp shoe 2846 clamps the first cover sheet 2812-1 between the clamp shoe 2846 and the internal fixing element 2820.

Ladder Style

A further exemplary furniture panel according to the invention is a ladder style furniture panel. A ladder style furniture panel comprises two pairs of edge structures joined together using a plurality of mid beams. No cover sheets are required in the ladder style furniture panel. The ladder style furniture panel has a ladder-like appearance with the two pairs of edge structures forming the sides or legs of the ladder and the mid beams forming the rungs. A pair of edge structures is formed by coupling or joining two edge structures together using a plurality of internal fixing elements therebetween.

FIGS. 20*a* to 20*h* show an exemplary ladder style furniture panel 2000 according to an aspect of the invention. A pair of edge structures is formed from a first edge structure 2014-1, a second edge structure 2014-2 and an internal fixing element in the form of a bracket rail 2050. The bracket rail 2050 is positioned in a rebate or cavity provided within each of the first edge structure 2014-1 and the second edge structure 2014-2 in use. The bracket rail 2050 being coupled or attached to the first edge structure 2014-1. The mid beams 2032 are coupled or attached at one or more pre-determined locations between the two pairs of edges structures 2014. A secondary fixing element 2021 is fixed or coupled to each of the first edge structures 2014-1 at the one or more predetermined locations to facilitate the coupling or attachment of the mid beams 2032 to the pair of edge structures 2014. Preferably one end 2021-2 of the secondary fixing element 2021 is configured to be positioned over or within a space in the bracket rail 2050. In an alternative arrangement (not shown) one or more secondary fixing elements 2021 may be integrated with the bracket rail 2050 at pre-determined locations.

The secondary fixing elements 2021 may have a substantially L-shaped portion 2021-1 provide at the opposing end. The L-shaped portion may have a transverse portion 2021-1*b* configured to extend through a gap or slot provided between the first edge structure 2014-1 and the second edge structure 2014-2 and a projection portion 2021-1*a* that then extends towards and adjacent the second edge structure 2014-2 in use.

Beam fixing elements 2058 and 2060 are each coupled or attached to each end of the mid beam 2032 to facilitate attachment of the mid beam to the first edge structures 2014-1 and secure or clamp the second edge structure 2014-2 to the first edge structure 2014-1. Preferably the beam fixing elements 2058 and 2060 are located within a channel or rebate provided in the mid beam 2032.

Beam fixing element 2058 has an n-shape such that each end of the beam fixing element includes a flange portion 2058*a*, 2058*b* adapted to receive a fastener. The section between the two flange portions 2058*a*, 2058*b* is loosely coupled to the mid beam to allow movement or sliding of the beam fixing element 2058 during tensioning. For example, the fixing beam element 2058 may have a slot for receiving a fastener there through with a length longer than the width of the fastener. This slot allows the fixing beam element 2058 when loosely fastened to the mid beam 2032 to slide within the slot.

The beam fixing element 2058 is positioned such that the flange portion 2058*a* extends beyond the edge of the mid beam 2032 towards the pair of edge structures and is configured to engage with the transverse portion 2021-1*b* the L-shaped portion of 2021-1 of the secondary fixing element 2021 in use. A fastener may secure the extending flange portion 2058*a* and the transverse portion 2021-1*b* of the L-shaped portion of 2021-1 of the secondary fixing element 2021 together (see FIG. 20*h*). The second flange portion 2058*b* is configured to engage with a flange 2060*a* provided on beam fixing element 2060.

The beam fixing element 2060 has a substantially L-shape with flange portion 2060*a* configured to receive a tensioner element 2030 there through. Beam fixing element 2060 may be fixed to the mid beam 2032 and is positioned adjacent the beam fixing element 2058 with a space or gap provided between the flange portion 2060*a* and the flange portion 2058*b*. The tensioner element 2030 is configured to couple and tension the flange portion 2060*a* and the flange portion 2058*b* together. This tensioning of the tensioner element 2030 results in the movement or sliding of the beam fixing element 2058 under the fastener along the mid beam 2032 towards the beam fixing element 2060. Consequently, securing or clamping the second edge structure 2014-2 between the first edge structure and the mid beam 2032. Finally, the fastener used to secure the beam fixing element 2058 to the mid beam 2032 is tightened to secure or lock the arrangement in the tensioned position and prevent loosening of the tensioner element 2030 over time.

The assembly process is repeated for each mid beam 2032 to be coupled between the two pairs of edge structures 2014.

Figure 20A:
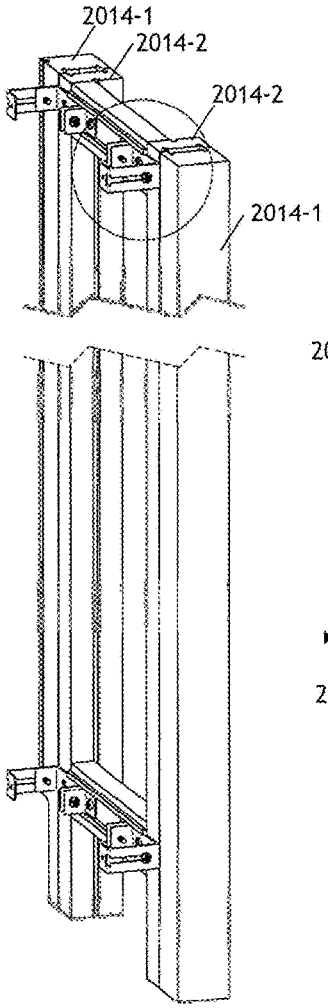
FIGS. 20*a* to 20*h* show a range of views of an exemplary ladder style furniture panel including an exemplary internal fixing element according to an embodiment of the invention.
Figure 20B:
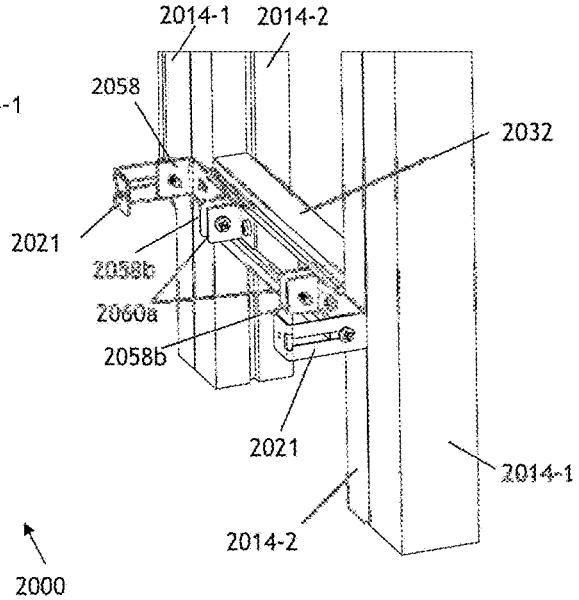
Figure 20C:
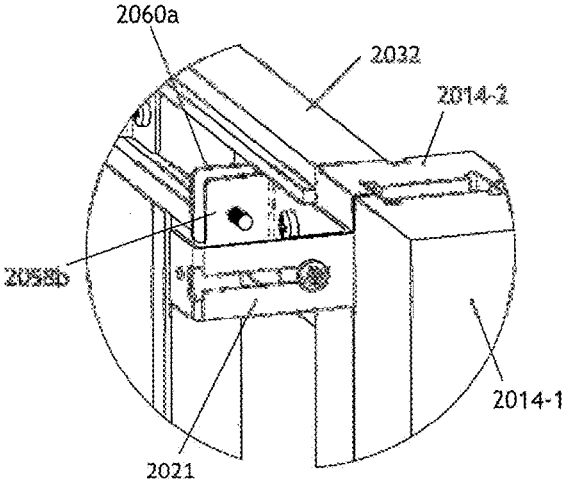
Figure 20D:
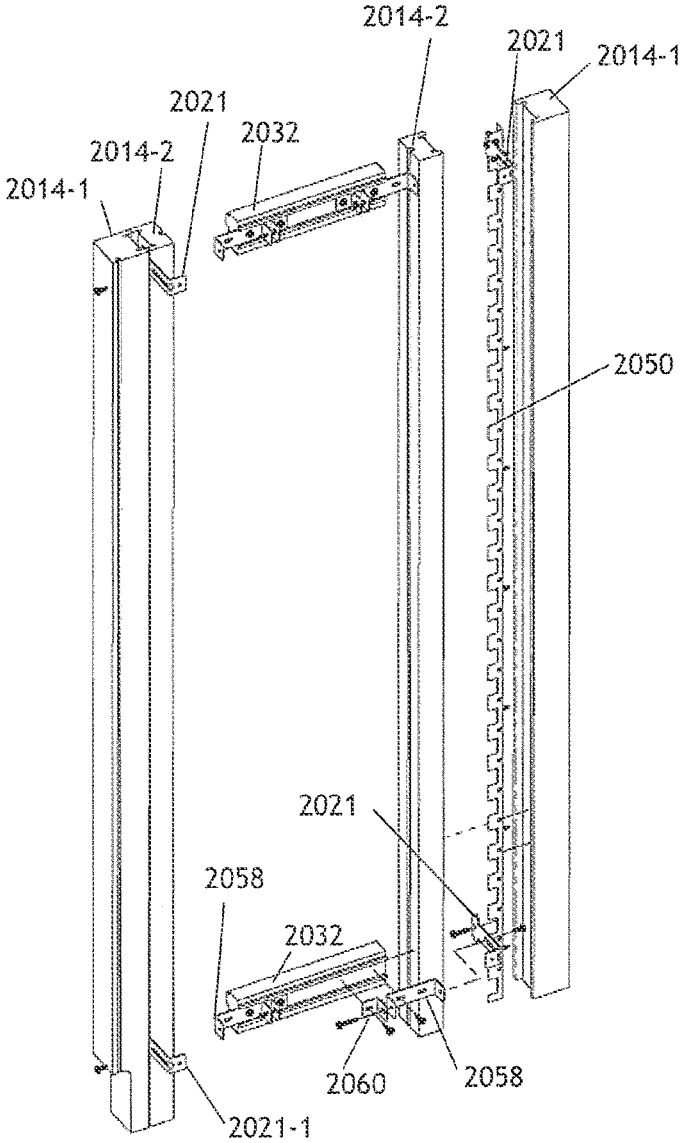
Figure 20E:
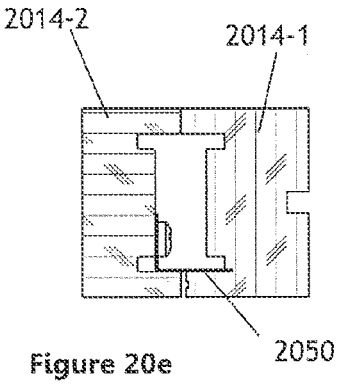
Figure 20F:
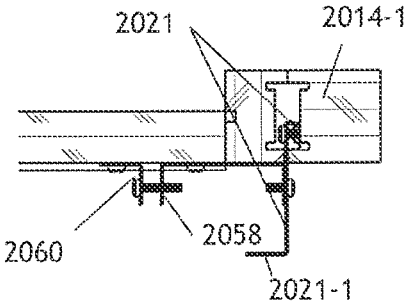
Figure 20G:
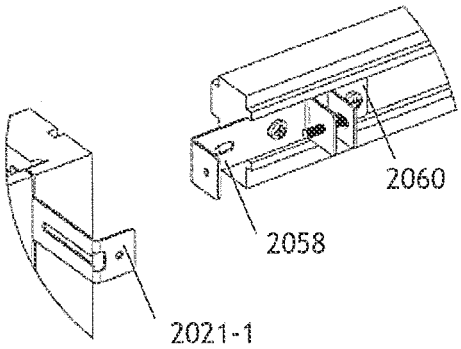
Figure 20H:
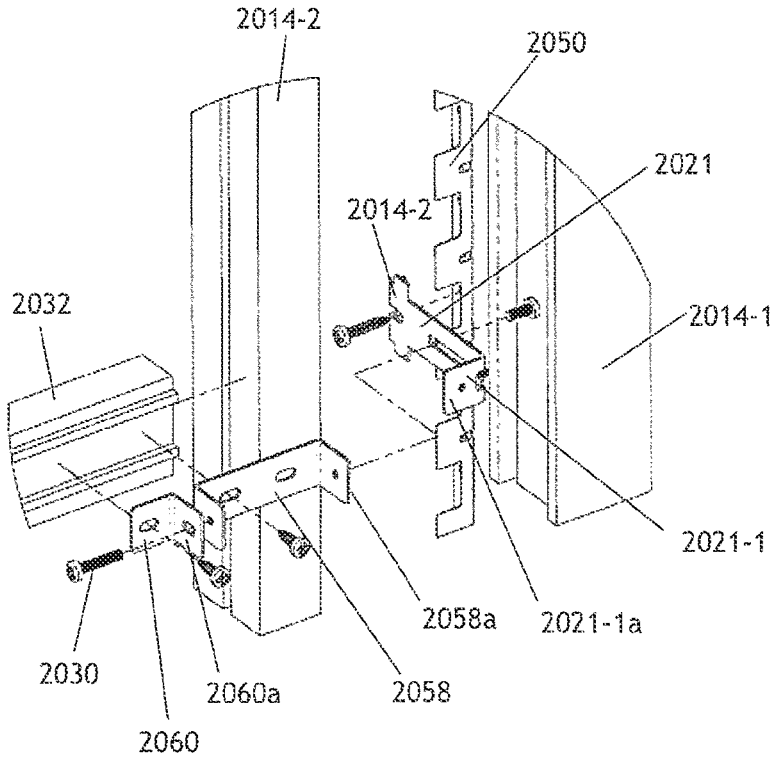
Figure 21A:
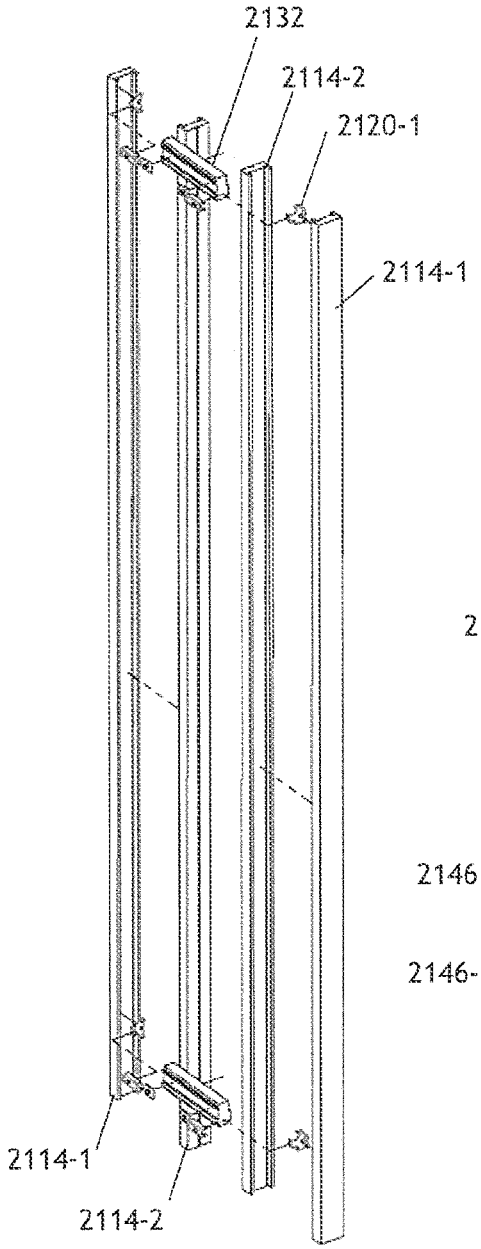
FIGS. 21*a* to 21*e* show a range of views of a further exemplary ladder style furniture panel including an exemplary internal fixing element according to an embodiment of the invention.
Figure 21B:
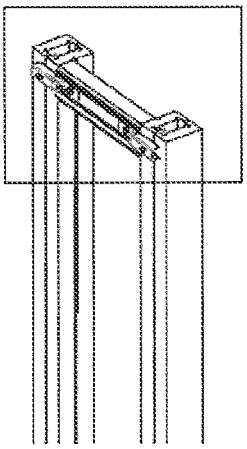
Figure 21C:
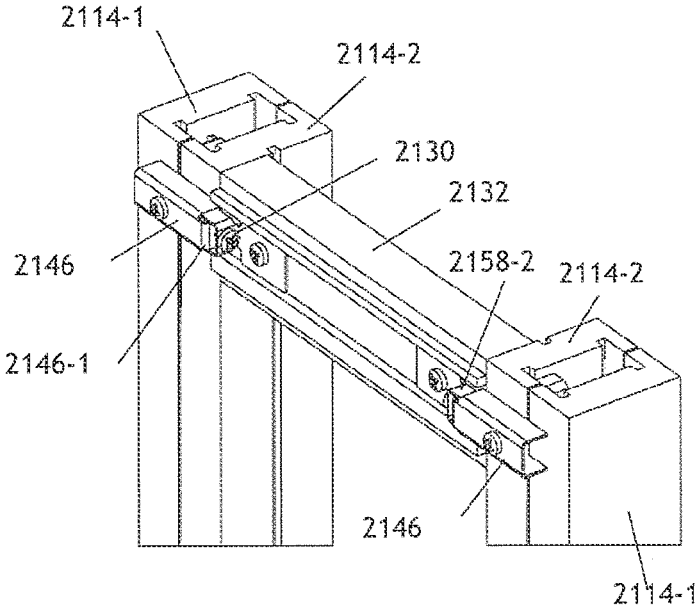
Figure 21D:
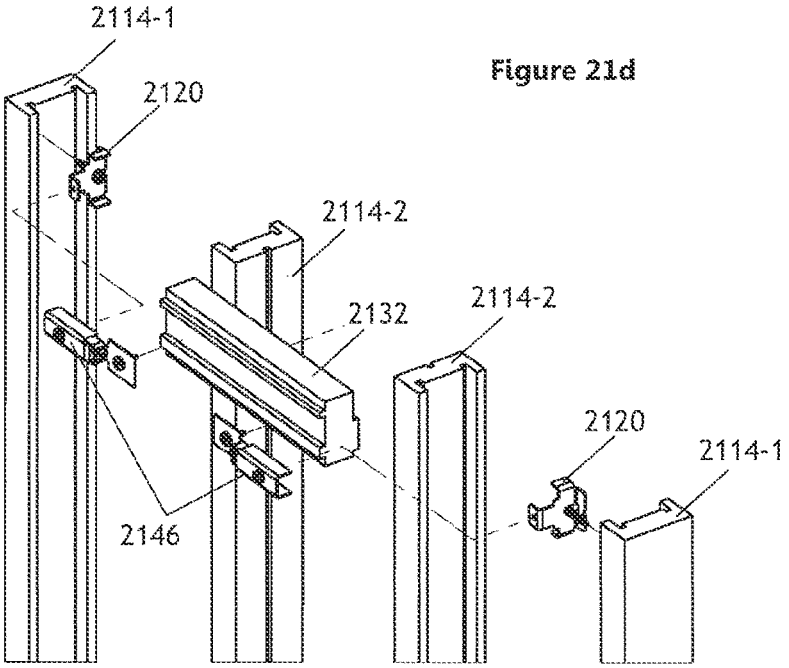
Figure 21E:
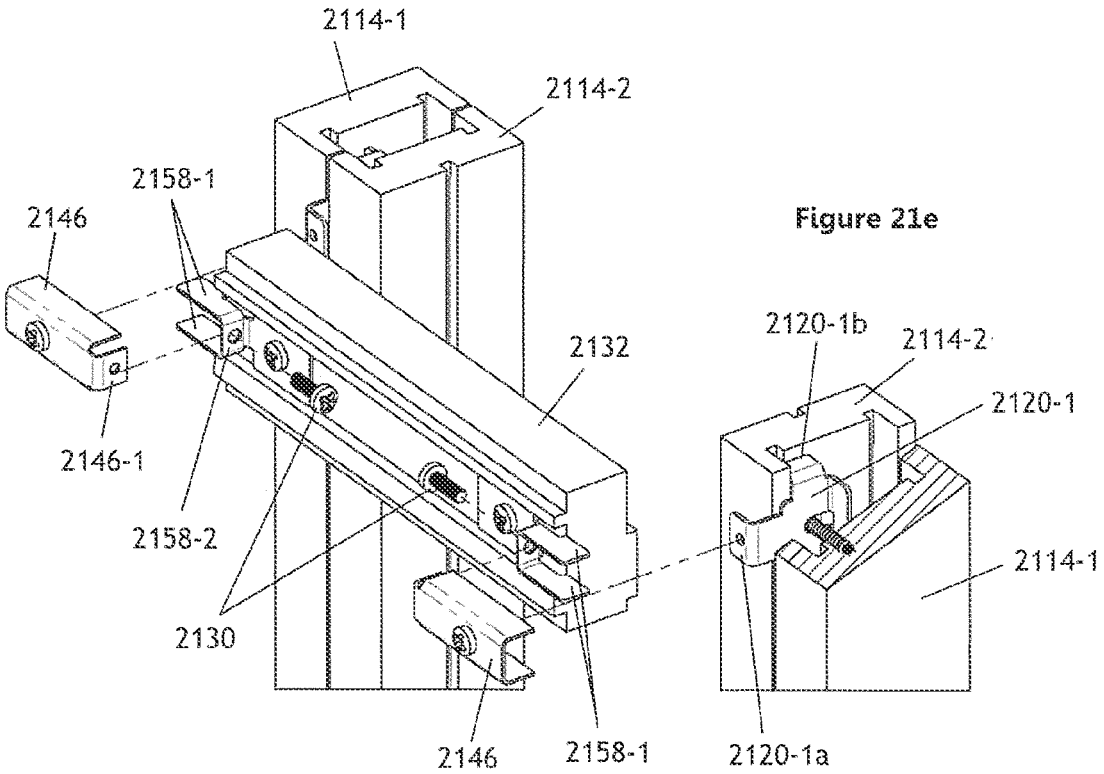
Figure 22A:
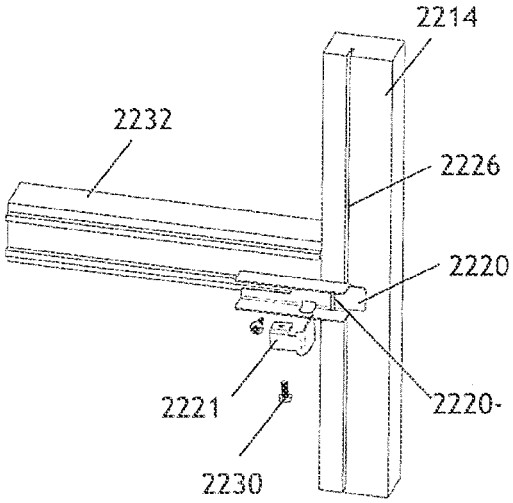
FIGS. 22*a* to 22*d* show a range of views of a further exemplary ladder style furniture panel including an exemplary internal fixing element according to an embodiment of the invention.
Figure 22B:
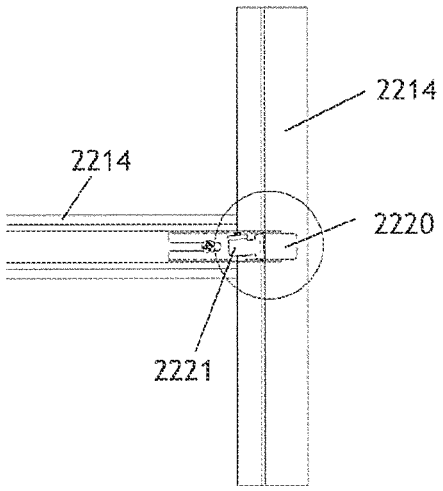
Figure 22C:
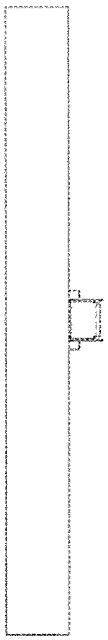
Figure 22D:
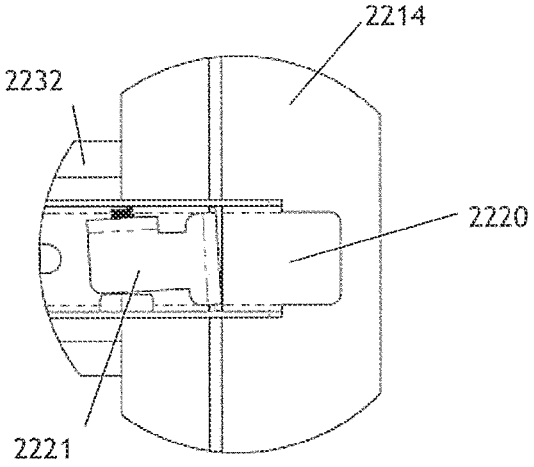
Figure 23A:
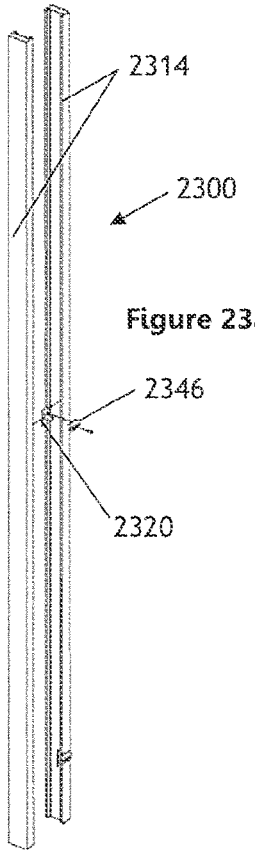
FIGS. 23*a* to 23*f* show a range of views of an exemplary upright pair style furniture panel including an exemplary internal fixing element according to an embodiment of the invention.
Figure 23B:
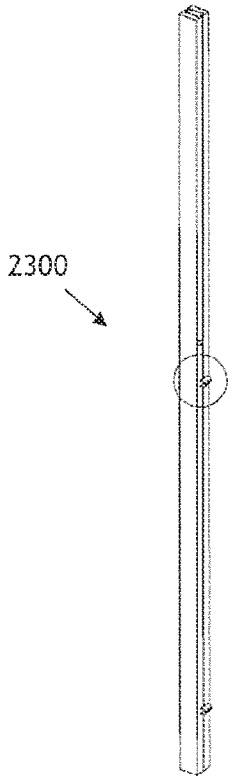
Figure 23C:
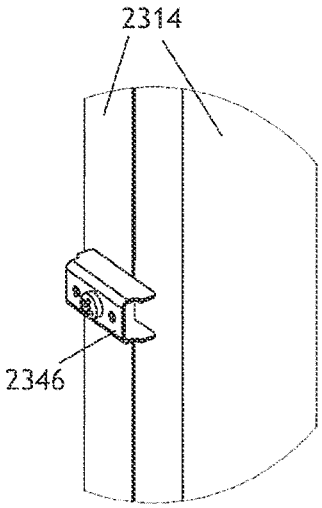
Figure 23D:
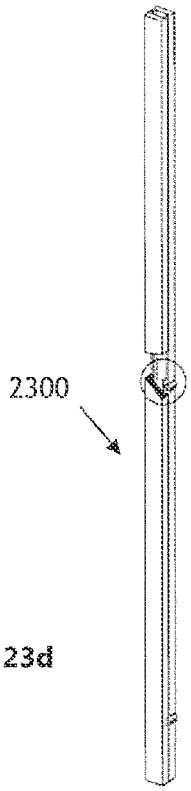
Figure 23E:
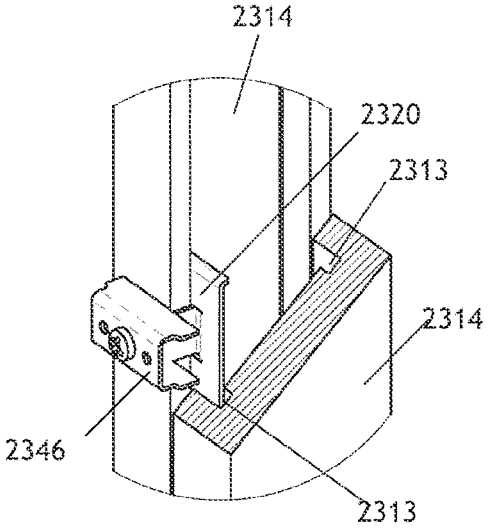
Figure 23F:
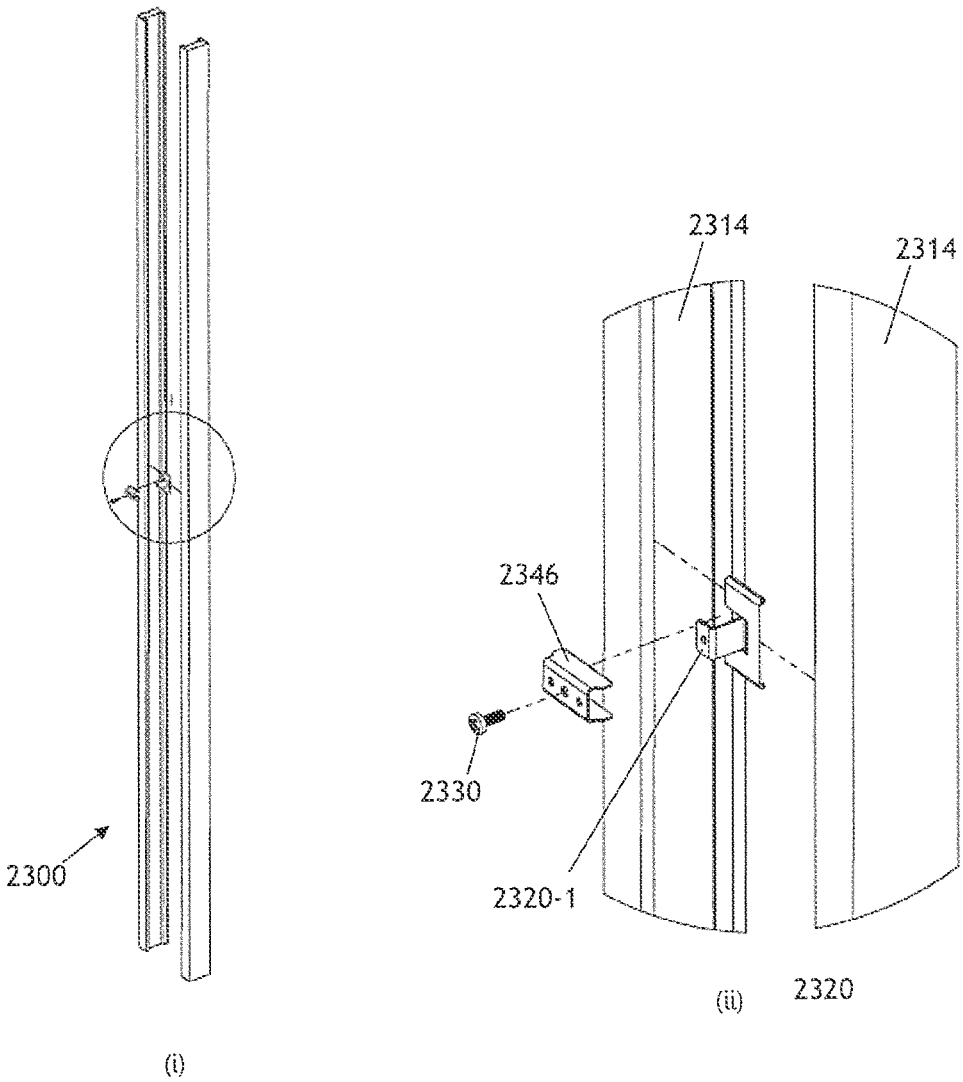

As shown the first edge structure 2014-1 and the second edge structure 2014-2 have different profiles, the first edge structure 2014-1 having a wider profile than the second edge structure 2014-2 (see FIG. 20*e*). However, it is to be understood that in other forms the first and second edge structures may be the same or have the same profile width.

FIGS. 21*a* to 21*e* show a further example of a ladder style furniture panel 2100 according to an aspect of the invention. In this arrangement, the first edge structure 2114-1 and second edge structure 2114-2 are coupled together using a clamp shoe 2146 and internal fixing element 2120-1 in a similar manner to that described above in relation to FIGS. 12*a* to 12*e* for securing the edge structure 1214 to the first cover sheet 1212-1. An internal fixing element 2120-1 is coupled, for example using a fastener, to an inner surface adjacent each end of each first edge structure 2114-1. A first tang 2120-1*a* of the internal fixing element 2120-1 is configured to extend inwardly towards the second edge structure 2114-2 in use (see FIGS. 21*d* and 21*e*). The internal fixing element 2120-1 may also include a second tang 2120-1*b* perpendicular to the first tang 2120-1*a* configured to engage with an inner surface of the second edge structure 2114-2 to secure the second edge structure 2114-2 to the first edge structure 2114-1.

Beam fixing elements 2158 are fastened to each end of the mid beam 2132. The beam fixing elements 2158 includes arms 2158-1 (see FIG. 21*e*) that protrude beyond the side edges of the mid beam 2132 towards the pair of edge structures. Between the arms is a tab 2158-2 configured to receive a tensioner element 2130 in use. Preferably the beam fixing elements 2158 are received within rebates or channels in the mid beam 2132. The clamp shoe 2146 has a pair of arms forming a general C shape and a clamp shoe tab 2146-1 provided at one end perpendicular to the pair of arms. The pair of arms of the clamp shoe 2146 are configured to fit over or receive the arms 2158-1 of the fixing beam 2158. The clamp shoe tab 2146-1 is received within the fixing beam element 2158 such that the tab 2158-2 of the beam fixing element 2158 is positioned over and aligned with the clamp shoe tab 2146-1. The tensioner element is inserted through an aperture in tab 2158-2 of the beam fixing element 2158 and into clamp shoe tab 2146-1. The tightening of the tensioner element 2130 pulls the mid beam 2132 towards the pair of edge structures 2014 forcing the end of the mid beam 2132 against the internal surface of the second edge structure 2114-2.

In some forms, a cover sheet (not shown) may optionally be coupled to and between the second edge structures 2114-2, for example by being inserted into grooves or rebates provided in the second edge structures 2114-2. The cover sheet may be configured to conceal the internal cavity between two the mid beams 2132 and the second edge structures 2114-2. The cover sheet may be supported at bottom and top edges by steps or notches provided in the mid beam 2132.

The profile of the mid beam may allow for shelves in adjacent side by side ladder style furniture panels 2100 with the sharing of an intermediate ladder style furniture panel 2100. Adjacent shelves at the same height may use mid beams oriented in opposing orientations such that the profiles would match and provide a groove at the top and bottom of the combined rungs to allow the bottom edge of a cover sheet to be captured if required.

FIGS. 22*a* to 22*d* show a further example of a ladder style furniture panel according to an aspect of the invention. In this arrange the ladder arrangement is formed between at least one mid bean 2232 secured between an edge structure 2214. A fixing element 2220 is secured to each end of the mid beam and extending over a portion of the edge structure 2214. The fixing element 2220 can have a cut-out channel 2220-1 configured to align with a rebate 2226 provided in the edge structure 2214. Preferably the cut-out channel 2220-1 has a width larger than the width of the rebate 2226.

A secondary fixing element 2221, in the form of a jam fitting is coupled with a tensioner element 2230. The tensioner element 2230 is threaded into the secondary fixing element 2221 prior to the secondary element being inserted through the cut-out channel 2220-1 and into the rebate 2226. The secondary fixing element 2221 may be received between arms of the fixing element 2220. The tensioner element 2230 may be configured to be tightened to provide a force to the secondary fixing element 2221 such that it rotates and locks within the rebate 2226. The reaction force on the secondary fixing element 2221 provides a rotation force to the mid beam 2232, however the mid beam is unable to move due to the end being abutted to the centre facing surface of the edge structure 2214.

Upright Pair

A further exemplary furniture panel according to the invention is an upright pair furniture panel. An upright pair furniture panel comprises a pair of edge structures joined together using at least one internal fixing element. The pair of edge structures each comprise a channel and are arranged such that the channels are internal and facing each other to create an internal cavity. The two edge structures may have the same cross section and may be coupled together to provide a slot therebetween. No cover sheets are required in the upright pair furniture panel. Generally, two or more upright pair furniture panels may be used together to form legs of a furniture assembly. In some arrangements, an upright pair furniture panel may be attached to a wall or other structure.

FIGS. 23*a* to 23*f* (*ii*) show an example of an upright pair furniture panel 2300 formed from a pair of edge structures 2314, an internal fixing element 2320 and a shoe clamp 2346. The internal fixing element 2320 is inserted into slots 2313 provided in a channel on the inner surface of each of the edge structures 2314. Alternatively, the internal fixing element 2320 may be provided in a lip portion (not shown) provided in a channel on the inner surface of each of the edge structures 2314. The internal fixing element 2320 has an extending arm 2320-1 that projects out between the join between the two edges structures (see FIG. 23*d*(*ii*)). The clamp shoe 2346 is then positioned over the extending arm 2320-1 of the internal fixing element 2320 and against the outer surface overlapping the join between the two edge structures 2314. A tensioner element 2330 engages with the extending arm 2320-1 of the internal fixing element 2320 (see FIGS. 23*c* and 23*d*). The tightening or tensioning of the tensioner element 2330 forces the clamp shoe 2346 against the edges structures 2314.

A plurality of shoe clamps 2346 and internal fixing elements 2320 may be used to couple the two edges structures 2314 together. For example, at least two shoes clamps 2346 combined with at least two internal fixing elements 2320 may be used.

Figure 24A:
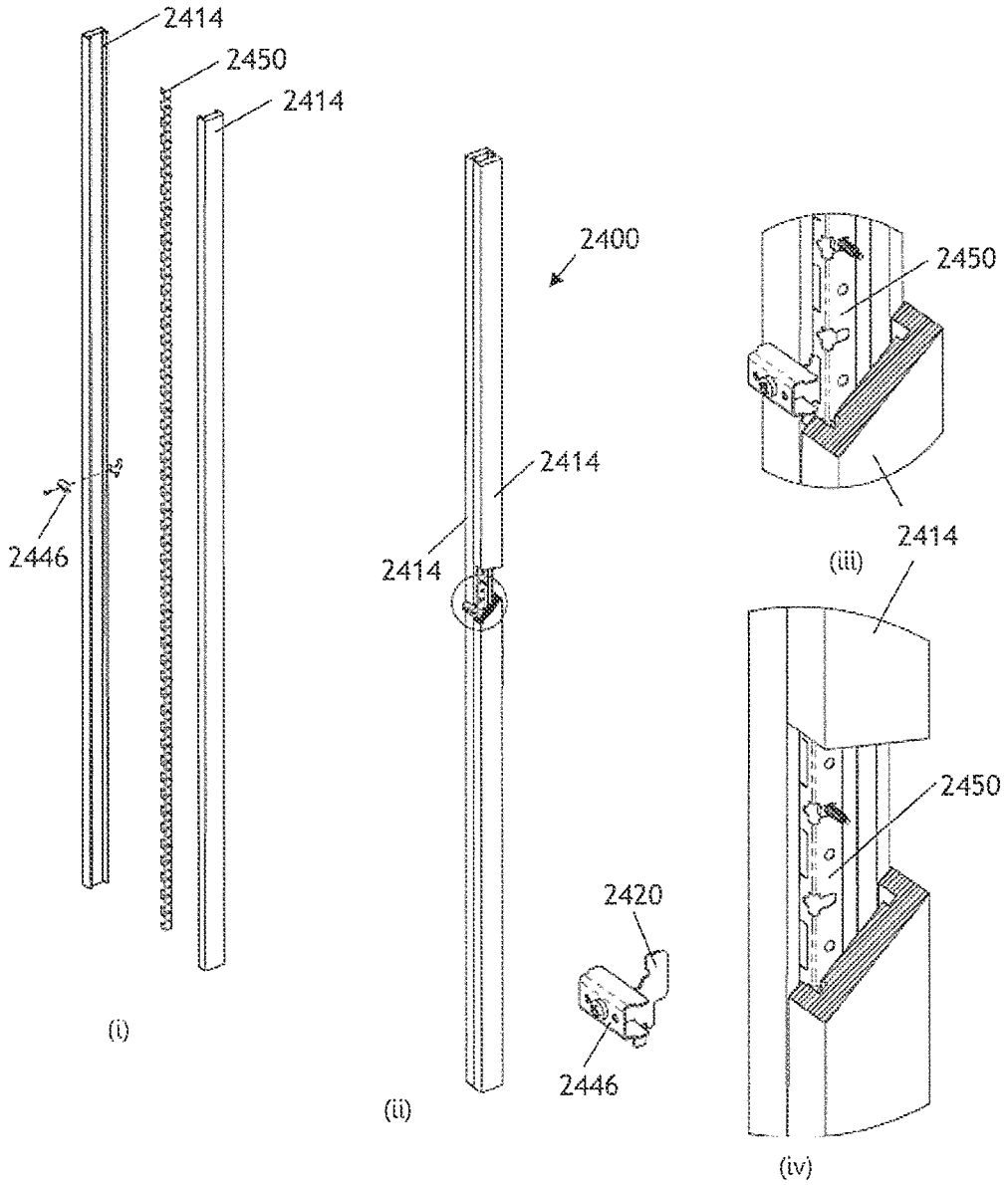
FIGS. 24*a*(*i*) to 24*a*(*iv*) show a range of views of a further exemplary upright pair style furniture panel including an exemplary internal fixing element according to an embodiment of the invention.
Figure 24B:
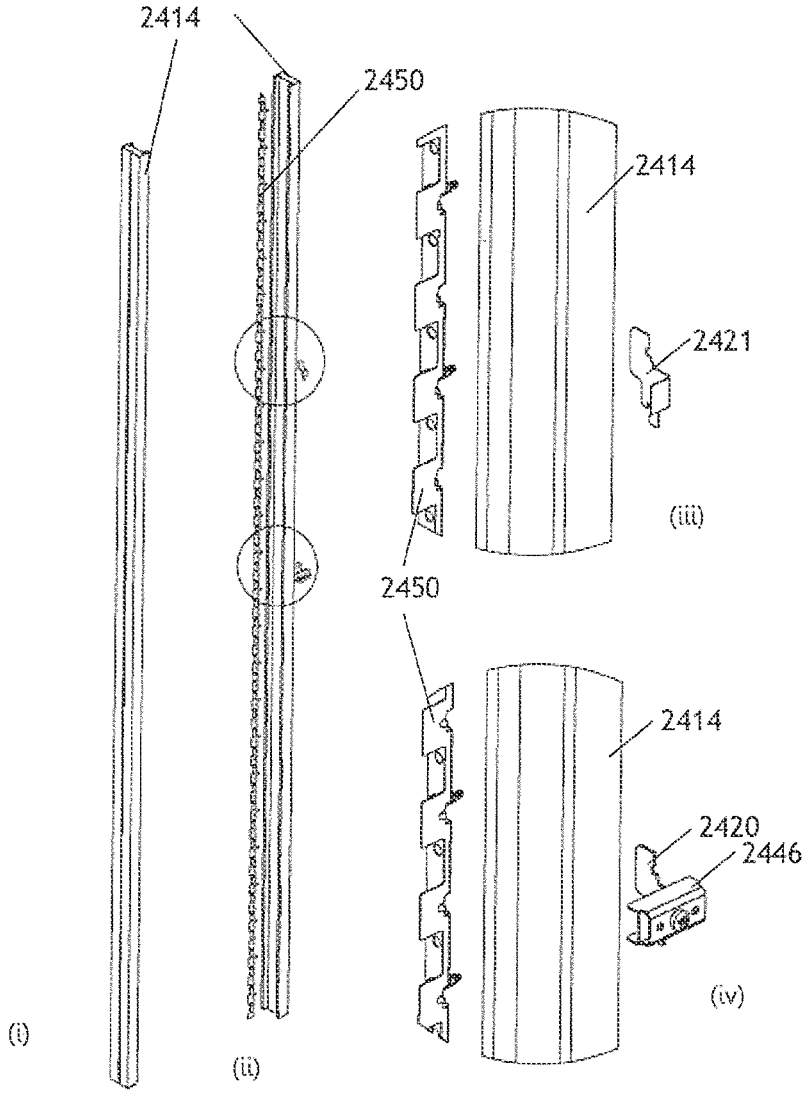
FIGS. 24*b*(*i*) to 24*b*(*iv*) show a range of views of a further exemplary upright pair style furniture panel including an exemplary internal fixing element according to an embodiment of the invention.

FIGS. 24*a* and 24*b* show alternative upright pair furniture panels 2400 that use different internal fixing elements 2420 and a bracket rail 2450. In FIG. 24*a* the bracket rail 2450 is coupled to the internal channel of one of the edge structures 2414. The internal fixing element 2420 is configured to insert in a slot created between the two edge structures and engage with a gap or aperture in a portion of the bracket rail 2450.

Once the internal fixing element 2420 is located in bracket rail 2450 and both edge structures 2414 are positioned either side of the protruding portion of the internal fixing element 2420. The method of fixing the structure is the same as described for furniture panel 2300 above. The portion of internal fixing element 2420 extending away from the edge structure 2414 is the same or similar to 2320-1 and presents the same tang and fastener hole by which to secure the shoe clamp 2446 in the same way shoe clamp 2346 is secured to provide force by the shoe clamp 2446 pressing against the respective edge structure 2414 clamping it between the reaction force of bracket rail 2450 on the other side.

Similarly, FIG. 24*b* shows two examples of an internal clamping arrangement with a bracket rail 2450. In FIG. 24*b*(*iii*) a height adjustable internal fixing element 2421 passes through a narrow slot formed between the two opposing edge structures 2414 and engages with a gap or aperture in the bracket rail 2450 using a hook arrangement and not requiring a fastener.

FIG. 24*b*(*iv*) shows a further arrangement similar to above that is height adjustable by engagement with a gap or aperture in the bracket rail 2450. The shoe clamp 2446 is coupled with an internal fixing element 2420 that then passes through a narrow slot formed between the two opposing edge structures 2414. A portion of the internal fixing element 2420 is configured to engage with the edge structure 2414 that does not have the bracket rail 2450 attached thereto.

FIG. 24*b* (*iii*) shows a moveable support bracket 2421 that may pass through the gap between the two edge structures 2414 and be located in the gap between rungs of the bracket rail 2450.

Figure 25A:
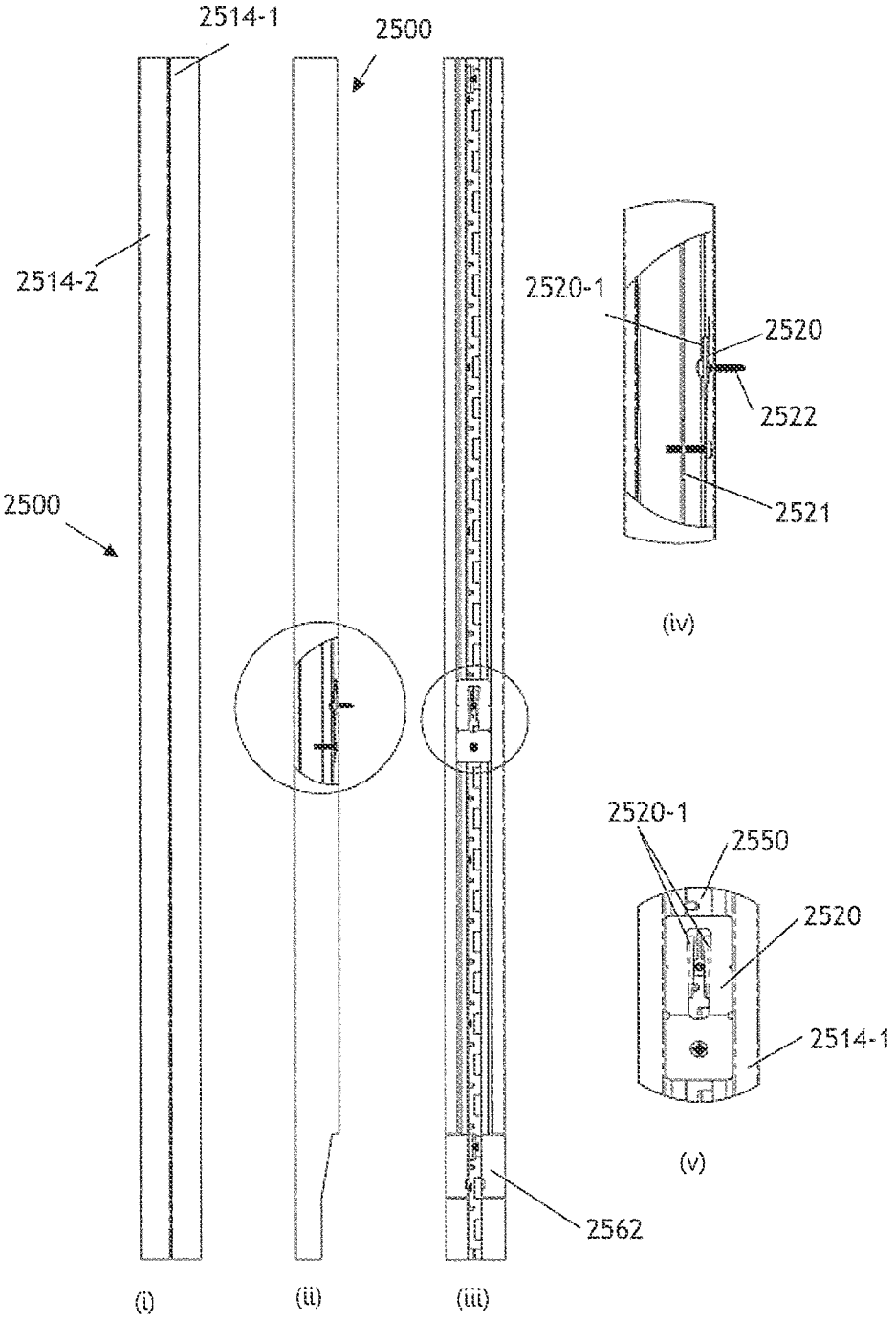
FIGS. 25*a*, 25*b* and 25*c* show a range of views of a further exemplary upright pair style furniture panel including an exemplary internal fixing element according to an embodiment of the invention.
Figure 25B:
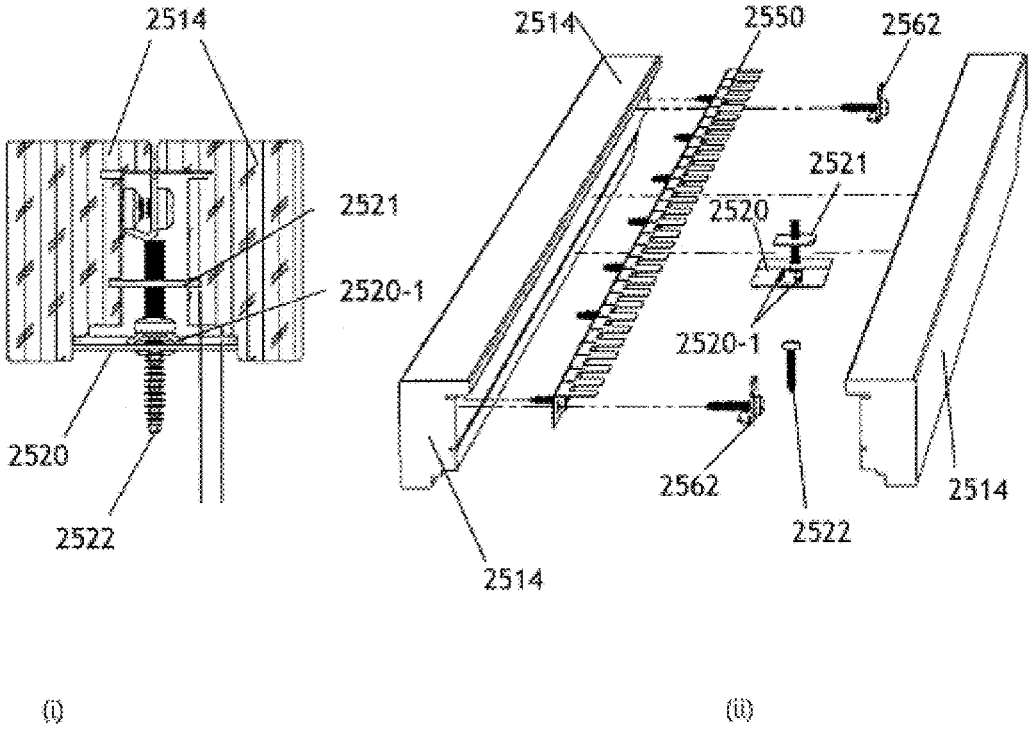
Figure 25C:
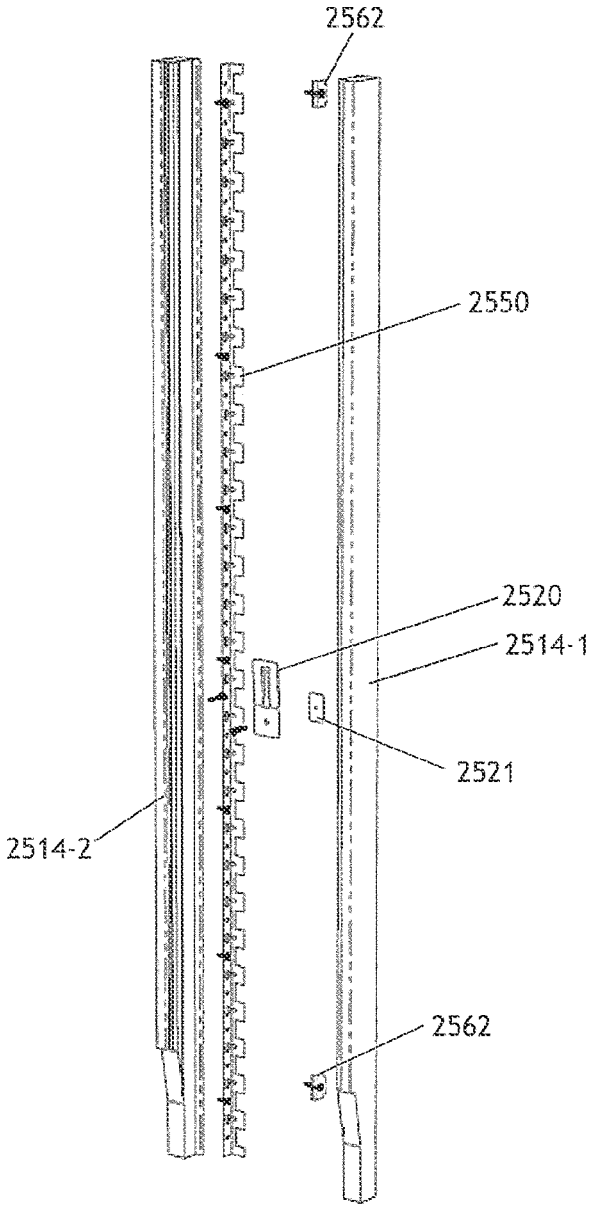

FIG. 25*a* to 25*c* show a further alternative upright pair furniture panel 2500. The pair of edge structures 2514 may have the same internal cross section but may optionally be handed due to the presence of cut away at the bottom edge to provide clearance for a skirting board. As shown a bracket rail 2550 may be fastened to one of the edge structures 2514-1. One or more slot spacers 2562 may be coupled through the bracket rail 2550 and to the edge structures 2514-1, preferably adjacent one or both ends of the edge structure 2514-1. An internal fixing element 2520 is coupled with a secondary fixing element 2521 to form a clamping assembly to couple the two edge structures 2514-1 and 2514-2 together. The channel in edge structure 2514-2 is held against the slot spacer 2562 attached to the edge structure 2514-1. The clamping assembly is slid into place with the secondary fixing element 2521 located in a groove in the edge structures 2514 and the internal fixing element 2520 is positioned in the channel created by the profiles of the two edges structures 2514-1 and 2514-2 on the opposite side to the slot. The clamping assembly is positioned along the length of the panel in the chosen position for clamping and a fastener is tightened pulling the internal fixing element 2520 to the secondary fixing element and consequently applying a holding force to pair of edge structures 2514-1 and 2514-2 on either side holding them in place. Subsequently the tensioned upright furniture panel 2500 may be held to a wall by the secondary fixing element 2521 engaging with a fitting or fastener fixed to the wall.

There is an internal fixing element 2520, in the form of a key plate, configured to be positioned on an outer face within a rebate provided on one side of both the edge structures 2514 and a second internal fixing element 2521 captured within the opposing edge structures 2514 as seen in FIG. 25*b*(*i*).

The internal fixing element 2520 may be configured to abut a wall. The key plate 2520 allows the head of a fastener 2522 to pass through and then slide longitudinally becoming trapped behind the keyplate for fixing to wall. Ramp feature 2520-1 on the rear of the key plate 2520 rides along the underside of the fastener head causing 2520 to flex and apply force to the underside of the fastener and forces the upright pair to the wall in which the fastener 2522 is fixed. It is expected that the sliding action is downward with the bottom face of the upright pair resting on the floor. This system is very useful when fixing to a stud wall. A vertical line can be marked on the wall and a horizontal stud (nog) can be found and the screw 2522 fixed to the wall into the structural timber behind. As the clamping arrangement is easy to loosen off and position at any point along the length it is easy to place it back-to-front beside the screw in the wall and move the keyplate 2520 to the correct height.

Figures 26A, 26B:
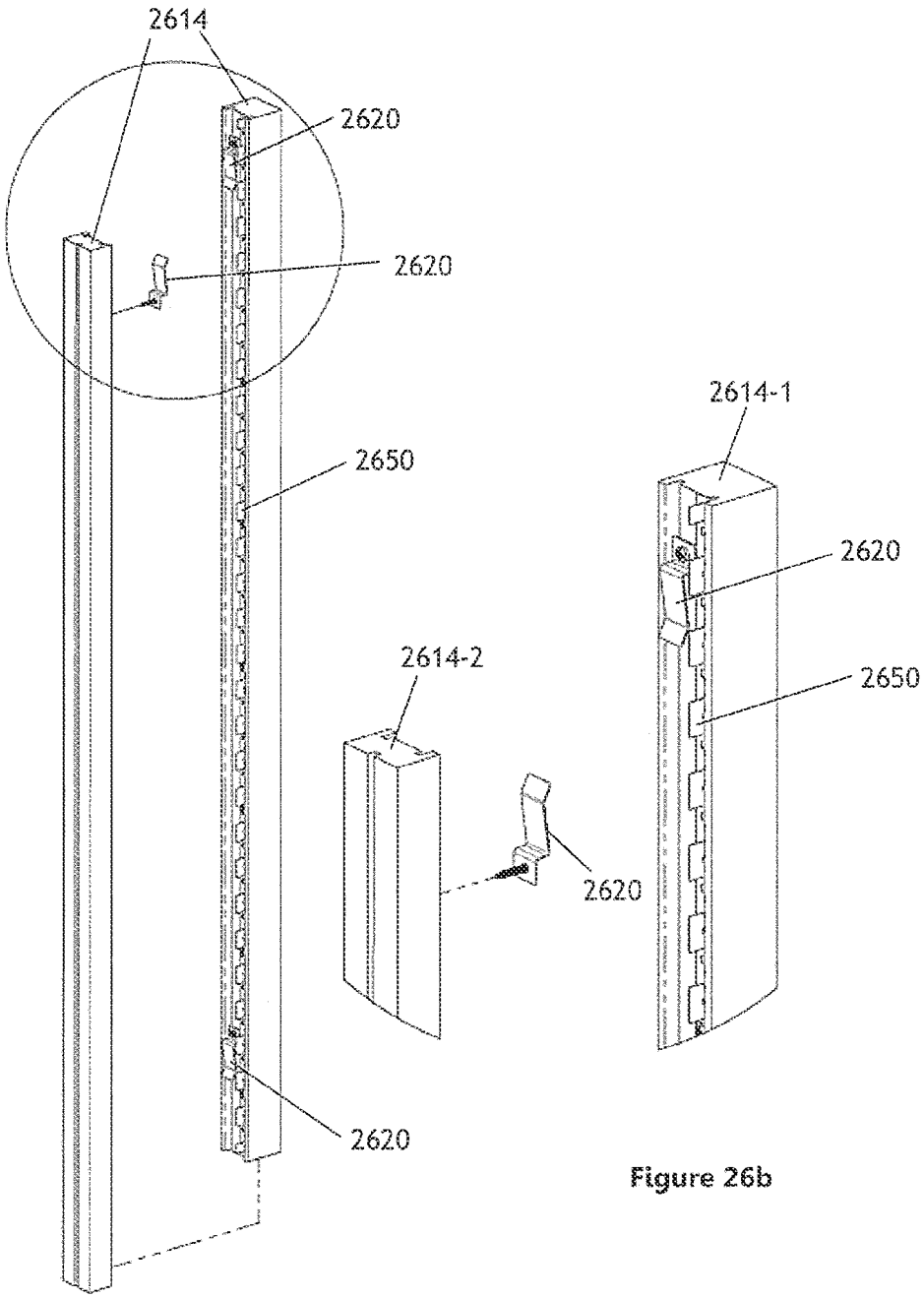
FIGS. 26*a* to 26*c* show a range of views of a further exemplary upright pair style furniture panel including an exemplary internal fixing element according to an embodiment of the invention.
Figure 26C:
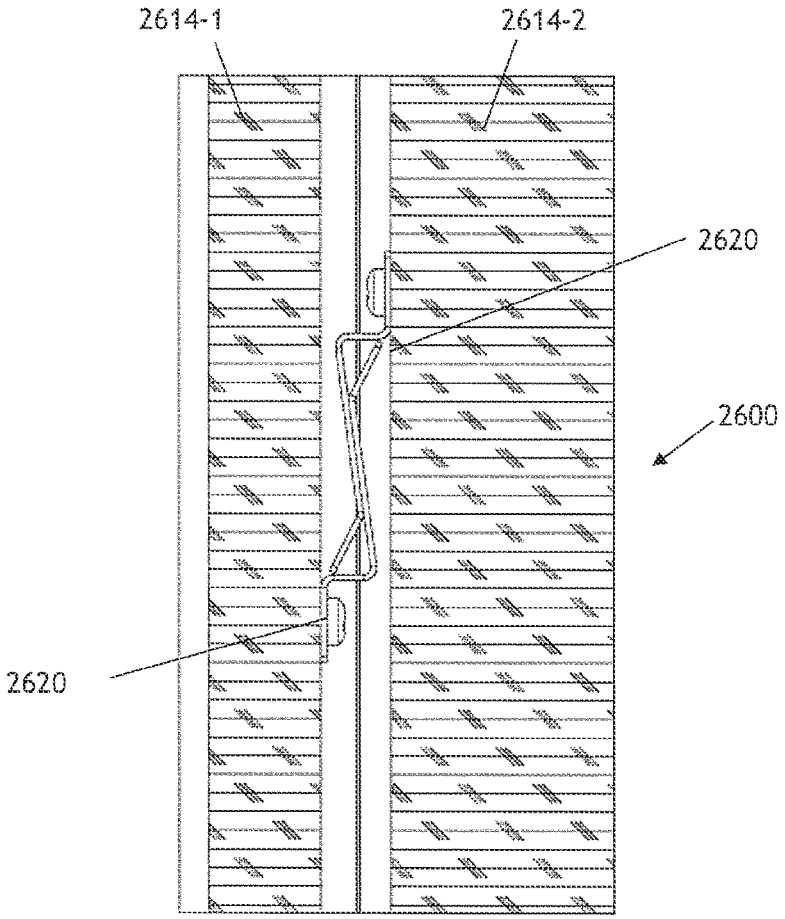

FIGS. 26*a* to 26*c* provide a further example of an upright furniture panel 2600 according to an embodiment of the invention. A bracket rail 2650 is coupled to an edge structure 2614-1. In addition, at least one internal fixing element 2620 is coupled to each of the edge structures 2614-1 and 2614-2. The internal fixing elements are arranged in opposing directions on the edge structures 2614-1 and 2514-2 as shown. Depending upon the length of the edge structures one, two or more pairs of internal fixing elements may be coupled to the edge structures 2614. As shown a pair of opposing internal fixing elements 2620 may be positioned near or adjacent the top of the edge structures and a similar opposing pair provided near or adjacent the bottom of the edge structures. The edge structure 2614-1 and 2614-2 are brought together at an offset height to facilitate the engagement of the open ends of the internal fixing elements to secure the two edges structures 2614-1, 2614-2 together.

As illustrated the internal fixing elements 2620 each comprise an attachment portion at one end and an extending arm including an elbow at the opposing end. The depth of the elbow may be configured to ensure a slot is provide between the two coupled edge structures 2614-1, 2614-2. The distance of the elbow from the attachment portion will limit the displacement between the edge structures as the elbow from one internal fixing element 2620 attached to one edge structure will contact the opposing edge structure (see FIG. 26*c*). In some forms the extending arm of the internal fixing element 2620 may be spring loaded to assist with the engagement and allow for a variation of dimensions. The spring movement may provide a closing force between the two edge structures. Alternatively, the extending arms may be rigid and provide an interlock engagement.

Figure 27:
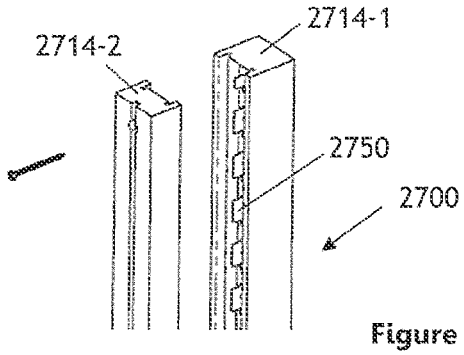
FIG. 27 shows a further exemplary upright pair style furniture panel including an exemplary fastening internal fixing element according to an embodiment of the invention.

FIG. 27 shows a further embodiment of an upright pair furniture panel 2700. In this simple arrangement, the upright pair furniture panel may include a bracket rail 2750 as an internal fixing element attached to one edge structure 2714-1 as described above. The two edge structures 2714-1 and 2714-2 may be coupled together by a fastener. A slot spacer as seen in FIGS. 25*a* to 25*c* above may be placed at the slot faces prior to tightening of the fastener to ensure a slot is provided between the edge structure 2714-1 and the edge structure 2714-2 to allow further fixing elements to be passed through the gap and engage with the bracket rail. For example, this approach may be used to attach a shelf or other furniture panel.

Other Furniture Panels

FIGS. 29*a* to 29*e* show an embodiment of a shelf furniture panel 2900. This shelf furniture panel may be built-in-place. The shelf furniture panel 2900 comprises at least one edge structure 2914 connected to a first cover sheet 2912-1 using a plurality of internal fixing elements 2920 in the form of a support beam. A plurality of toggle locks 2964, 2966 secure the first cover sheet 2912-1 and the edge structure 2914 to the internal fixing element 2920. A second cover sheet 2912-2 is provided to hide the internal fixing elements 2920 and toggle locks 2964, 2966.

As illustrated the toggle locks 2964 for connecting the first cover sheet 2912-1 to the internal fixing element may be a different size to the toggle locks 2966 that are used to connect the edge structures 2914 to the internal fixing element 2920. The different sizes of the toggle locks are configured to engage with the different depths of the first cover sheet 2912-1 and the edge structures 2914. FIGS. 29*f* (*i*) to (*iii*) show exemplary views of a toggle lock 2966 for fixing an edge structure 2914 to the internal fixing element 2920. FIGS. 29*f* (*iv*) to (*vii*) show a toggle lock that may be used for fixing a first cover sheet 2912-1 to the internal fixing element 2920. It is appreciated that in an alternative arrangement the same type of toggle lock may be configured to be used for connecting edge structures and cover sheets having the same depths to the internal fixing element.

As seen in FIG. 29*f* the toggle locks 2964, 2966 are similar in construction but differ in the lengths of their shafts 2964-1, 2966-1. The toggle locks 2966 as shown in FIGS. 29*f* (*i*) to (*iii*) are configured for connecting to the edge structure 2914 and will be described in more detail and it is to be understood that the toggle lock 2964 functions in a similar manner. The toggle lock 2966 comprises a head 2966-2 and base 2966-4 with the shaft 2966-1 provided between. The base 2966-4 may have flange portions and non-flange portions. The flange portions may extend from a portion of the base 2966-4. The non-flange portions can be configured (see FIG. 29*f* (*iii*)) to allow insertion of the toggle lock 2966 through an aperture in the internal fixing element 2920 and into engagement with a slot provided on the inner face of the edge structure 2914 (e.g. a T-slot profile). After insertion, the toggle lock is rotated, for example rotated approximately 90°, to engage the flange portions of the base 2966-4 with an undercut in the slot of the edge structure 2914. At least one projection 2966-3 protrudes from the upper end of the shaft adjacent the head 2966-2 and with the rotation of the toggle lock is configured to lock or tension the toggle lock 2966 between the internal fixing element 2920 and the edge structure 2914. The at least one projection 2966-3 is adapted to lock in against a lip on the inner face of the internal fixing element 2920 adjacent the aperture forcing the toggle lock 2966 in a fixed position between the internal fixing element 2920 and the edge structure 2914.

A plurality of toggle locks 2966 may be provided to secure between the edge structure 2914 and the internal fixing element 2920. A second internal fixing element 2920 is connected to the first cover sheet 2912-1 using toggle lock 2964 in a similar manner. Optionally (not shown) the second internal fixing element 2920 may also be connected in a similar manner using a toggle lock 2966 to a second edge structure 2914.

For assembly of the shelf furniture panel the first cover sheet 2912-1 is coupled to the at least one edge structure 2914 and attached to two internal fixing elements 2920 as described above. A plurality of toggle locks 2964 are used to secure the first cover sheet 2912-1 to each of the internal fixing elements 2920. Alternatively, the first cover sheet 2912-1 may be attached to each of the internal fixing elements 2920 and then attached to the at least one edge structure. The second cover sheet 2912-2 is inserted to cover the internal cavity. The toggle locks 2964 connect to the first cover sheet 2912-1 in a similar manner to how the toggle lock 2966 connects to the edge structure 2914. A slot is provided adjacent each edge of the cover sheet 2912 for the engagement with the toggle lock 2964.

A second cover sheet 2912-2 is inserted between the two edge structures 2914 and may be supported by a rim of the internal fixing element 2920. The second cover sheet 2912-2 may be inserted or slid into rebates 2926 provided in the inner surface of each of the edge structures 2914 to assist in retaining the second cover sheet 2912-2 in position. Alternatively, the second cover sheet may form an upper surface and rest unsecured on a rim of the two internal fixing elements 2920 and between the two edge structures.

Figure 29A:
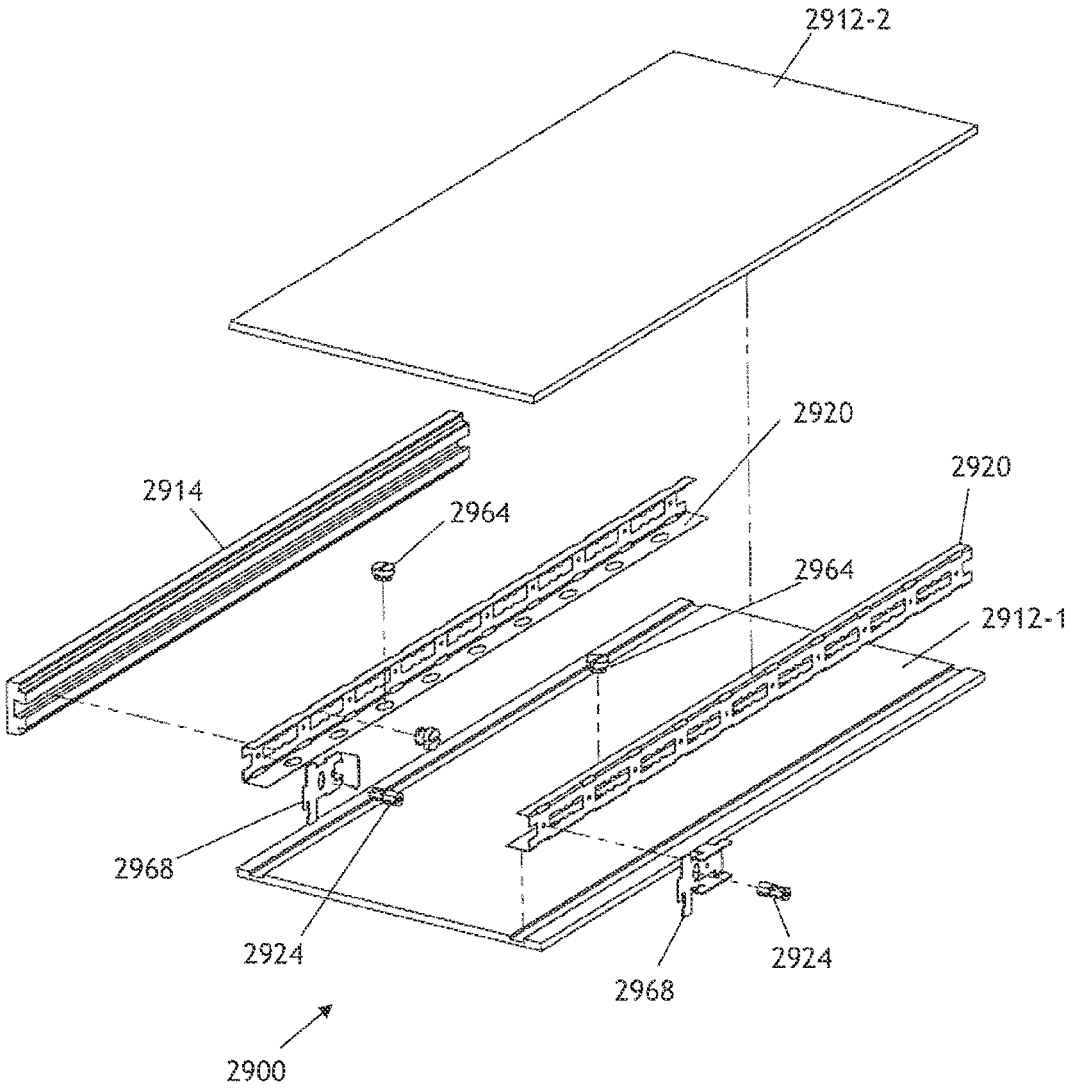
FIGS. 29*a* to 29*e* show a range of views of an exemplary built in shelf furniture panel including an exemplary internal fixing element according to an embodiment of the invention.
Figure 29B:
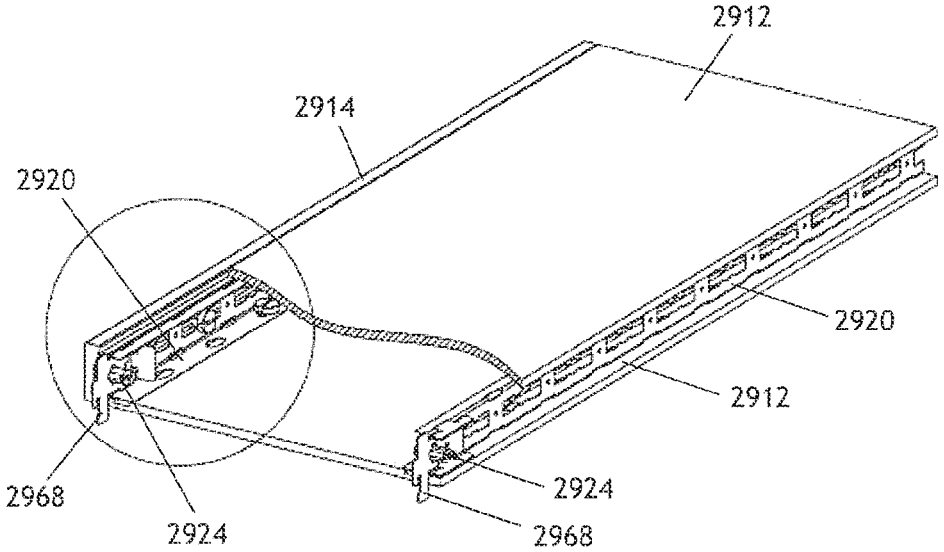
Figure 29C:
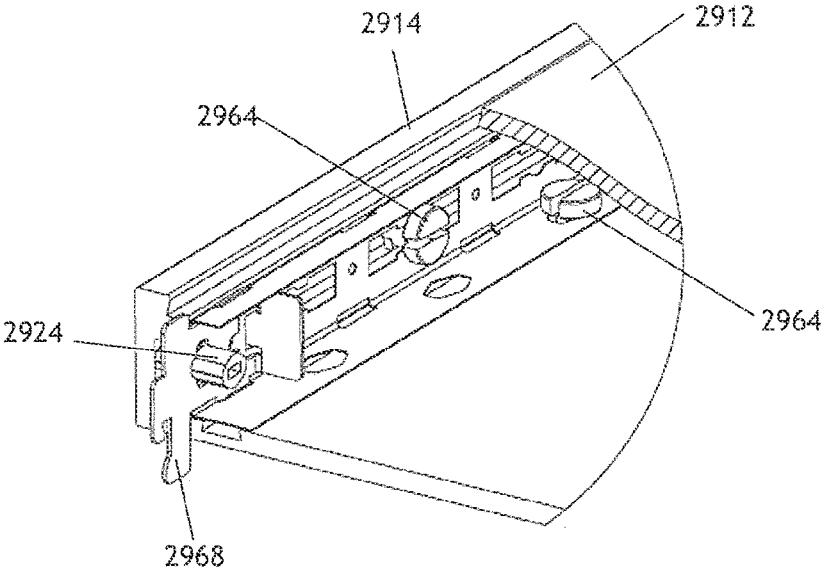
Figure 29D:
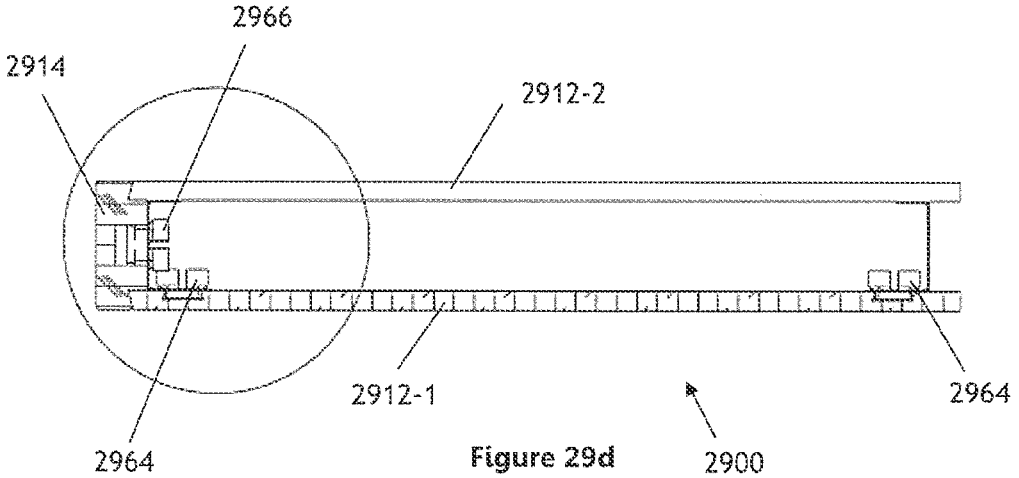
Figure 29E:
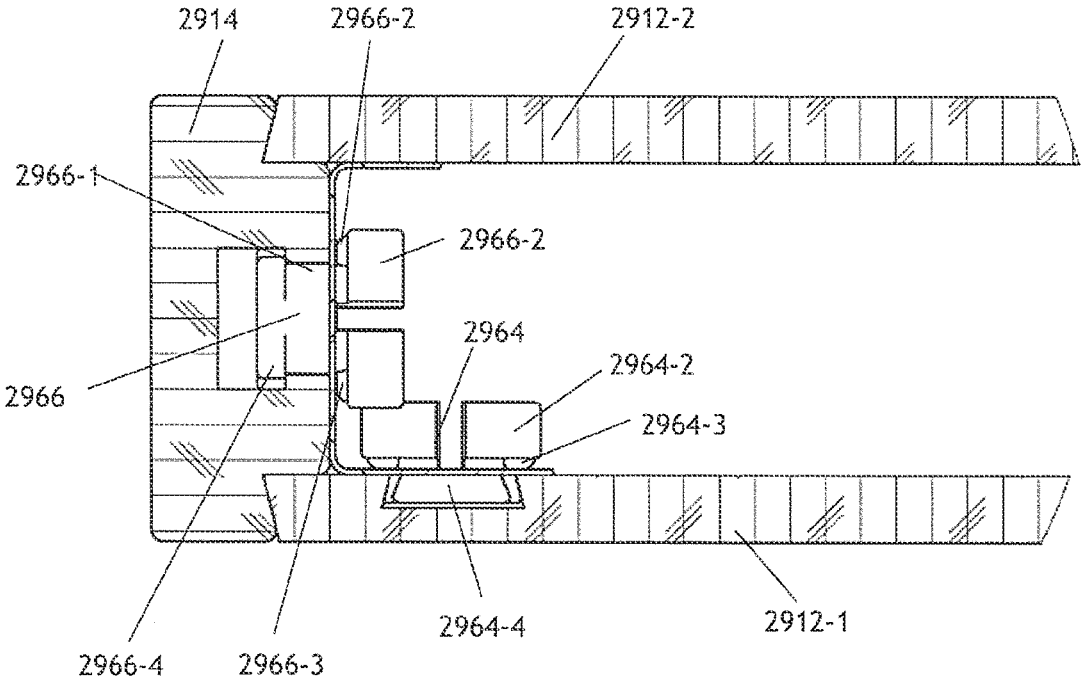
Figure 29F:
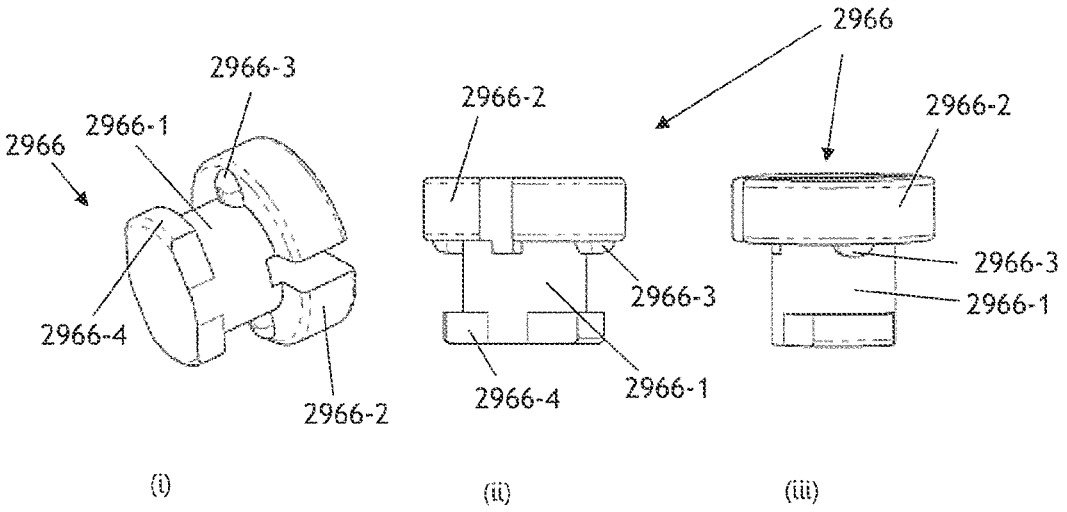
FIGS. 29*f*(*i*) to (*vi*) show a range of views of a further exemplary internal fixing element according to an embodiment of the invention.
Figure 29F:
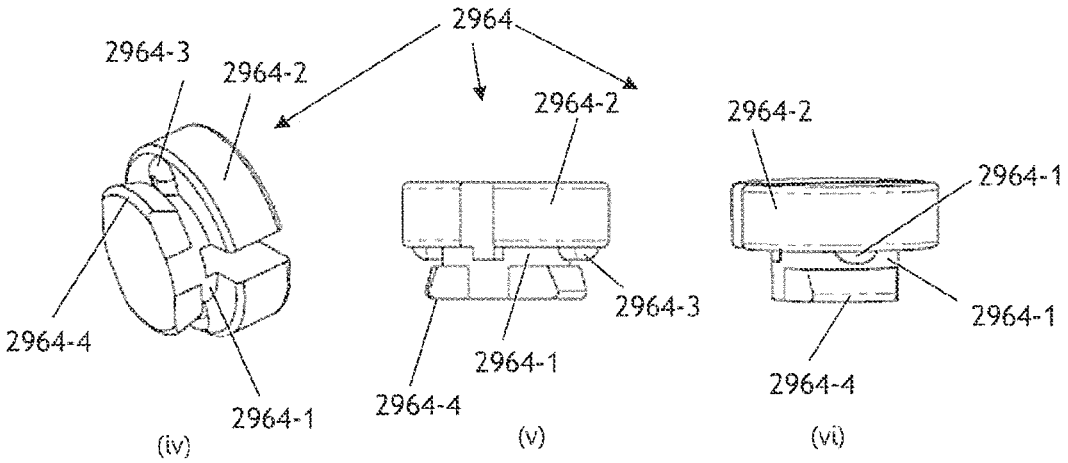

A coupling bracket 2968 is shown in FIGS. 29*a* to 29*c*, where the coupling bracket 2968 is an example of a fixing that may be used to secure and tension the shelf panel 2900 to second furniture panel (not shown). The coupling bracket 2868 is connected to a bracket rail of the second furniture panel (not shown) and tensioned using a fastener 2924. The fastener 2924 has lobes that provide a cam action to provide a tensioning force to secure the coupling bracket 2968 to the second furniture panel. Fastener 2924 passes through a complementary shaped hole in coupling bracket 2968 with the lobes top and bottom. Turning of the fastener 2924 through 90 degrees forces the lobes against the complementary panel. The coupling bracket 2968 has a forward-facing tang that locates the internal fixing element 2920 and edge structure 2914. In addition, fastener 2924 protrudes into the opening of the slot at the inner edge of the edge structure 2914. For additional fixing of the internal fixing element 2920 to the edge structure 2968 a fastener (not shown) can pass through a hole in the coupling bracket 2968 and fasten into the hole shown in the internal fixing element 2920. The protruding fastener has clearance in the slot in the edge structure 2914. In use, the coupling bracket 2968 is attached to a second furniture panel and is used to connect the shelf furniture panel to the second furniture panel.

Figure 30A:
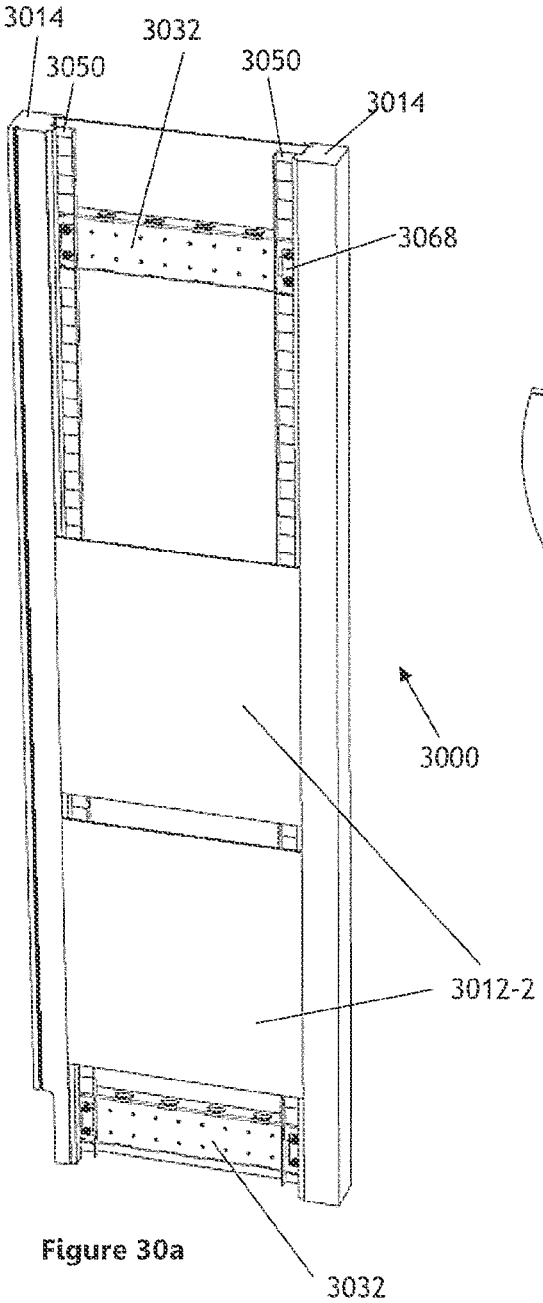
FIGS. 30*a* to 30*c* show a range of views of an exemplary segmented furniture panel including an exemplary internal fixing element according to an embodiment of the invention.
Figure 30B:
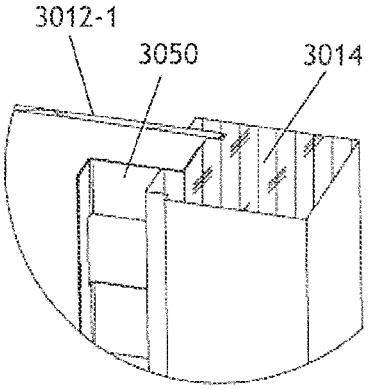
Figure 30C:
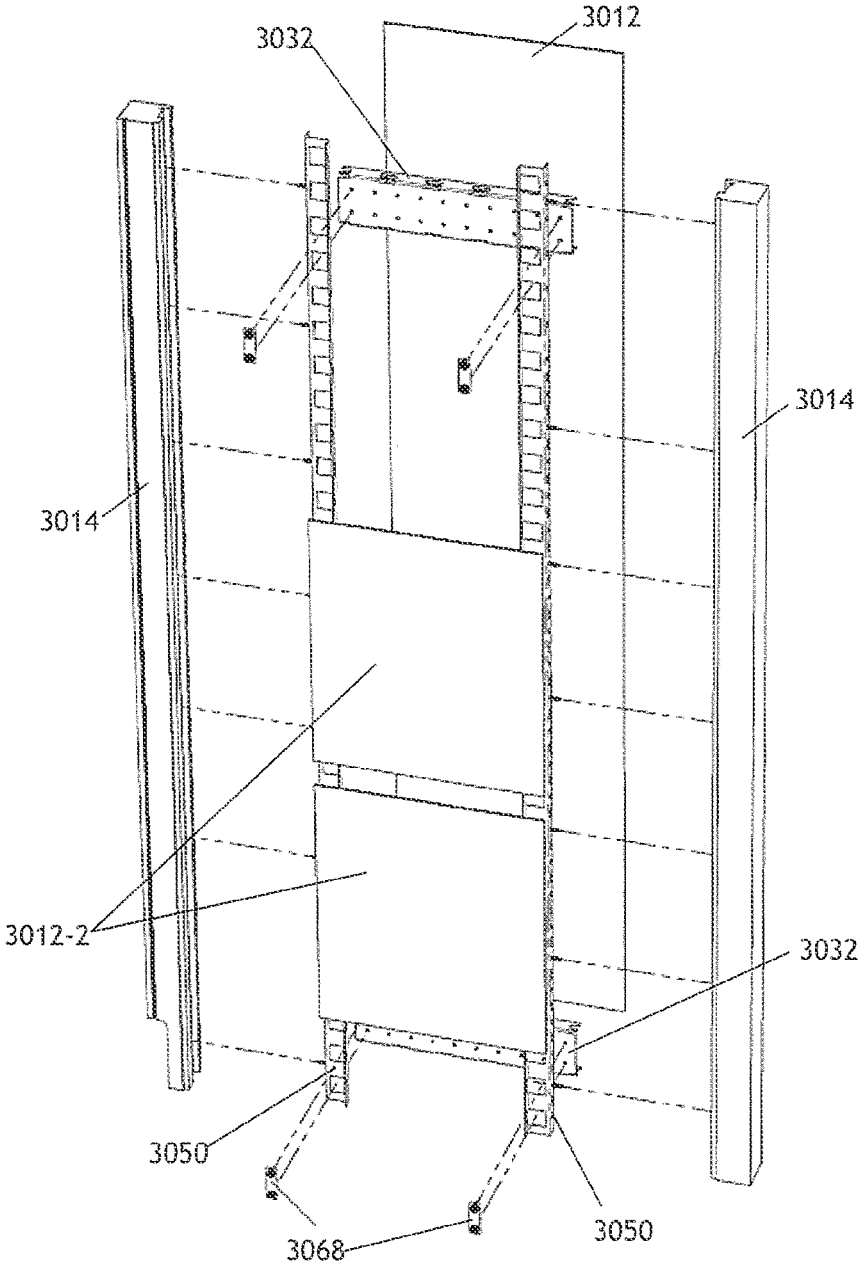

FIGS. 30*a* to 30*c* show an embodiment of a segmented furniture panel for use in constructing a furniture assembly. This segmented furniture panel 3000 has an internal structural integrity with one cover sheet provided on the outer facing surface and is open on the inner facing surface for joining to shelf furniture panels as described above. This allows a bracket, such as the coupling bracket 2968 above, for a shelf furniture panel to be accessible from above or below the shelf with direct access to the cavity from the segmented furniture panel from the shelf furniture panel side, being particularly useful for a box style as described above. Once the join is tensioned one or more cover sheets 3012-2 may be positioned in the panel opening on the inner facing surface between shelves to capture or hide the internal fixing elements.

For assembly of a segmented furniture panel 3000 one or more mid beams 3032 is connected between two bracket rails 3050. In some arrangements, a screw plate 3068 may be fastened through the bracket rail 3050 and into the mid beam 3032. The one or more mid beams 3032 are fastened to each of two edges structures 3014 via the bracket rails 3050. A first cover sheet 3012-1 may be slid into the partial assembly along centrally facing rebates in the edge structures 3014. Alternatively, the first cover sheet 3012-1 may be attached after shelf furniture panels have been attached. The latter enables access above and below from both inward and outward facing directions of the shelves for the assembly process. At least the inward facing side of the partially assembled furniture panel remains open for attachment of joining fittings to subsequently join a type of shelf furniture panel. Following attachment of shelf furniture panels in the desired positions one or more second cover sheets 3012-2 having a height that fits between the joining bracket of two consecutive shelves are inserted into rebates 3028 provided in the edge structures 3014.

The inner panel is not required if a drawer is used in place of a shelf furniture panel that covers the face of the furniture panel. This system allows for the shelf portion of a drawer to be firmly secured without having to access the volume of the shelf. The shelf may then provide the support for installation of runners for the drawer.

Figure 35A:
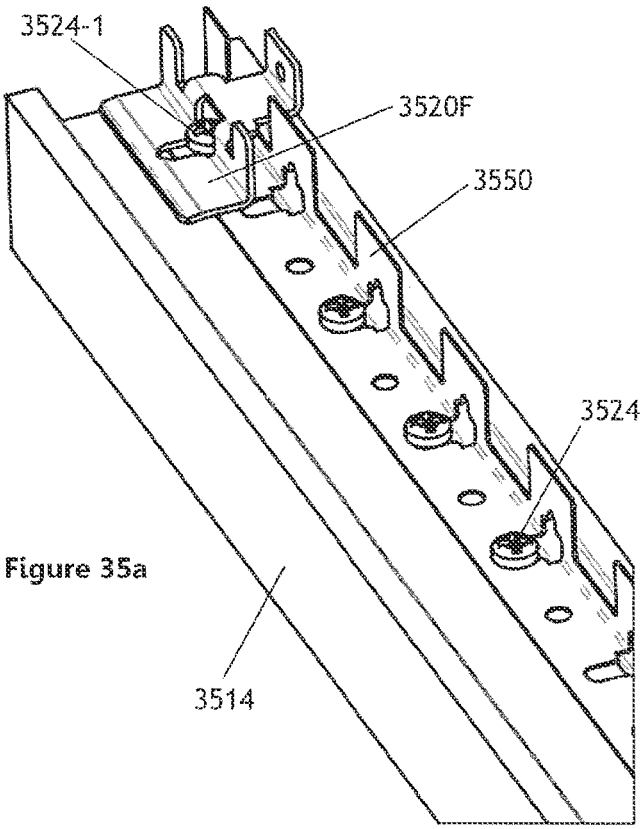
FIGS. 35*a* to 35*e* show examples of pre-attached fixtures attached to components of furniture panels.
Figure 35B:
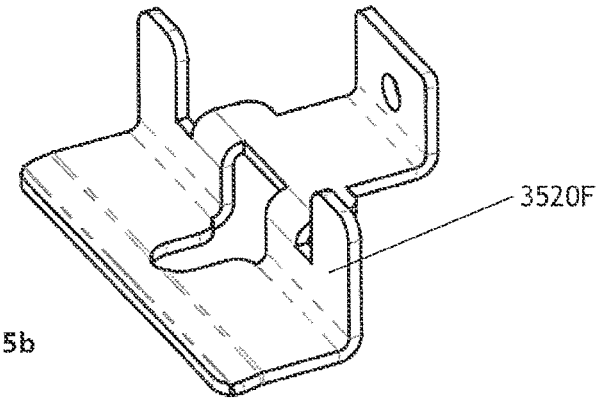
Figure 35C:
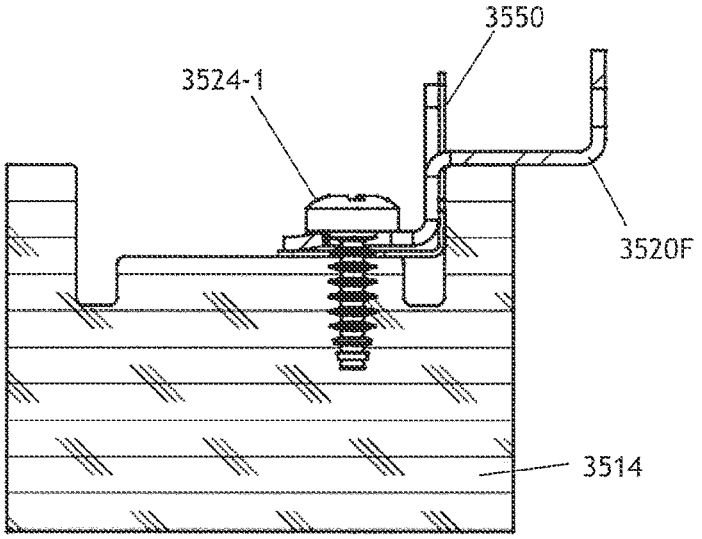
Figure 35D:
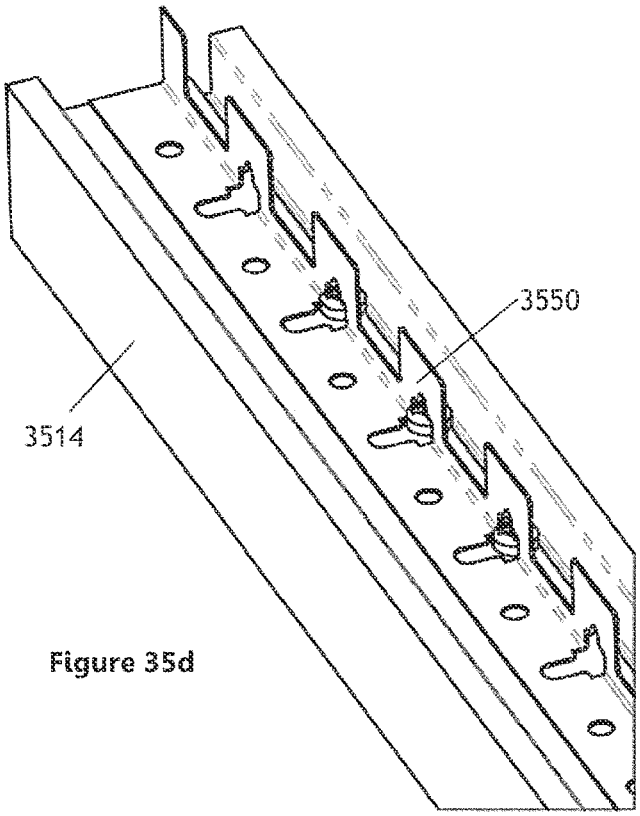
Figure 35E:
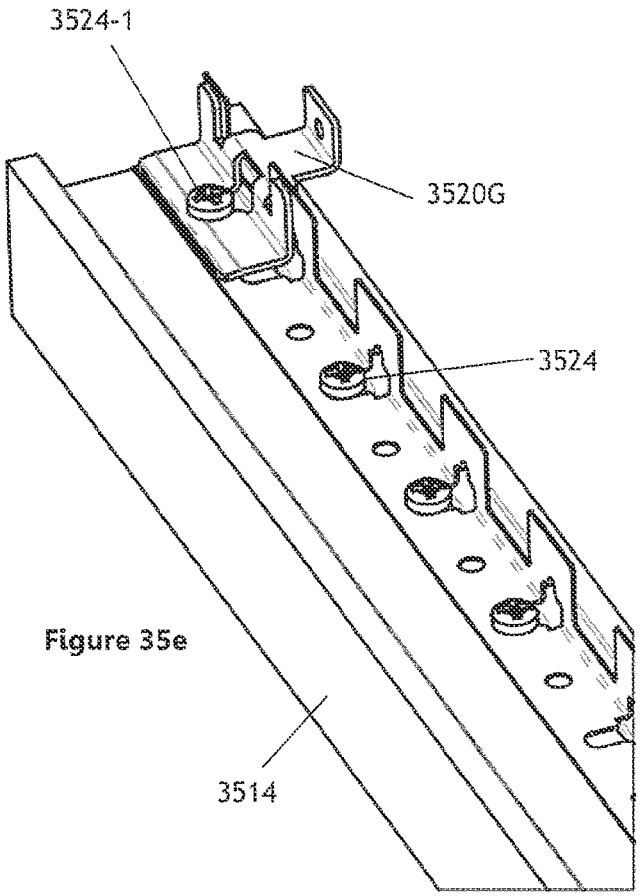

In some arrangements, where a fastener is provided to secure a fixing element or bracket rail or similar to an edge structure, one or more of the fasteners may optionally be pre-fixed to the edge structure to form a sub-assembly and consequently reduce the level of assembly required by a user. This has the advantage of saving time in assembly, ensuring accurate positioning of the fastener and use of the correct fastener. For example, a bracket rail 3550 may be provided pre-fixed via a fastener 3524 to an edge structure 3514 as shown in FIG. 35*a*. Optionally a further fixing element 3520F (as seen in FIG. 35*b*) may be attached to the bracket rail using one of the pre-attached fasteners 3524 as also shown in FIG. 35*a*. The fixing element 3520F may be configured to slide under the head of an untightened state fastener 3524-1 and the fastener subsequently tightened to a tightened state (as seen in FIG. 35*e*) to secure the fixing element 3520F to the bracket rail and edge structure using the fastener 3524-1. FIG. 35*c* shows a profile view of the fastener 3524-1 in a tightened state to secure the fixing element 3520F to the bracket rail and edge structure. FIG. 35*b* showing an example of the fixing element 3520F with an aperture to allow the head of the fastener to pass through at a first position but prevented the fastener 3524 from passing back through at a second position. The second position is the position where the fastener is tightened to secure the fixing element 3520F to the bracket rail 3550 and edge structure 3514.

In a similar manner, the fasteners may optionally be provided pre-fixed in the required location in a component of the furniture panel, such as an edge structure, the fasteners being provided in an untightened state. In this arrangement the bracket rail, fixing element or similar may be configured to insert over the fastener and then subsequent tightening of the fastener secured the said bracket rail, fixing element or similar secures the component of the furniture panel. FIG. 35*d* shows an example of the positioning of a bracket rail 3550 under the heads of pre-attached fasteners. The bracket rail 3550 includes apertures configured to allow the head of the fastener to pass through the side of the bracket rail 3550 but not through a base portion of the bracket rail. The fasteners are subsequently tightened as shown in FIG. 35*e* to secure the bracket rail 3550 to the edge structure 3514.

It is noted that the skilled addressee would understand that a range of different components of the furniture panel may be provided pre-assembled or a complete furniture panel may come pre-assembled for subsequent attachment with other furniture panels to allow assembly of a furniture assembly whilst providing reduced size for transport.

It is acknowledged that in assembling multiple components together to form a furniture panel or a furniture assembly there may be confusion and potential mistakes in assembly of correct components especially where two components may accept the same fitting. In an attempt to overcome this problem some embodiments may include different profile shapes or keyed profiles to ensure correct assembly.

For example, a change of the undercut portion of connection region such as a T-slot may assist in correct assembly of components as there may be a one-to-one fit correlation for the connection of one or more components.

Figure 36:
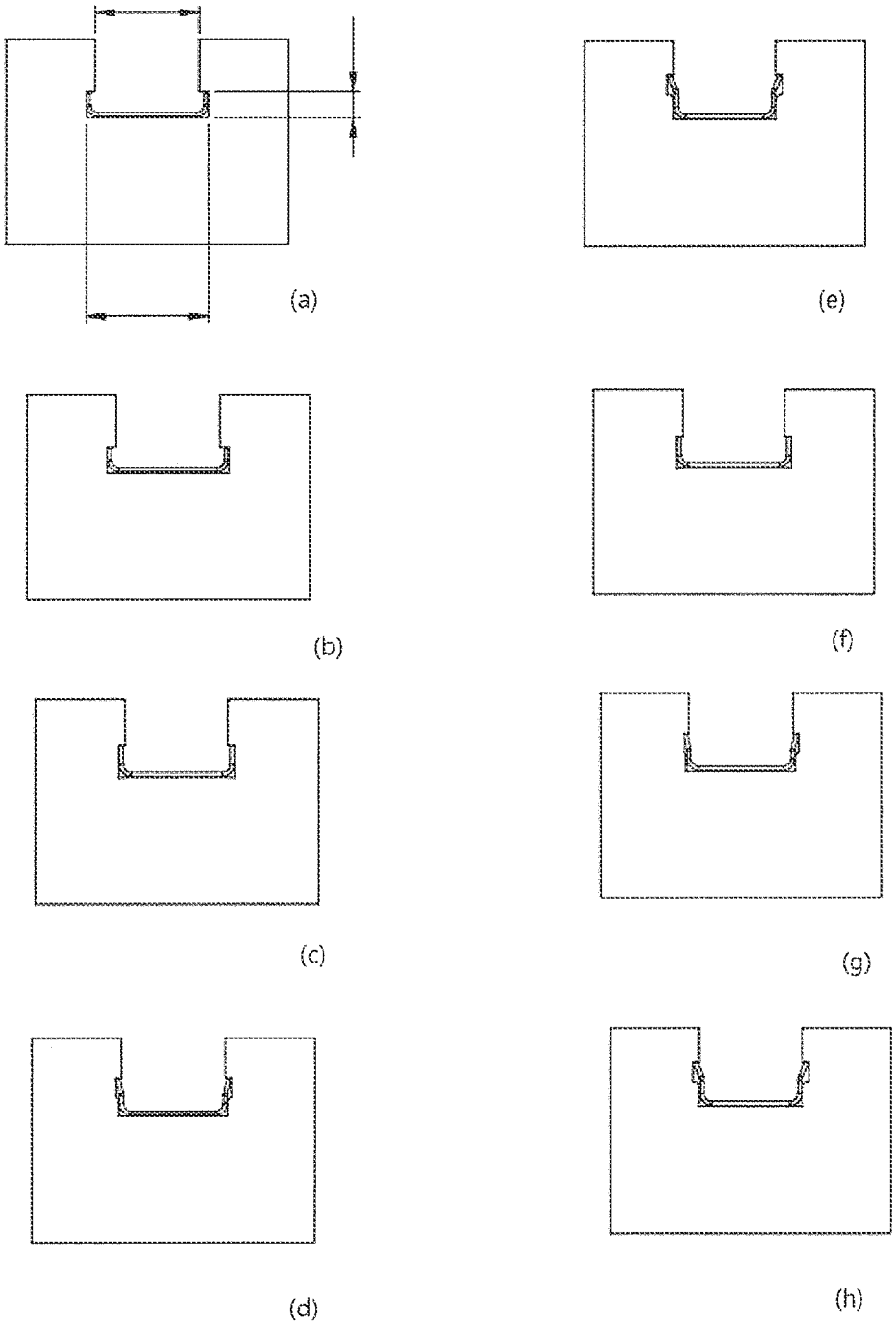
FIGS. 36*a* to 36*h* show examples of different sized and shaped keyed profiles for an undercut.

FIGS. 36*a* to 36*h* show examples of a range of keyed profiles that may be for used for an undercut space of the T-slot configured to accept different width and depths of tang profiles. FIG. 36*a* shows how the different dimensions of the undercut space, as indicated by arrows, may be varied. A series of differently sized and shaped slots and associated tangs may be utilised to assist with mistake proof assembly as seen in FIGS. 36*b* to 36*h*.

Further control of "handing" (controlling for left and right) may also be achieved using asymmetric keying profiles (not shown).

Edge Structure Profiles

It is noted that a number of different profiles for the inner face of the edge structure 114 to 3514 have been illustrated. The inner profile of the edge structures may provide assembly benefits as described in more detail below.

In some embodiments of the invention a preferred general cross section of the edge structure is as shown by edge structure 1214 in FIG. 12*e*. In this embodiment, the edge structure 1214 has a main channel 1214-1 that may be used to contain fittings or portions of fittings below the inner face 1214-2, such as the bracket rail 2021 shown in FIG. 20*d*. A fixing element, such as secondary fixing element 2021 (described below), may benefit from the depth of the notch not spanning the full width of the face while the remaining material between rungs provides stiffness to the secondary fixing element 2021. This stiffened portion needs to be inside the main channel 1214-1 and inside the face 1214-2 to allow access of other fittings passing through the panel adjacent to the inner face 1214-2. The sides 1214-3 of this main channel may provide location for a bracket rail such as secondary fixing element 2021 or for other fittings such as removal tool 1721-1 (if biased towards the upright), removable fixing element 1921-1 and capping elements 1244. In addition to the functionality provided by the main channel 1214-1, a narrow channel 1214-4 sharing a face coincident with one of the main channel sides 1214-3 may provide location and retention for the cover sheet 1212-2.

The edge structure 1214 may have broader use and functionality when used for hollow section joinery when it has a main channel 1214-1 together with one or more extra narrow channels 1214-4 as illustrated. Edge structure 1514, described herein, is an example of a simpler edge structure.

In some forms, the cross section profile of edge structures, such as edge structures 1014 and 1114, have features that provide preferred functionality of the finished shelf furniture panels, such as furniture panels 1000 and 1100. This functionality may include (i) the concealing of fixing or supporting fittings of the shelf furniture panel, when in use; (ii) when fixed to or supported by a complementary panel with a vertical edge structure, such as edge structures 1214 or 2014-1, the inner visible edge 1014-2 of the edge structure 1014 (see FIG. 10*b*) and the complementary panels equivalent, such as 1214-2 (see FIG. 12*e*), are aligned.

The cross-section profile of edge structure 1014 has a rebate 1014-1 to receive the cover sheet 1012. The vertical edge of the rebate 1014-2 may be set to approximately align with the inner edge of a complimentary panel's edge structure, such as edge structure 1214-2. To allow a shelf furniture panel to descend onto support brackets a relief is provided in the section profile of edge structure 1014, such as by the lower rebate 1014-3 that has an inner face 1014-4 that is vertical in FIG. 10*b*. Alternatively, the inner face 1114-4 may be angled as seen in FIG. 11*c*. Inner face 1014-4 is set coincident with or outward of rebate edge 1014-2 to allow inner face 1014-4 to pass by protruding support or fixing brackets that may themselves have an outward edge set at an outward position at least approximate to the inward edge of the edge structure 1214-2 to which they are attached. This allows the complementary panel inner edge and rebate 1014-2 to be aligned. In addition to these requirements, it is preferable that the edge structure 1014 uses the minimal amount of material.

The internal fixing element 1020 may be positioned for fixing to the edge structure 1014 by the first end 1036*a* being aligned with the end face 1014-5 of the edge structure 1014 (see FIG. 10*e*). This is achieved by recessing the first end 1036*a* of the internal fixing element 1020 into the channel of the edge structure 1014 and therefore displacing the first end 1036*a* outward of inner face 1014-4, allowing movement past the aforementioned brackets. The angled face 1114-4 increases the clearance between edge structure 1114 and the complementary panel inner edge and requires only a planner cut to size the length of edge structure 1114.

In some arrangements, such as when edge structure 414 is fixed or supported by a complementary panel such as furniture panel 1200, the inner visible edge 414-2 of the rebate 414-1 is approximately aligned with the inner edge 1214-2 of edge structure 1214 (see FIGS. 4*c* and 12*e*). This may also be preferred if there is an edge beam fitting 816 as seen with furniture panel 800. A supporting or fixing bracket protruding from a complementary panel will present the outer edge of such a fitting coincident with the inner edge 1214-2 of the edge structure such as 1214 and require the profile of the edge structure 414 or similar to provide a cavity to accommodate the bracket. If the depth of the rebate 414-1 places the inner face 414-3 inward of 1214-2 then a channel 414-4 may be provided to accommodate the brackets of the complimentary panel. As shown in furniture panel 800 the support for the cover sheet 812 may be provided by an internal fixing element such as 820 and not by the parallel face of the edge structure rebate 826. When the support is to be provided by the edge structure rebate 826 and the matching inner edges of the complementary edge structures is to be approximately coincident it is preferred that the location and support of the edge beam structure is by a channel such as 414-4.

Furniture Assemblies

Furniture assemblies may be constructed by joining together two or more furniture panels. The different furniture panels may be connected using some of the internal fixing elements included within or attached to the furniture panel. Generally, a substantially horizontal type furniture panel can be connected to a substantially vertical type furniture panel. Examples of connecting such furniture panels are described but are not to be considered limiting as other forms of joining two furniture panels may be used.

In some forms, a furniture assembly may be constructed from at least two shelf panels, such as a box shelf furniture panel (as described above) coupled to four edge structures (see FIGS. 31*a* to 31*g*). In such an arrangement, the shelf panels may be used as a structural cross member between front and rear edge structure sub-assemblies to form an outer carcass for a furniture assembly. In such arrangements, some of the furniture panels, such as the box shelf furniture panels, are pre-assembled for use in constructing the furniture assembly. Alternatively other furniture panels, such as an upright segmented furniture panel, may be assembled during the assembly of the furniture assembly.

Figure 31A:
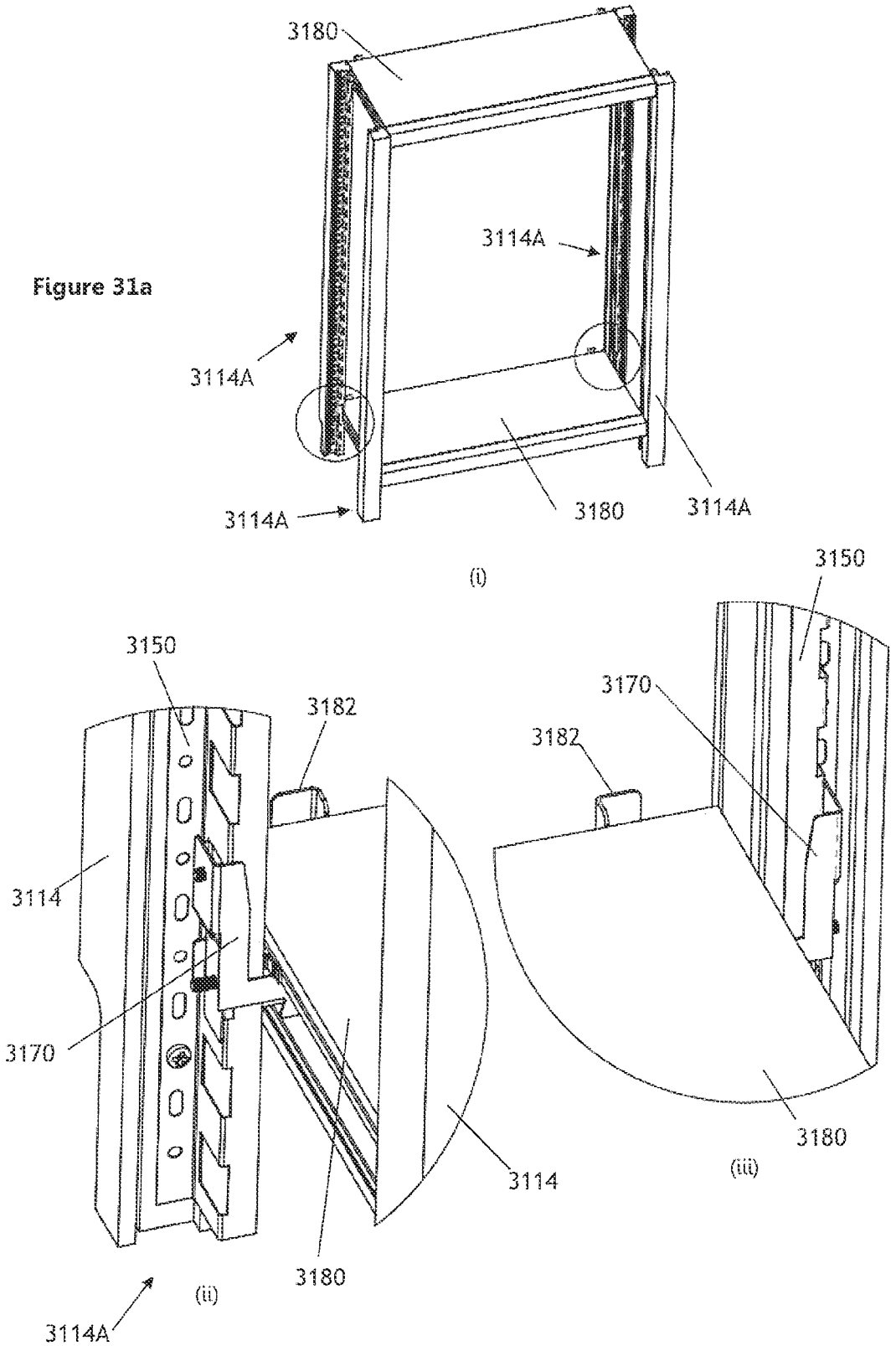
FIGS. 31*a* to 31*g* show a range of views of an exemplary assembly of a bookshelf furniture assembly using an exemplary internal fixing element according to an embodiment of the invention.
Figure 31B:
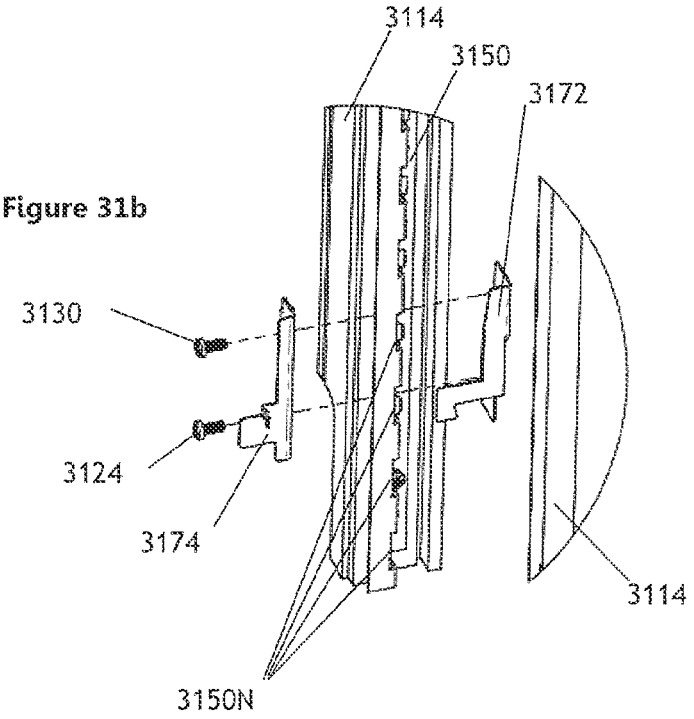
Figure 31C:
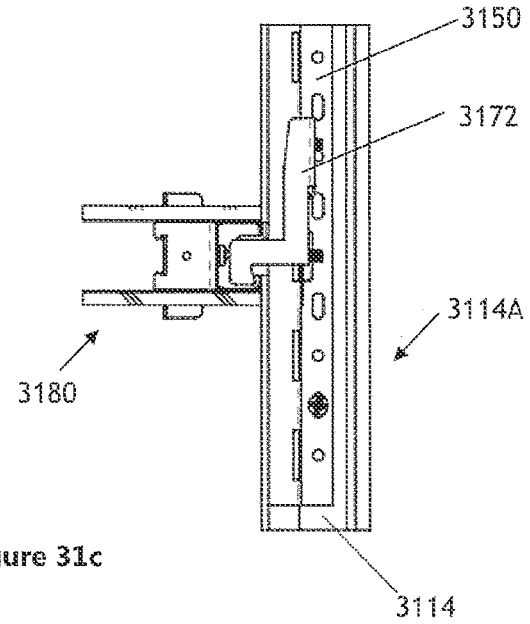
Figure 31D:
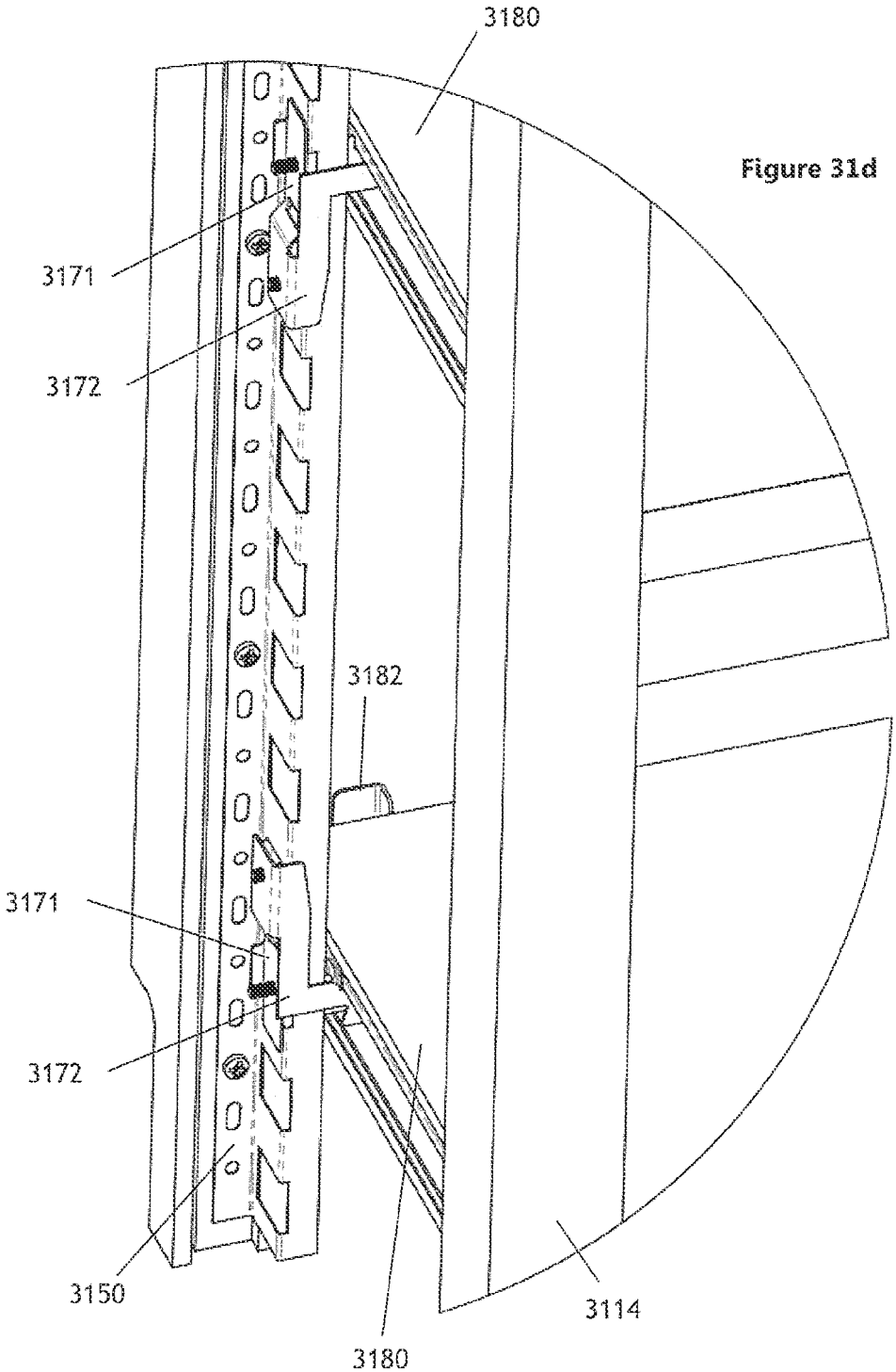
Figure 31E:
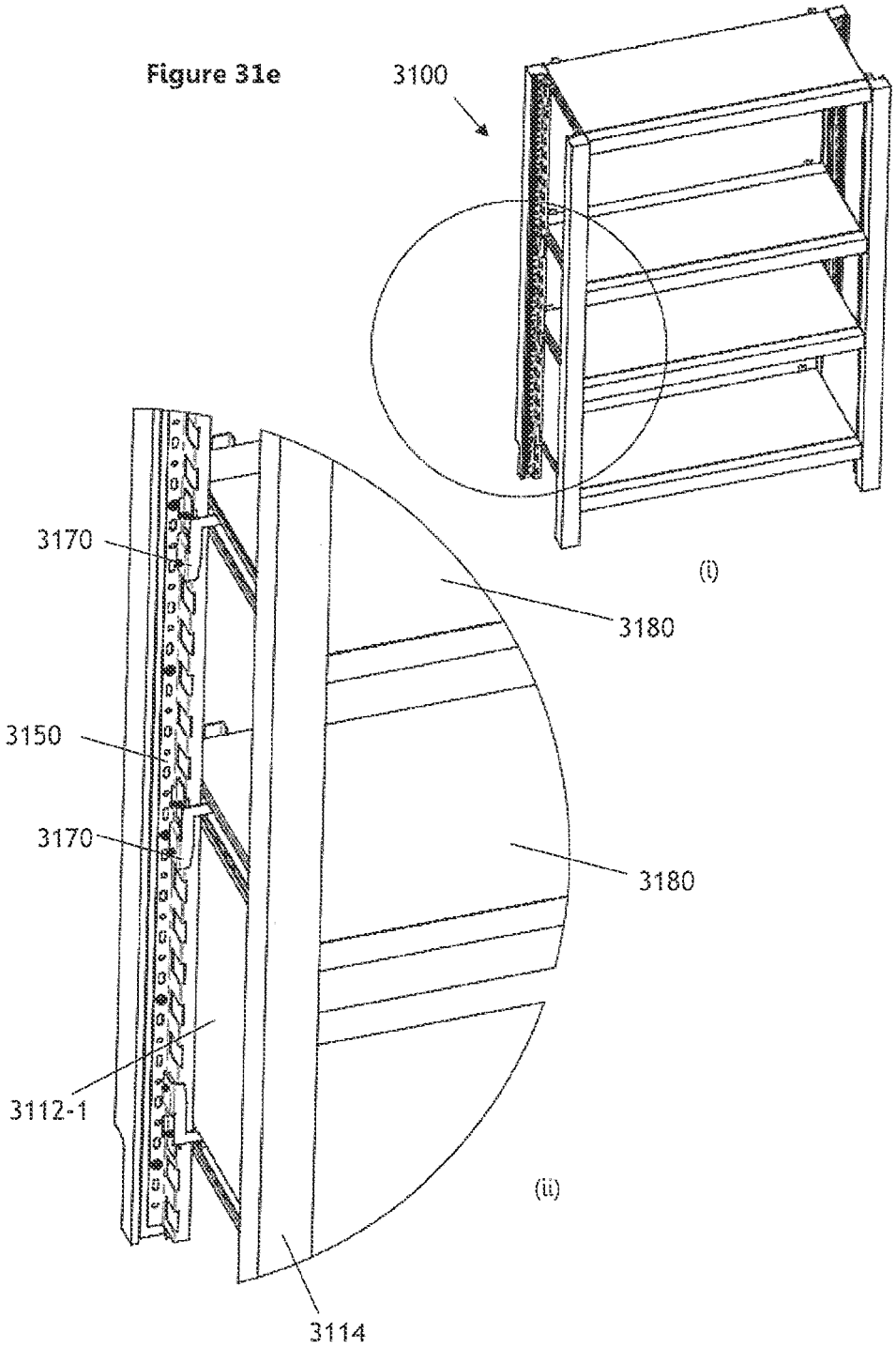
Figure 31F:
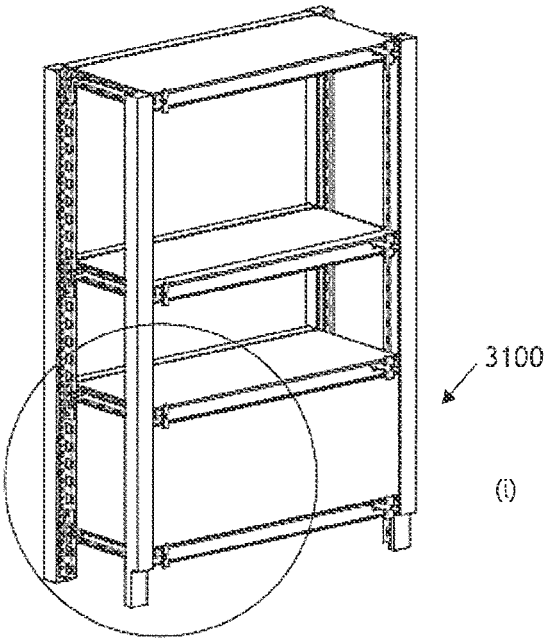
Figure 31F:
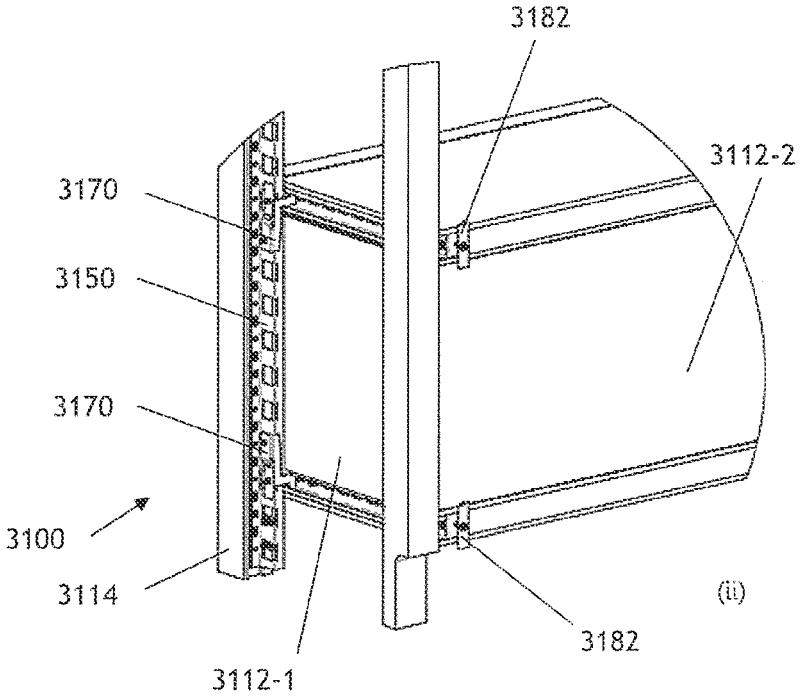
Figure 31G:
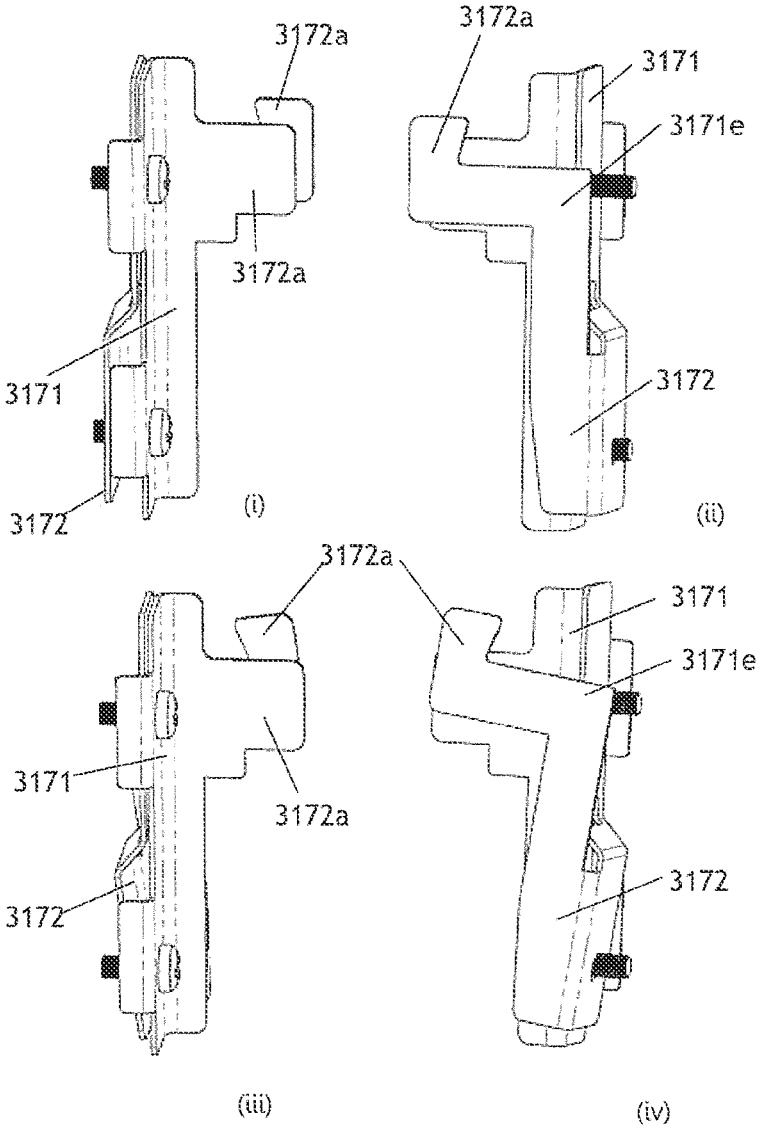
Figure 32A:
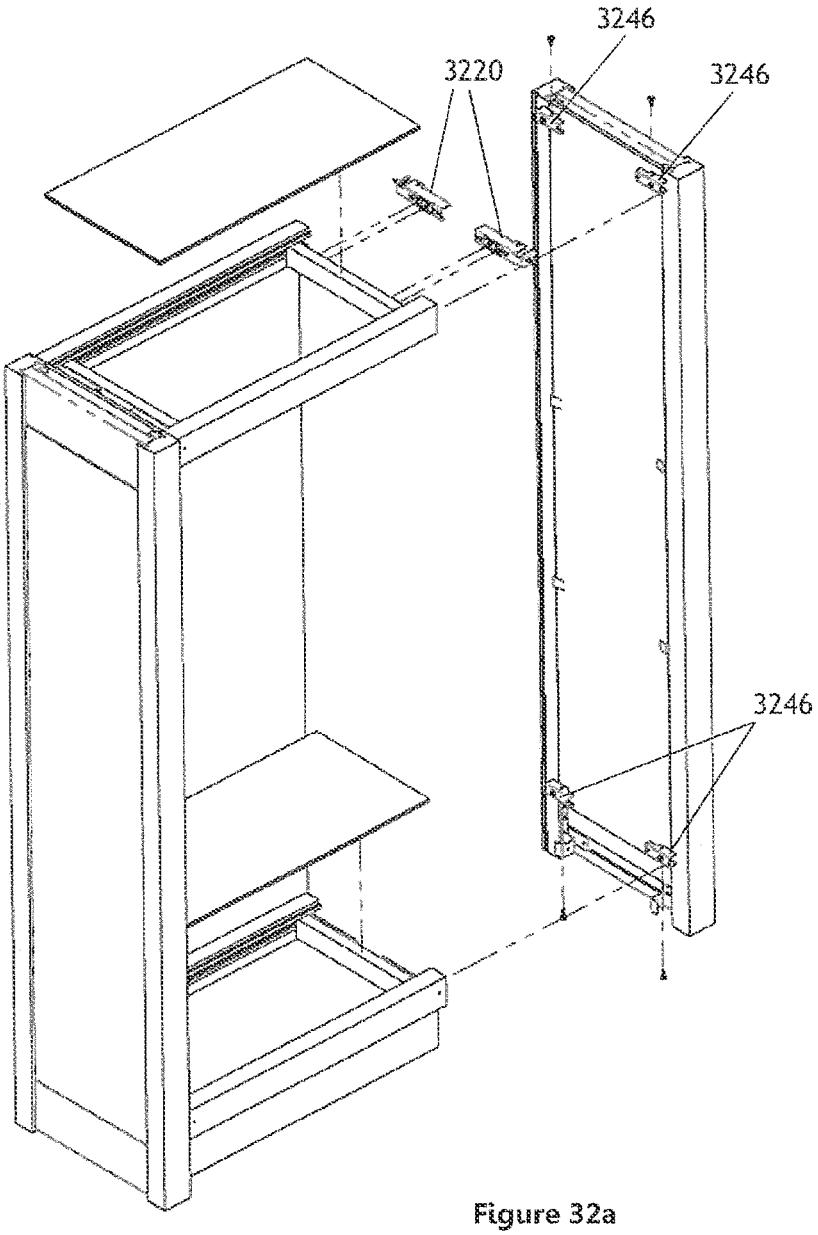
FIGS. 32*a* to 32*d* show a partial assembly of a book shelf showing the connection of a plurality of furniture panels according to an embodiment of the invention.
Figure 32B:
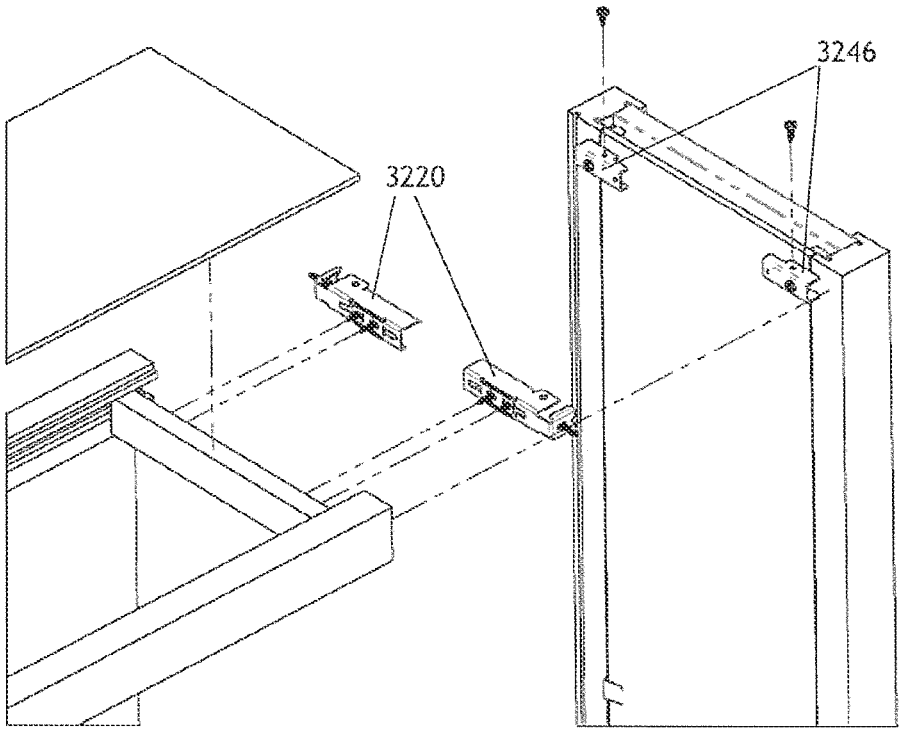
Figure 32C:
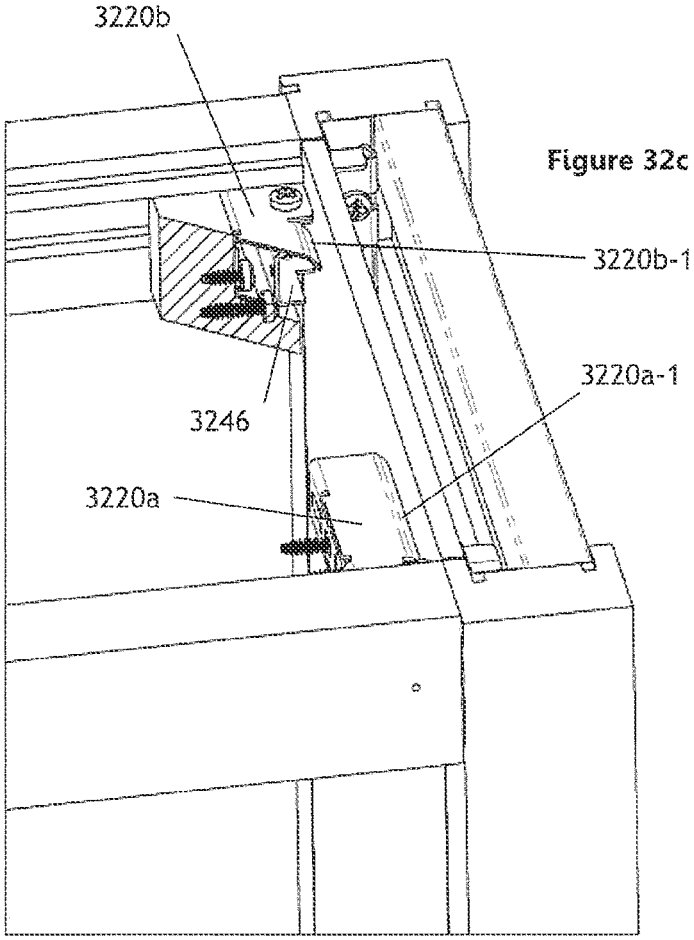
Figure 32D:
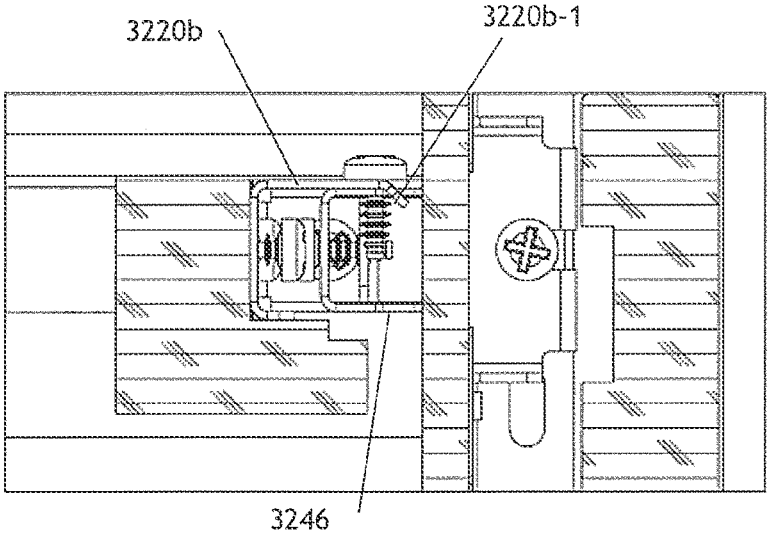
Figure 33A:
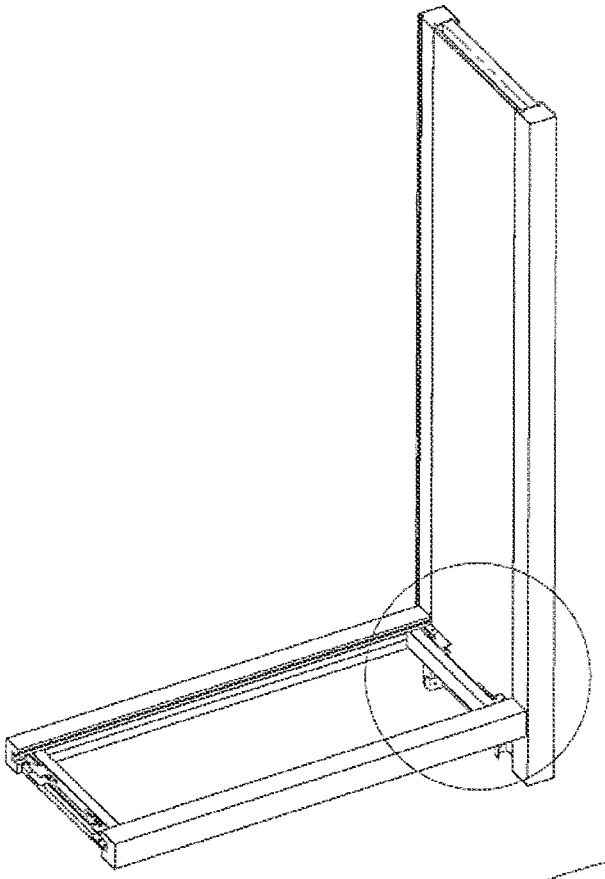
FIGS. 33*a* to 33*f* show a further example of a type of joining arrangement for attaching a vertical furniture panel and horizontal furniture panel.
Figure 33B:
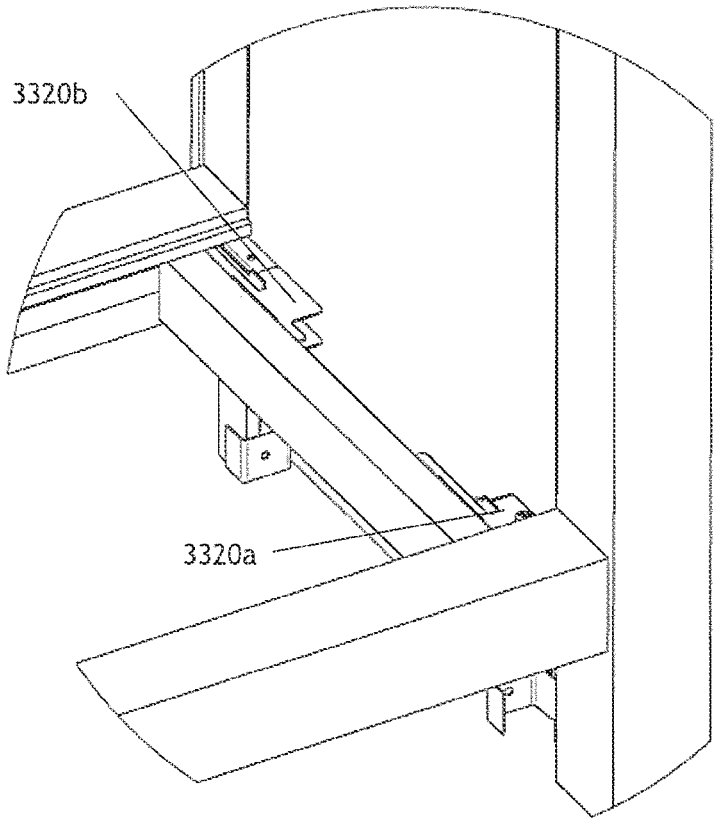
Figure 33C:
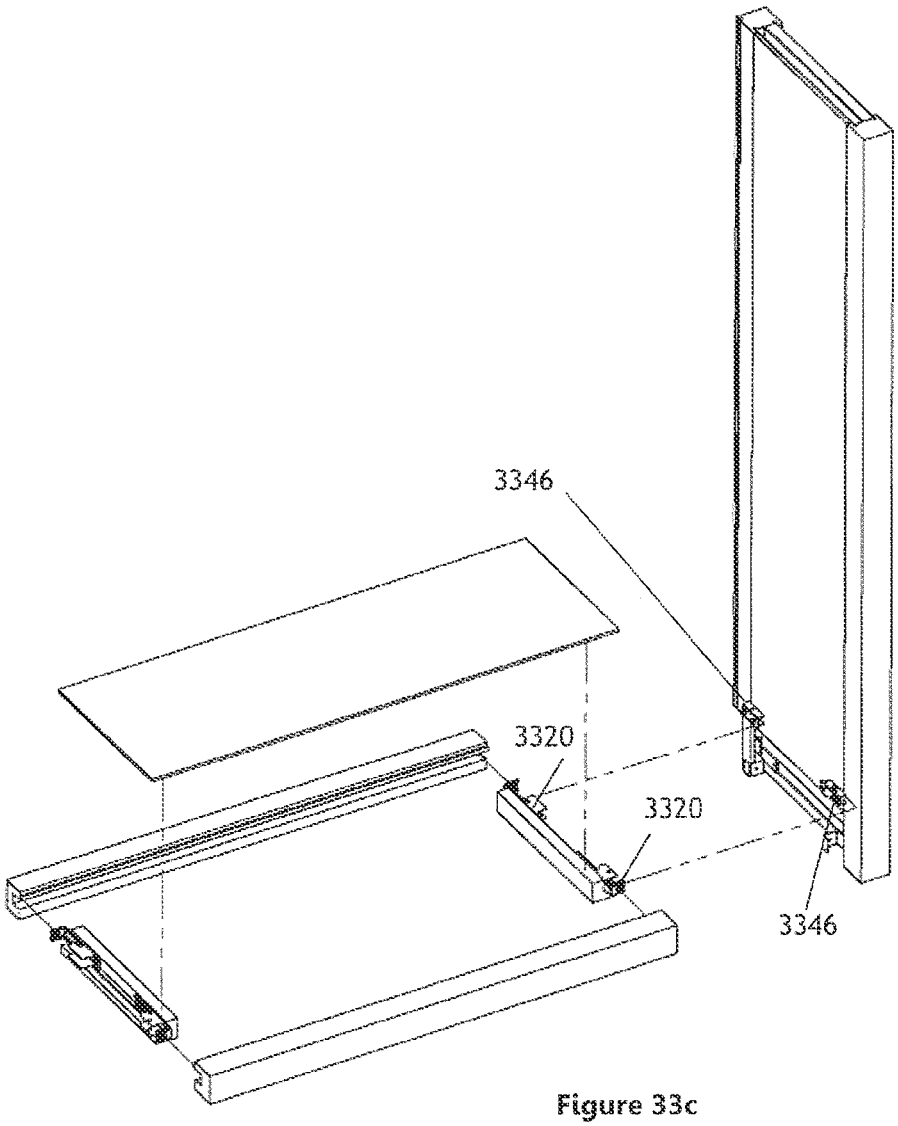
Figure 33D:
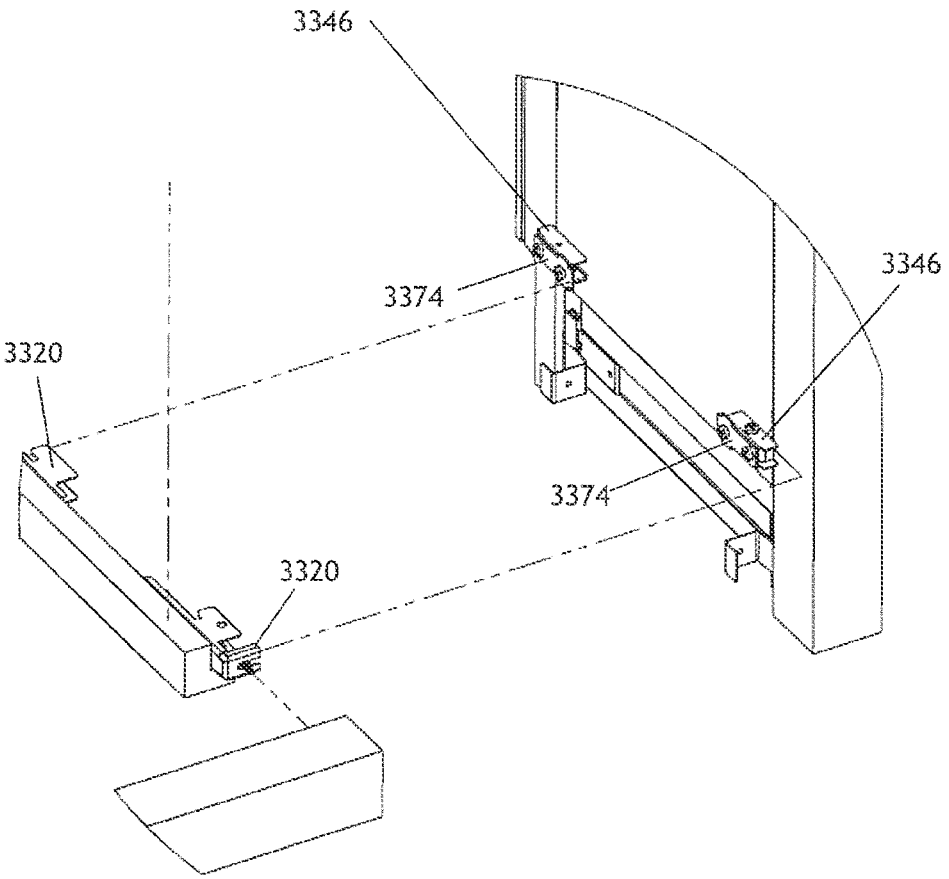
Figure 33E:
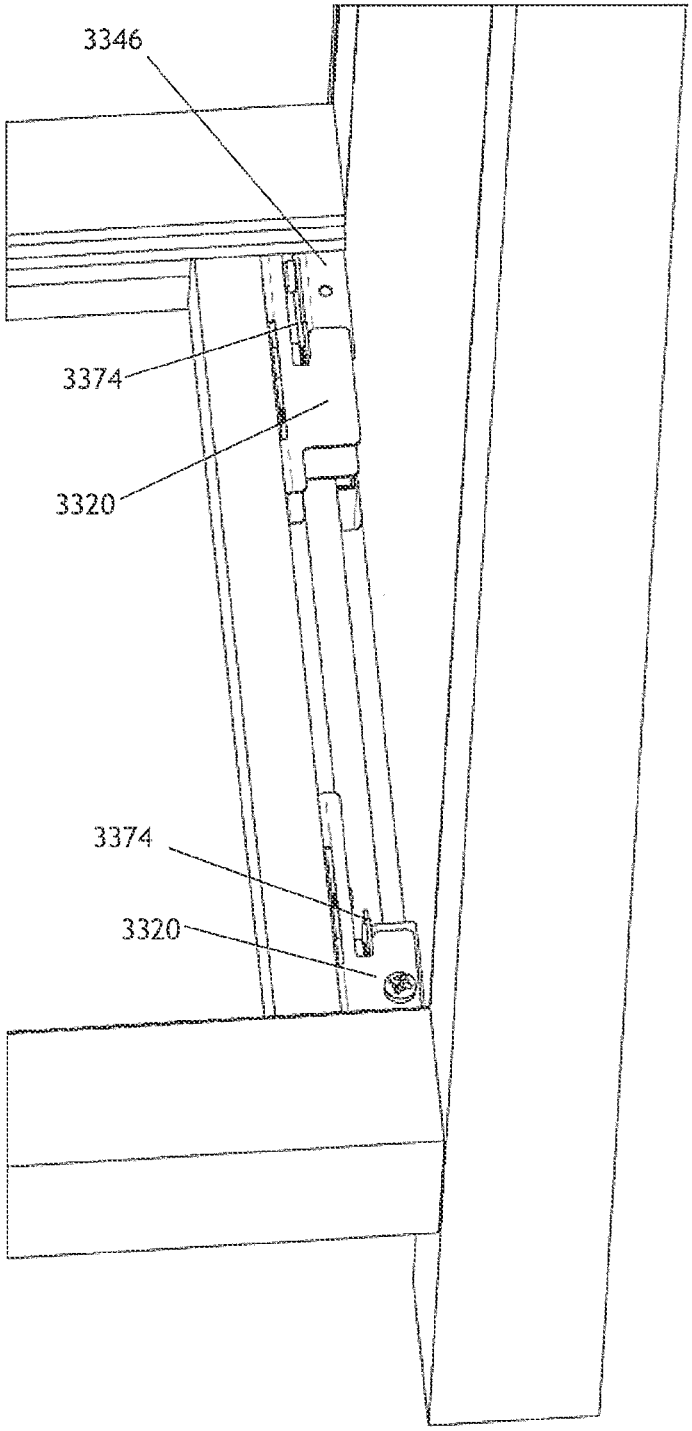
Figure 33F:
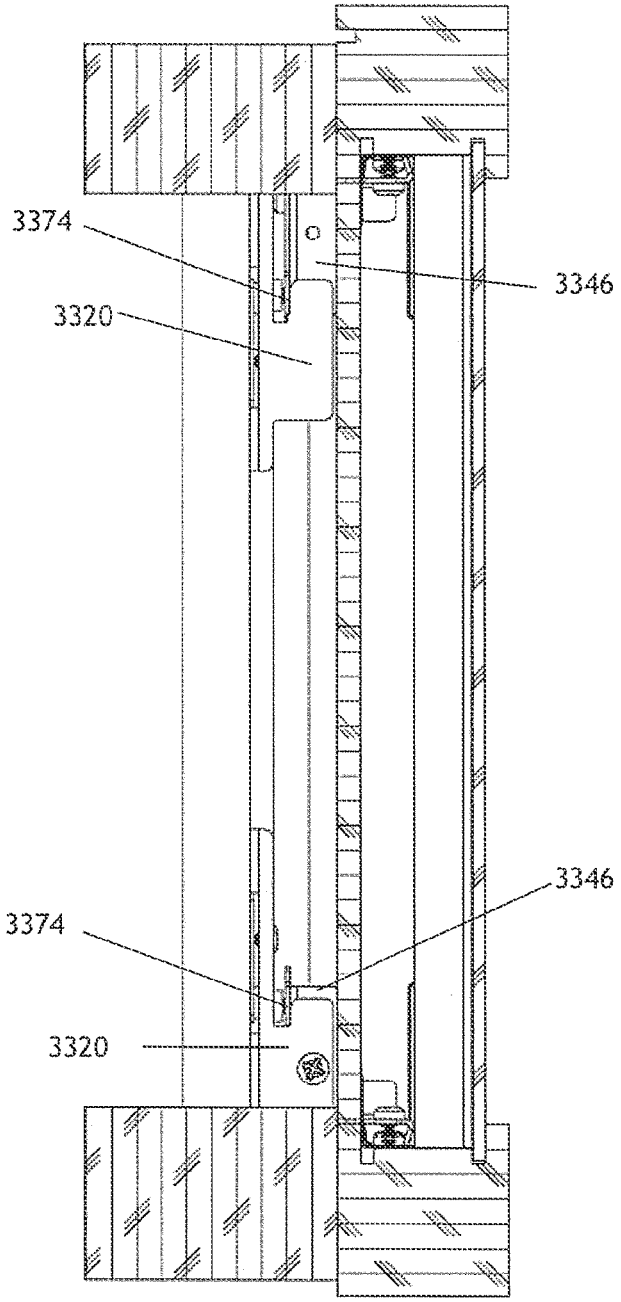
Figure 34A:
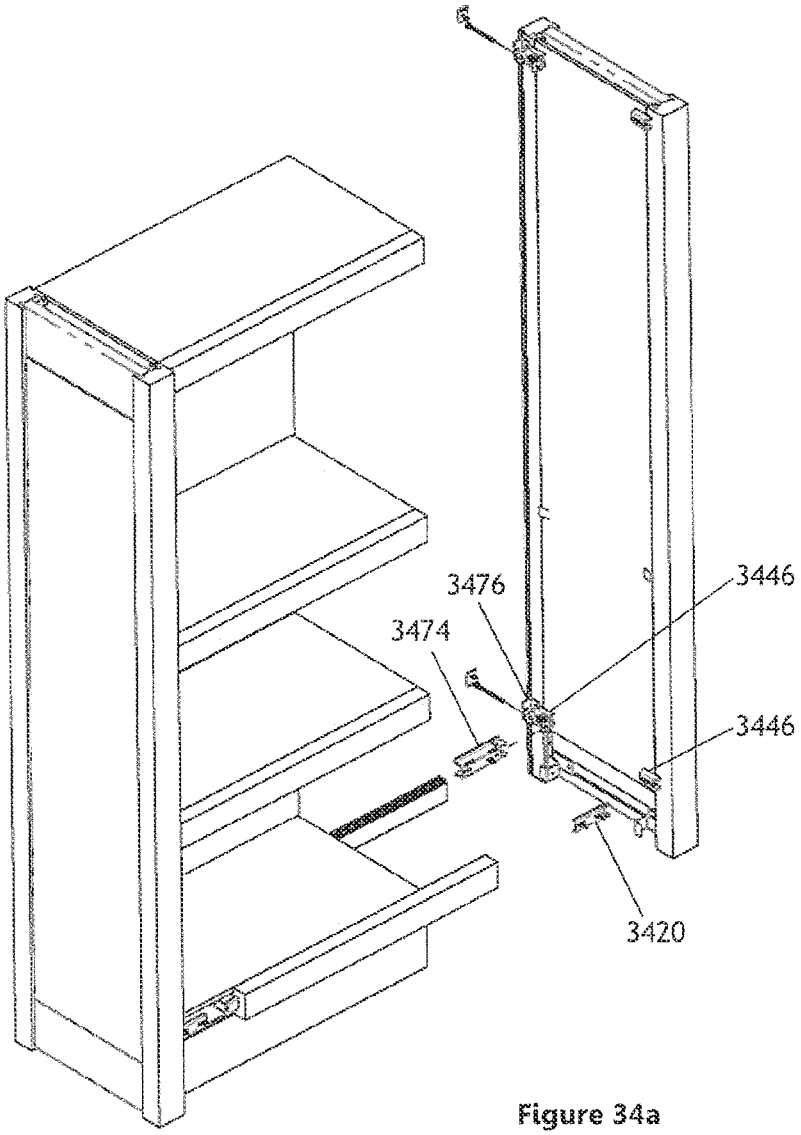
FIGS. 34*a* to 34*e* show another example of a type of joining arrangement for attaching a vertical furniture panel and horizontal furniture panel.
Figure 34B:
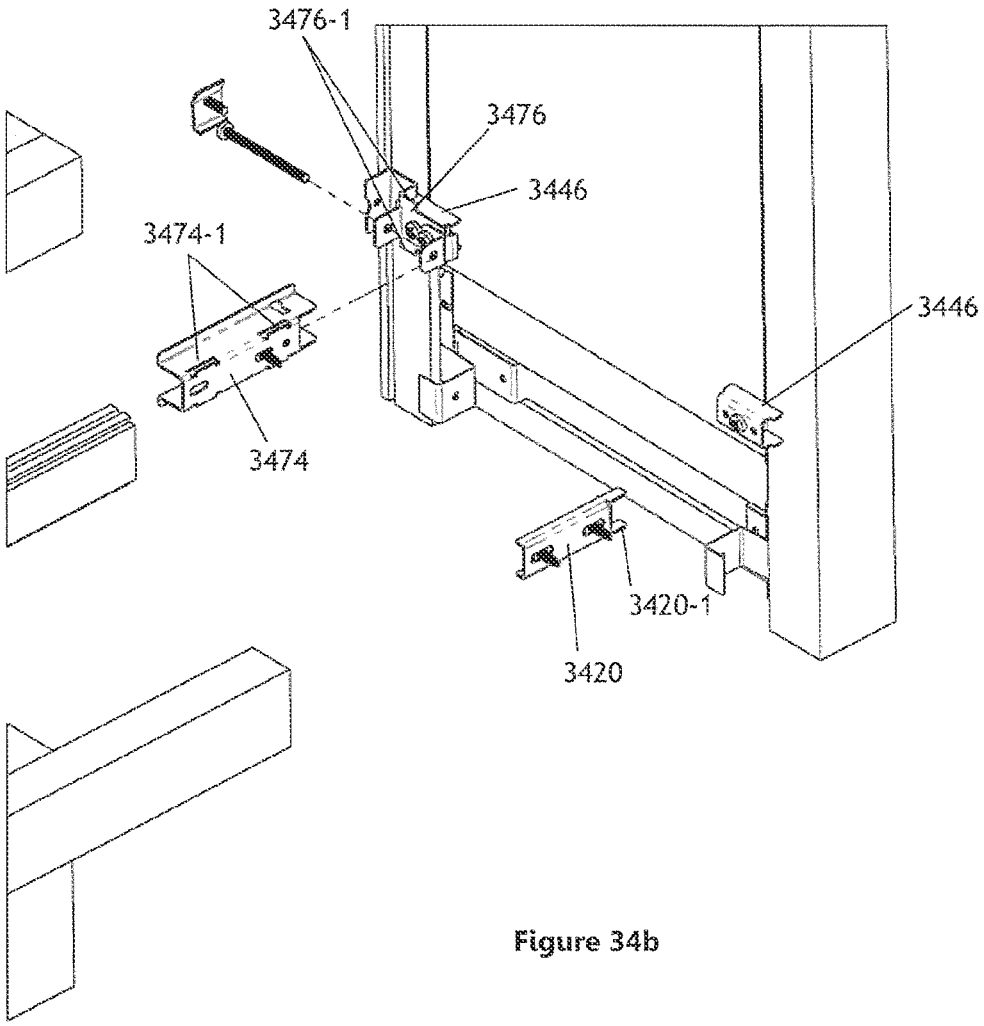
Figure 34C:
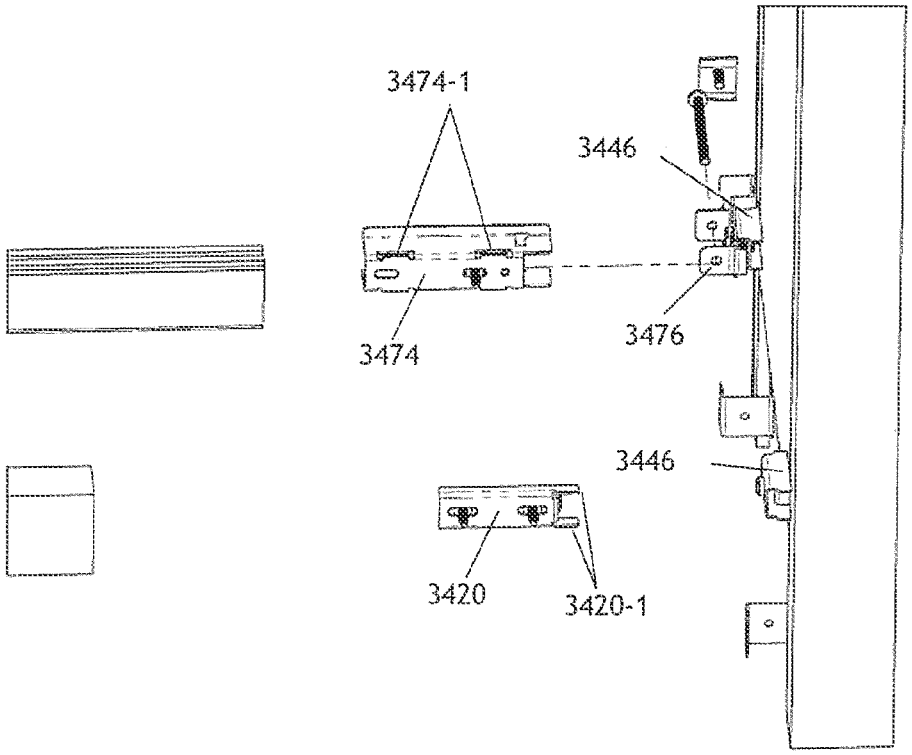
Figure 34D:
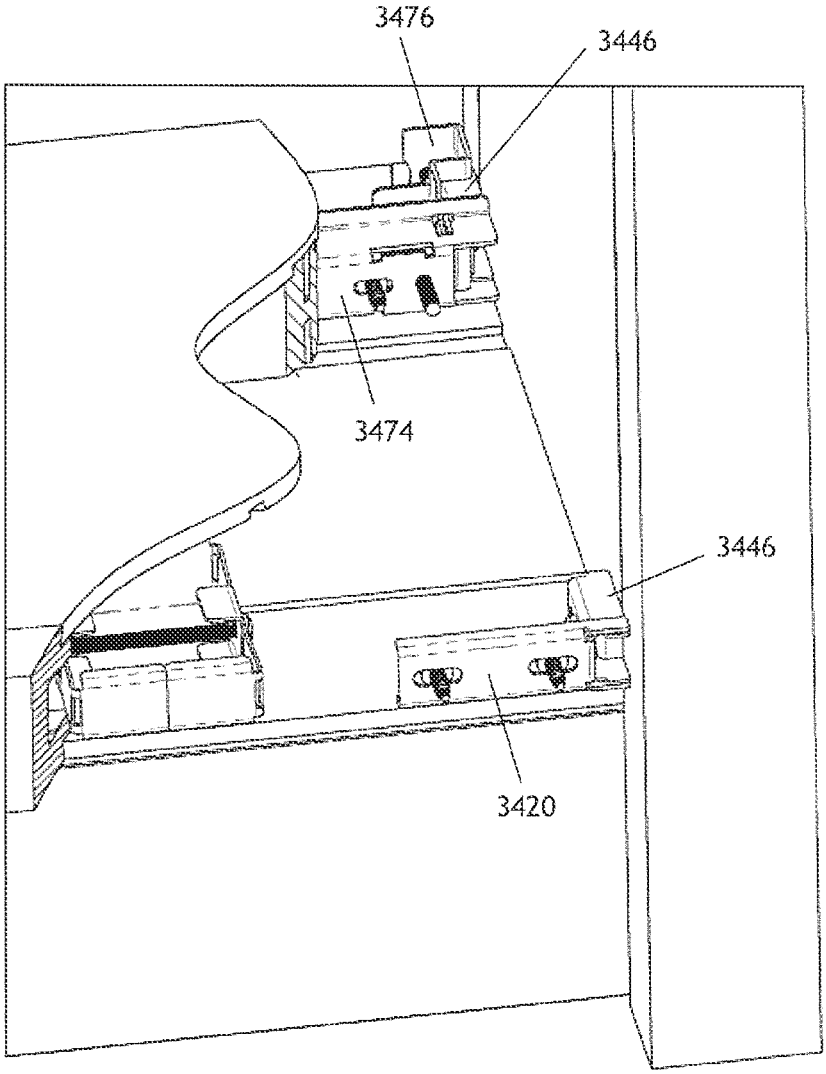
Figure 34E:
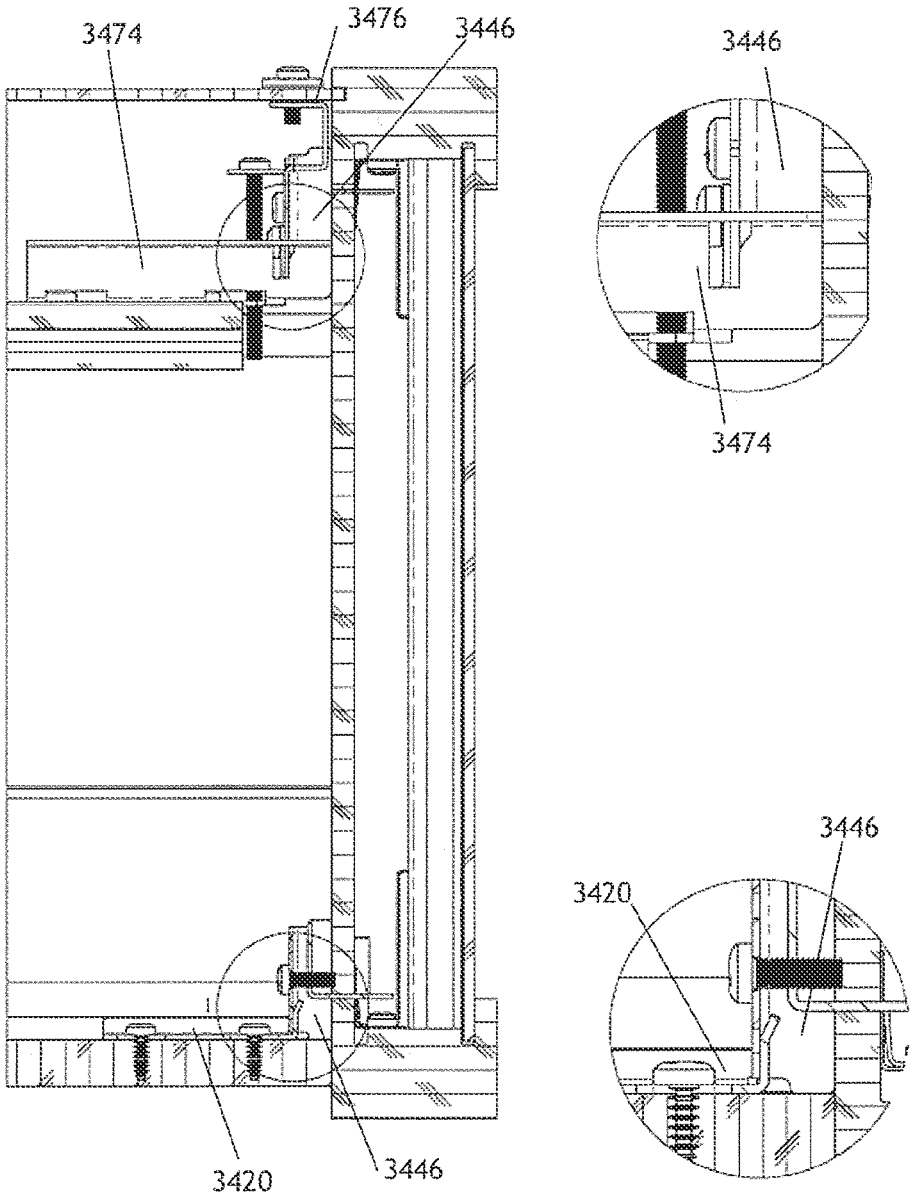

FIGS. 31*a* to 31*h* show a bookshelf furniture assembly 3100 and FIG. 31*g* shows an example of a join tensioner 3170 that may be used during assembly of the bookshelf furniture assembly 3100.

For assembly of the bookshelf furniture assembly 3100 initially a bookshelf carcass is formed, as shown in FIG. 31*a* (*i*).

Each of the structural components used in the construction of this bookshelf furniture assembly 3100 can initially be cut through their transverse cross section to provide a desired length depth a height dimension.

The bookshelf carcass includes two box shelf furniture panels 3180 and four edge structure assemblies 3114A. The box shelf furniture panels form the top and bottom horizontal surfaces of the bookshelf with the four edge structure assemblies 3114A forming supporting legs or sides. Each edge structure assembly 3114A comprises an edge structure 3114 with a bracket rail 3150 fixed along an inner edge. Each bracket rail includes a plurality of notches 3150N that may be used for aligning and/or positioning of shelves or other types of furniture panels. The box shelf furniture panels 3180 may include any one of the box shelf furniture panels described above or a similarly constructed box shelf arrangement.

The box shelf furniture panel 3180 may be attached to each of the four edge structure assemblies 3114A using a join tensioner 3170 (see FIG. 31*g*) formed from a first fixing element 3171 and a second fixing element 3172. The join tensioner 3170 is first attached at desired shelf locations on each of the edge structure assemblies 3114A. Each of the four edge structure assemblies 3114A has a joiner tensioner 3170 attached at the same locations to allow subsequent coupling of the shelf furniture panel 3180 at the desired shelf location to each of the edge structure assemblies 3114A.

As seen in FIG. 31*b* the join tensioner 3170 is attached to the edge structure assemblies 3114A by positioning a first fixing element 3171 at a desired location on the inward side of the bracket rail 3150 of each edge structure assembly 3114A. The first fixing element 3171 may be aligned with one of the notches 3150N in the bracket rail 3150. The second fixing element 3172 is fastened in the same desired location on the opposing outward side of the same bracket rail 3150. Subsequently the two fixing elements 3171, 3172 are fastened together using a fastener 3124 with the bracket rail clamped therebetween.

A tensioner element 3130 is passed through the first fixing element 3171 and bracket rail 3150 and into the second fixing element 3172 for tensioning the join tensioner 3170. During initial assembly, the tensioner element 3130 is coupled but not tensioned. The second fixing element 3172 of the join tensioner 3170 comprises an arm portion 3172*a* that protrudes inwards beyond the bracket rail and is adapted to be received within a cavity of the shelf furniture panel 3180. The first fixing element 3171 may also comprise a protruding arm portion 3171*a*.

In this embodiment the projecting arm portion 3172*a* defines an exterior fixing element used to engage the shelf panel 3180 with the supporting sides of the bookshelf carcass. The shelf panel 3180 defines a receiving cavity which is used to encapsulate the exterior fixing element formed by the projecting arm portion 3172*a*.

For coupling of the shelf furniture panel 3180 to the edge structure assemblies 3114A the arm portions 3171*a*, 3172*a* of the join tensioner 3170 are inserted into the side cavity of the shelf furniture panel 3180 as seen in FIGS. 31*a* (*ii*), (*iii*) and 31*c*.

The tightening of tensioner element 3130 results in the arm portion 3172*a* (see FIG. 31*g*(*iv*)) on the second fixing element 3172 located inside a channel or cavity in the shelf furniture panel 3180 moving outward and acting on the cover sheet of the shelf furniture panel 3180. The outward movement of the arm portion 3172*a* angles the second fixing element 3172 such that an engaging portion 3172*e* is forced into engagement with the edge structure 3114 consequently tensioning the shelf furniture panel 3180 to the edge structure assemblies 3114A FIG. 31*d* shows the coupling of two shelf furniture panels 3180 to two edge structure assemblies 3114A. As seen the join tensioner 3170 may be positioned in opposing orientations depending upon the desired position of the shelf furniture panel 3180. FIGS. 31*e* show front views of a bookshelf furniture assembly with four shelf furniture panels attached between the four edges structure assemblies 3114A. FIG. 31*f* shows rear views of the bookcase of FIG. 31*e*.

Following attachment of all desired shelf furniture panels 3180, cover sheets 3112 may be slid into position at each side and at the rear between each pair of adjacent shelves. 3112-1 being a side cover sheet inserted between two edges structure assemblies 3114A and between upper and lower attached shelf furniture panels. The side cover sheet 3112-1 is slid into this space being slightly flexed to allow entry and for it to move upward being trapped by the upper shelf. Then the cover sheet is brought vertical and can descend below the top of the lower shelf coming to a stop against the join tensioner 3170 while the top edge is retained behind the upper shelf. Optionally a back cover sheet 3112-2 may be flexed in the horizontal plane to allow it to fit into slots in the edge structures, first on one side then into the same on the other side. The height of back cover sheet 3112-2 allows it to fit between adjacent shelves.

In the illustrated assembly, the shelf furniture panel 3180 may optionally include a support bracket 3182 to assist with retaining the back cover sheet 3112-2. The support bracket 3182 may be secured to the back edge of the shelf furniture panel 3180 prior to the insertion of the back cover sheets 3112-2. As the support brackets 3182 are located at the back of the furniture assembly 3100 they will not be visible from a front view as they will be hidden by the cover sheets 3112-2.

Optionally a further outer side cover sheet (not shown) may be inserted into a channel provided on the outer edge of the edge structures 3114 to cover or hide the internal fixing elements such as the bracket rails 3150 in the assembled furniture assembly.

It is to be understood that other types of furniture assemblies may be constructed in a similar manner. Furthermore, the described orientations of furniture panels is not to be taken as limiting. The furniture panels may be configured and combined in any orientation.

FIGS. 32*a* to 32*d* show an example of connecting two furniture panels together such as a continuous sheet furniture panel (as a vertical furniture panel) and a shelf furniture panel (as a horizontal furniture panel) to form a bookshelf.

Two fixing elements 3220*a* and 3220*b* provided as part of the horizontal furniture panel have a downward angled face 3220*a*-1 and 3220*b*-1 on an upper surface with a lower edge of the angled face configured to position over the top surface of the shoe clamp 3246 that is part of the vertical furniture panel. Once the horizontal panel abuts the vertical panel the angled face can descend into a gap between the shoe clamp 3246 and the surface of the vertical furniture panel that is created by a notched formed in the shoe clamp 3246. A fastener passes through a hole provided in the upper surface of the fixing element 3220*a* and 3220*b* and threads into the shoe clamp 3146. As the fastener is tightened the fixing element 3220 is forced vertically to the shoe clamp 3246 and the angled face of the fixing element 3220 bears on the notch edge of the shoe clamp 3246, creating a lateral force that forces the two panels together.

In this embodiment the exterior portion of each shoe clamp 3246 extending from the vertical panels defines an exterior fixing element mounted the exterior surface of the vertical furniture panels. This form of exterior fixing element is then encapsulated by the receiving cavity defined in an end of the horizontal shelf furniture panel.

FIGS. 33*a* to 33*f* illustrate a further example of a type of joining arrangement for attaching a vertical furniture panel and horizontal furniture panel. Two further types of fixing elements 3320—being part of a horizontal panel—have rear facing fingers that have ramped edges that act as a linear cam. A joiner key 3374 is sandwiched between a fastener used to tension the shoe clamp 3346 and presents ears that extend beyond the top and bottom surface of the shoe clamp 3346.

The horizontal furniture panel is moved laterally to the horizontal furniture panel in a forward position allowing the fixing elements 3320 to pass forward of the joiner key 3374. Once the horizontal furniture panel is close enough to the vertical furniture panel it is moved backwards allowing the linear cam on the fingers on the fixing element 3320 to ride against the edges of the ears on the joiner key 3374. The force of backwards movement of the horizontal furniture panel generates a lateral force from the contact of the fixing element 3320 and the joiner key 3374 forcing the two furniture panels together.

After positioning the horizontal panel, the profile of the linear cam becomes parallel with the surface of the vertical furniture panel and through compliance of the fittings exerts only a lateral force and no force pushing the horizontal panel forward. For security of the joint to avoid unwanted forward or backward movement of the horizontal panel a fastener may be secured through the fixing element 3320 and into the shoe clamp 3346 to retain or prevent the forward or backward movement of the furniture panel.

FIGS. 34*a* to 34*e* show another example of a type of joining arrangement for attaching a vertical furniture panel and horizontal furniture panel. A further type of joiner key 3474 is secured to a first edge structure of the horizontal furniture panel. The joiner key 3474 has an opening at the outer end with upper and lower flanges extending therefrom. The opening allows the joiner key 3474 to be positioned over the shoe clamp 3446 as the horizontal panel is moved into position. The shoe clamp 3446 is connected to the vertical furniture panel. The joiner key 3474 also has slots 3474-1 provided on the upper and lower surfaces that receive ears 3476-1 protruding from the upper and lower surfaces of a further fixing element 3476 coupled to the shoe clamp 3446 connected to the vertical furniture panel. The slots 3474-1 in the joiner key 3474 have a linear cam profile that contact with the ears 3476-1 on the further fixing element 3476 creating a lateral reaction force pushing the two furniture panels together.

A fixing element 3420 is secured to the rear side of the second edge structure of the horizontal panel. The fixing element 3420 has a rear facing finger 3420-1 configured to engage with a second shoe clamp 3446 against the upper surface of the passage that the shoe clamp 3446 creates against the surface of the vertical furniture panel. The profile of the finger 3420-1 provides a linear cam allowing for engagement if the panels are slightly displaced and a ramp that creates a reaction force as the horizontal furniture panel moves backwards that forces the horizontal furniture panel laterally to the vertical furniture panel.

Both linear cam profiles front and back become perpendicular to the lateral direction when the furniture panels are at the installed position and therefore no reaction force in the forward direction is present. To secure the furniture panels in position and to avoid accidental forward movement a tensioner element 3230 is inserted through an aperture in the further fixing element 3476 and threaded into the joiner key 3474. The tensioner element 3430 provides some mechanical advantage in the tensioning movement backwards. Tightening the tensioner element 3430 draws the horizontal furniture panel backwards and secures or holds it in the desired position.

The joining of two panels by abutting the end of one with the side of the other requires the first panel to have a cavity at the end facing the second panel and concealing the tensioning and joining arrangements. The majority of illustrations show the first to be a shelf and the second to be a vertical panel. It is to be understood that equally the first panel may be a vertical panel and the second panel a top "capping" shelf or bottom "base" shelf.

Figure 37A:
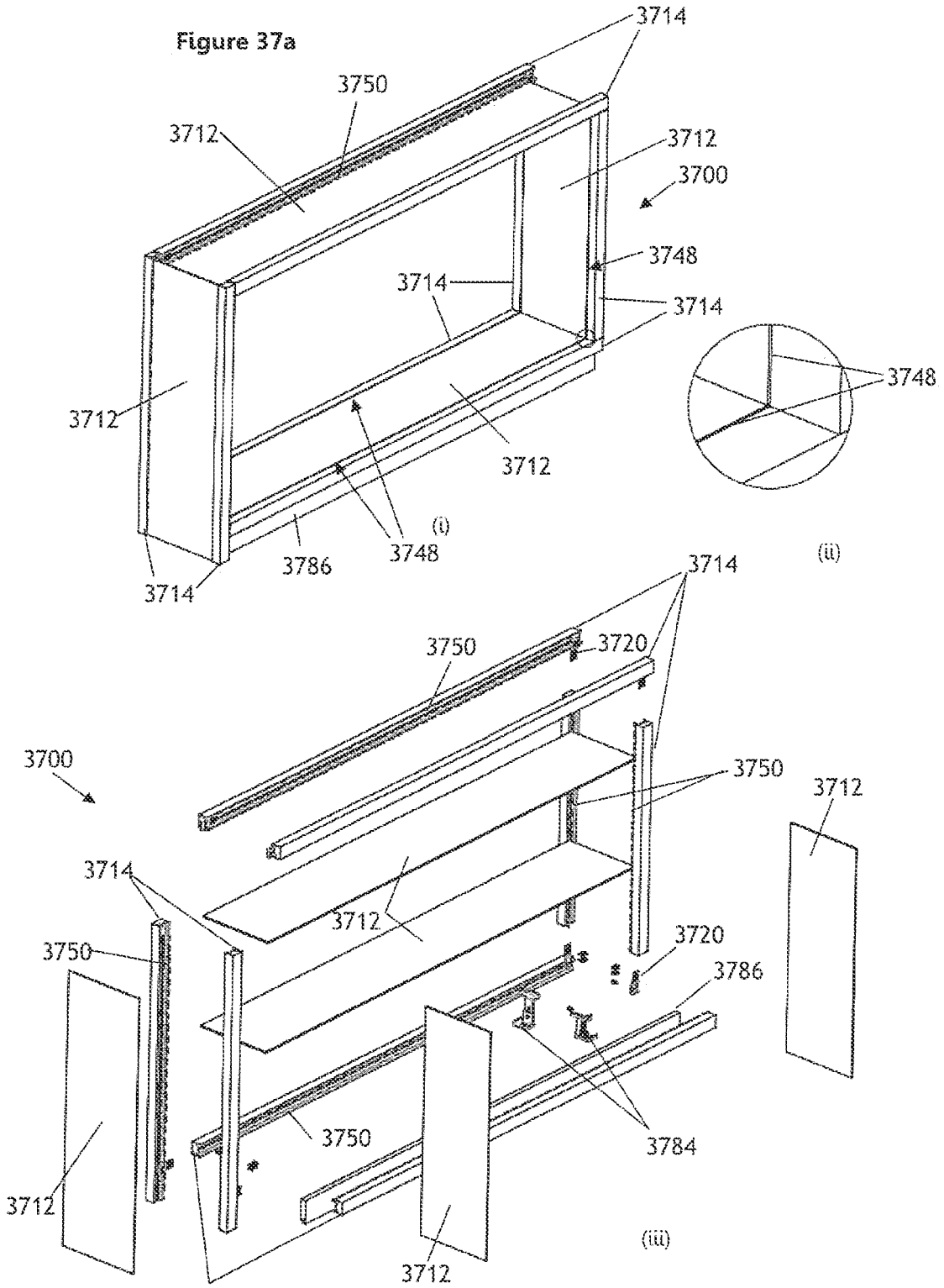
Figure 37C:
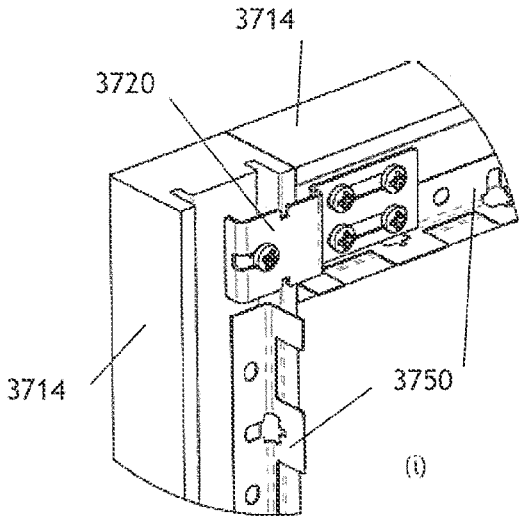
Figure 37C:
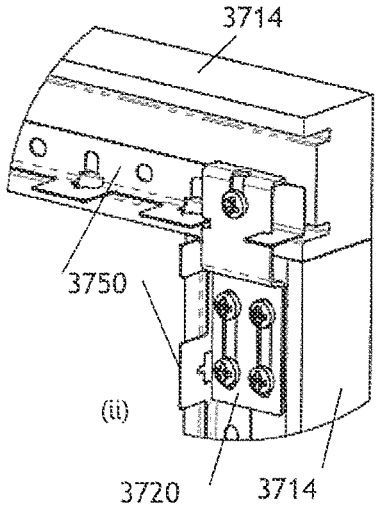

FIGS. 37*a*(*i*) to 37*e*(*iv*) show a further alternative furniture assembly 3700. This furniture assembly is a built-in-place furniture assembly such that rather than assembling one or more furniture panels prior to assembly of the furniture assembly the furniture panels are assembled simultaneously to at least form the furniture assembly carcass or outer structure. The furniture assembly 3700 may provide the same benefits of lightweight furniture with internal fittings hidden within internal cavities of furniture panels of the furniture assembly. The furniture assembly may provide adjustability and ease of relocating of additional panels, walls or shelves whilst keeping the internal fixing elements hidden.

FIGS. 37*a*(*i*) and 37*a*(*ii*) show the assembled and exploded view of an exemplary furniture assembly 3700 respectively. The furniture assembly 3700 is formed from two sets of four edge structures 3714 that are initially attached together to form a pair of outer frames. A bracket rail 3750 may be attached to either the vertical edge structures or the horizontal edge structures or both as shown. Cover sheets 3712 are attached between the pair of outer frames to form the inner and outer walls surfaces. The inner cover sheets are arranged such that narrow gaps or slots 3748 may be formed between the edge of the cover sheet 3712 and the edge structures 3714. The outer cover sheets 3712 may be inserted into slots provided in the edge structures 3714.

Optionally as shown in this example the bottom horizontal pair of edge structures 3714 may be attached to a plurality of feet brackets 3784 (see FIG. 37*b*(*i*)). Such feet brackets 3784 may be used to adjust the height of the furniture assembly and consequently provide additional space at the bottom of the furniture assembly. In such an arrangement, a cover or kick board 3786 may be provided along one or more of the bottom surfaces to conceal the additional space.

FIG. 37(*a*)(*ii*) shows a corner of the assembled furniture assembly carcass from 37(*a*)(*i*) and the created narrow slot or gap 3748 that may appear as a dark line from a distance as described above, particularly in relation to FIGS. 12*a* to 12*d*. The narrow slot or gap 3748 is formed between an edge structure 3714 and a cover sheet 3712 and hides the internal bracket rails 3750. The slot or gap is configured to provide access for removable fixing or bracket solutions for other furniture panels to be inserted and may be provided along any of the edge surfaces where a furniture panel or component may be attached, such that they may be in a substantially horizontal and/or vertical direction. Preferably the width of the slot (gap) and the depth of the slot creates the illusion that the slot is merely the transition between the edges of two components.

Figure 37D:
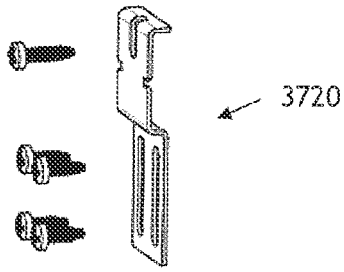

Internal fixing elements 3720 may secure two edge structures 3714 together as illustrated in FIGS. 37*b*(*i*) to 37*c*(*ii*). To facilitate correct alignment the internal fixing element 3720 may be configured to be secured within a notch of the bracket rail 3750. An exemplary internal fixing element 3720 is shown in FIG. 37*d*(*i*). An alternative exemplary internal fixing element 3720*a* is shown in FIG. 37*d*(*ii*) and is formed of multiple parts to assist in compensating for misalignments between the two edge structures. As viewed in 37*d*(*ii*) tightening additional fasteners and components provides additional levels of adjustment to assist in providing improved abutment at the visible join edges.

In some forms, the internal fixing element may also include integrated feet brackets (not shown) for use in securing bottom edge structures and side edge structures. It is to be understood that other types of fixing elements may be used to secure the two edge structures 3714 together.

FIGS. 37*e*(*i*) to (*iii*) illustrate the use of a horizontal narrow slot or gap 3748 in facilitating assembly of furniture panels or components, such as a pair of internal edge structures to form a vertical wall. These figures show an exemplary retaining element 3788 comprising a first retaining portion 3787 and a second retaining portion 3789. The first retaining portion 3787 is clamped to the edge structure 3714 via the second retaining portion 3789 such that the first retaining portion 3787 is slidable within a fixed range as defined by the second retaining portion 3789. The first retaining portion 3787 includes a protruding tongue 3787-1 that is configured to insert into a notch in a bracket rail 3750 attached to a perpendicular edge structure 3714. A tool 3790 (as seen in FIGS. 37*f*(*i*) to (*iv*)) may be configured to insert within the narrow slot or gap 3748 to adjust the position of the tongue into engagement or out of engagement with the notch in the perpendicular bracket rail 3750.

Figure 37F:
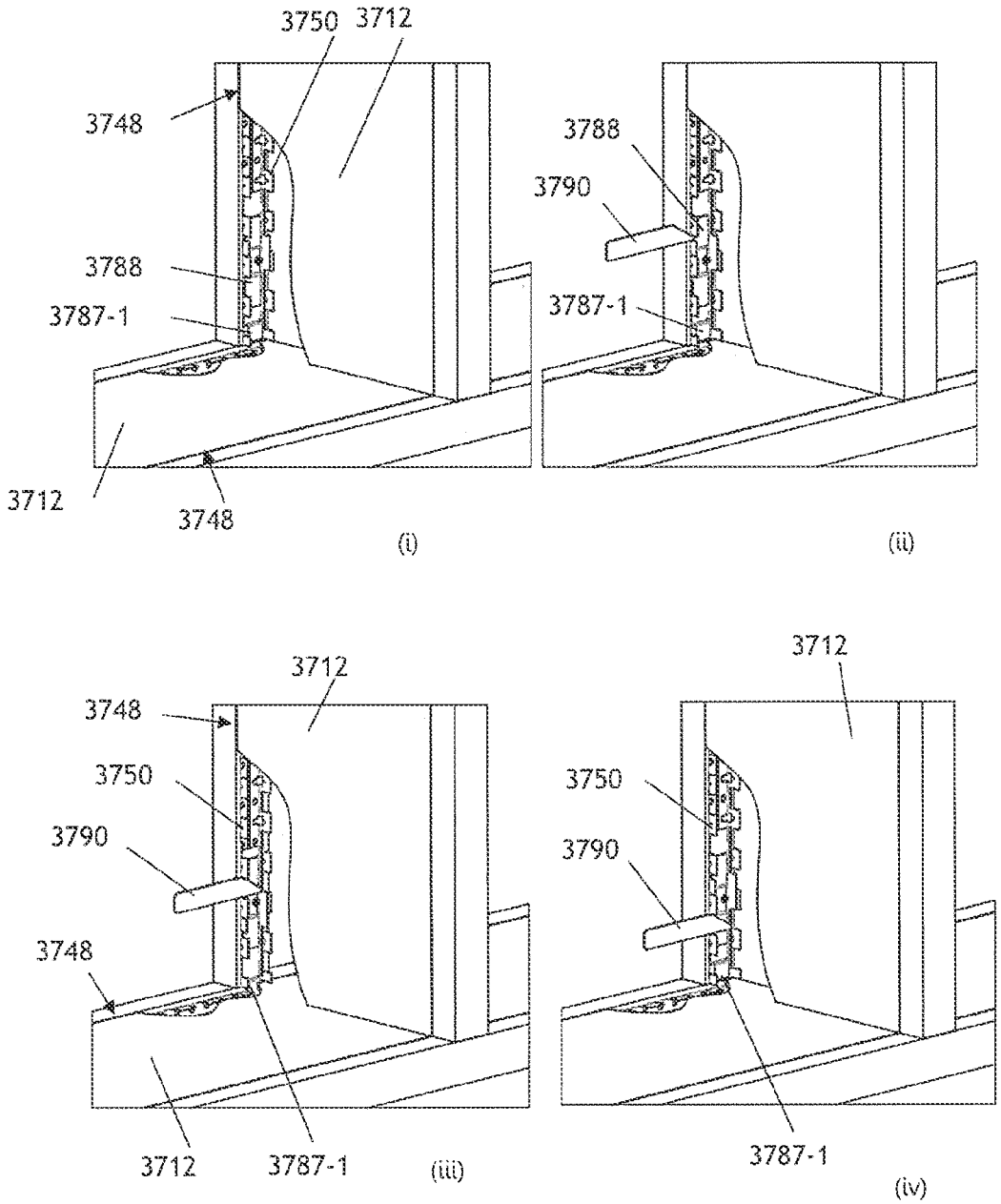

As shown in FIG. 37*f*(*i*) to (*iv*) the retaining element 3788 may be coupled at the top/bottom and front/back of an intermediate panel. The protruding tongue 3787-1 is configured to be removably inserted through the narrow gap or slot 3748 and into a locating slot in the engaging bracket rail 3750 on the horizontal edge structure 3714 to accurately locate the panel within the carcass. FIG. 37*f*(*i*) shows the retaining element 3788 within the intermediate panel with the protruding tongue 3787-1 withdrawn allowing the panel to be assembled into the carcass.

FIG. 37*f*(*ii*) shows the tool 3790 inserted through the vertical panel's narrow gap or slot 3748 and acting against a first end of a flange 3787-2 on the slidable first retaining member 3787 and the protruding tongue 3787-1 forcing the tongue down. FIG. 37*f*(*iii*) shows the protruding tongue 3787-1 fully protruding and the tool 3790 fully inserted. FIG. 37*f*(*iv*) shows the tool 3790 acting on the protruding tongue 3787-1 and the second end of the flange 3787-2 thus forcing the protruding tongue 3787-1 to be withdrawn.

The bracket rails may be used to locate and secure other components such as door hinges, pelmet brackets, shelf brackets, intermediate vertical panel location fittings, electrical connectors or similar.

FIG. 38 illustrates a further embodiment of a type of shelf furniture panel and the components used in the assembly of this panel. This figure illustrates the following components:

- 3820-1 is universal for join fixing two panels at the front and rear positions and on both sides as well as a non-panel-join fixing shelf.
- 3820-5 is universal for front and back and both sides for join tensioning.
- 3820-2 is a spring material allowing the panel fixing to relax when un-tensioned. It has optimised geometry for the displacement ration of fastener movement to fitting movement.

Fixing element 3846 has slot entry for the assembly to the panel it tensions and another slot entry to accept the adjacent panel.

- 3846 has increased area for contacting against the cover sheet reducing pressure and damage to the cover sheet.
- 3846 has relief on the panel side to avoid contact with the edge structure and only apply force to clamp the cover sheet.
- 3820-1 has an extended feature to engage in the edge structure moving the reaction force to tensioning to (or closer to) the line of action of the tensioning and thus reduces the turning moment on the panel joint.
- 3820-1 has an enclosed channel to receive another component if required. For example, an electrical connection component.
- 3820-1 has a spade feature for a standard electrical shoe connector.
- 3800 shows some of the end portion of one panel similar to 1000 and some of the side portion of another panel similar to 1200. The tensioning of the first panel is by four corner clamps 3820 that are similar to 1020.

Corner clamp 3820 can include a number of components. In its final state 3820 includes the attachment tab 3820-5 and fastener 3820-6 to provide fixing to a complementary panel. For construction of the first panel these components are omitted. Second corner clamp component 3820-2 is assembled to first corner clamp component 3820-1 with a first end of the second corner clamp component 3820-2 being located within the curled end of first corner clamp component 3820-1 and held in place by the tang 3820-1*d* on first corner clamp component 3820-1 which is bent to hold second corner clamp component 3820-2 in place. The opposing second end of second corner clamp component 3820-2, 3820-2*a* is not restricted at the end but one side bears down against the first corner clamp component 3820-1.

The fastening screw 3820-4 fixes the corner clamp 3820 assembly to the mid beam 3832. The portion 3820-2*a* of the second corner clamp component 3820-2 applies a force on the first corner clamp component 3820-1 to force it against the mid beam 3832. The tensioning fastener 3820-3 passes through a raised or bridge portion 3820-2*b* of second corner clamp component 3820-2 and engages with the mid beam 3832. An edge structure 3814-1 or 3814-2 engages with the end portion of first corner clamp component 3820-1 the same as 1020. The tensioning of the edge structure and mid beam is also the same as 1020.

When the two components are in the correct position which is set by the end of first corner clamp component 3820-1 being flush with the end of the edge structure 3814-1 or 3814-2 the tensioning fastener 3820-3 can be tensioned forcing the bridge portion 3820-2*b* towards the mid beam 3832 and causing the bridge portion 3820-2*b* to collapse thus forcing the base of the bridge apart. The sides of the bridge 3820-2*b* being approximately 45 degrees to the top and bottom provides an effective linkage that move the base apart by a distance roughly equal to the amount it is collapsed. The extended portions 3820-1*a* of the first corner clamp component 3820-1 engage with the T-slot in the edge structure 3814-1 or 3814-2 acting in the T-slot on the other side of the tensioning force applied by the fittings and provide a balancing reactionary force to neutralise or minimise the turning moment applied to the joint by the tensioning force.

Once tensioned the attachment tab 3820-5 for joining the two panels can be located in the slot 3820-1*b* located in top and bottom portions of first corner clamp component 3820-1. This retains attachment tab 3820-5 for easy assembly of the two panels. Indentations in the slot base provide a spring-loaded clipping retention of the attachment tab 3820-5 that has corresponding notches in the top and bottom edges. This location can be broken with gentle force to allow final alignment of the two panels as required.

The complementary panel is similar to 1200 with the clamp shoe 3846 having differing features to 1246 in the following respect. 3846 has an open slot 3846*a* that allows clamp shoe 3846 to be positioned under the tensioning fastener 3850-2 without it being removed from the fitting 3850-1. The face that bears against the panel is relieved at the end portion 3846*b* where it is adjacent to the edge structure 3814. The surface 3846*c* that bears against the cover sheet 3812 has a folded portion presenting a wider area then the material thickness used in 1246. The outward facing face has an opening to receive the complementary panel attachment tab 3820-6 and a slot in the top and bottom faces to receive the fastener 3820-6 without it be removed first from 3820-5. Additionally, the tab features 3846*d* are on both sides of this receiving slot top and bottom. The extremity of these features on each side of the slot defining a plane inclined from the horizontal for the attachment tab 3820-5 to bear against. The edges of the opening 3846*e* are positioned to lie on the same plane to also support the attachment tab 3820-5.

The two panels are brought together with the attachment tabs 3820-5 front and back locating in the opening on the outward face of 3846. The fastener 3820-6 passed through the slot in 3846 with the head clear of the top surface of 3846. Once in position the joint can be tensioned by tightening 3820-6. As this fastener bears down on the clamp shoe 3846 it pulls the attachment tab to the plane defined by the features 3846*d* and 3846*e* in 3846. This plane inclined from the horizontal produces a component force pulling the two panels together. The tensioning force on the fastener 3820-6 causes it to hold in place with the joining force remaining.

The internal cavities of the furniture panels or furniture assemblies may be used to hide additional components such as internal conduction of electrical supply via fixing hardware of wiring concealed within cavities.

Example Components

Provided below is a non-limiting outline of example components and features that may be used in the furniture panels and furniture assemblies of the invention.

Edge structures, preferably moulded edge structures having a main channel and comprising one or more rebate or grooves configured to engage with cover sheets.

Furniture panels including narrow gaps or slots configured to allow engagement of relocatable shelves or panels whilst concealing the bracketing location points and the brackets within the furniture panel.

Internal fixing elements such as a bracket rail, clamp shoe, join tensioner and/or retaining element. The internal fixing elements may use different types of fixing methods including holding, clamping, keying configurations, gripping and/or fastening. The internal fixing elements may also be configured to be tensioned post assembly via use of a tensioner element.

Optional power supply may be provided and hidden within the furniture panels. A low voltage power supply may be provided via the bracket rails and attached fittings. For example, two bracket rails in two different edges may act as bus bar rails to carry electrical current, one as the positive the other the return or negative. A power source may be connected directly to each bracket rail such as below a lower shelf or via some other connection. The support or anchor brackets being conductive can therefore supply electrical appliances concealed within the shelves. Lighting, appliance charging and other electrical devices can then connect to the power source without the need for external leads running from the supply external to the carcass.

The furniture panels and furniture assemblies of the invention may use at least one or more of the above example components or features arranged in different combinations.

In the preceding description and the following claims the word "comprise" or equivalent variations thereof is used in an inclusive sense to specify the presence of the stated feature or features. This term does not preclude the presence or addition of further features in various embodiments.

It is to be understood that the present invention is not limited to the embodiments described herein and further and additional embodiments within the spirit and scope of the invention will be apparent to the skilled reader from the examples illustrated with reference to the drawings. In particular, the invention may reside in any combination of features described herein or may reside in alternative embodiments or combinations of these features with known equivalents to given features. Modifications and variations of the example embodiments of the invention discussed above will be apparent to those skilled in the art and may be made without departure of the scope of the invention as defined in the appended claims.

What I claim is:

1. A furniture panel used to form a component of a furniture assembly, the panel comprising:

a first structural component being a first edge structure;

a second structural component selected from a second edge structure and at least one cover sheet;

a third structural component selected from any combination of: at least one edge structure, at least one cover sheet and/or at least one mid-beam;

an interior volume defined by each interior surface of the first structural component, the second structural component and the third structural component, and confined between the interior surfaces of the first structural component, the second structural component and the third structural component; and at least one internal fixing element disposed within the interior volume, the internal fixing element configured to engage together the first, second and third structural components to form the panel, wherein the interior volume at least partially conceals the internal fixing element from view.

2. The furniture panel of claim 1 wherein each structural component has a constant cross section form.

3. The furniture panel of claim 1, further comprising at least one mid beam configured to extend from an end of at least one edge structure.

4. The furniture panel of claim 1 wherein the second and/or third structural component is a cover sheet that is formed by a flat sheet material and is arranged to extend from at least one edge structure of the panel.

5. The furniture panel of claim 4 wherein an interior surface of the cover sheet defines one or more complimentary engagement forms which cooperate with the internal fixing element used to assemble the panel.

6. The furniture panel of claim 1 wherein the first, second and/or third structural component is an edge structure, and wherein an interior surface of the edge structure defines one or more complimentary engagement forms which cooperate with the interior fixing element used to assemble the panel.

7. The furniture panel of claim 3 wherein the first, second and/or third structural component is an edge structure, and wherein an interior surface of the edge structure defines one or more complimentary engagement forms which cooperate with the mid beam.

8. The furniture panel of claim 1 wherein the internal fixing element allows for the connection and subsequent disconnection of structural components.

9. The furniture panel of claim 1 wherein the internal fixing element can engage together two edge structures, or a cover sheet and an edge structure.

10. The furniture panel of claim 1 wherein the internal fixing element is formed by a clip structure.

11. The furniture panel of claim 1 wherein the internal fixing element is formed by a bracket which cooperates with at least one additional connector.

12. The furniture panel of claim 11 wherein the internal fixing element includes a drive mechanism operable to tension against at least one structural component of the panel enabling engagement with another structural component of the panel.

13. The furniture panel of claim 1 wherein the internal fixing element is formed by a clamp structure.

14. The furniture panel of claim 13 wherein the clamp structure defines a pair of opposed engagement faces and at least one linking member connected between the engagement faces, whereby deformation of the linking member by a force acting at an angle to the engagement faces pulls at least two structural components together.

15. The furniture panel of claim 1 further comprising one or more exterior fixing elements used to engage the panel with other components of an associated furniture assembly.

16. The furniture panel of claim 1 further comprising one or more exterior fixing elements used to engage the panel with other components of an associated furniture assembly, wherein the internal fixing element engages the first and second structural components together by locking the relative positions of each component with respect to each other, and the external fixing element extends between and projects past the two engaged structural components.

17. A furniture assembly, comprising:

a plurality of furniture panels, each panel comprising:

a first structural component being an edge structure;

one or more second structural components being selected from: one or more further edge structures, and/or one or more cover sheets;

an interior volume defined by each interior surface of the first structural component and the one or more second structural components, and confined between the interior surfaces of the first structural component and the second structural components; and at least one internal fixing element disposed within the interior volume, the internal fixing element configured to engage together the first and second structural components, wherein the interior volume at least partially conceals the internal fixing element from view;

wherein at least a first panel of the plurality of furniture panels defines a receiving cavity, and at least a second panel of the plurality of furniture panels includes at least one exterior fixing element, the exterior fixing element being used to connect the-first panel having the receiving cavity to the second panel having the at least one exterior fixing element, wherein the receiving cavity encapsulates the at least one exterior fixing element, connecting the two panels together.

18. The furniture assembly of claim 17 wherein the exterior fixing is mounted on an exterior surface of the second panel, and is encapsulated by the receiving cavity of the first panel.

* * * * *